US005121162A

United States Patent [19]

Iwamoto

[11] Patent Number: 5,121,162

[45] Date of Patent: Jun. 9, 1992

[54] CONTROL SYSTEM FOR A COPIER WITH RETENTION OF SETTINGS THEREFOR

[75] Inventor: Minoru Iwamoto, Yokohama, Japan

[73] Assignee: Ricoh Company, Ltd., Tokyo, Japan

[21] Appl. No.: 361,689

[22] Filed: Jun. 5, 1989

Related U.S. Application Data

[63] Continuation of Ser. No. 73,749, Jul. 15, 1987, abandoned.

[30] Foreign Application Priority Data

| | | | |
|---|---|---|---|
| Jul. 15, 1986 | [JP] | Japan | 61-167352 |
| Jul. 15, 1986 | [JP] | Japan | 61-167353 |
| Jul. 15, 1986 | [JP] | Japan | 61-167354 |
| Jul. 15, 1986 | [JP] | Japan | 61-167355 |
| Jul. 15, 1986 | [JP] | Japan | 61-167356 |
| Jul. 15, 1986 | [JP] | Japan | 61-167357 |
| Jul. 15, 1986 | [JP] | Japan | 61-167358 |

[51] Int. Cl.[5] ..... G03G 21/00

[52] U.S. Cl. ..... 355/218; 355/200

[58] Field of Search ..... 355/200, 202, 218, 210

[56] References Cited

U.S. PATENT DOCUMENTS

| | | | |
|---|---|---|---|
| 4,657,380 | 4/1987 | Hamano et al. | 355/218 X |
| 4,659,207 | 4/1987 | Maekawa | 355/7 X |
| 4,688,930 | 8/1987 | Ohno | 355/25 |
| 4,702,589 | 10/1987 | Ito | 355/7 X |
| 4,707,126 | 11/1987 | Ohshima et al. | 355/7 X |
| 4,728,985 | 3/1988 | Nakashima et al. | 355/7 |

*Primary Examiner*—Fred L. Braun

*Attorney, Agent, or Firm*—Oblon, Spivak, McClelland, Maier & Neustadt

[57] ABSTRACT

A control system for a copier having at least some of the following functions: color printing function; a combining function; a shifting function; a trimming function; a continuous copying function; a magnification changing function. When using a trim function the shift function or the combine function which involves data setting function, the first data setting and the second data setting are performed at the same time to enhance operability of the copier. In the combine function, which is performed after a copying operation, the trim function, the shift function or the like is restored. The center of a magnification-changed image is aligned with that of a document image in terms of coordinates. Such an image is shifted by a particular amount specified (absolute value). When a 1 magnification condition, an image is shifted by an amount selected if the size of a document is different. When an image is to be shifted in such a direction that a paper precedes the image, the image may be shifted beyond a limit which is mechanically improved by a drum and register rollers. A single document may be reproduced a plurality of times on a single paper whose size is double the size of the document, or two documents may be reproduced side by side on a single paper which is greater in size than the documents, or a plurality of documents may be reproduced on a single paper.

11 Claims, 105 Drawing Sheets

A-1-5-1
RIGHT / LEFT KEY PROCESSING
RIGHT KEY ?
LEFT KEY ?
IMAGE SHIFT ?
X DATA INPUT ON ?
X1 X2 ) DATA INPUT ON
RET
INCREMENT LOOP COUNTER BY 1
Y
N

| |
|---|
| Fig.8E-2a |
| Fig.8E-2b |
| Fig.8E-2c |

| Fig. 8E-4a | Fig. 8E-4b |
|---|---|

| |
|---|
| Fig.8E-6a |
| Fig.8E-6b |

| |
|---|
| Fig.8E-7a |
| Fig.8E-7b |

| Fig.8E-8-2a | Fig.8E-8-2b |
|---|---|

| |
|---|
| Fig. 8F-1 |
| Fig. 8F-2 |

| Fig. 8I-1 | Fig. 8I-2 |
|---|---|

| |
|---|
| Fig. 9A |
| Fig. 9B |

| |
|---|
| Fig.12B-1a |
| Fig.12B-1b |

| |
|---|
| Fig. 12D-1 |
| Fig. 12D-2 |

| |
|---|
| Fig.15C-1a |
| Fig.15C-1b |

| |
|---|
| Fig.15D-1 |
| Fig.15D-2 |

| | |
|---|---|
| Fig. 19A | Fig. 19B |
| Fig. 19C | Fig. 19D |
| Fig. 19E | Fig. 19F |

Fig.22B ⇨

REFERENCE DEFINED BY ONE SIDE

REFERENCE DEFINED BY CENTER

CONTROL SYSTEM FOR A COPIER WITH RETENTION OF SETTINGS THEREFOR

This application is a continuation of application Ser. No. 07/073,749, filed on Jul. 15, 1987, now abandoned.

BACKGROUND OF THE INVENTION

The present invention relates to a control system for a copier and, more particularly, to a control system for an electronic copier of the type having a monocolor or multicolor printing function, a combining function, a shifting function, a trimming function, a continuous printing function, a magnification changing function, and others.

A modern high-performance copier has various functions such as a monocolor or multicolor printing function, a combining function for printing images a plurality of times on a single paper, a shifting function for printing an image by shifting the display position of a document, a trimming function for printing only a part of a document, a continuous printing function for printing images of a plurality of objects carried on, for example, an A3 document on papers of smaller than the document format by dividing the objects, and a magnification changing function for printing an image of a document by enlarging or reducing the image.

In a prior art copier of the type described, each of the functions is accomplished by setting data only once when it is not accompanied by another. To execute two different functions together, after an image has been printed out with data on the first function set, data on the other function is set to print out an image on the same paper. For example, in a combining mode which includes a trim mode and a shift mode, data for trimming or shifting is set, an image is printed out, then another document data to be combined is set, then the data is printed out combined with the previous one. In this manner, data has to be registered by two consecutive times of manipulation on a function-by-function basis. Such not only forces troublesome manipulations upon the operator but also frequency invites erroneous manipulation, faulty printing, and other undesirable occurrences.

Although a special mode capable of executing such settings at the same time may be proposed, it will never occur that after the first copying operation the same mode is needed, e.g., that after the trim mode has been set and executed, the same trimming data is set for the next mode. Hence, repeating the same mode would limit the user's editing ability and data correcting ability.

Further, such a high performance copier is operated to reproduce a document image by changing the magnification to 110%, 100%, 94%, 78%, 64% or the like, the center of an image is unavoidably shifted based on the magnification selected. Also, the amount of shift is changed according to the magnification. This makes it difficult for the user to edit an image because the position of an image to be reproduced on a paper differs from that of an image printed out on a document. For example, when the trim mode or the image shift mode is combined with the magnification change mode or when combine is combined with the magnification change mode, even if a shift area is specified, the image is shifted by an amount which is produced by multiplying it by the magnification selected; converting the amount of shift to a specified one would make the editing work more difficult.

When it is desired to provide a margin on a paper for a binding purpose, a particular amount of shift is specified to shift an image to the right or to the left relative to a paper (shift mode). Specifically, since a paper is discharged upside down, right shift has to be executed by delaying the timing for causing register rollers to drive a paper while left shift has to be executed by delaying the timing for turning on a lamp. To shift an image in such a direction that a paper precedes the image, it has been customary to start the register rollers (paper) by a signal from a scanner. However, an image cannot be shifted beyond a certain limit.

As regards the continuous copy mode, it is a common practice to reproduce two discrete images carried on a single document independently of each other on two papers each being of a format double the format of the document. Although such a mode is desirably applicable to a case wherein a plurality of documents are to be divided, it is incapable of reproducing a plurality of images on papers of large format or reproducing a plurality of documents on a single paper of large format with images positioned side by side. A difficulty is also experienced in bookbinding.

SUMMARY OF THE INVENTION

It is an object of the present invention to provide a copier control system which, when the combine mode which includes involves data setting for, for example, trimming and shifting is desired, allows the first and second data settings to be performed at the same time, thereby enhancing efficient manipulation.

It is another object of the present invention to provide a copier control system which, in the combine mode which includes trimming, shifting and the like, restores the mode to a standard mode after copying.

It is another object of the present invention to provide a copier control system which controls the center of a magnification-changed image into alignment with that of a document image in terms of coordinates, causes a magnification-changed image to be shifted by a specified distance (absolute value), and, when the document size is different, allows an image to be shifted by a specified distance even for 1 magnification.

It is another object of the present invention to provide a copier control system which, when it is desired to shift an image in a direction for causing a paper to precede the image, allows the image to be efficiently shifted even beyond a limit which is imposed mechanically by a photoconductive drum and register rollers.

It is another object of the present invention to provide a copier control system having a special continuous copy mode which allows a plurality of images carried on a single document to be reproduced on a single paper having a greater size than the document, thereby promoting efficient copying.

It is another object of the present invention to provide a copier control system having a special continuous copy mode which allows two documents to be reproduced side by side on a single paper, thereby improving the copying efficiency.

It is another object of the present invention to provide a copier control system having a special continuous copy mode which allows a plurality of documents to be reproduced on a single paper, thereby enhancing efficient copying and simple bookbinding.

In accordance with the present invention, in a control system for a copier having at least a trim mode, a shift mode, and a combine mode, when the trim mode or the shift mode is selected after the combine mode has been set, a program mode is automatically set up so that data for the combine mode, which is to be executed first, and data for the trim mode or the shift mode, which is to be executed next, are set and registered at the same time by a program.

Also, in accordance with the present invention, in a control system for a copier having a trim mode, a shift mode, and a combine mode, when the trim mode or the shift mode is selected while the combine mode, which includes an undercolor mode, is set, a composite copy mode is set and, then, one of a mode in which after copying in the composite copy mode the mode is to be restored to a standard mode and a mode in which the mode is to be restored to a first mode of the combine mode is selected.

Further, in accordance with the present invention, in a control system for a copier having a means for setting a magnification, and at least one of a means for specifying an area of a document for partial copying and means for producing an image-shifted copy, a mode in which a position of a center of a copy image coincides with that of a document or a distance of shift of the copy image is variable in response to a magnification depending upon an order of designation of the means is set up. This mode causes data to be converted such that copy image and the document coincide with each other with respect to the position of the center or the distance.

Besides, in accordance with the present invention, in a control system for a copier which shifts an image by varying a relative position of an image provided on a drum and a paper to which the image is to be transferred, one of three different modes (a), (b) and (c) stated below is automatically selected based on an amount of shift of an image:

(a) a mode in which an image-forming process on the drum is started a predetermined period of time before arrival of the paper at register rollers, and an interval between arrival of a scanner, which is operated in response to the image-forming process, at a predetermined position and activation of the register rollers is varied;

(b) a mode in which the image-forming process is started when the paper reaches the register rollers, and an interval between a time of start of the image-forming process and activation of the register rollers is varied; and (c) a mode in which the register rollers are activated at a time when the paper reached the register roller is slightly slackened, and an interval between a time of activation of the register rollers and the time of start of the process is varied.

Further, in accordance with the present invention, in a control system for a copier having an automatic document feeder and a combining device, a control is performed such that a first copy is fed to reproduce an image printed on the document in a left-hand side of a paper, and then a second document is fed to reproduce an image printed on the second document on a right-hand side of a same surface of the paper by using the combining device.

Further, in accordance with the present invention, in a control system for a copier having an automatic document feeder and a combining device, a control is performed such that a first document is fed to reproduce an image printed on the document on one side of a surface of a paper and then the same image of the document is reproduced on the other side of that surface of the paper by using the combining device.

In addition, in accordance with the present invention, in a control system for a copier having an automatic document feeder, a two-side copying device, and a combining device, a control is performed such that a first document is reproduced on a right-hand side of a front surface of a paper, then a second document is reproduced on a left-hand side of a rear surface of the paper by using the two-side copying device, then a third document is reproduced on a right-hand side of the rear surface of the paper by using the combining device, and then a fourth document is reproduced on a left-hand side of the front surface of the paper by using the two-side copying device.

The above and other objects, features and advantages of the present invention will become more apparent from the following detailed description taken with the accompanying drawings.

BRIEF DESCRIPTION OF THE DRAWINGS

FIG. 8A-1 is a flowchart showing magnification set 1 processing;

FIG. 8A-2 is a flowchart showing magnification set 2 processing;

FIG. 8A-3 is a flowchart showing magnification set 3 processing;

FIG. 8E-1 is a flowchart showing right/left key processing;

FIG. 8E-2 is a flowchart showing up/down key processing;

FIG. 8E-3 is a flowchart showing enter key processing;

FIG. 8E-4 is a flowchart showing partial magnification change processing;

FIG. 8E-5 is a flowchart showing edit data convert processing;

FIG. 8E-6 is a flowchart showing trimming data convert 1;

FIG. 8E-7 is a flowchart showing trimming data convert 2;

FIGS. 8E-8-1 and 8E-8-2 are flowcharts showing trimming data convert 3;

FIG. 8E-9 is a flowchart showing trimming data convert 4;

FIG. 8E-10 is a flowchart showing centering data convert processing;

FIG. 8E-11 is a flowchart showing shift data convert processing;

FIG. 8J-1 is a flowchart showing data convert processing;

FIG. 9 is a flowchart showing print condition check;

FIG. 10 is a flowchart showing pre-copy processing;

FIG. 11 is a flowchart showing print ON initialization;

FIG. 12B-1 is a flowchart showing paper feed control;

FIG. 12B-1-1 is a flowchart showing paper feed/transport clutch ON;

FIG. 12B-1-2 is a flowchart showing combine gate/-solenoid ON;

FIG. 12B-2 is a flowchart showing combine sensor check;

FIG. 12B-3 is a flowchart showing combine paper feed control;

FIG. 12C-1 is a flowchart showing copy start check;

FIG. 12C-2 is a diagram showing copy start positions to be checked;

FIG. 15C-1 is a flowchart showing register clutch control processing;

FIG. 15C-2 is a diagram showing a positional relationship between a photoconductive drum and register rollers;

FIGS. 22A to 22D are diagrams showing how an image is shifted in a usual magnification change mode;

DESCRIPTION OF THE PREFERRED EMBODIMENTS

Figure 1:
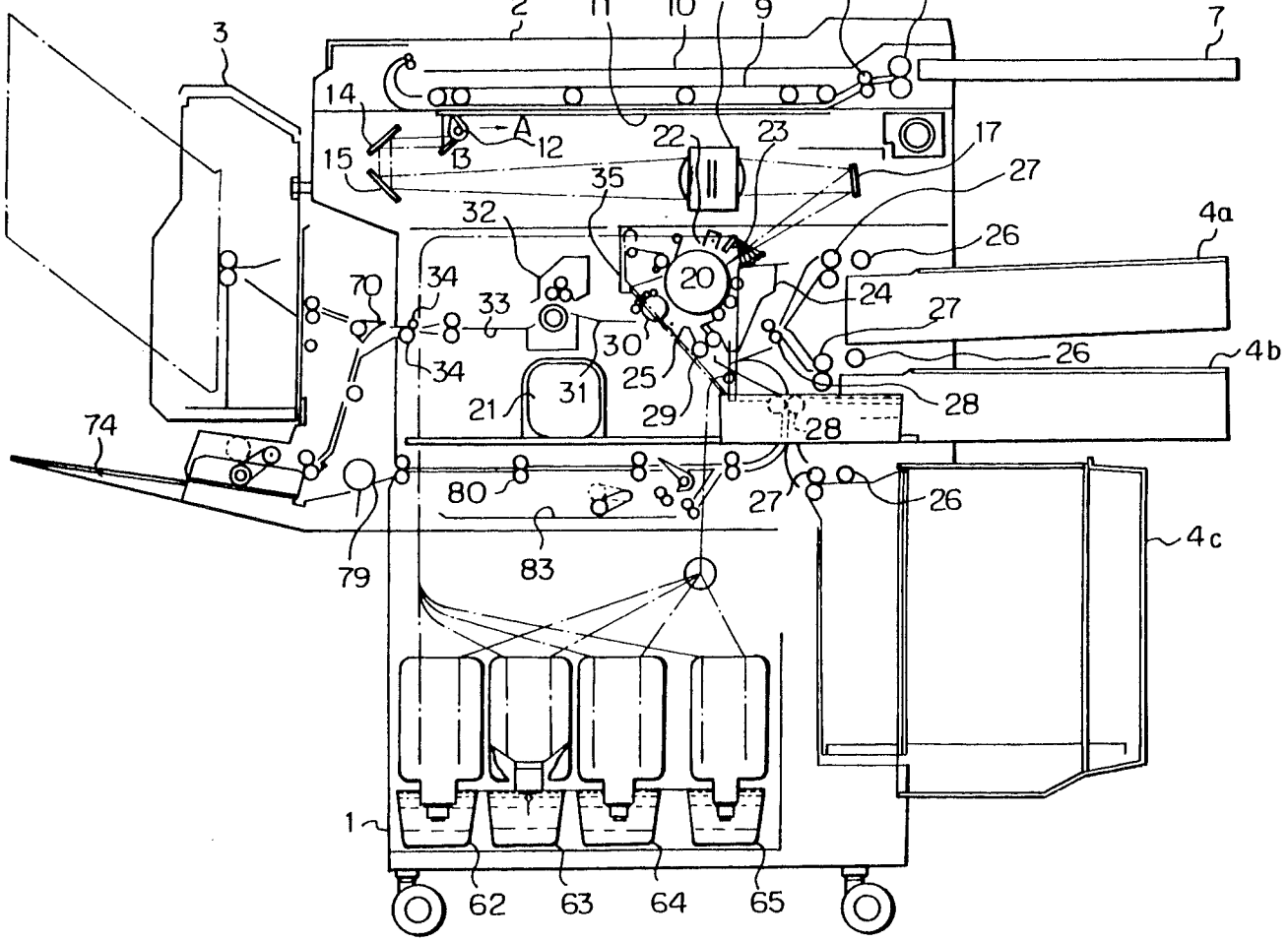
FIG. 1 is a sectional elevation of a monocolor copier to which the present invention is applicable.

Referring to FIG. 1 of the drawings, a monocolor copier to which the present invention is applicable is shown. As shown, an automatic document feeder (ADF) 2 is loaded on the top of a copier body 1, and a sorter 3 is provided on the paper outlet side of the copier body 1. Provided on the paper inlet side of the copier body 1 is a paper feed section which includes paper cassettes 4*a* and 4*b*, and a paper tray 4*c* adapted for the supply of a large amount of papers. The ADF 2 includes a document setting portion 7, ADF feed rollers 8, ADF conveyor belt 9, and a document discharge tray 10. Documents loaded in the document setting section 7 are fed one by one by the ADF feed rollers 8 to the ADF conveyor belt 9, then positioned on a glass platen 11, and then discharged to the tray 10 after copying. The ADF 2 is hinged at one side thereof to the copier body 1 to be movable toward and away from the glass platen, serving as a cover or presser plate when a document is manually set on the glass platen 11.

The document laid on the glass platen 11 is illuminated by a lamp 12. A reflection from the document is focused on the surface of a photoconductive drum 20 by way of a first mirror 13, a second mirror 14, a third mirror 15, a lens unit 16, and a fourth mirror 17. The drum 20 is driven in a clockwise rotational motion by a main motor 21 through a power transmitting mechanism, not shown. The lamp 12 and first mirror 13 are loaded on a first carriage, not shown, and driven at a predetermined rate in a direction indicated by an arrow A. The second and third mirrors 14 and 15 are mounted on a second carriage, not shown and driven in the direction A at half the rate of the first carriage. The surface of the drum 20 is uniformly charged by a main charger 22. The charged surface is exposed to the imagewise reflection from the document, so that an electrostatic latent image is formed on the charged surface. The latent image is developed by a developing unit 24, and the resulting visible image is fed to a transfer charger 25.

A paper fed from the paper feed section by feed rollers 26 is driven sequentially by rollers 27 and 28 to register rollers 29. At a predetermined timing, the register rollers 29 drive the paper toward the transfer charger 25 along a paper guide, whereby the previously mentioned visible image is transferred to the paper. Then, the paper is separated from the drum 20 by a separating unit 30 and, then, fed along a paper guide 31 to a fixing unit 32 which applies heat to the paper. The paper coming out of the fixing unit 32 is advanced along a paper guide 33 to discharge rollers 34 to be thereby fed out of the copier body 1. The sorter 3 sorts the papers which are sequentially fed out of the copier body 1.

In a combine mode or a two-side copy mode, images should be printed out twice on a single paper. In such a mode, the paper is transferred by a switch 70 toward a position 74 where it awaits another copying cycle. Thereafter, the paper is advanced through a second transport path by rollers 79 and 80 to reach the transfer charger 25 again. In the two-side copy mode, the paper directly transferred from the waiting position 74 to the transfer charger 25 is upside down and, therefore, can be printed with the next image without changing its position. On the other hand, in a combine mode which allows, for example, an undercolor to be printed over a single color, the paper is turned over at a second waiting position 83 and, then, transported to the transfer charger 25 so as to print out another image on the same side of the paper. The surface of the drum 20 is cleaned by a cleaning unit 35, whereafter the main charger 22 is energized again. Located in a bottom part of the copier body 1 and independently of each other are a red printing liquid 62, a green printing liquid 63, a blue printing liquid 64, and a cleaning liquid 65. Each of these liquids is circulated between its associated reservoir and the drum 20.

Figure 2:
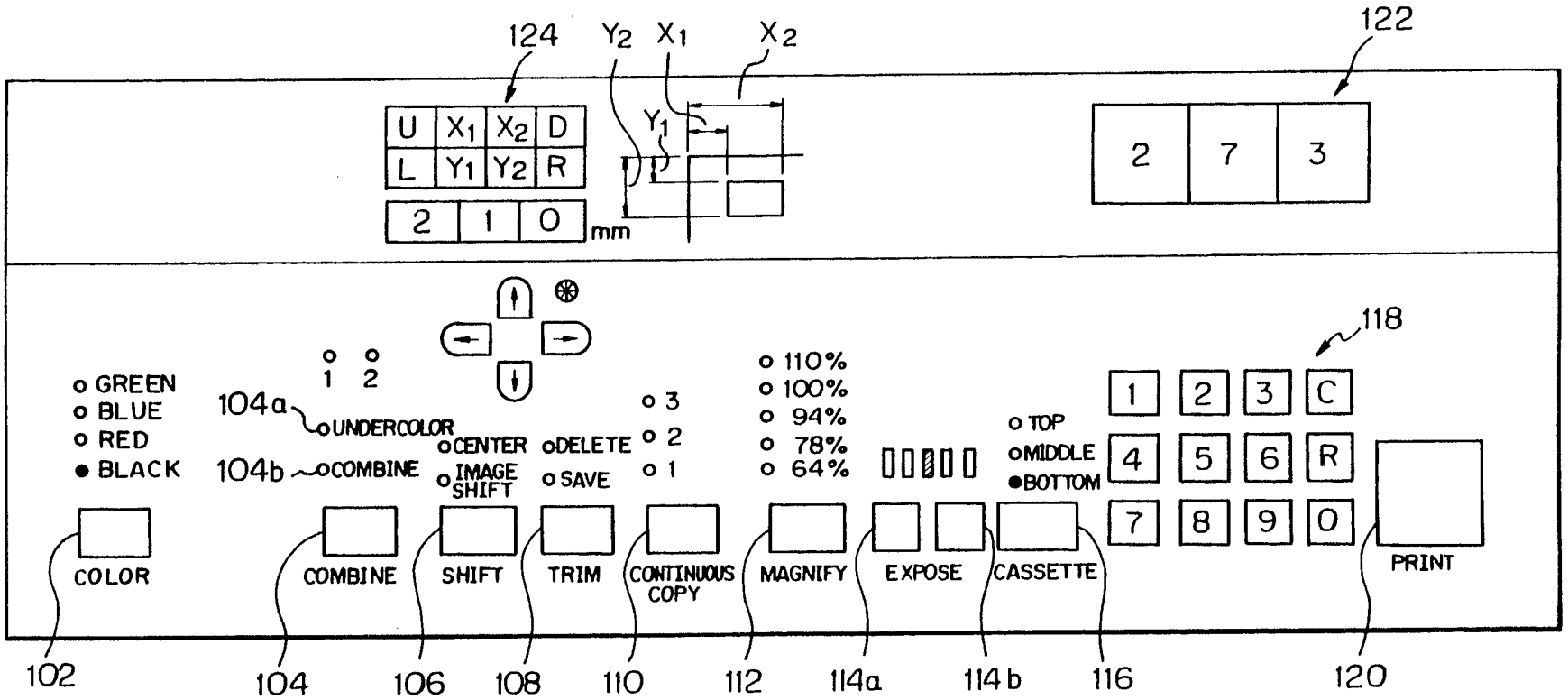
FIG. 2 is a view of an exemplary control panel of the copier as shown in FIG. 1.

Referring to FIG. 2, a control panel, or operation board, in accordance with one embodiment of the present invention is shown. Various keys provided on the control panel will be described from the right to the left of the drawing. When a color key 102 is depressed, a green, a blue, a red and a black lamp are sequentially turned on in this order. As a combine key 104 is depressed, one of an undercolor lamp **104*a* and a combine lamp 104*b* is turned on to set up a mode. Depressing a shift key 106 causes a centere lamp and an image shift lamp to glow alternately. Depressing a trim key 108 causes a delete lamp and a save lamp to glow alternately. A save mode is such that a desired area of an image is specified and left with the other area deleted, and a delete mode is such that that desired area is deleted. A continuous copy key 110 is adapted to select divisional copying of the first, second or third time. A magnify key 112 is operable to select a magnification of 110% to 64%. Expose keys 114*a* and 114*b* are selectively operable to sequentially increase the image density, from the right to the left as viewed in the figure. A cassette key 116 is adapted to select desired one of the top, middle and bottom cassettes. Numeral keys 118 may be depressed to enter a desired number of copies. A print key 120 is operable to start a copying operation. A numerical display 122 provided in an upper right portion of the control panel shows a cumulative number of copies. In an upper left portion of the control panel, symbols U, D, L, R, X1, X2, Y1 and Y2 are provided. The symbols U, D, L and R are representative of UP, DOWN, LEFT and RIGHT, respectively, while the symbols X1, X2, Y1 and Y2 are individually representative of the distances which are shown at the center of the control panel. Specifically, in the event of setting data for trimming and image shifting, the arrows which are positioned above the various keys are selectively manipulated to select a particular direction of shift and, then, a distance from the starting point is set by means of the symbols 124** and a display, which is shown as indicating 210 mm.

Figure 3:
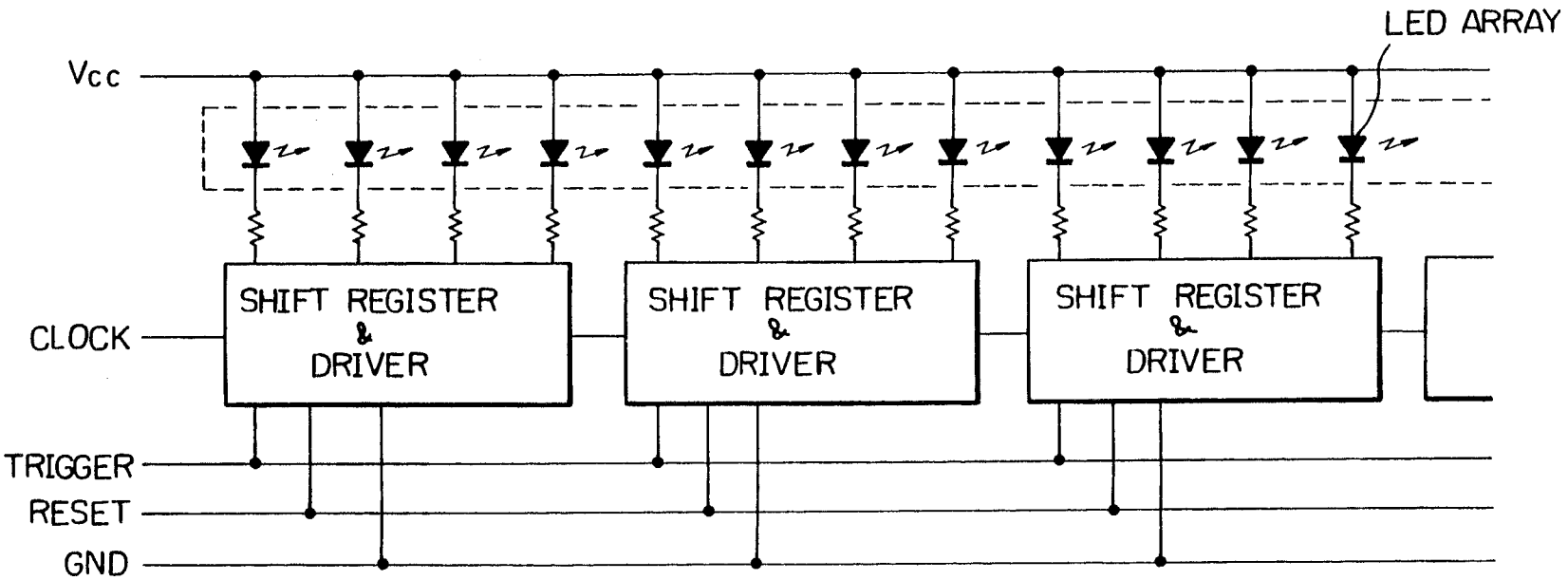
FIG. 3 is a diagram showing an LED array control circuit installed in the copier of FIG. 1.

Referring to FIG. 3, there is shown an LED (light emitting diode) array control circuit adapted to erase a part of a latent image which is provided on the drum 20. A CPU (central processing unit) delivers an LED arrangement signal as counted from a reference side in response to a clock signal, whereby a bit arrangement corresponding to turn-on and turn-off of LEDs is generated. Then, a trigger is input in synchronism with a turn-on timing to selectively control the LEDs. While a shift register and driver is associated with each four LEDs, such merely suggests the use of shift registers each having four pin terminals; use may be made of a single shift register having a great number of pins.

Figure 4:
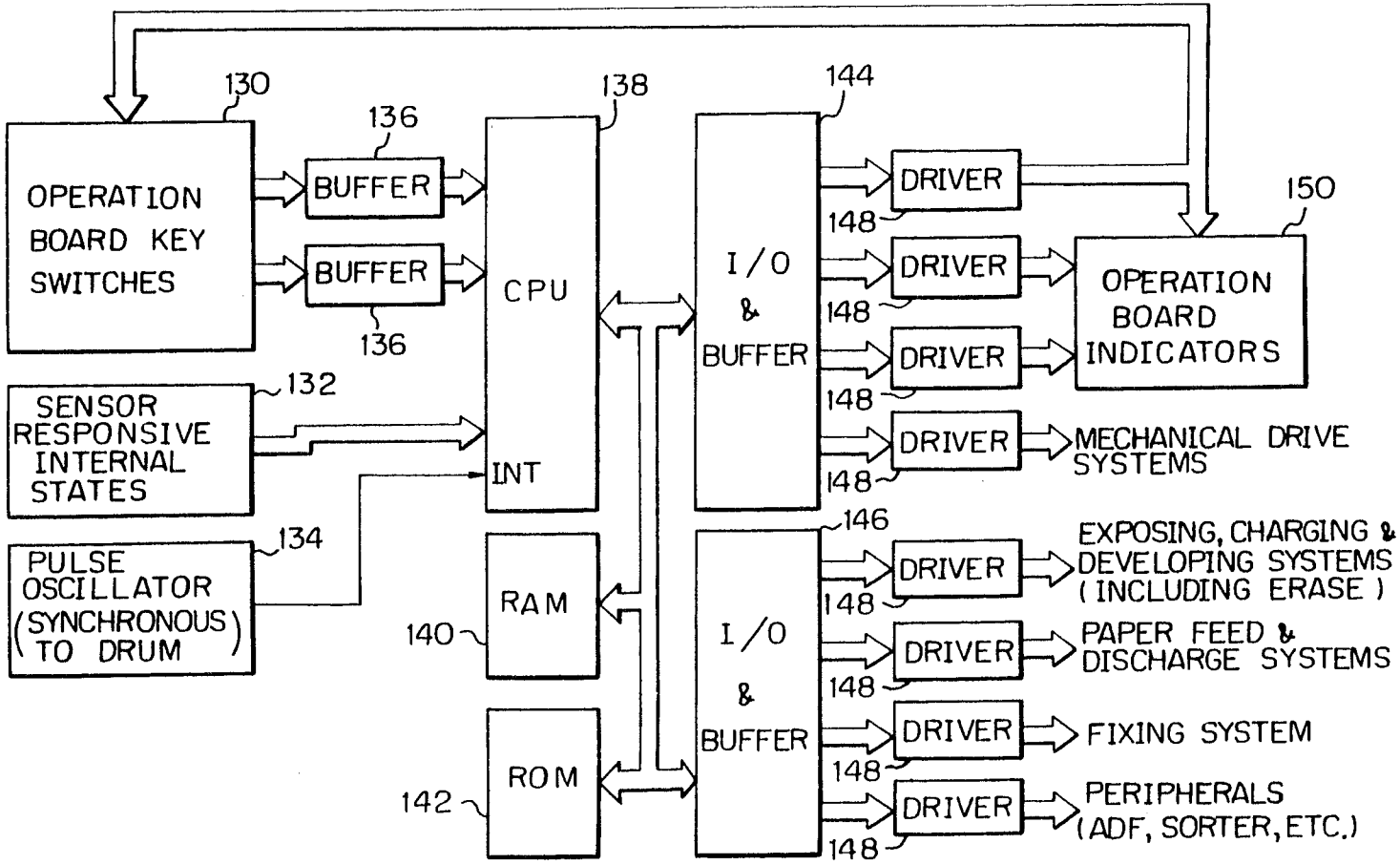
FIG. 4 is a block diagram showing a control section of the copier as shown in FIG. 1.

FIG. 4 shows a copier control section in accordance with the present invention. As shown, a CPU 138 is connected via buffers 136 to various key switches 130 of the copier, sensors 132 responsive to various conditions inside of the copier, and a pulse oscillator 134 which is synchronous to the drum 20. The CPU 138 is also connected to a RAM 140, a ROM 142, and I/O (input/output) port buffers 144 and 146 by an address bus, a control bus, a data bus, etc. The I/O port buffers 144 and 146 are connected via drivers 148 to a load 150 which is adapted for drive, display, and others. Hereinafter will be described the basic operation of the copier and the trim mode, shift mode, combine mode, program mode, and others.

Basic Operation

Figure 5:
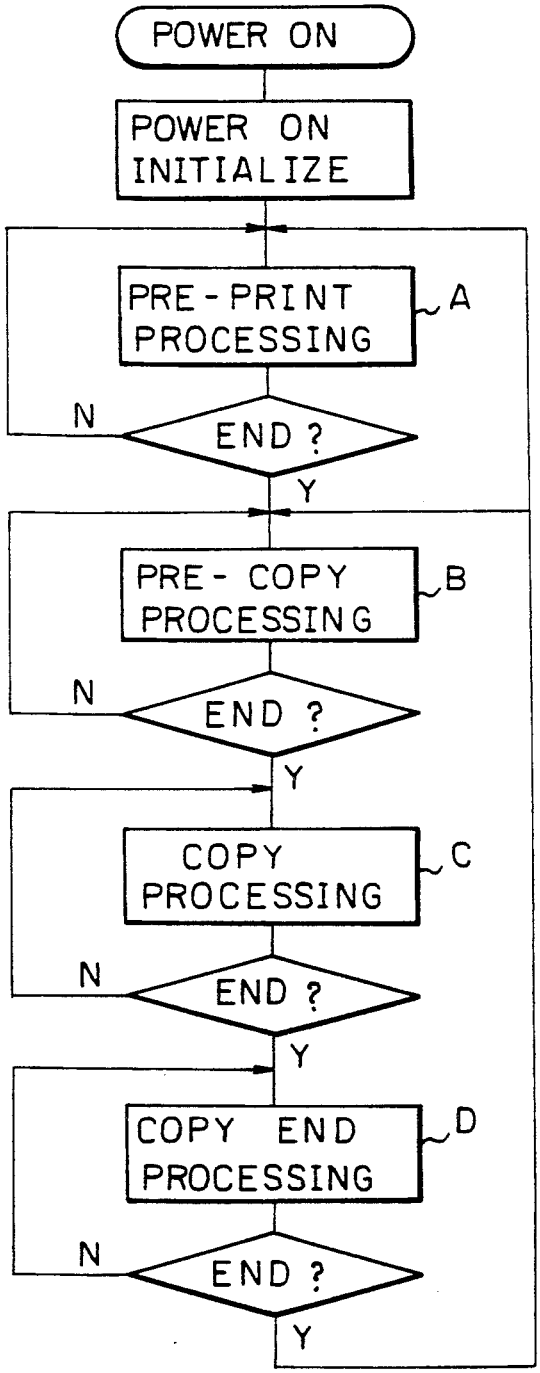
FIG. 5 is a flow chart demonstrating the basic operation of the copier.

Referring to FIG. 5, the basic operation of a copier which uses the invention is shown in a flowchart. When a power switch, not shown, of the copier is turned on, power ON initialize processing is executed and, then, copy processing (C) is performed by way of pre-print processing (A) and pre-copy processing (B). After the copy processing (C), copy end processing (C) is executed to effect a pre-processing for the next copying or, alternatively, the copy end processing is simply repeated.

Figure 6:
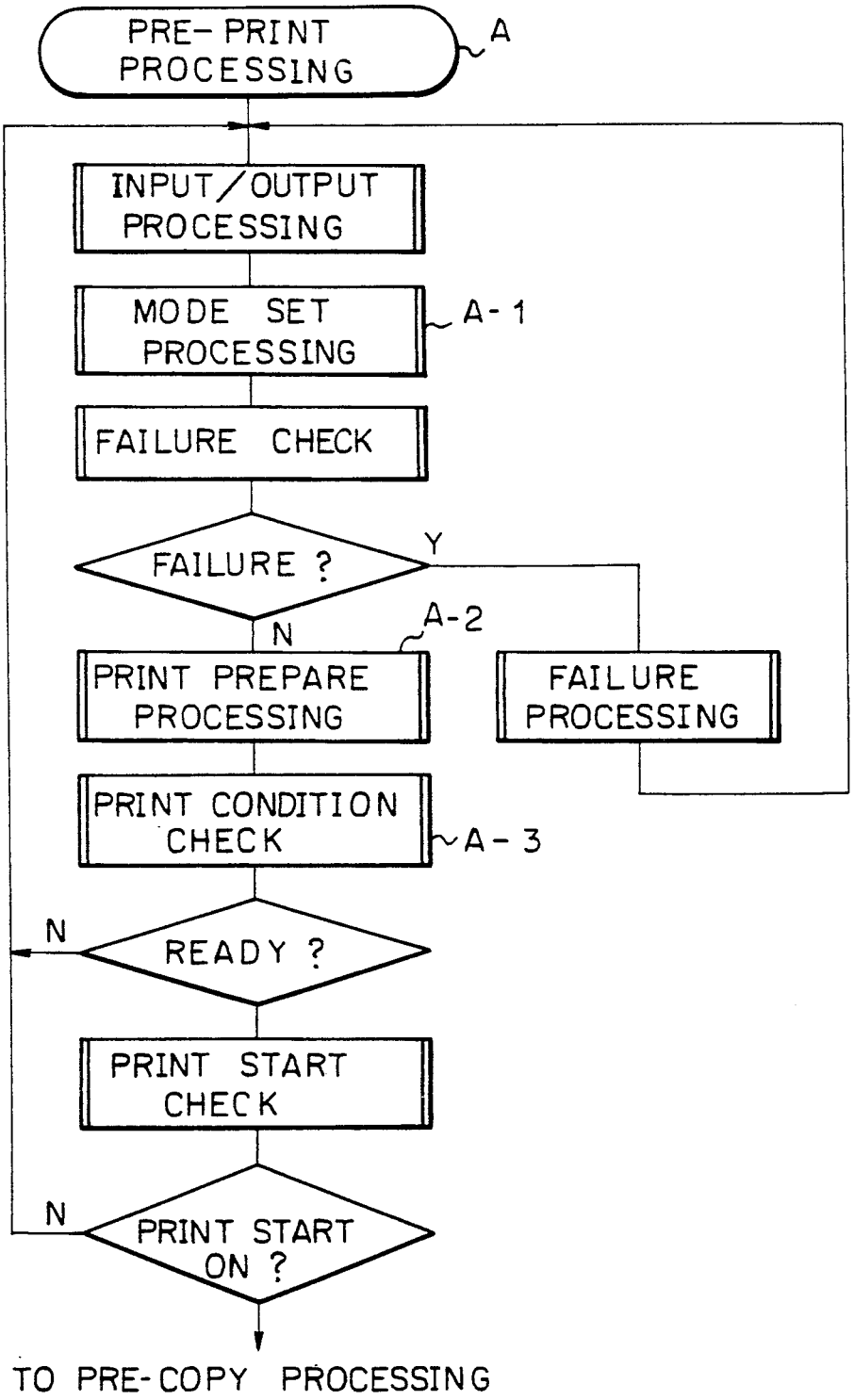
FIG. 6 is a flowchart showing pre-print processing.

FIG. 6 shows the pre-print processing (A) of FIG. 5 in detail. As shown, input/output processing, mode set processing (A-1), and failure checking are executed one after another in this order. If any failure is found, failure processing is performed. If no failure is found, the program advances to print prepare processing (A-2), and then to print condition check (A-3). If the printer is READY, print start check is performed to see if a print start ON condition has been reached. If the printer is not READY if the print start ON condition has not been reached, the program returns to the beginning to repeat the input/output processing.

Figure 8:
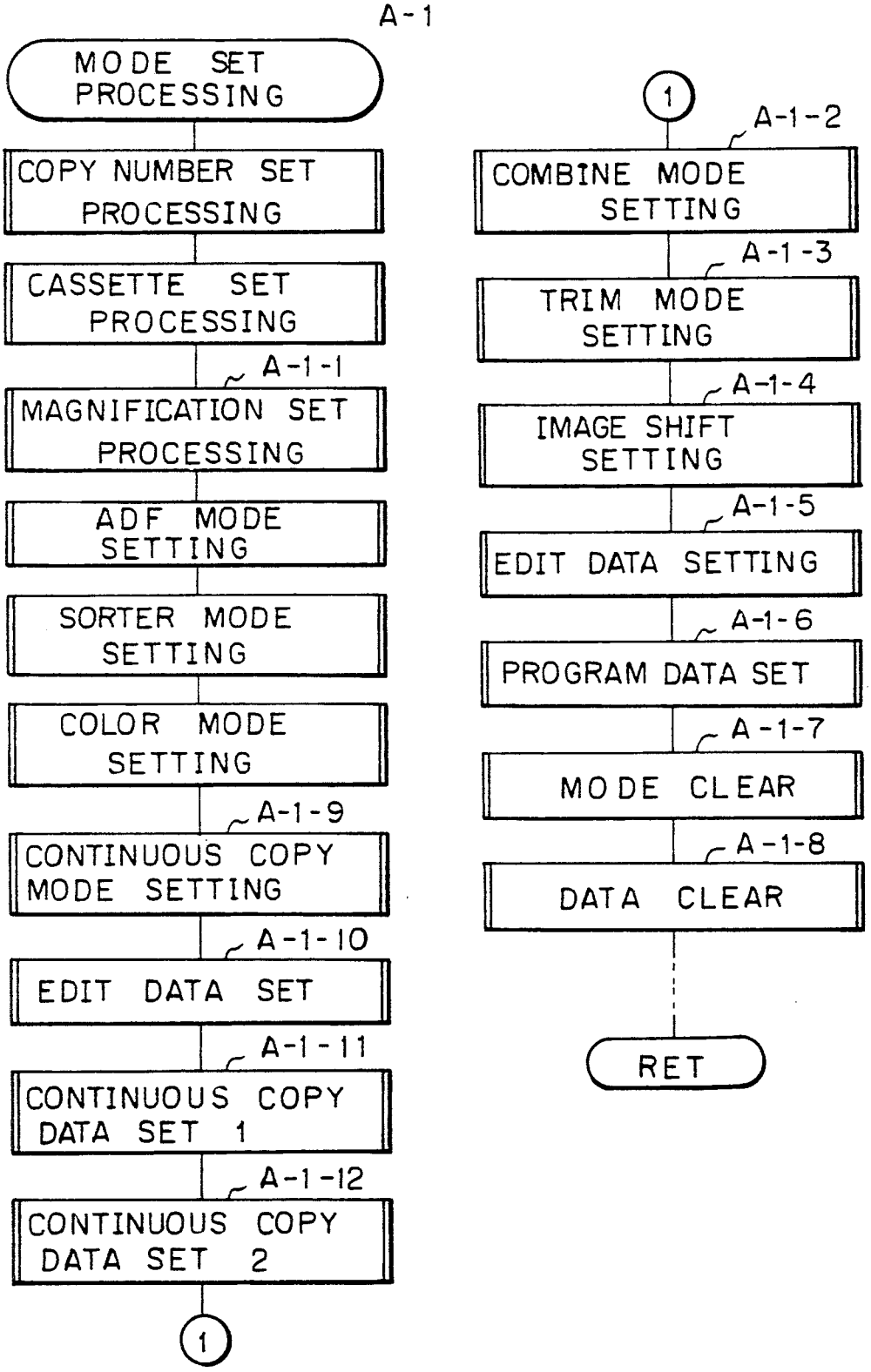
FIG. 8 is a flowchart showing mode set processing.

FIG. 8 shows the mode set processing (A-1) in detail. In the mode set processing (A-1), magnification set processing (A-1-1) is executed after copy number set processing and cassette set processing. This is followed by ADF mode set, sorter mode set color mode set, continuous copy mode set (A-1-9), edit data set (A-1-10), continuous print data set 1 (A-1-11), continuous copy data set 2 (A-1-12), combine mode set (A-1-2), trim mode set (A-1-3), image shift set (A-1-4), and edit data set (A-1-5), program set (A-1-6), and then by mode clear (A-1-7), data clear (A-1-8), and the like. Thereafter, the program returns (RET) to the beginning.

Figure 7:
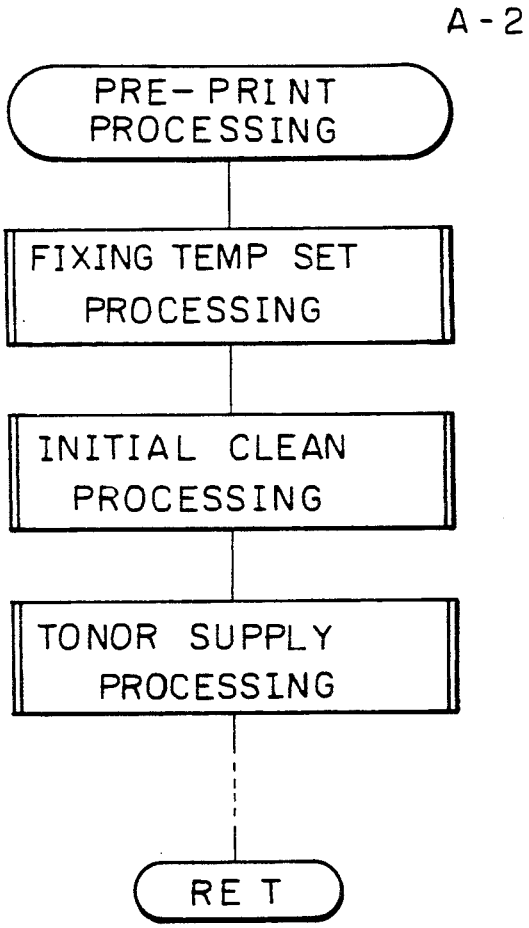
FIG. 7 is a flowchart showing print prepare processing.

FIG. 7 shows details of the print prepare processing (A-2) which is included in the pre-print processing (A). As shown, fixing temperature set processing, initial cleaning processing, toner supply processing and others are executed in sequence and, then, the program returns (RET) to the beginning.

Figure 8A:
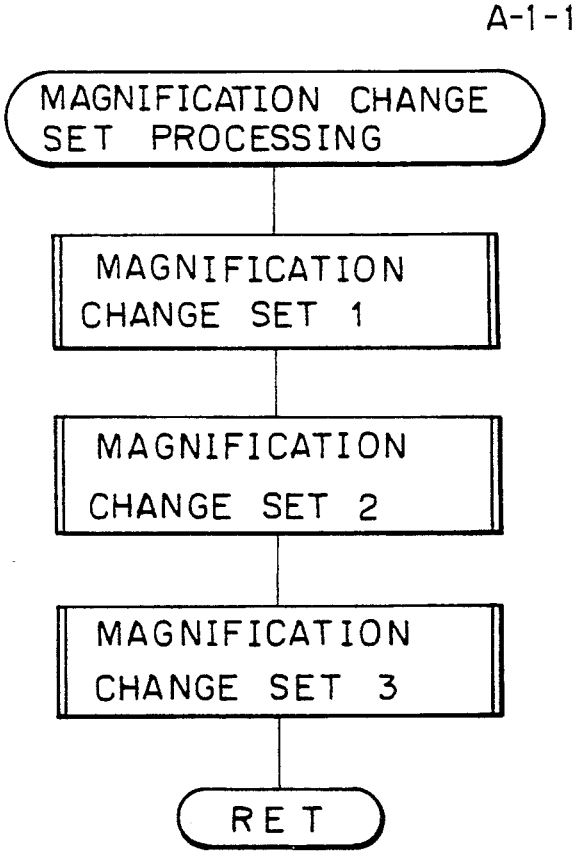
FIG. 8A is a flowchart showing magnification change processing.
Figures 1A, 8A:
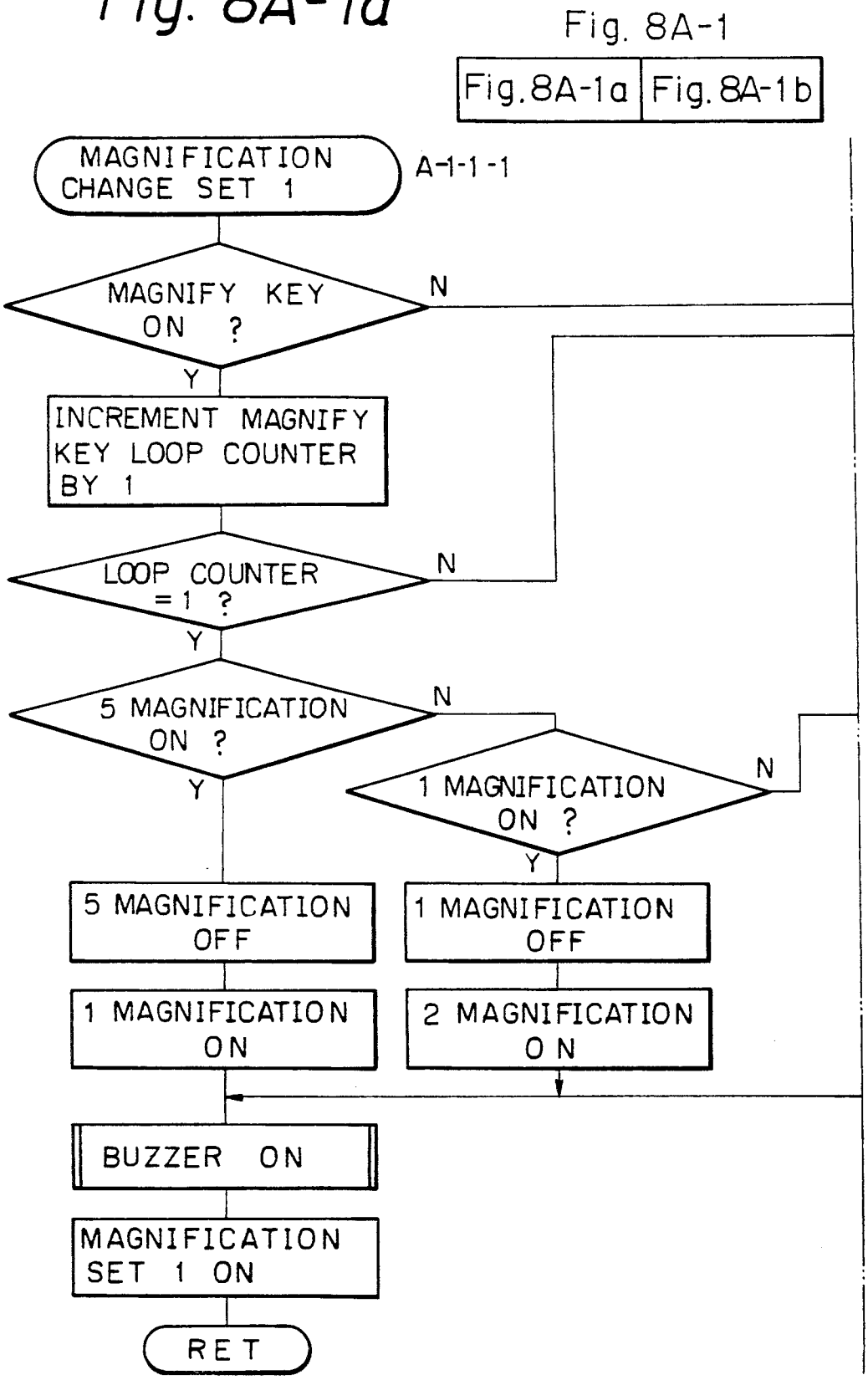
Figures 1B, 8A:
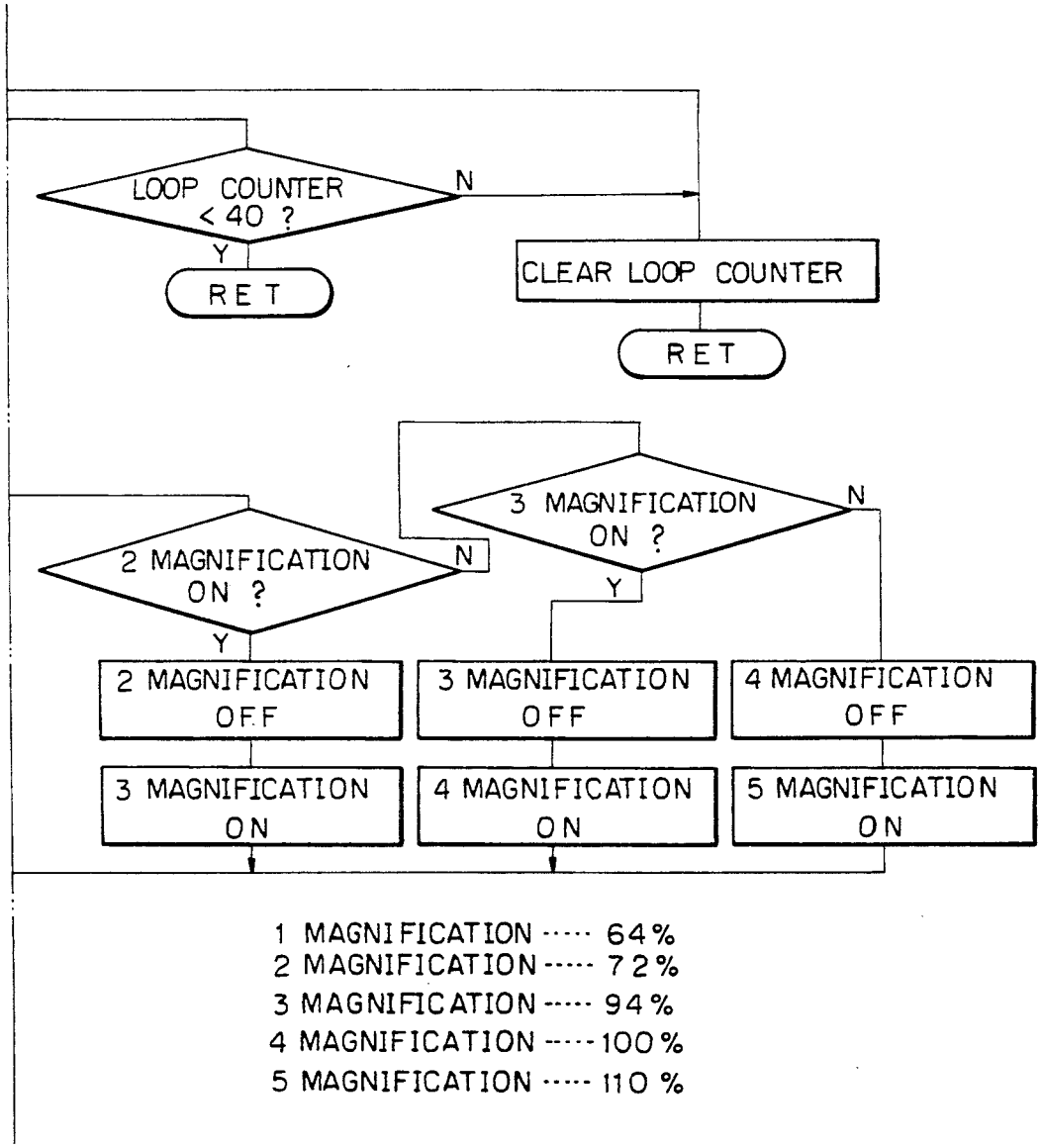
Figures 2, 8A:
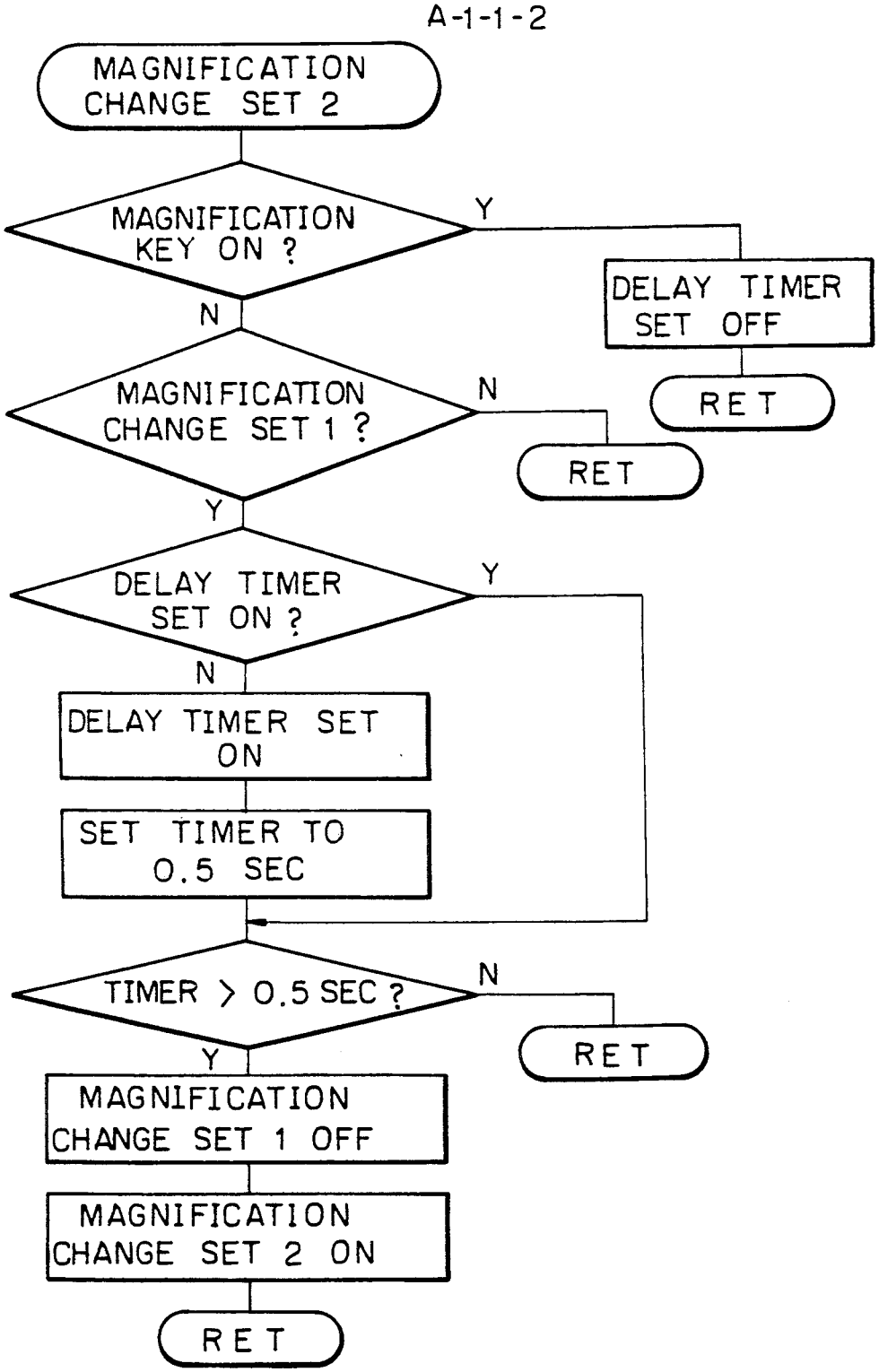
Figures 3, 8A:
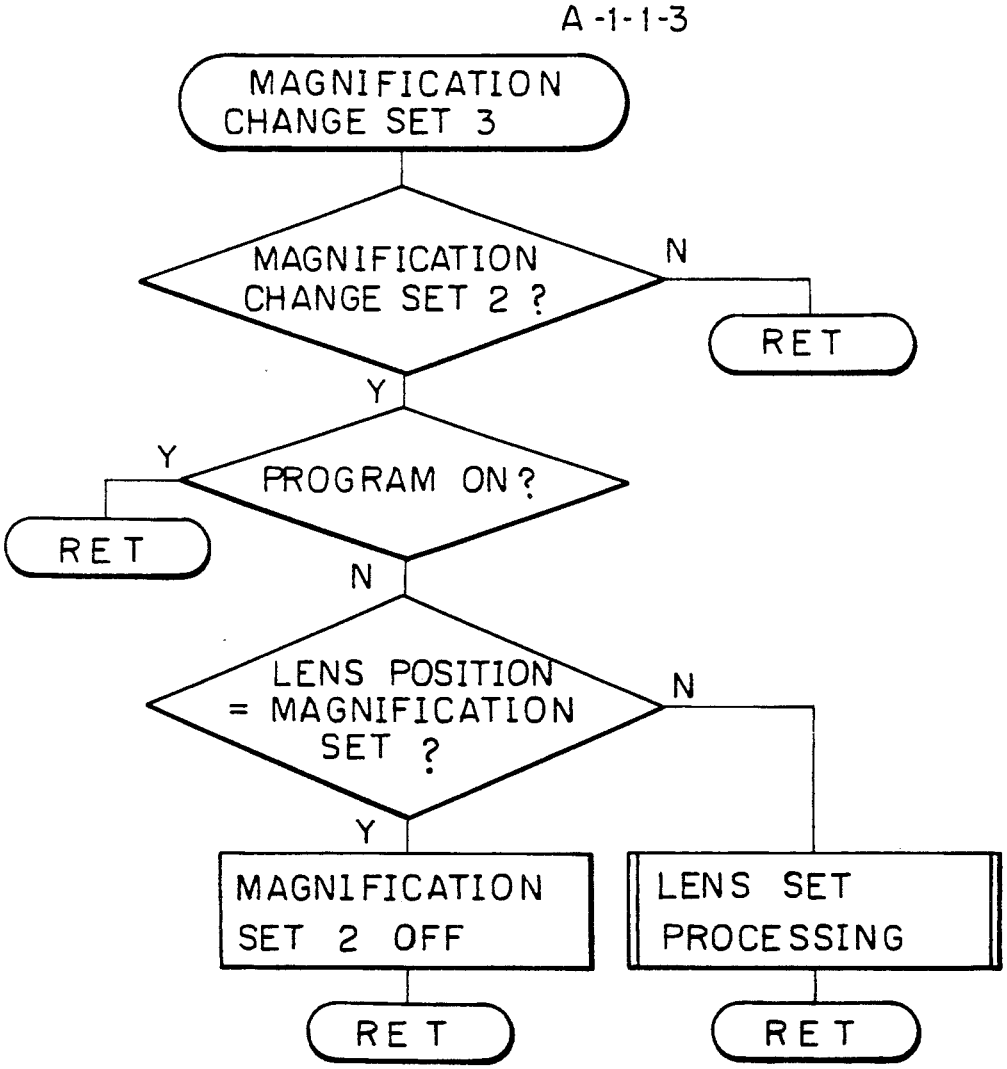
Figure 8B:
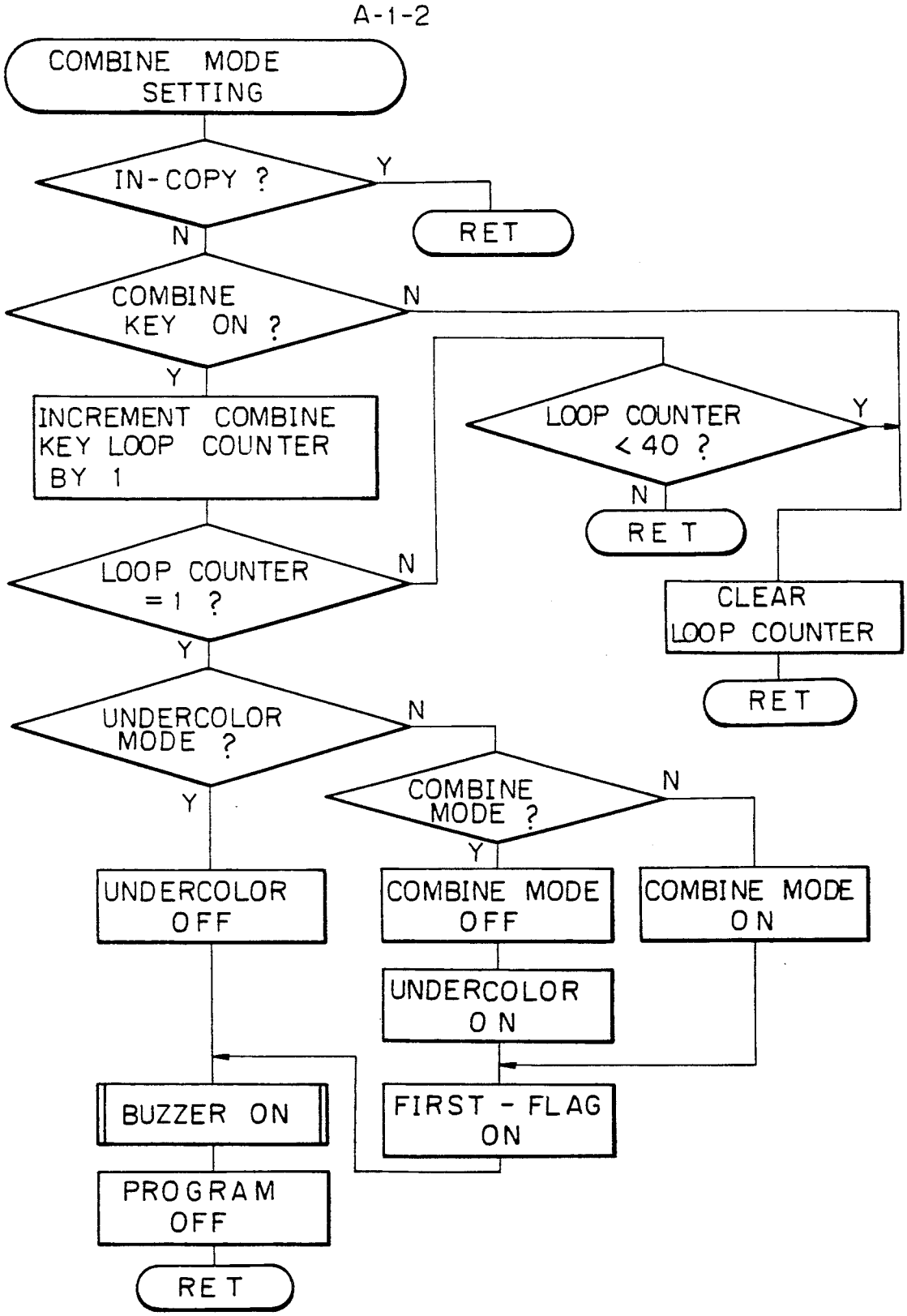
FIG. 8B is a flowchart showing combine mode set processing.
Figures 1, 8C:
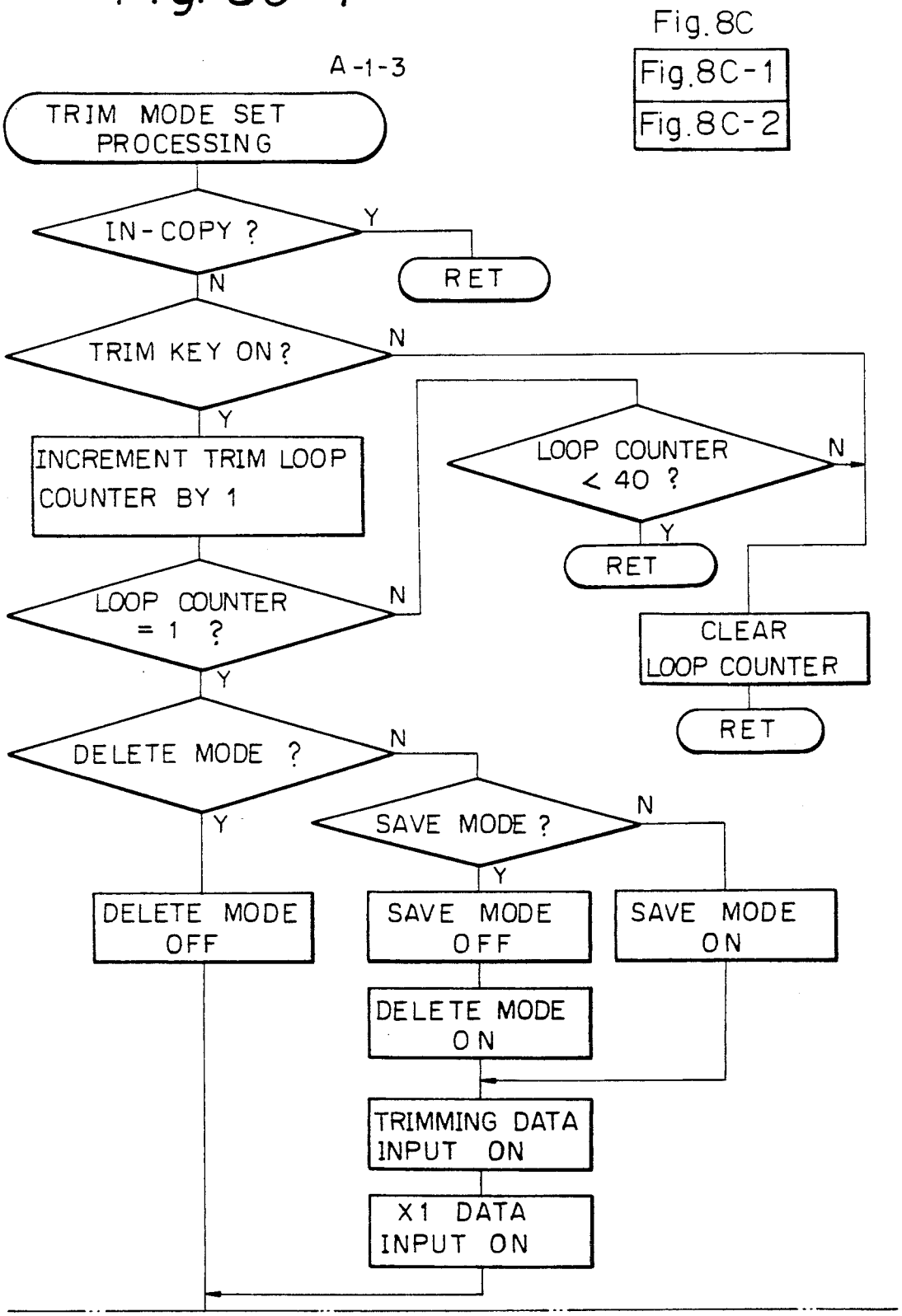
FIG. 8C is a flowchart showing trim mode set processing.
Figures 2, 8C:
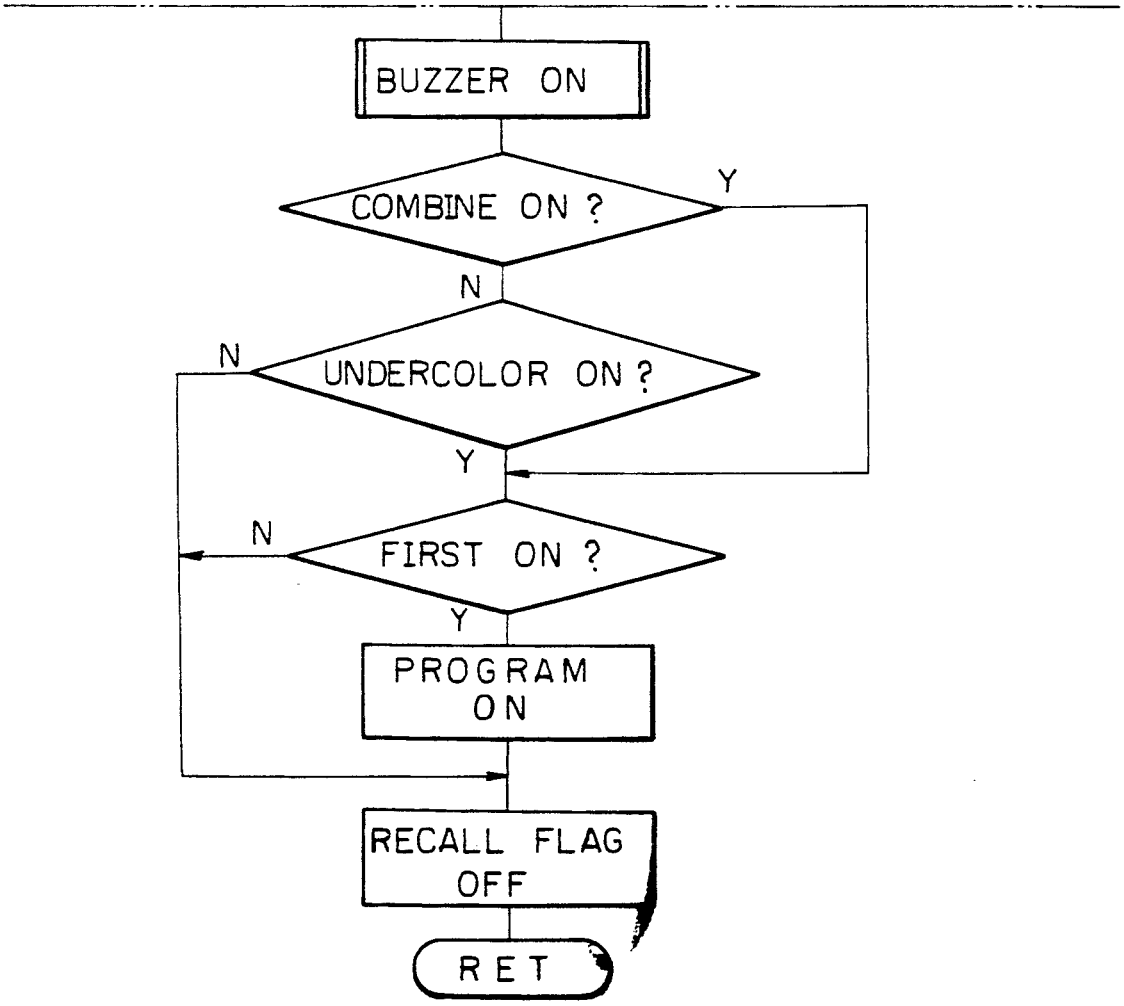
Figures 1, 8D:
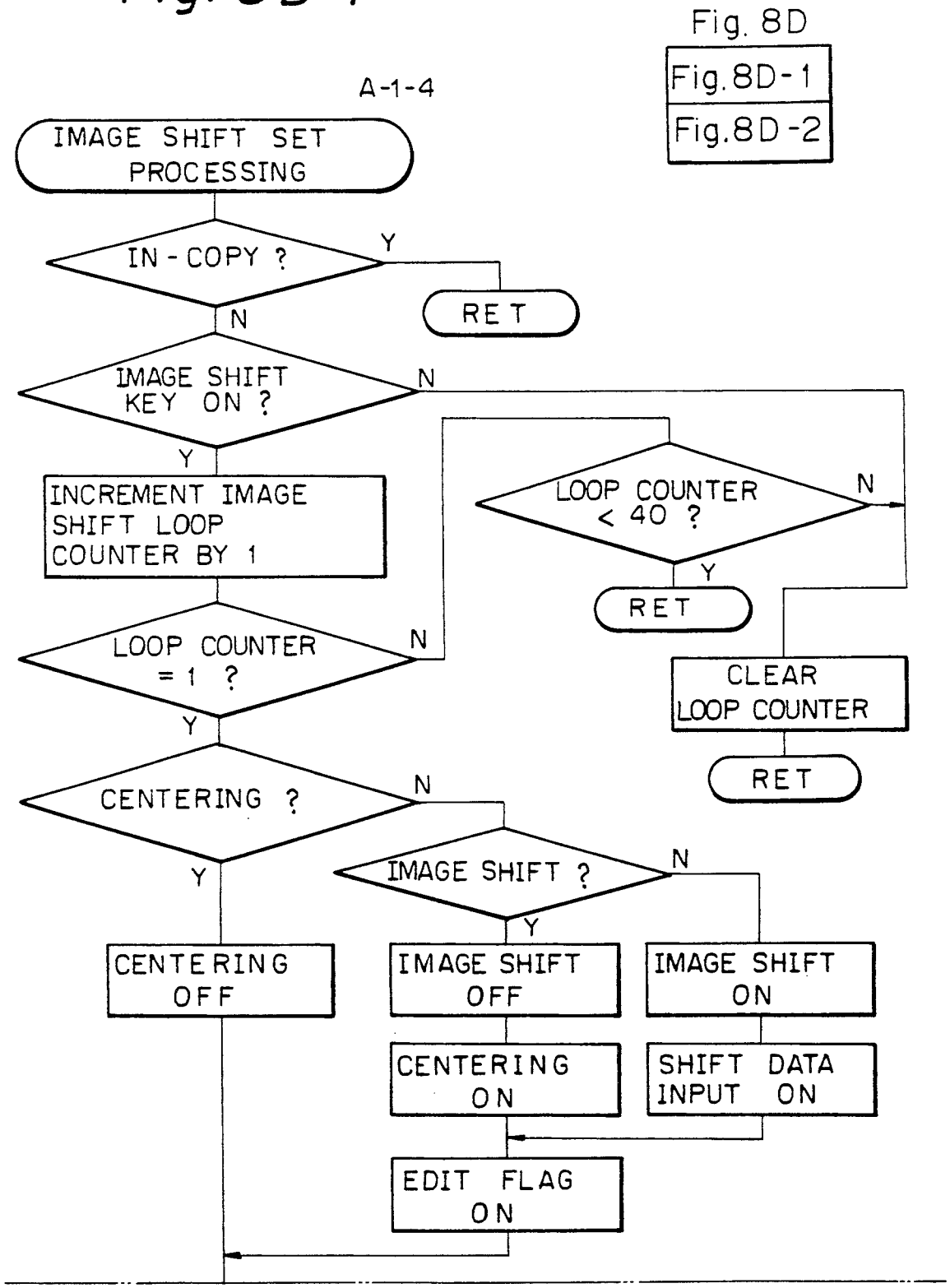
FIG. 8D is a flowchart showing image shift mode set processing.
Figures 2, 8D:
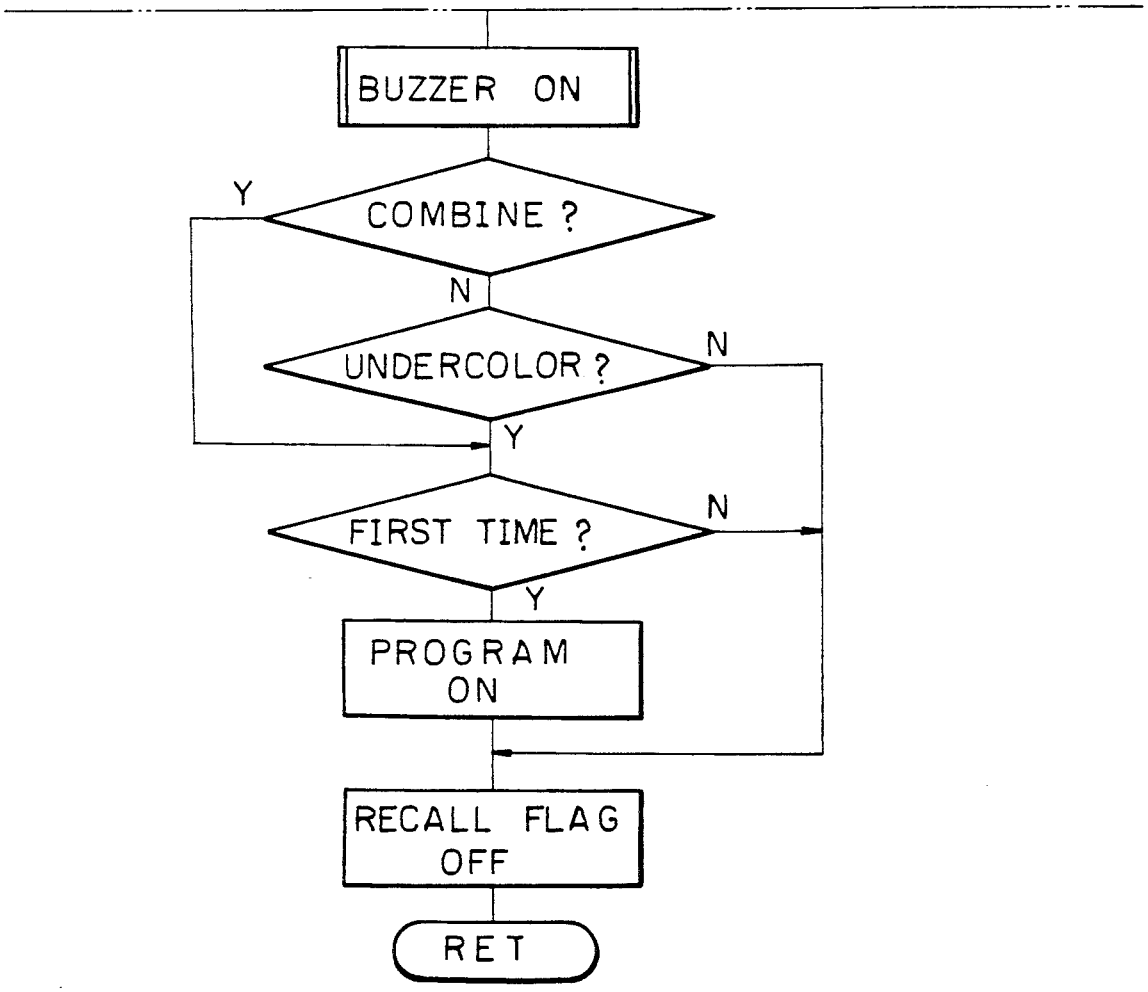
Figure 8E:
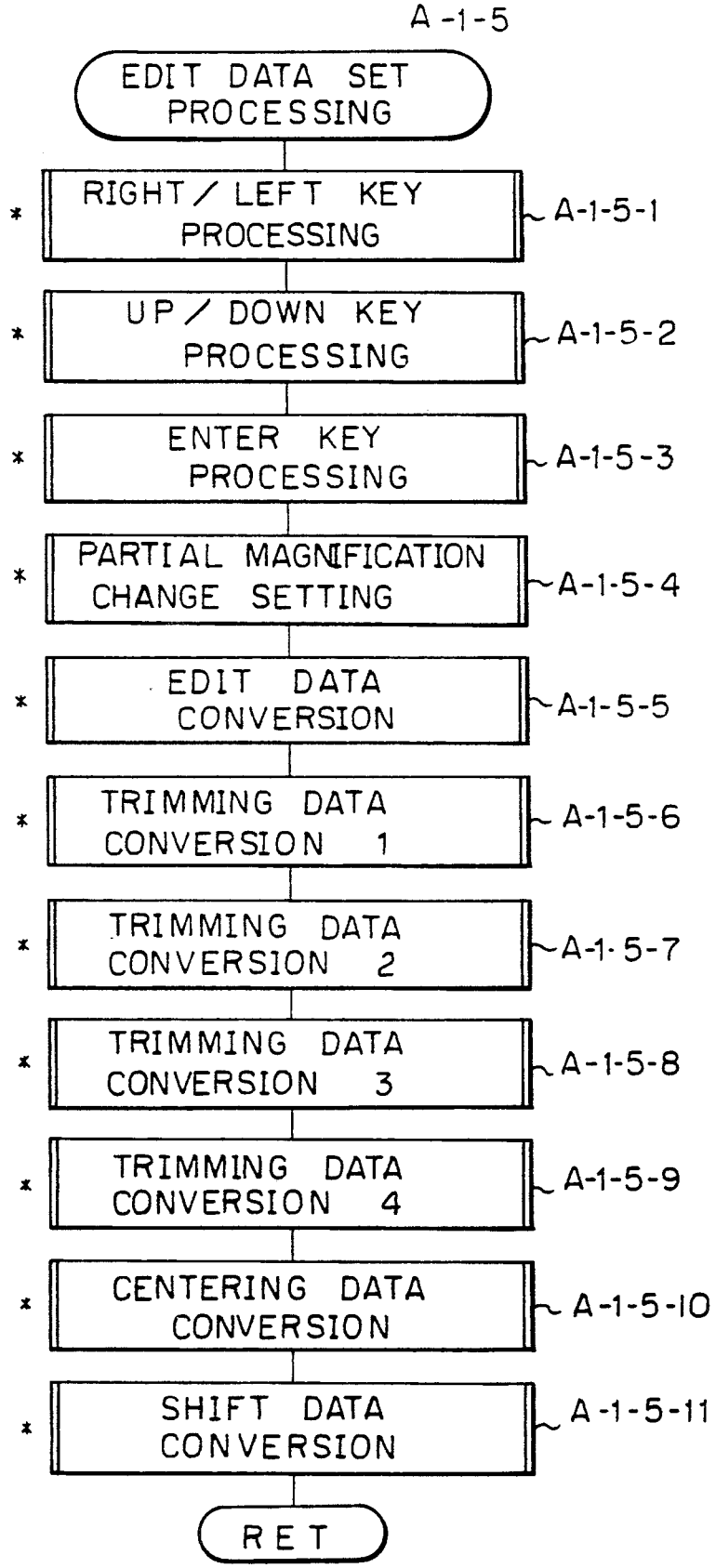
FIG. 8E is a flowchart showing edit data set processing.
Figures 1, 1A, 1B, 1C, 8E:
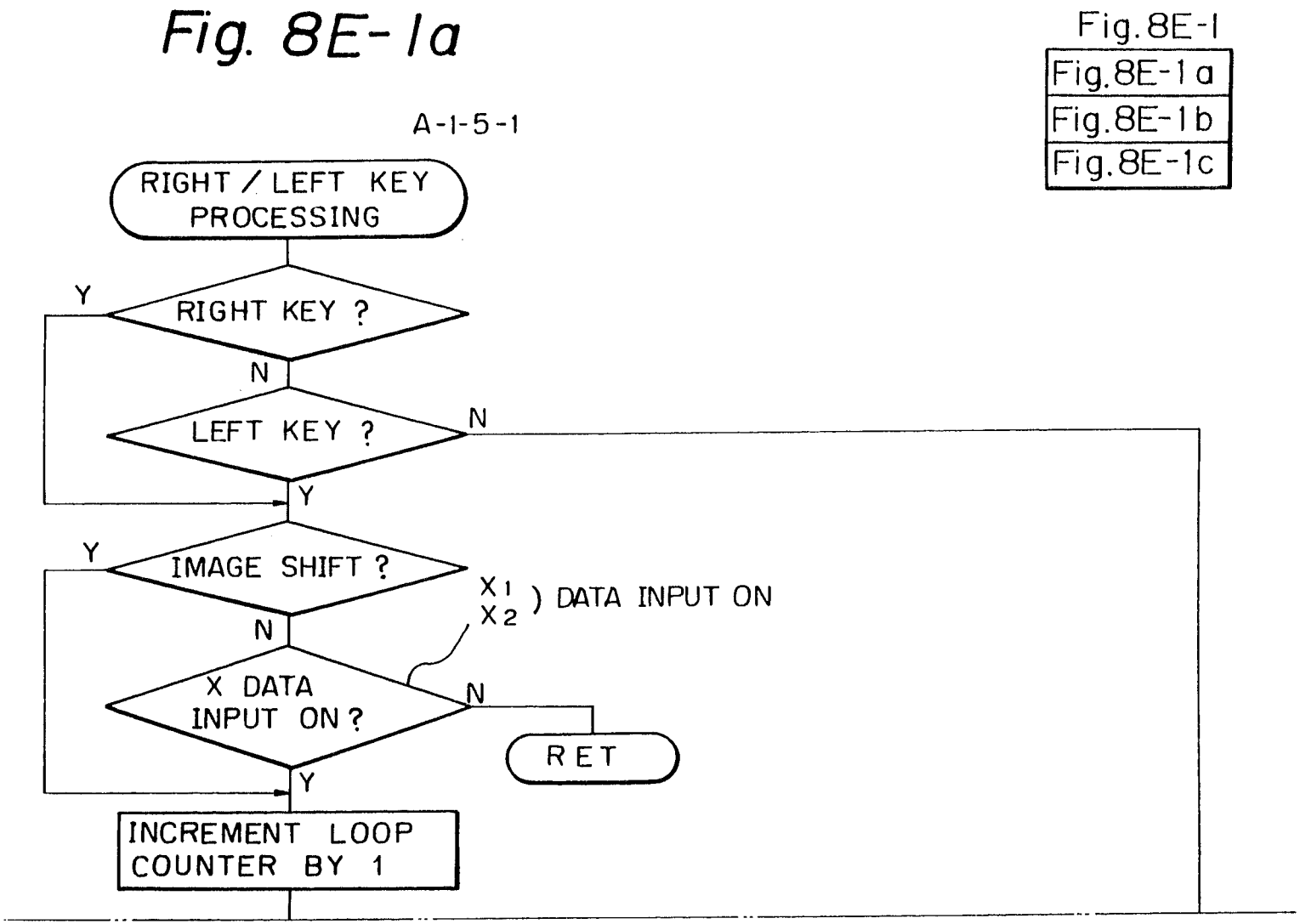
Figures 1B, 8E:
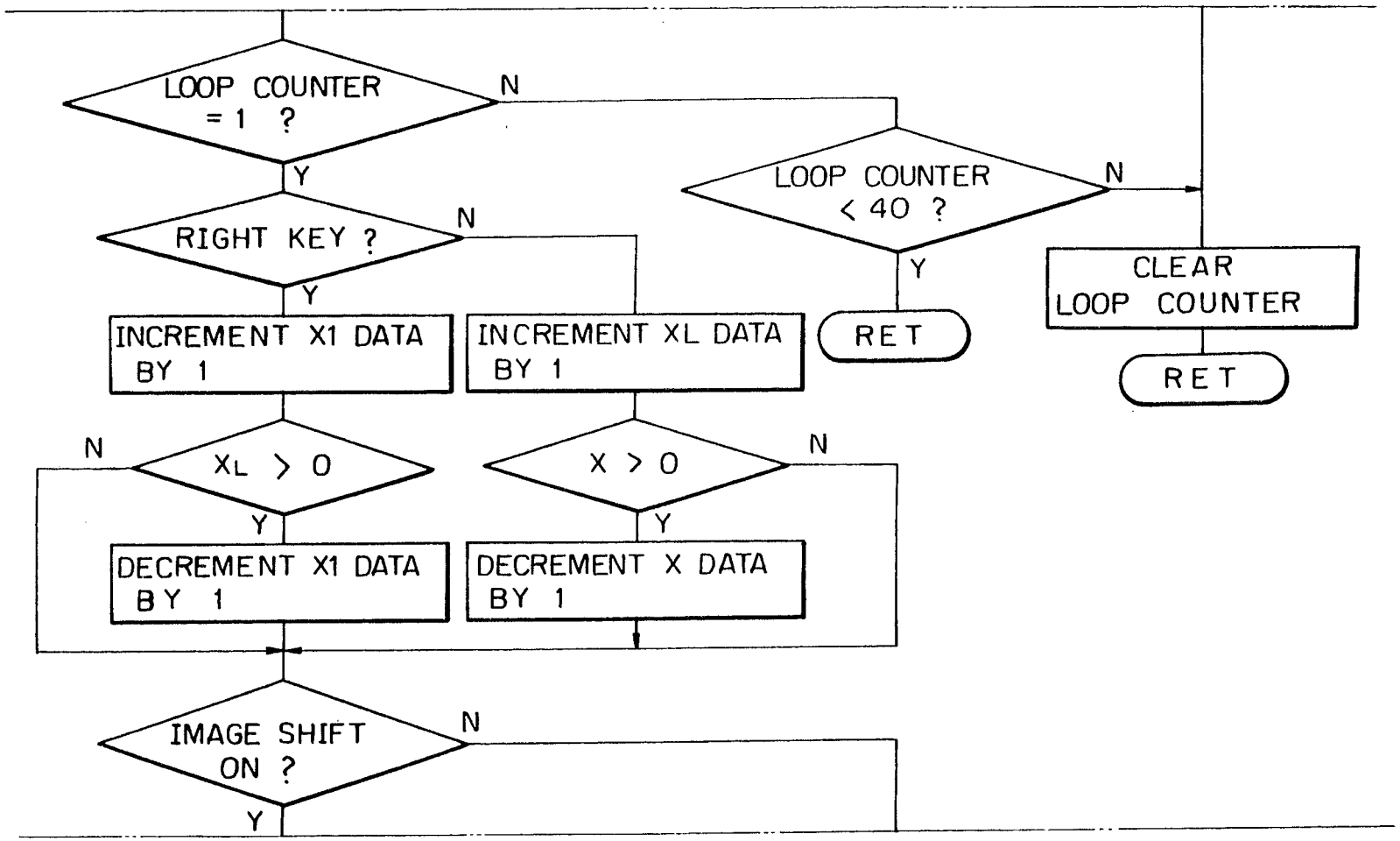
Figures 1C, 8E:
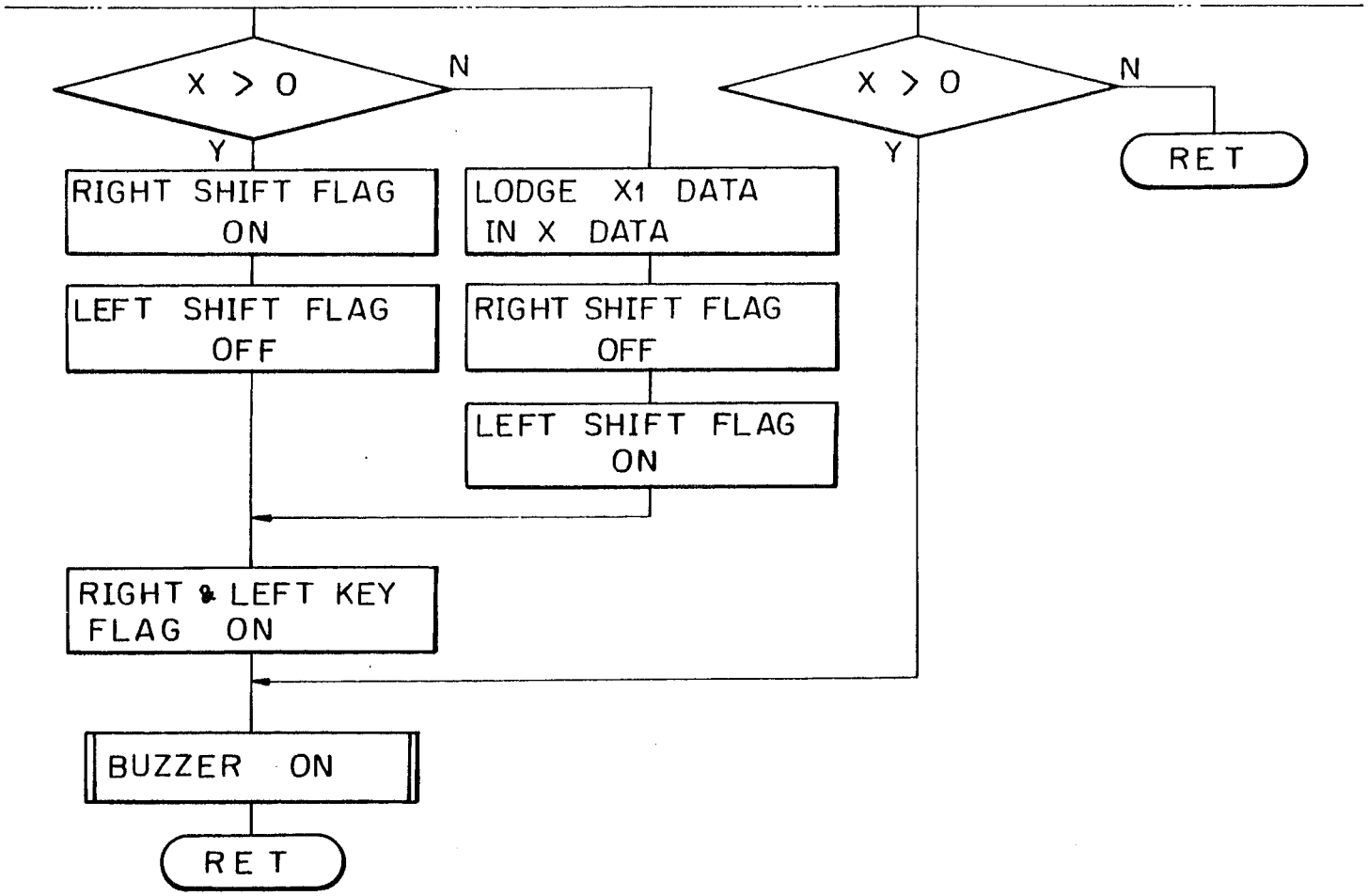
Figures 2, 2A, 8E:
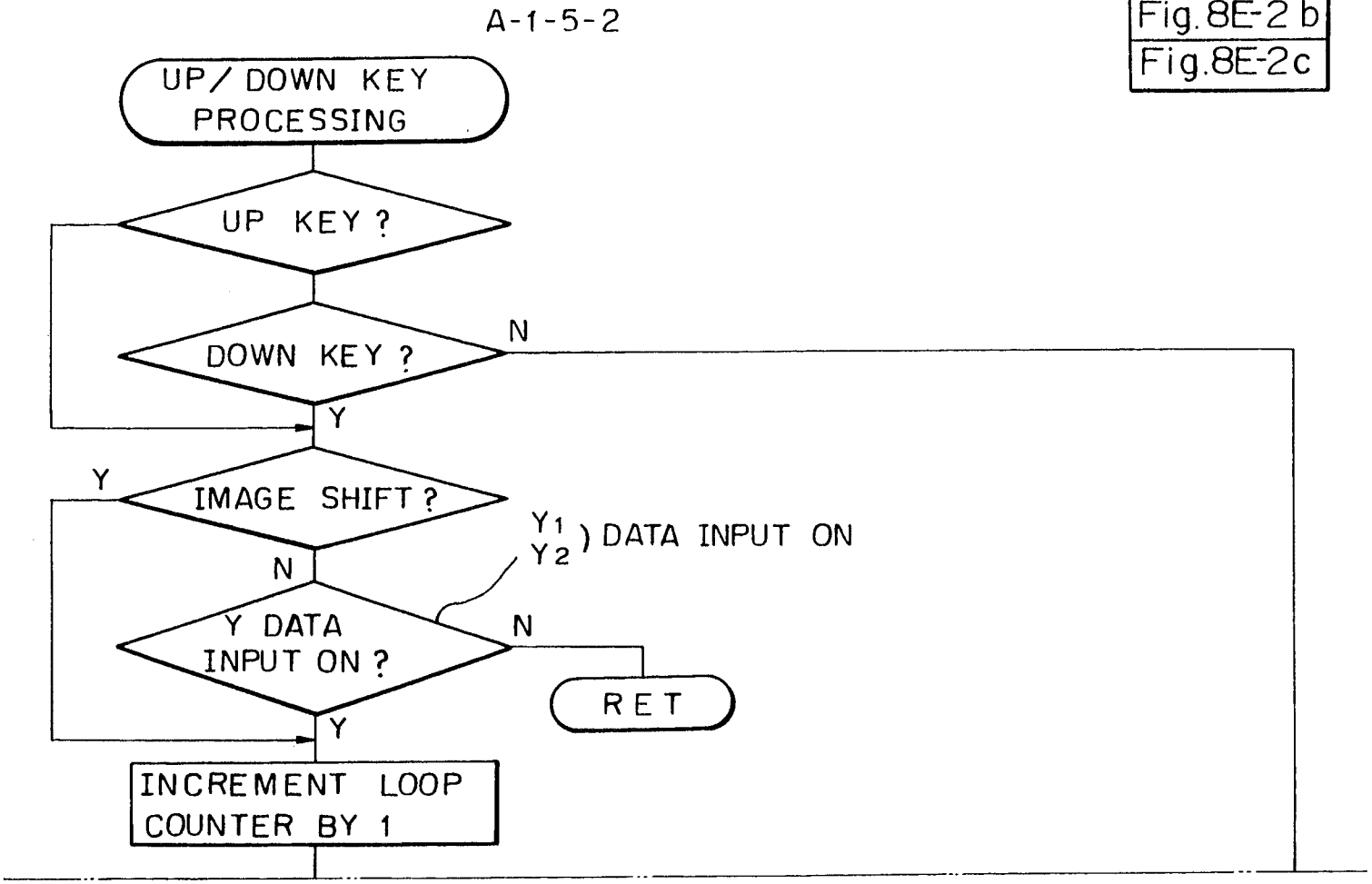
Figures 2B, 8E:
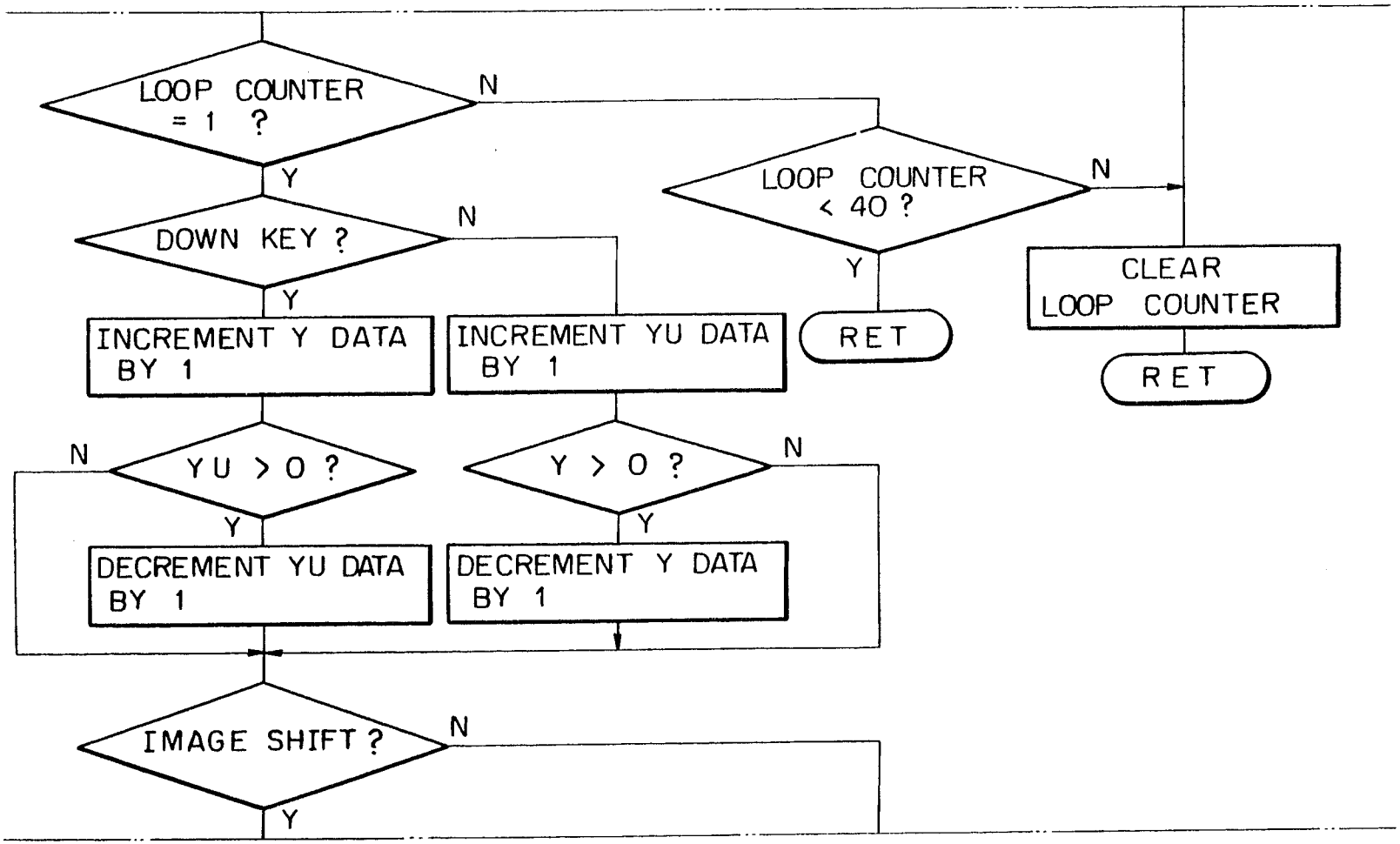
Figures 2C, 8E:
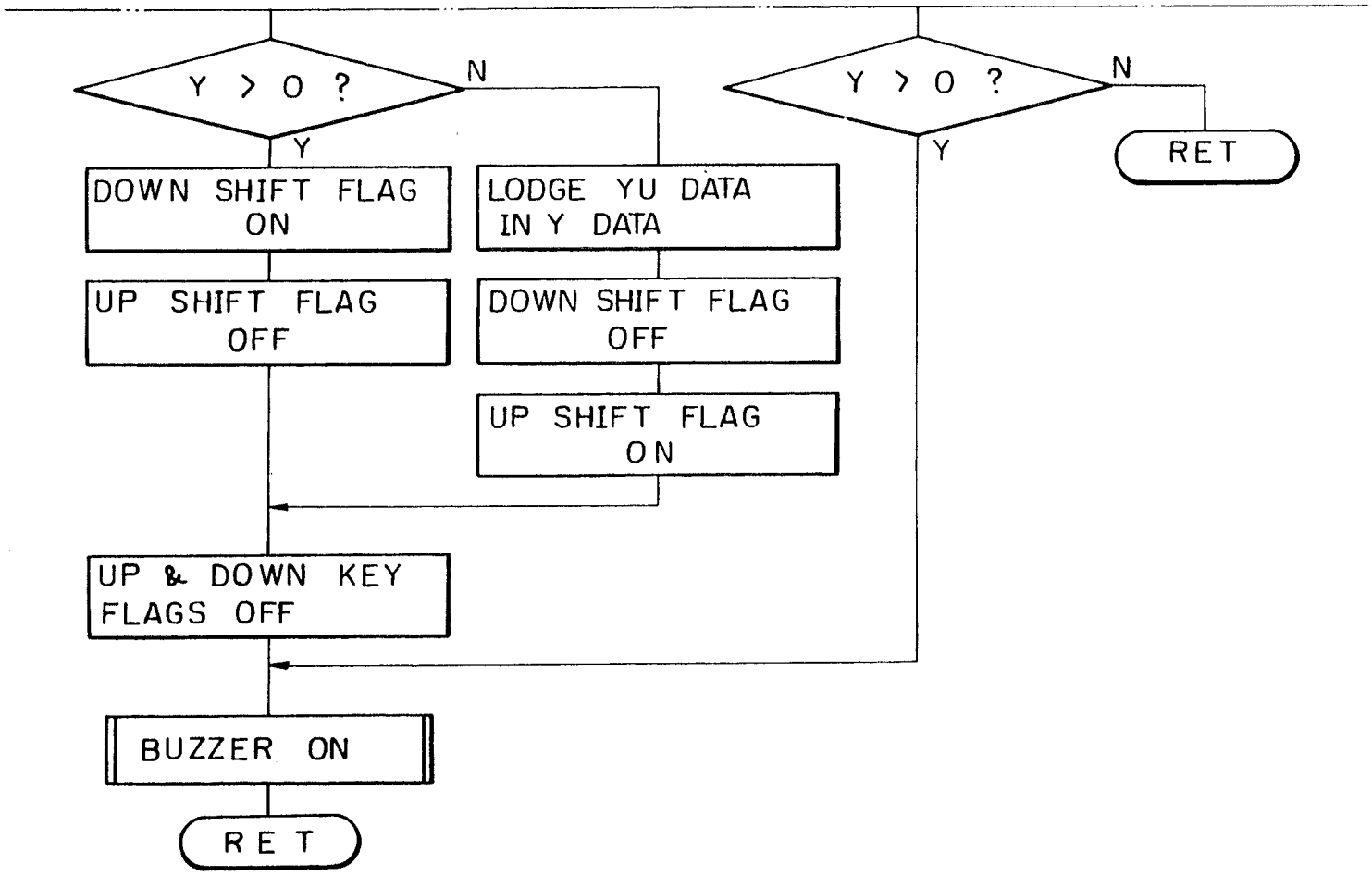
Figures 3A, 8E:
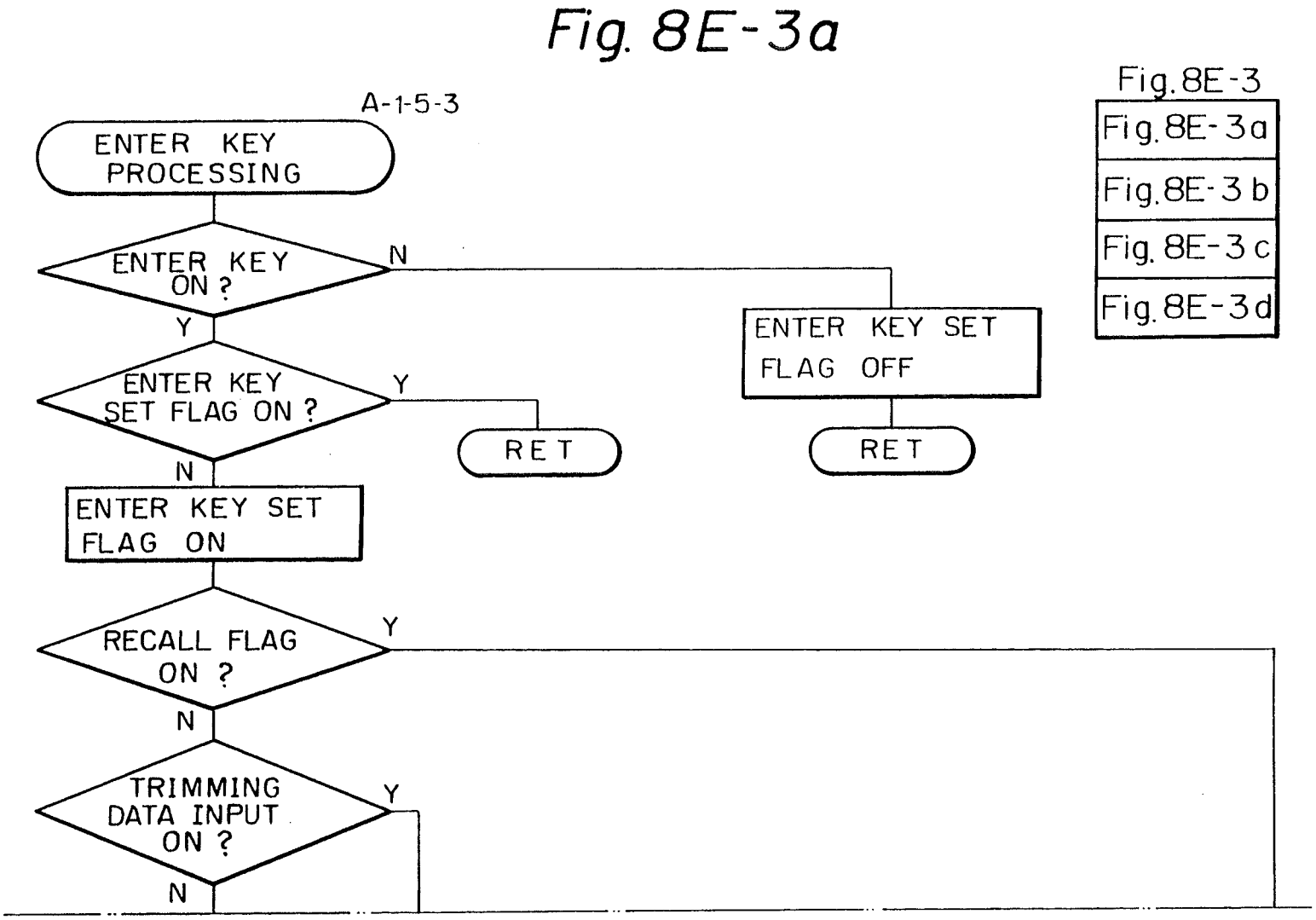
Figures 3B, 8E:
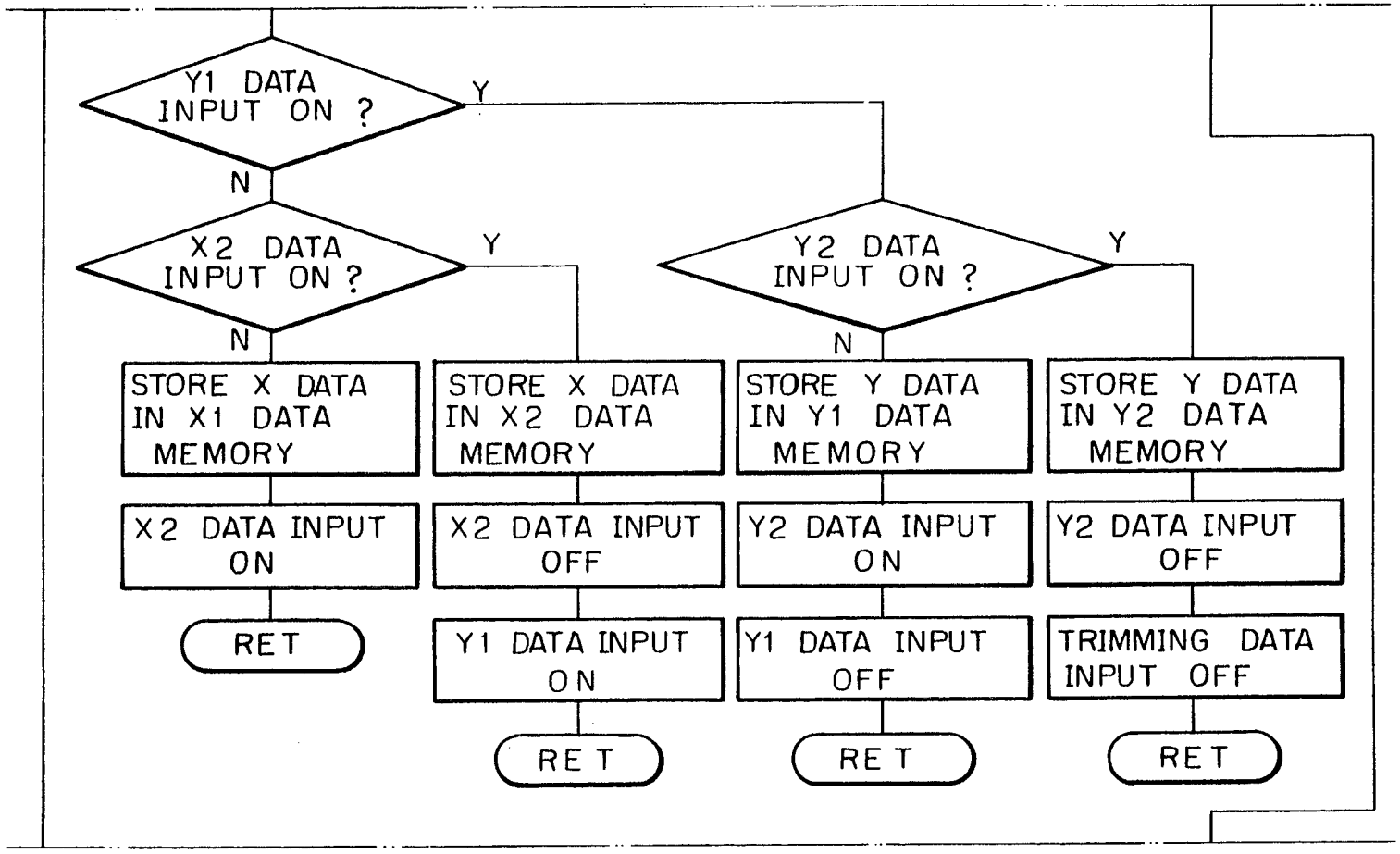
Figures 3C, 8E:
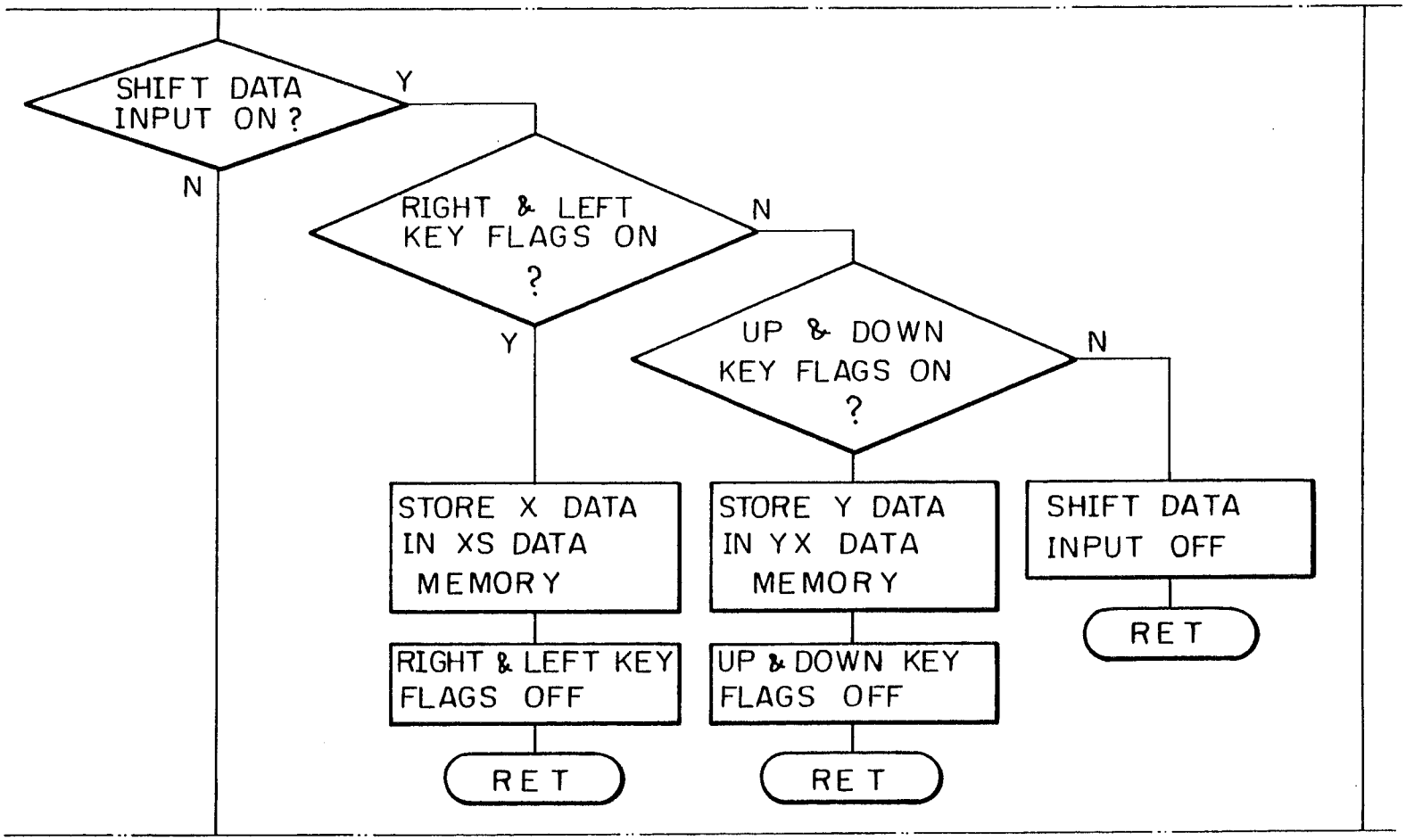
Figures 3D, 8E:
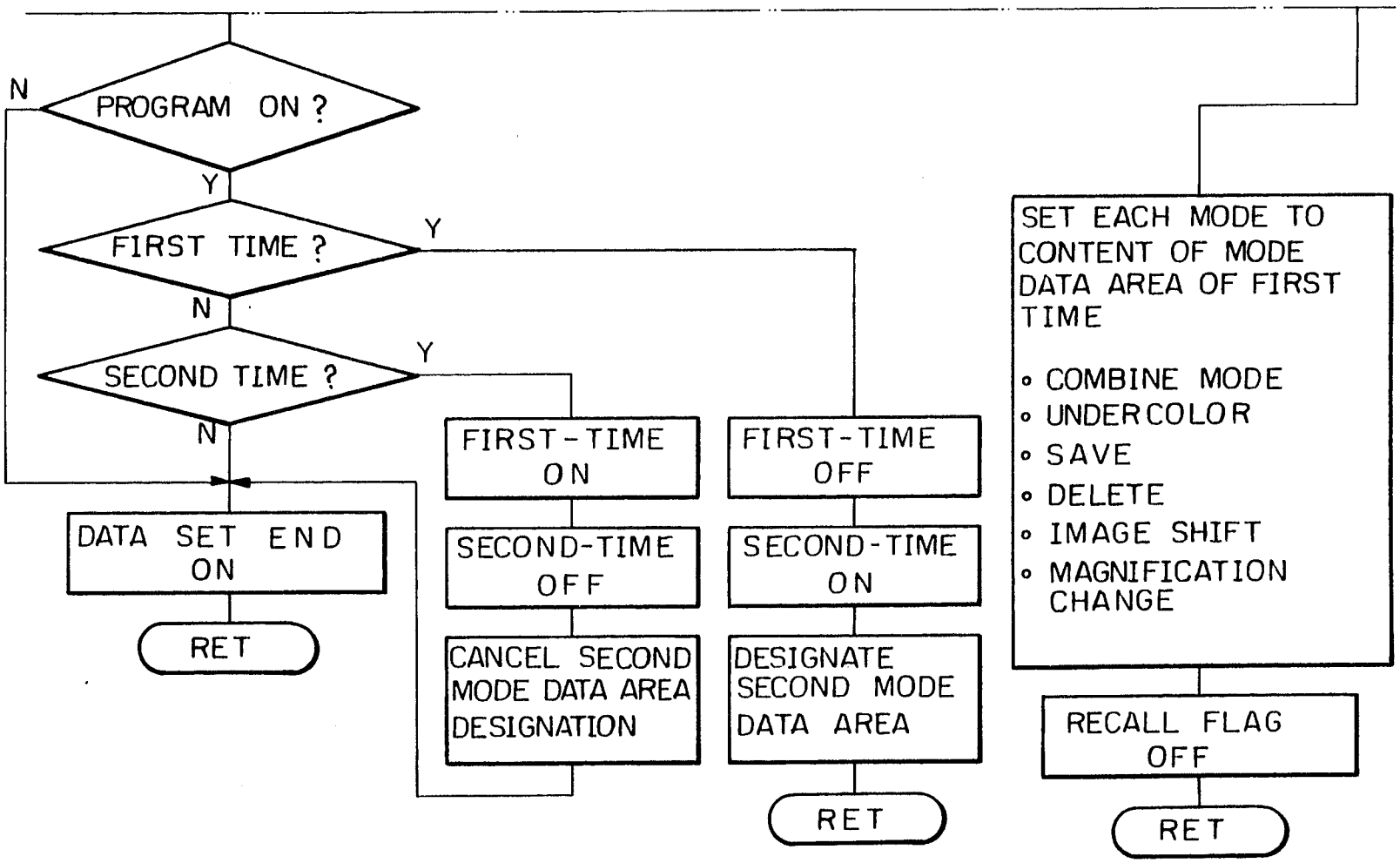
Figures 4, 4A, 8E:
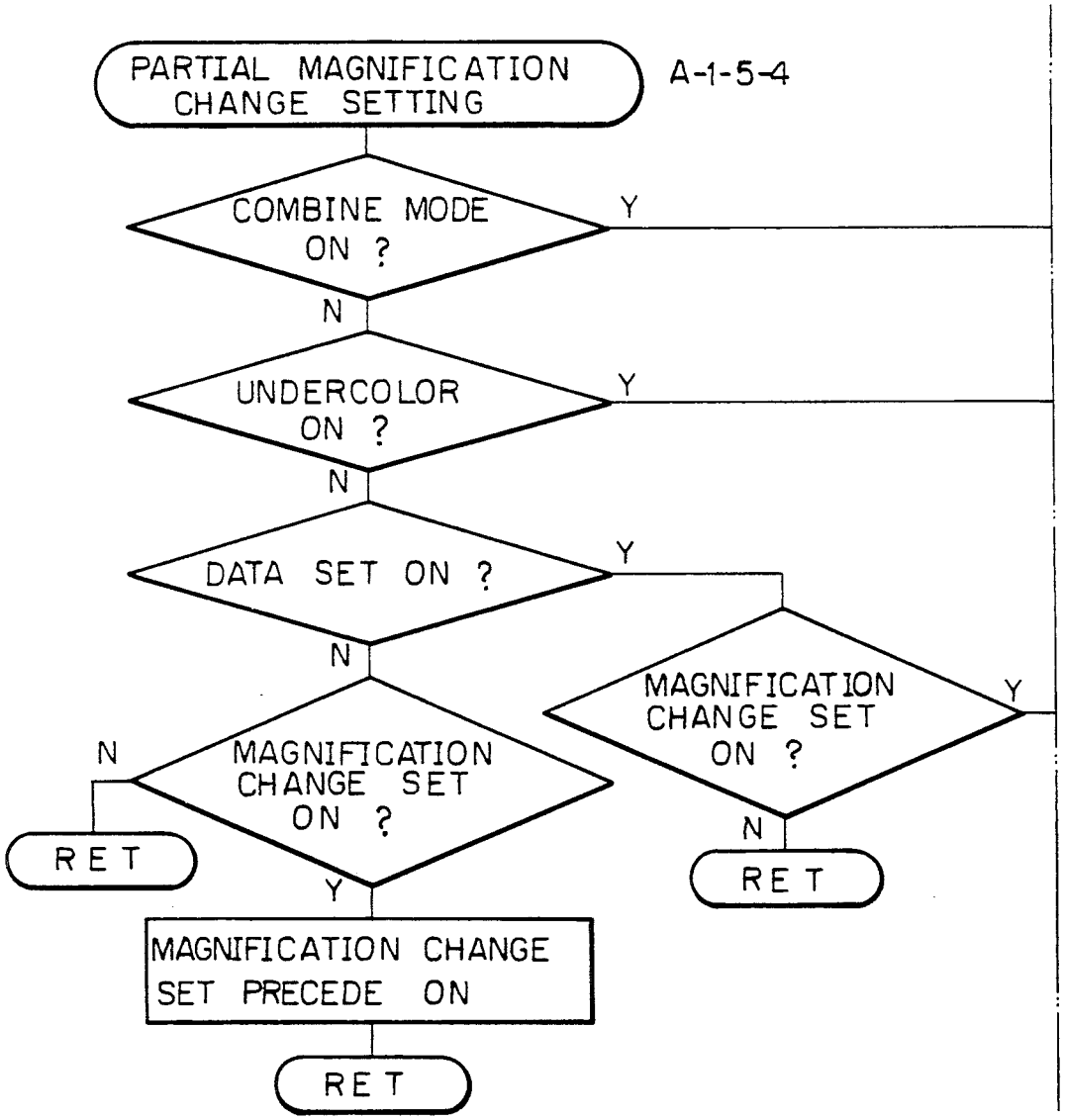
Figures 4B, 8E:
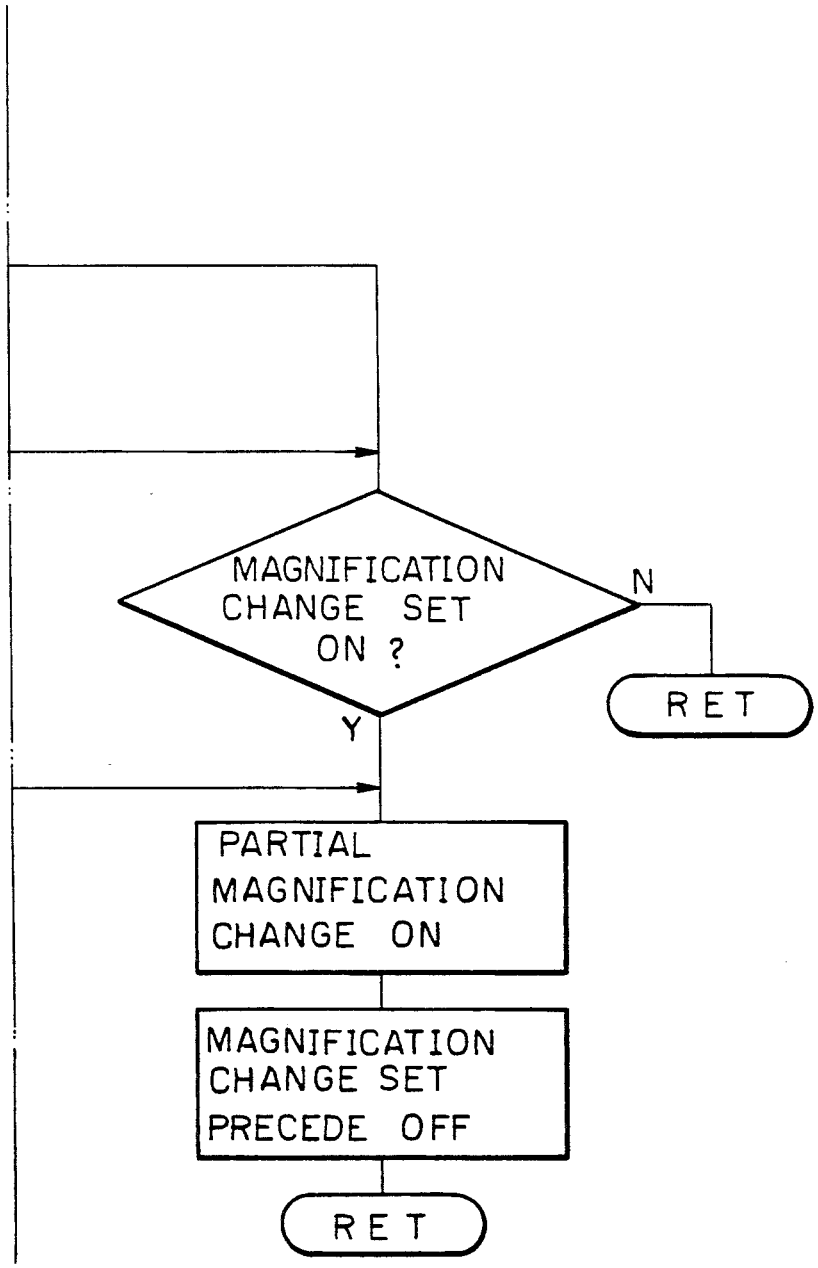
Figures 5, 8E:
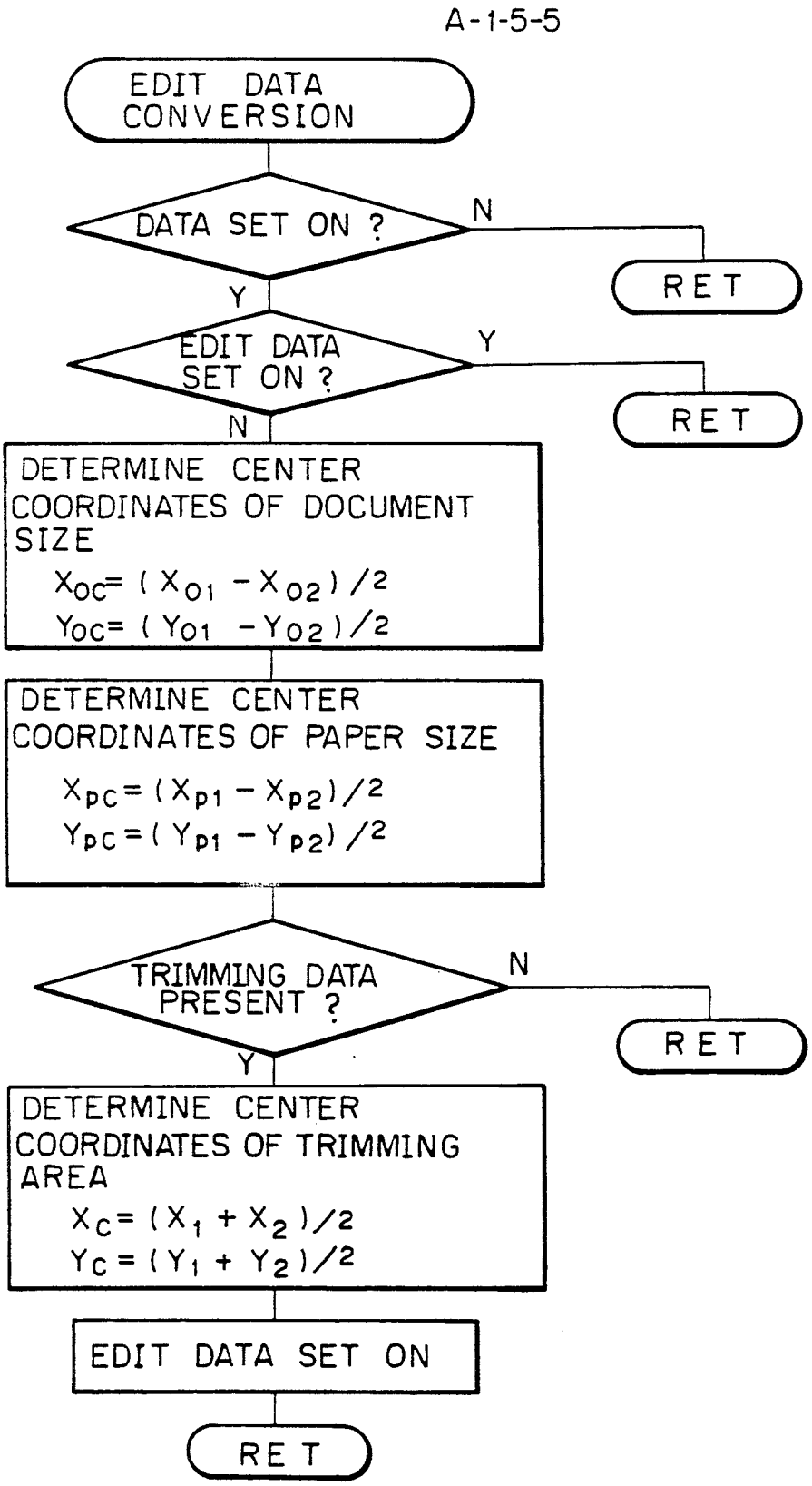
Figures 6, 6A, 8E:
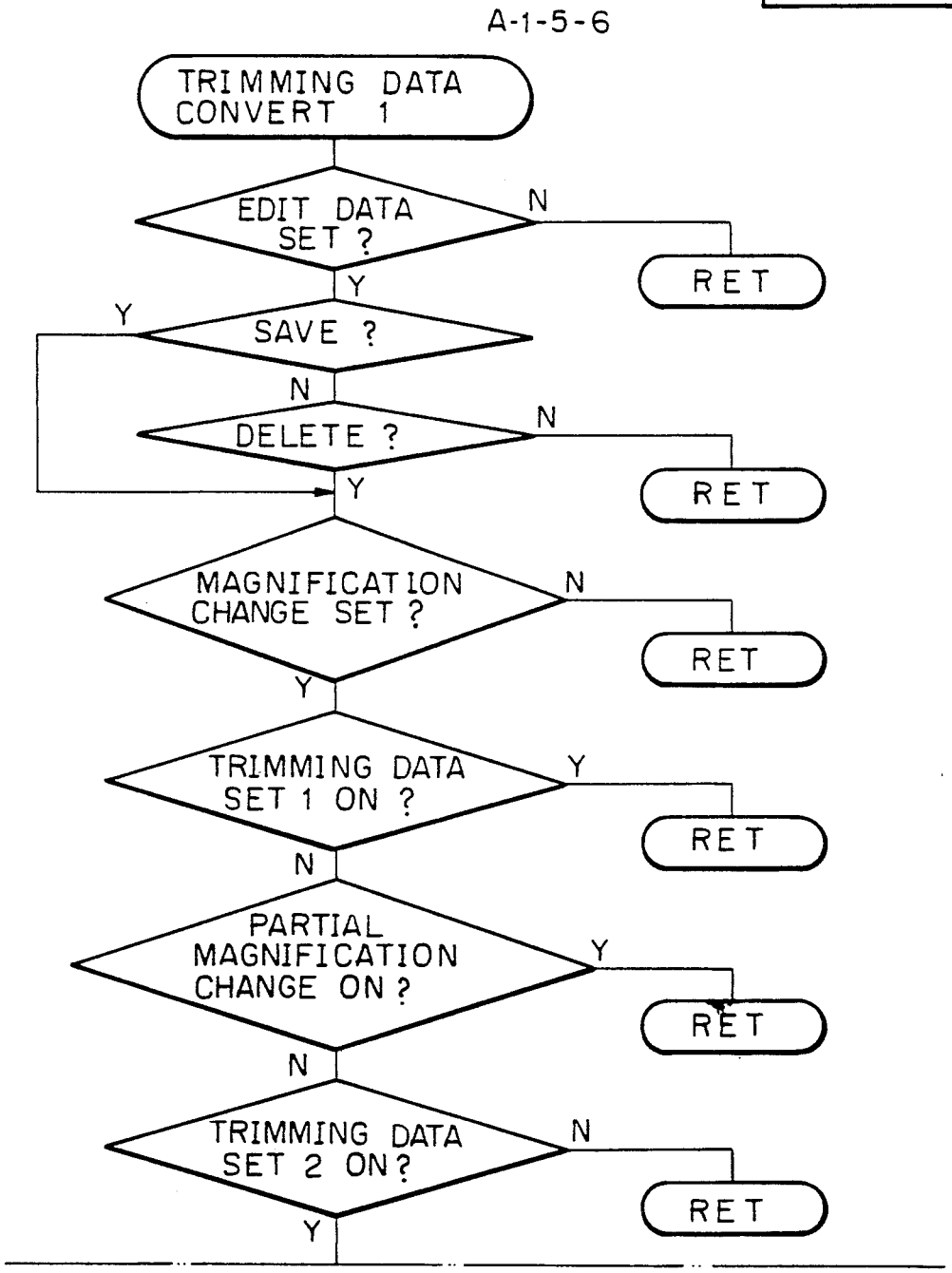
Figures 6B, 8E:
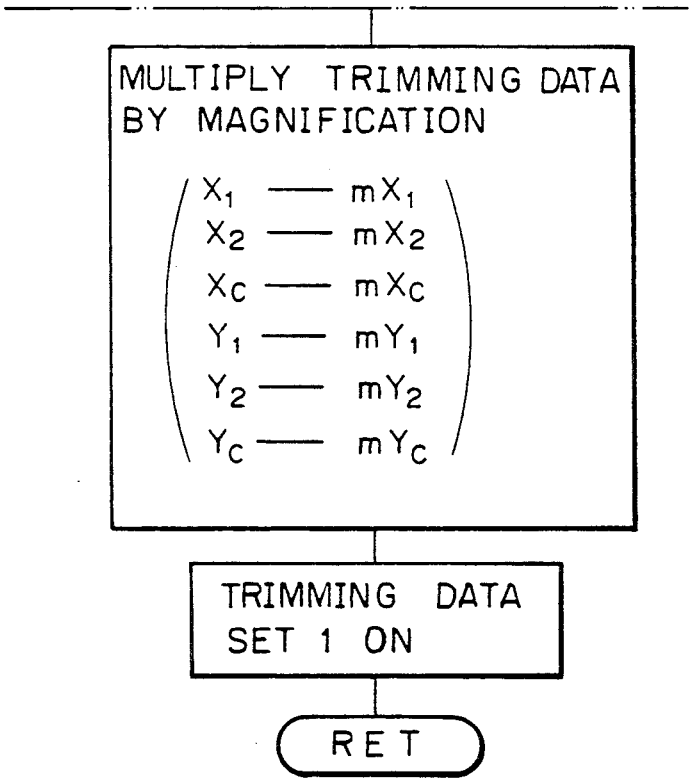
Figures 7, 7A, 8E:
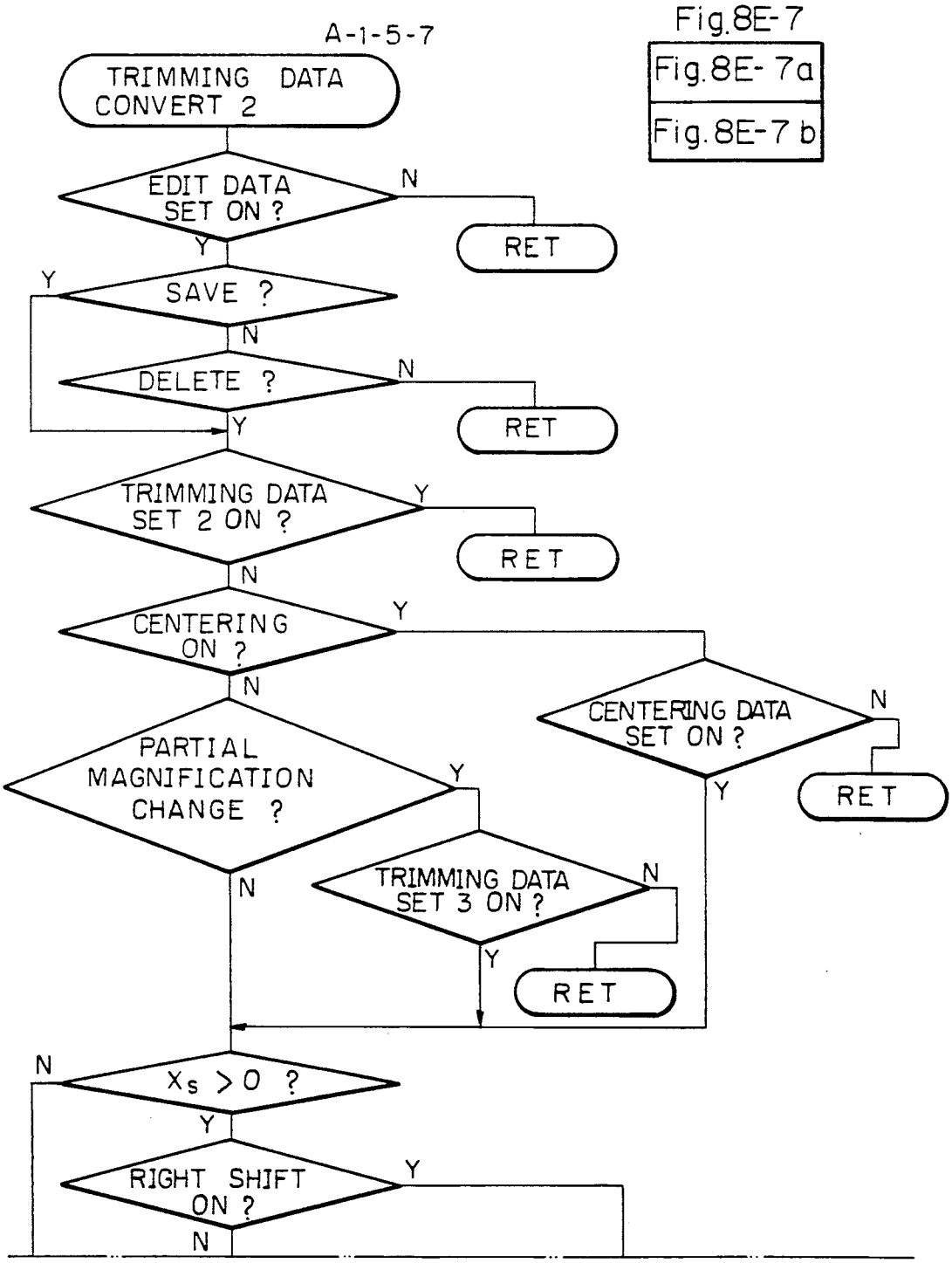
Figures 7B, 8E:
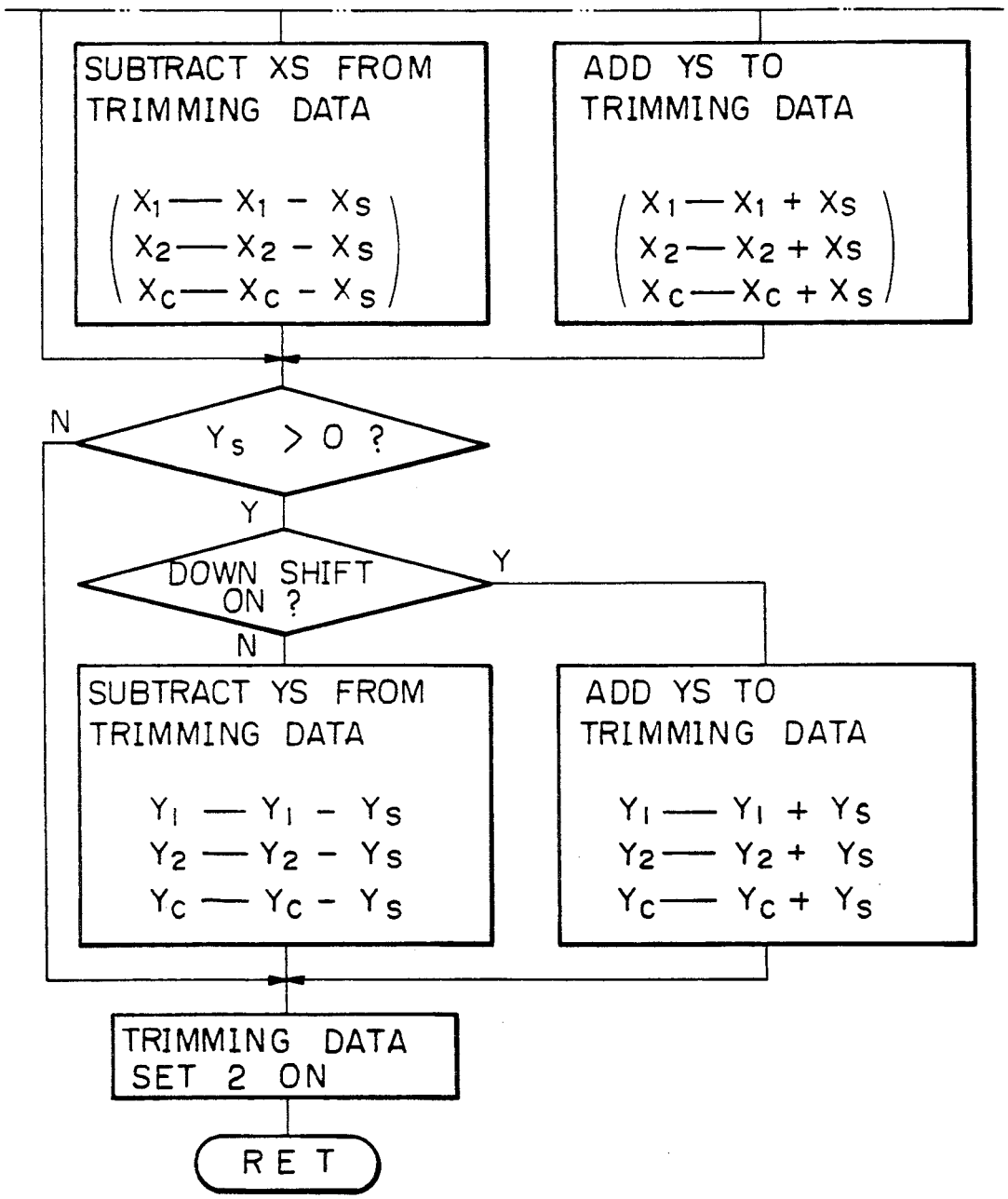
Figures 1A, 8, 8E:
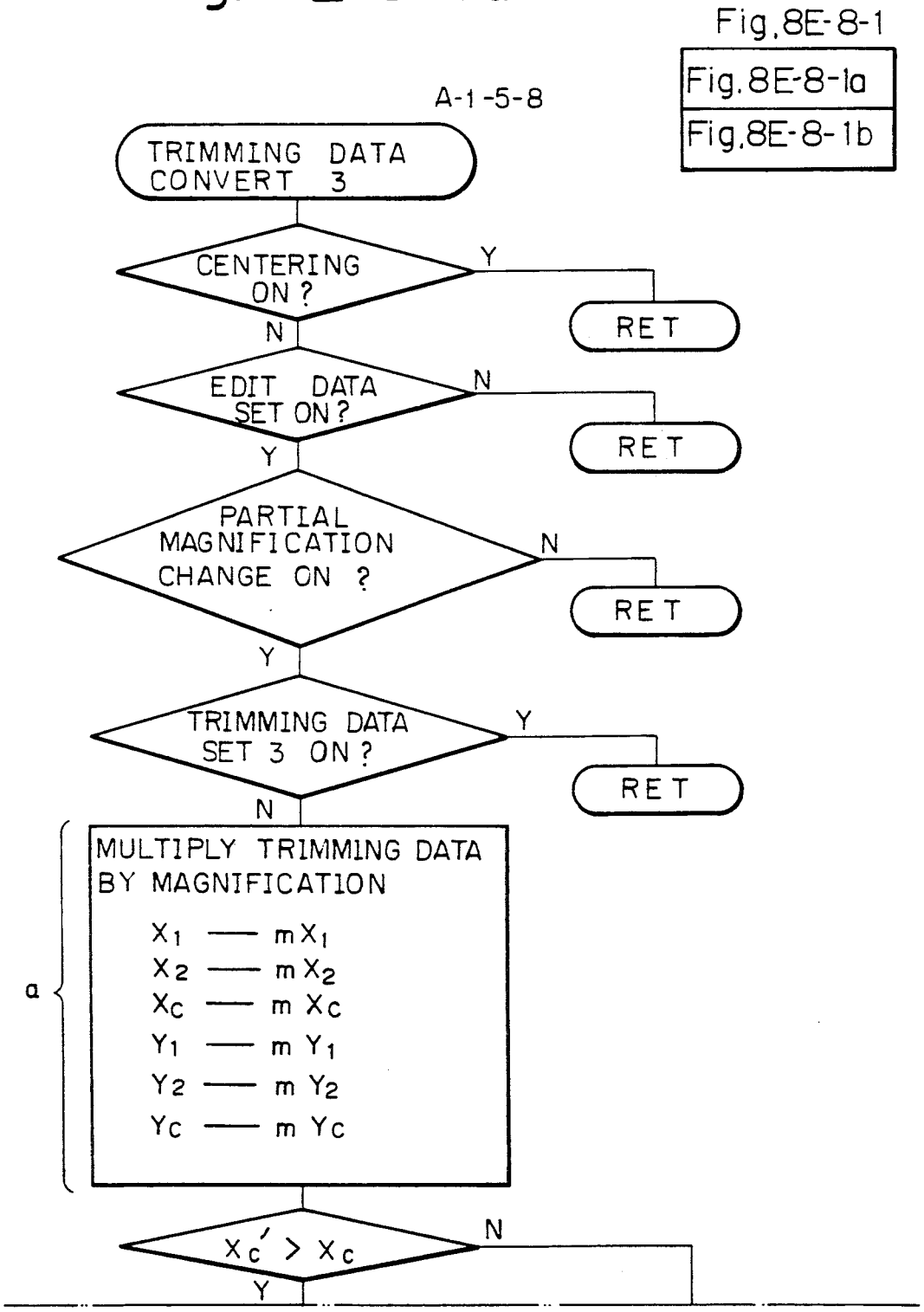
Figures 1B, 8, 8E:
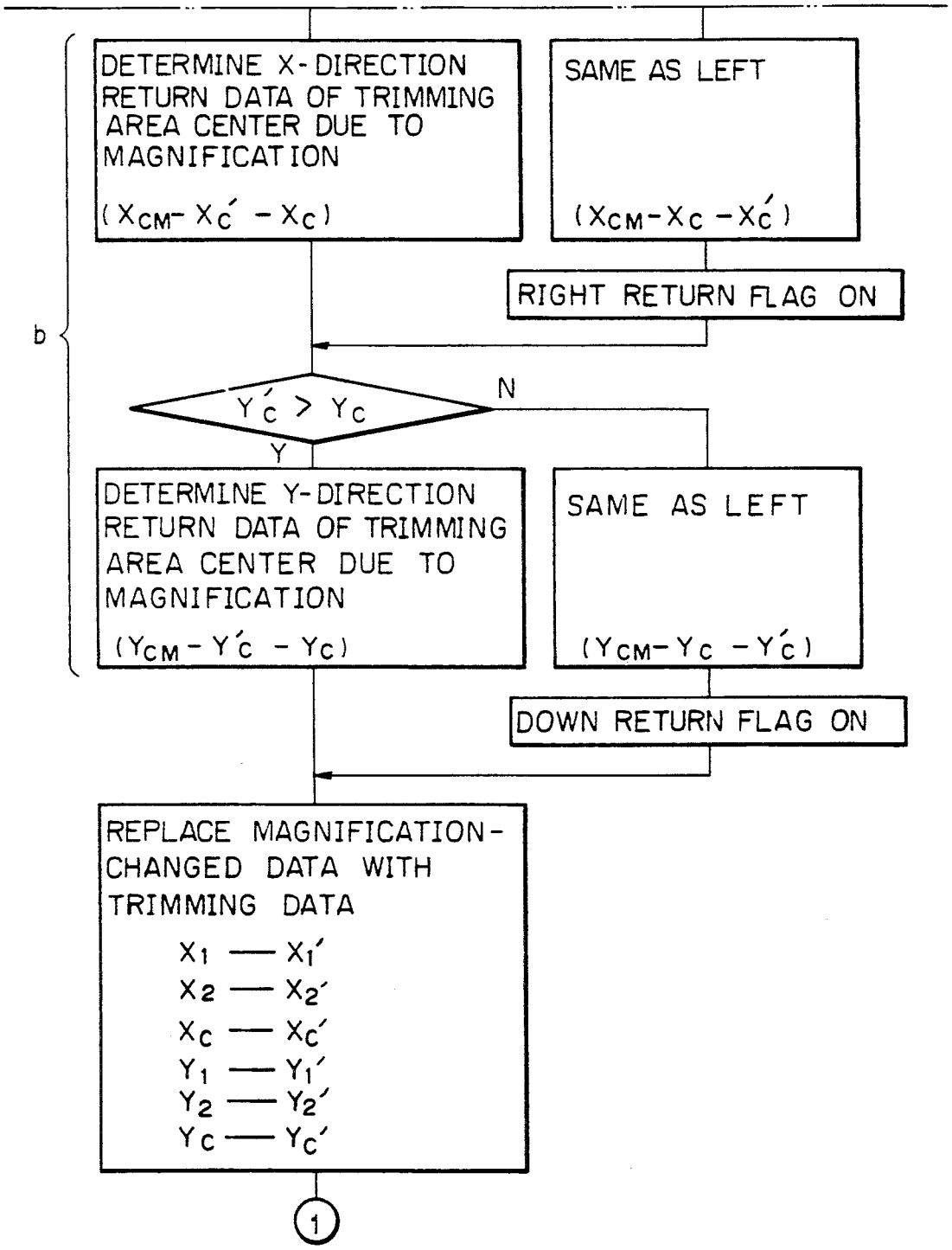
Figures 2, 2A, 8, 8E:
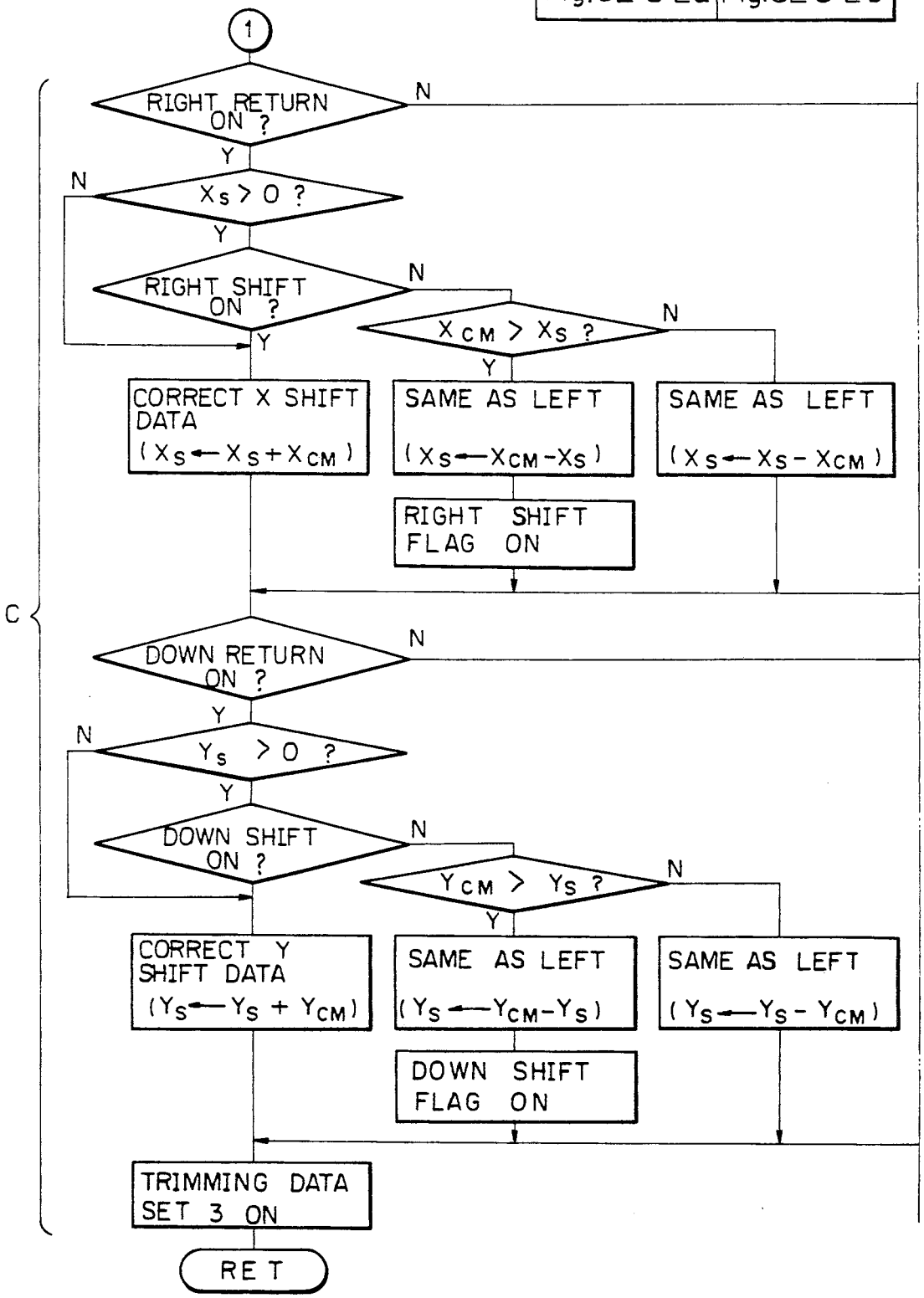
Figures 2B, 8, 8E:
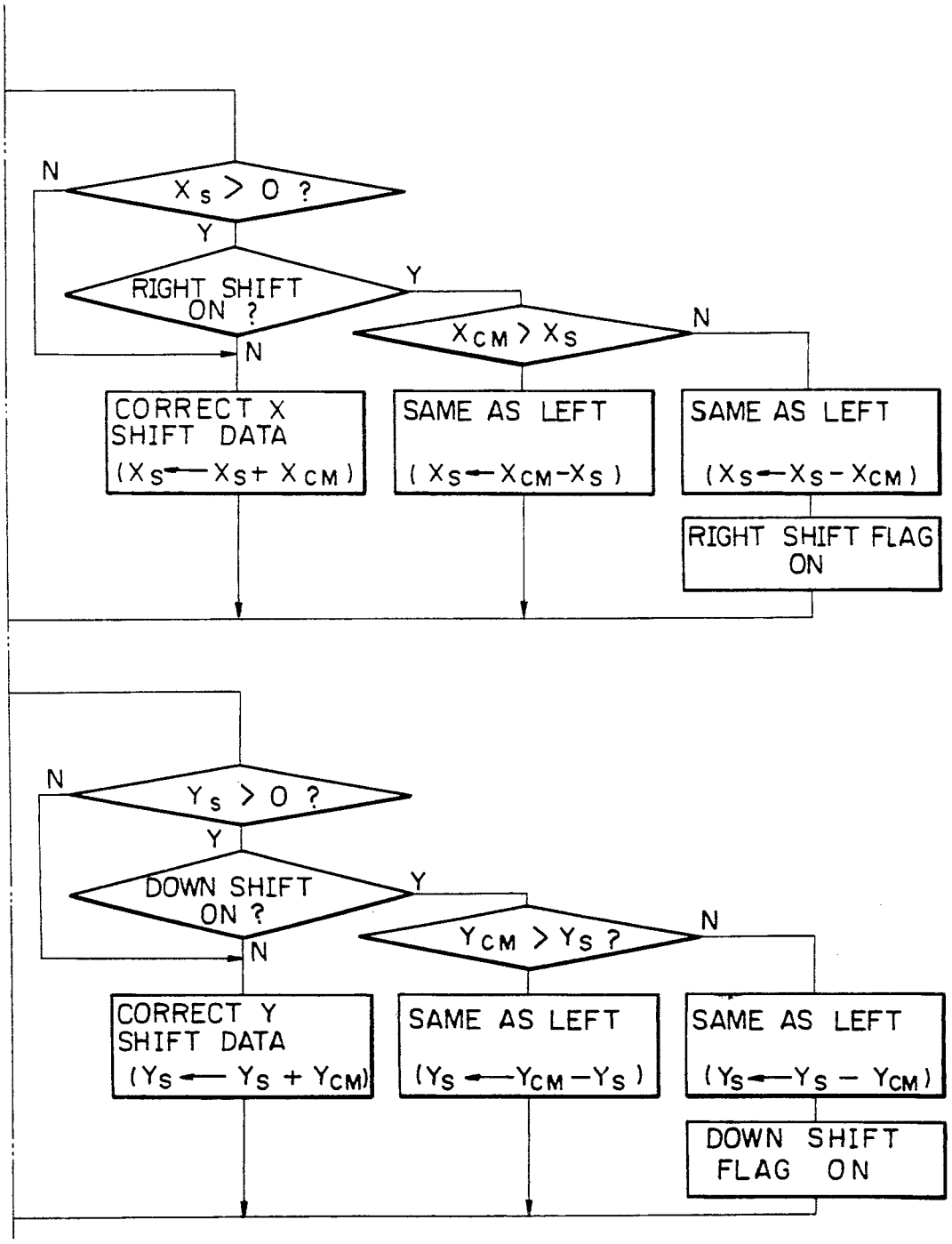
Figures 8, 8E, 9:
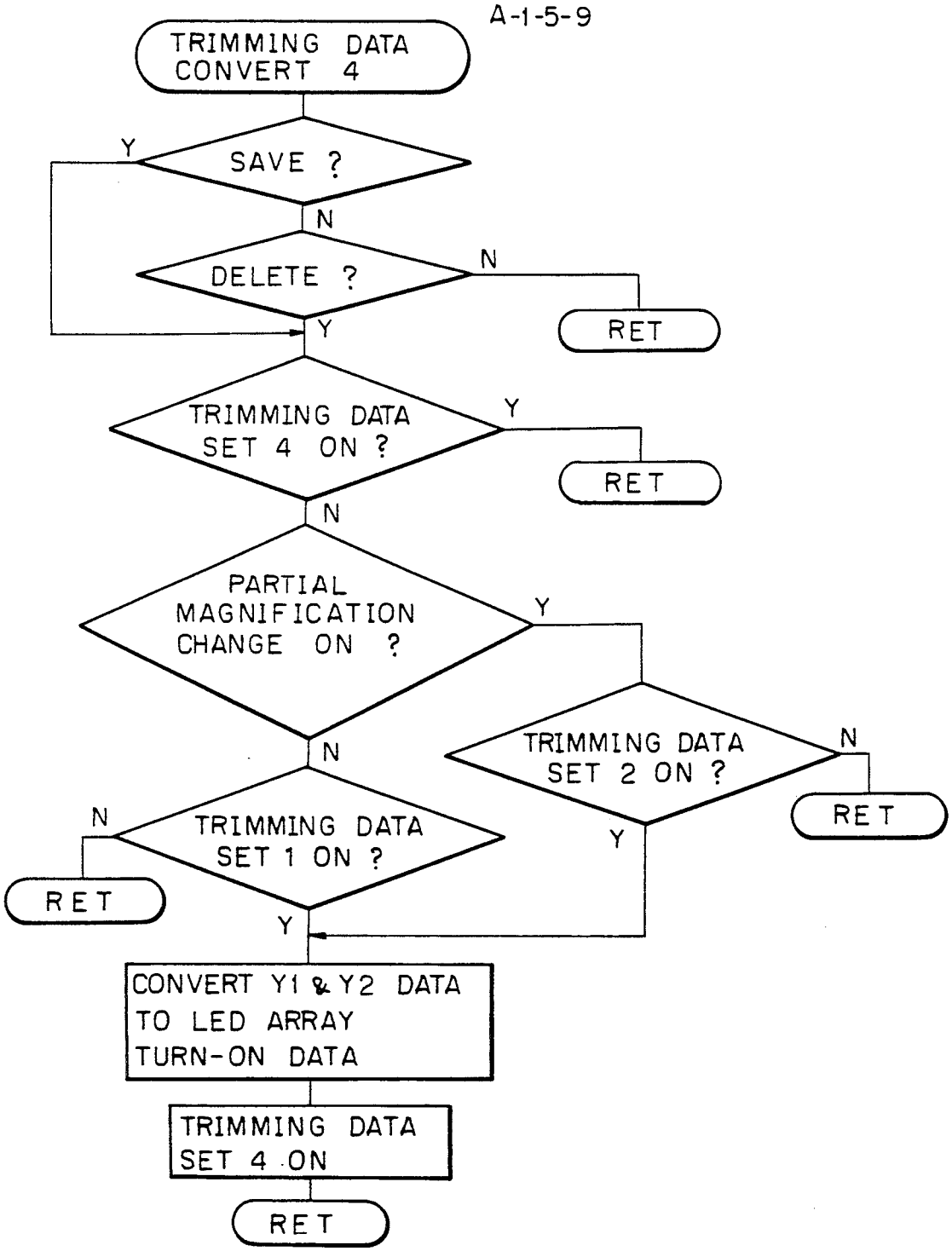

FIG. 9 shows in detail the print condition check (A-3) included in the pre-print processing (A). As shown, after whether or not the fixing temperature is adequate, whether or not the initial cleaning has been completed, whether a magnification has been changed, and whether color has been set are decided. Then, which one of the save mode and delete mode is selected is determined. Thereafter, whether or not trimming data has been set, whether or not, in the case of image shift, shift data has been set, whether or not, in the case of centering, centering data has been set, whether or not the combine mode is selected, whether or not the undercolor mode is selected, whether or not combine mode setting has been completed, and others are decided. If all the answers are yes (Y), the program returns to the beginning displaying inhibition.

Trim Mode

The trim mode includes a save mode and a delete mode as previously stated. By the combination of the trim mode and the combine mode, a program mode is set up.

Mode Setting

FIG. 8C shows details of the trim mode set processing (A-1-3) which is included in the mode set processing (A-1).

(a) By the trim mode set processing (A-1-3), either one of the save mode, delete mode, and OFF mode is set up.

(b) A mode indicator on the control panel which corresponds to the set mode is turned on.

(c) Then, the indicator X1 for urging the operator to enter data is turned on.

(d) When the trim mode is set after a particular magnification has been selected, a partial magnification change mode is set (A-1-5-4).

(e) When the trim mode is set after the combine mode or the undercolor mode has been selected, the program mode is set.

A reference will be made to FIG. 8C for describing the operation in detail. In the trim mode set (A-1-3), that the copier is out of operation is confirmed. Then, whether or not the trim key on the operation board is ON (i.e. turned ON when a signal is input) is decided and, if it is ON, a trim loop counter is incremented by 1. If it is not ON, the loop counter is cleared. If the count of the loop counter is greater than 2 and smaller than 40, the program returns (RET) to the beginning; if it is greater than 40, the loop counter is cleared. By the procedure described so far, the mode is sequentially changed over at predetermined intervals while the key is continuously depressed. As the loop counter is incremented to 1, if the mode is the delete mode or the save mode is decided and, then, a corresponding mode flag is set to thereby energize a corresponding mode indicator on the operation board. When the delete mode or the save mode is ON, a flag adapted for the entry of trimming data is set to execute right/left key processing (A-1-5-1, FIG. 8E-1) and enter key processing (A-1-5-3, FIG. 8E-3). By those flags, the data input command indicator X1 is displayed. At the same time, a buzzer is energized to urge the operator to enter data.

Subsequently, whether or not the program mode of this embodiment is to be set is decided. Specifically, if either the combine mode or the undercolor mode is ON and turned ON for the first time, the program mode is made ON. If it is the second ON or above, a recall flag is cleared to return (RET) to the beginning because the combine mode is under way. In the program mode, the first copy mode, i.e., combination or undercolor and the second copy mode, i.e., trim mode are programmed beforehand. After the last mode has been set, the first mode is set and, upon the turn-on of a print switch, the first copying operation is executed. As the first copying operation is completed, the second mode is automatically set up and, upon another turn-on of print switch, the second copying operation is executed.

Next, the entry of data in the trim mode will be explained.

Data Entry (a) A document size to be trimmed is entered.

(b) A trimming area is specified by entering the distances from the reference point to the four corners of the trimming area by means of the direction keys.

(c) First, X1 data is entered by the R (right) key (see A-1-5-1, FIG. 8E-1).

(d) After the entry of X1 data, an enter key is depressed to store it in an X1 data memory while, at the same time, X2 data input flag for the entry of X2 data is set (see A-1-5-3, FIG. 8E-3).

(e) X2 data is entered and, by the manipulation of the enter key, stored in an X2 data memory.

(f) In the same manner, Y1 and Y2 data are entered one after another.

(g) After the entry of all the trimming data, if none of the shift mode, program mode and others has been set, the enter key is depressed again to set a data set end flag to thereby finish data entry.

FIG. 8E shows the edit data set (A-1-5) which is included in the mode set processing of this embodiment. In the edit data set processing, there are sequentially performed right/left key processing (A-1-5-1), up/-down key processing (A-1-5-2), enter key processing (A-1-5-3), partial magnification change processing (A-1-5-4), edit data convert (A-1-5-5), trimming data convert 1 (A-1-5-6), trimming data convert 2 (A-1-5-7), trimming data convert 3 (A-1-5-8), trimming data convert 4 (A-1-5-9), centering data convert (A-1-5-10), and shift data convert (A-1-5-11). Then, the program returns (RET) to the beginning.

FIG. 8E-1 shows the right/left key processing (A-1-5-1) mentioned above. When the R (right) or the left (L) key is depressed, X1 data or X2 data entry is made ON. In the case of an image shift mode, entry of X1 and X2 data is not performed at this stage and is performed later by increasing or decreasing by means of the R or the L key. When data is entered, a loop counter is incremented by 1 and, when the R and L keys are not operated, the loop counter is cleared. Specifically, while any of the R and L keys is continuously depressed, it takes 10 msec for the loop counter to be incremented by 1. Hence, the loop counter is incremented forty consecutive times which corresponds to 0.4 second and, when incremented more than forty times, it is cleared. The increment of the loop counter by 1 causes a shift of 2 mm on the coordinates. The R key is adapted to increase the data, and the L key to decrease it (i.e. the loop counter is incremented in the leftward direction XL). When the R key is depressed while the initial position is at the left (XL>0), the XL data is decremented by 1. However, when the L key is depressed while the initial position is at the right (X>0), the X data is decremented by 1. Since the image shift may be effected to the left, a direction flag is provided to facilitate discrimination of data. Specifically, the mode is the trim mode if it is not the image shift mode and, in this condition, the keys are invalidated (the buzzer is not energized) because no data is present on the left-hand side with respect to the reference. In the case of image shift, when X is greater than zero, a right shift flag is set and a left shift flag is cleared and, when X is smaller than zero, XL data is included in the X data with the right shift flag cleared and the left shift flag set. Then, the right and left key flags are set to energize the buzzer. In response to these shift flags, the direction indicators on the operation board are selectively turned on.

FIG. 8E-2 shows the up/down key processing (A-1-5-2) which is included in the edit data set processing. First, a loop counter is cleared while the processing associated with the up key or the down key is not performed. The loop counter is incremented by 1 if the trim mode as distinguished from the image shift mode is set even when the up key or the down key processing is performed, and if $Y_1$ and $Y_2$ data are ON. Specifically, while any of the keys is continuously depressed, it takes 10 msec for the loop counter to be incremented by 1 once. Hence, the increment by 1 is repeated forty times, i.e., 0.4 second; as it is repeated more than forty times, the loop counter is cleared. Every time the loop counter is incremented by 1, a shift of 2 mm occurs on the coordinates. The down key increments data while the up key decrements it (i.e. the data is incremented by 1 in the upward direction YU). When the down key is depressed while the initial position is on the upper side (YU>0), the YU data is decremented by 1; when the down key is depressed while the initial position is on the lower side (Y>0), the Y data is decremented by 1. Since the image shift may be effected upward, a direction flag is provided for the discrimination of data. An upper shift flag and a lower shift flag cause their associated direction indicators on the operation board to glow. In the case of trimming, the up and down keys are invalidated (the buzzer is not energized) because no data is present above the reference.

FIG. 8E-3 demonstrates the enter key processing (A-1-5-3) included in the edit data processing. As the enter key is depressed, an enter key set flag is set, and whether or not a recall flag is set is decided (the recall flag is set when a reset mode switch is turned ON in a copy end routine (D-4)). If the recall flag is set, each mode is set to the content stored in the mode data area of the first time (combine, undercolor, save, delete, image shift, and magnification change) and, then, the recall flag is cleared. If the recall flag is not set and the trimming data input is OFF, X1, X2, Y1 and Y2 data are sequentially entered and, subsequently, the input flag and the trimming data input flag are cleared. Further, if the shift data input is ON, X data and Y data are stored, respectively, in an XS data memory and a YS data memory depending upon whether or not the right and left and the up and down key flags are set, followed by making the shift data input OFF. If the program mode is ON, it is turned OFF at the time of ON of the first time and turned ON at the time of ON of the second time, thereby designating a mode data area of the second time. If the second time is ON, the first time is made ON and the second time OFF, thereby cancelling the mode data area designation of the second time. Thereupon, a data set end flag is set.

Details of the data convert processing will be described hereinafter. Data conversion is adapted to prepare LED array control data on the basis of input data.

Data Conversion (a) Each center coordinate of a document trimming area is determined based on a document size, a paper size, and trimming area data (A-1-5-5).

(b) If there is any shift, the trimming data is increased or decreased by the amount of shift (A-1-5-7). In the event of partial magnification change, such is effected after the change of magnification.

(c) If the shift is combined with magnification change, data produced by the above step (b) is multiplied by a magnification. Here, the partial magnification change is skipped (A-1-5-6).

(d) The data produced by such conversion is used to produce data for controlling the turn-on of the LED array (A-1-5-9).

FIG. 8E-5 demonstrate the edit data convert processing (A-1-5-5) stated above. When the data set is ON, if edit data is not set, the center coordinates of a document size is determined and, then, that of a paper size. Then, if trimming data is present, the coordinates of a trimming area is determined and, then, edit data set is made ON.

FIGS. 8E-6, 8E-7 and 8E-9 demonstrate, respectively, the trimming data convert processing 1, 2 and 4.

In the trimming data convert 1 (A-1-5-6) of FIG. 8E-6, if edit data set is ON and if one of the save mode and delete mode is selected, that magnification change set is ON, that trimming data set 1 is OFF, and that partial magnification change is OFF are confirmed. Then, the trimming data set 1 is made ON after, if trimming data set 2 is ON, multiplying trimming data by the magnification.

In the trimming data convert 2 of FIG. 8E-7, if the edit data set is ON and if the save mode or the delete mode is selected, that the trimming data set 2 is OFF, that centering is OFF, and that the partial magnification change is OFF are confirmed. Then, centering data set and trimming data set are made ON. If XS is greater than zero, XS is added to the trimming data if right shift is ON and subtracted from the same if left shift is ON. Next, when YS is greater than zero, TS is added to the trimming data if down shift is ON and subtracted from the same if up shift is ON. Subsequently, the trimming data set 2 is made ON.

In the trimming data convert 4 (A-1-5-9) of FIG. 8E-9, if either the save mode or the delete mode is set, trimming data set 4 is not ON, the partial magnification change is not ON, the trimming data set 1 or the partial magnification change is ON, and the trimming data set 2 is ON, Y1 and Y2 data are converted into LED array turn-on data. Subsequently, the trimming data set 4 is made ON.

The copying operation will be explained in detail hereinafter.

Copying Operation (a) Among the trimming area data, the X-direction data is adapted to determine the turn-on timing of the LED array and delivered to an optical system (together with an optics start signal, size data, and other data).

(b) The optical system converts the X-direction data into position data as measured from the starting point of a scanner. The position data is transmitted to the body as a trimming signal when the scanner is brought to a corresponding position.

(c) In response to the trimming signal, LEDs corresponding to Xn are turned on to delete or save an image area on the drum (C-2-2).

Figures 8, 8E, 9, 10, 10A:
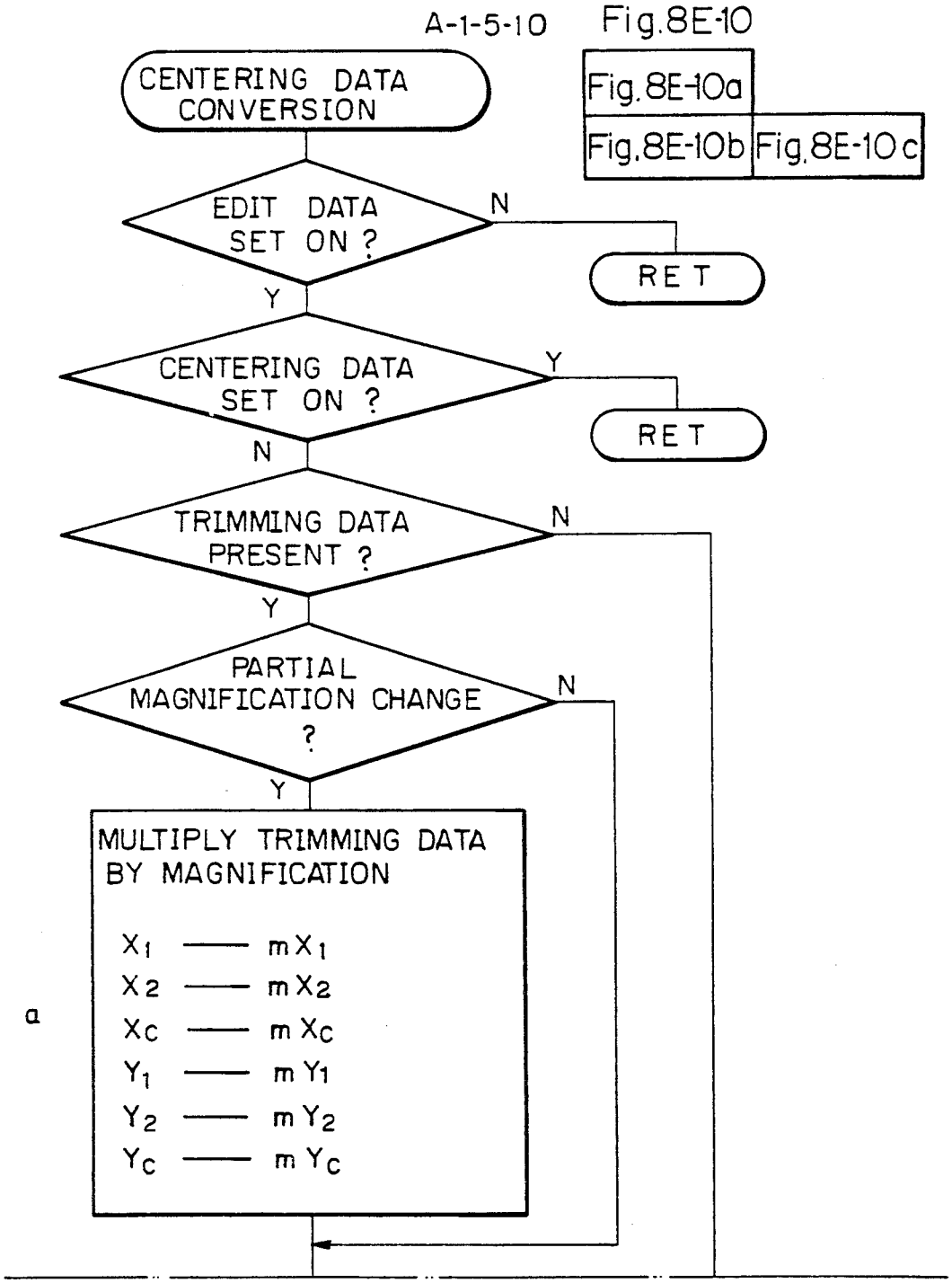
Figures 8, 8E, 9, 10, 10B:
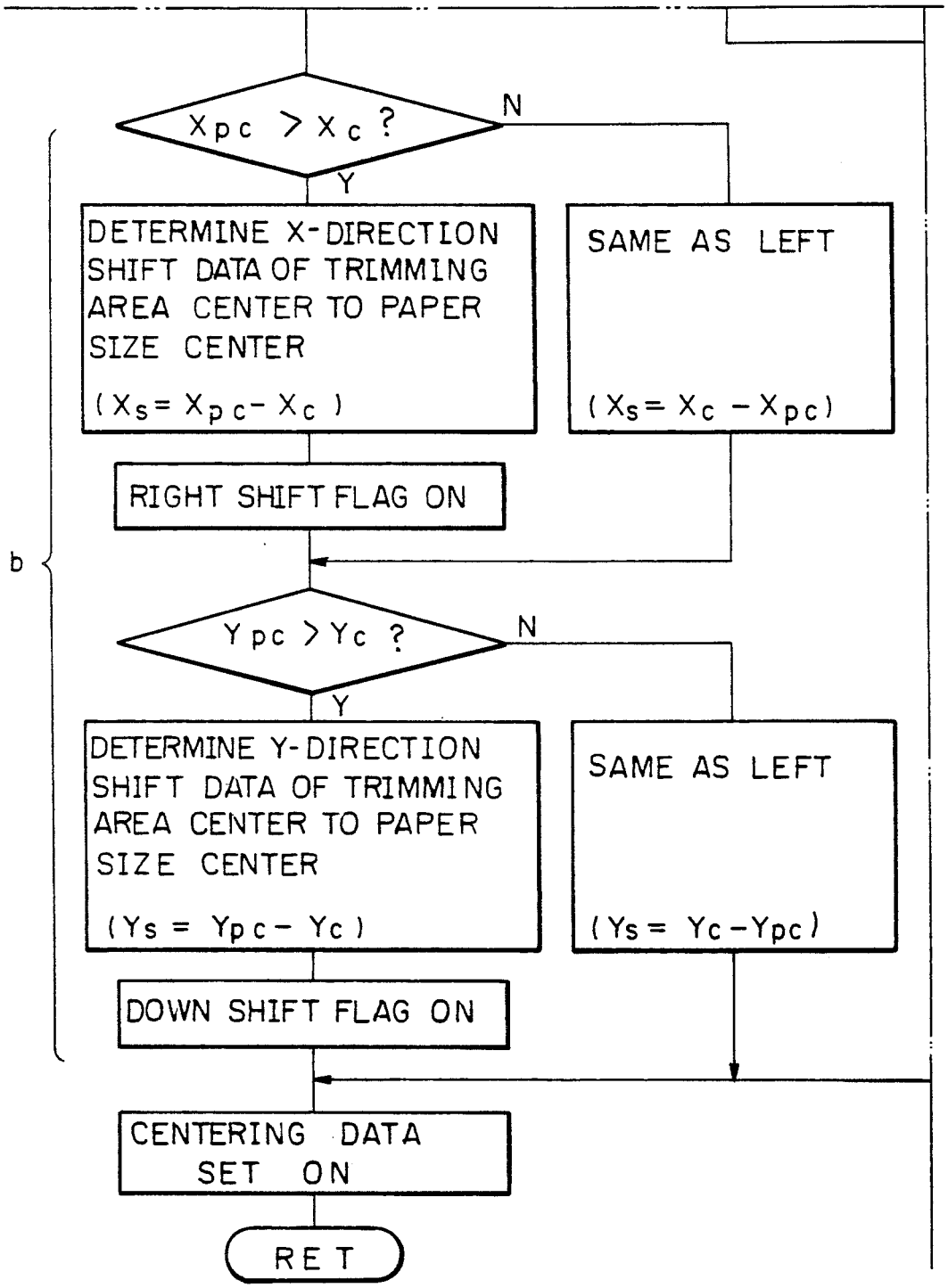
Figures 8, 8E, 9, 10, 10C:
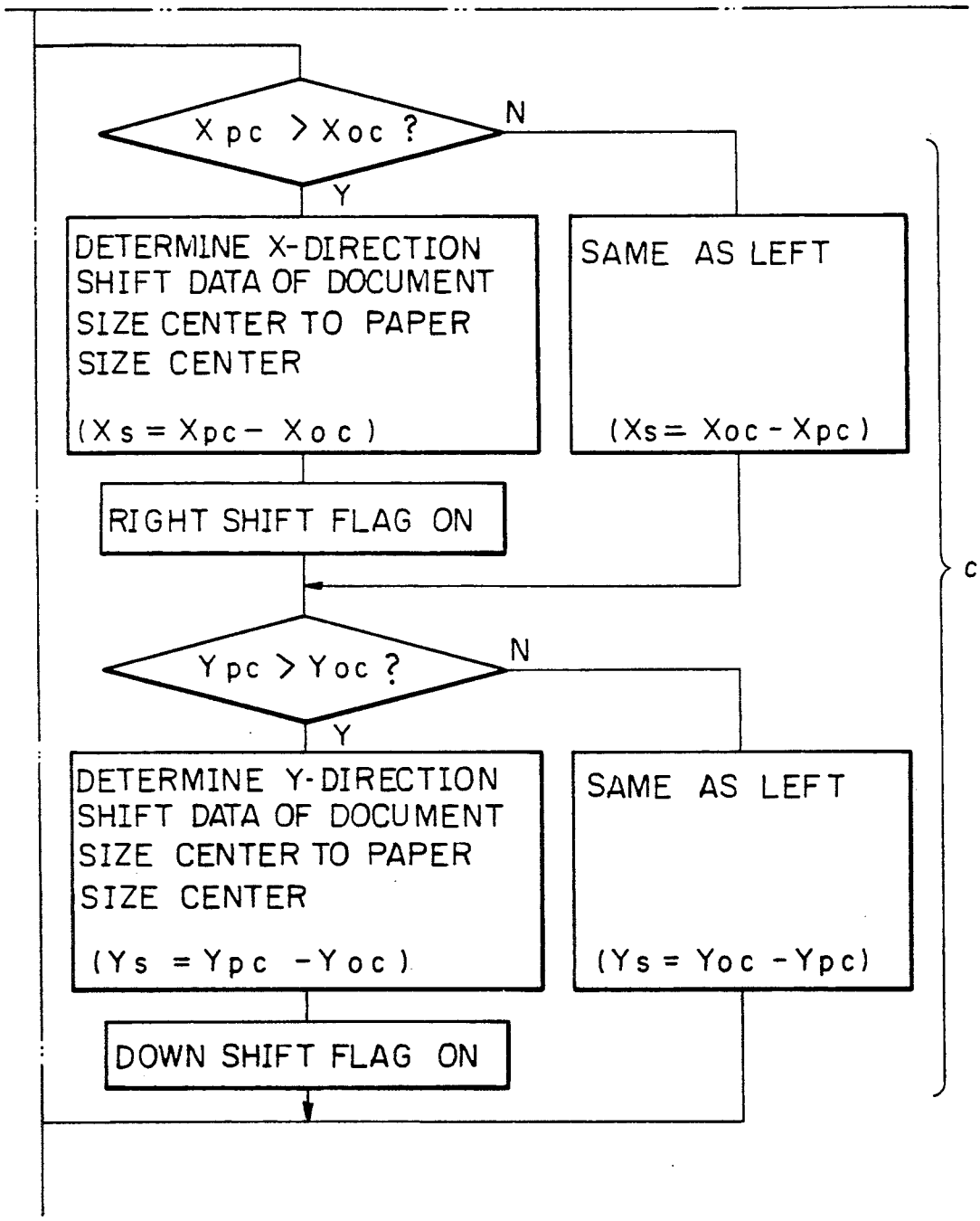
Figure 13:
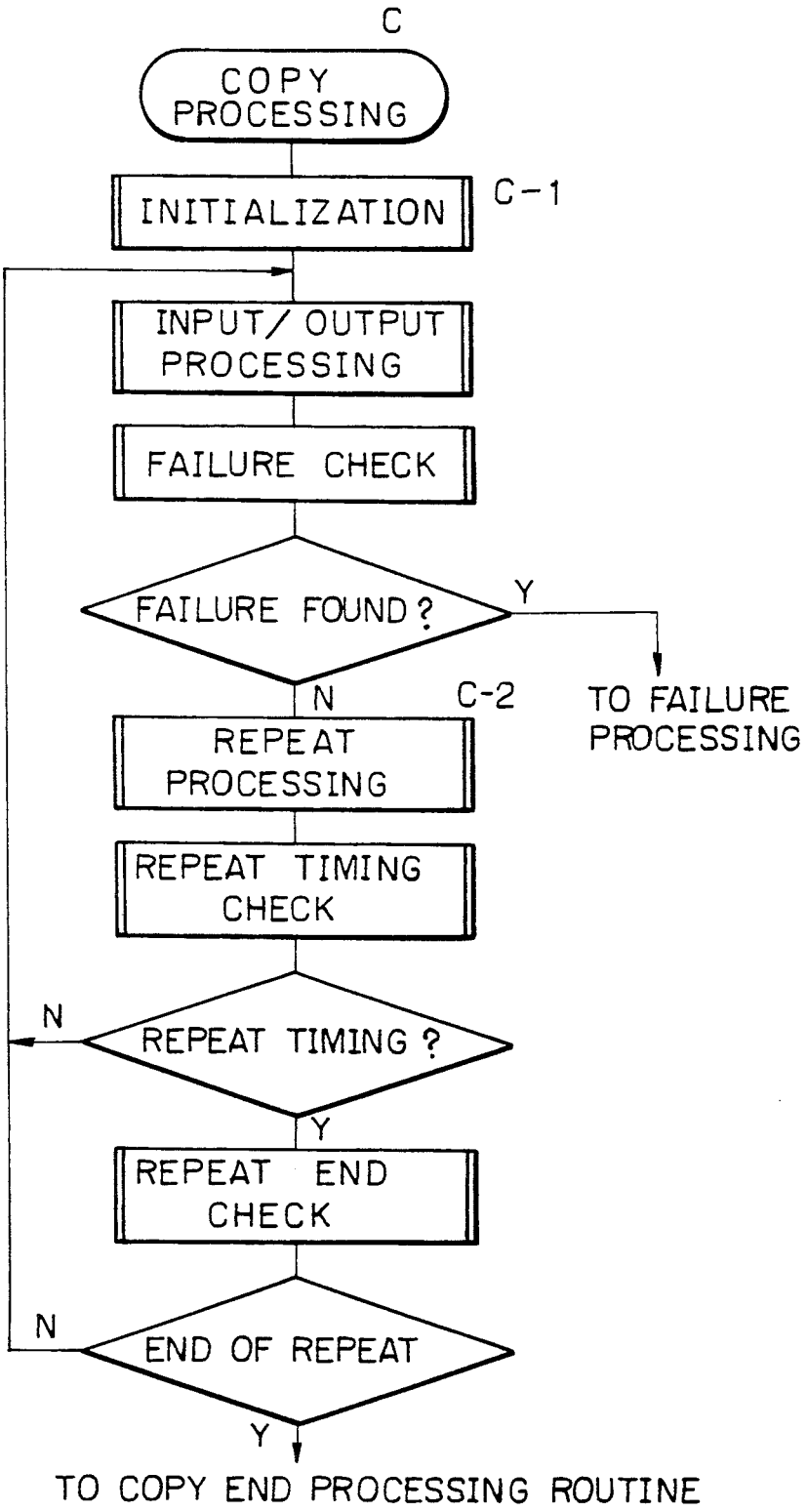
FIG. 13 is a flowchart showing copy processing.

FIGS. 10 and 13 demonstrate, respectively, the pre-copy processing and the copy processing. In the pre-copy processing (B), after the print ON initialization, input/output processing and failure checking are executed and, if no failure is found, the pre-copy processing is performed. If any failure is found, the program is transferred to a failure processing routine.

In the copy processing (C) of FIG. 13, the initialization is followed by input/output processing and failure checking. If no failure exists, repeat processing and repeat timing check are executed. If the repeat timing has been reached, repeat end check is performed. When the end of repetition is confirmed, the operation is transferred to a copy end processing routine.

Figure 15:
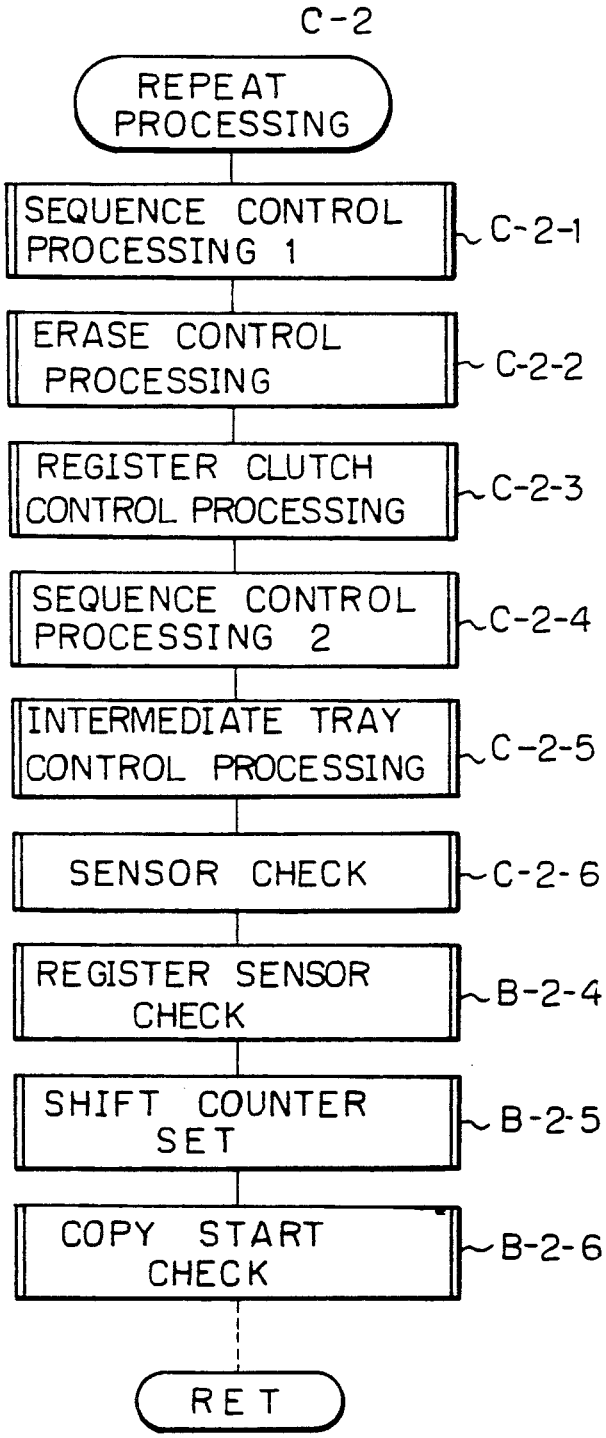
FIG. 15 is a flowchart showing repeat processing.
Figure 15A:
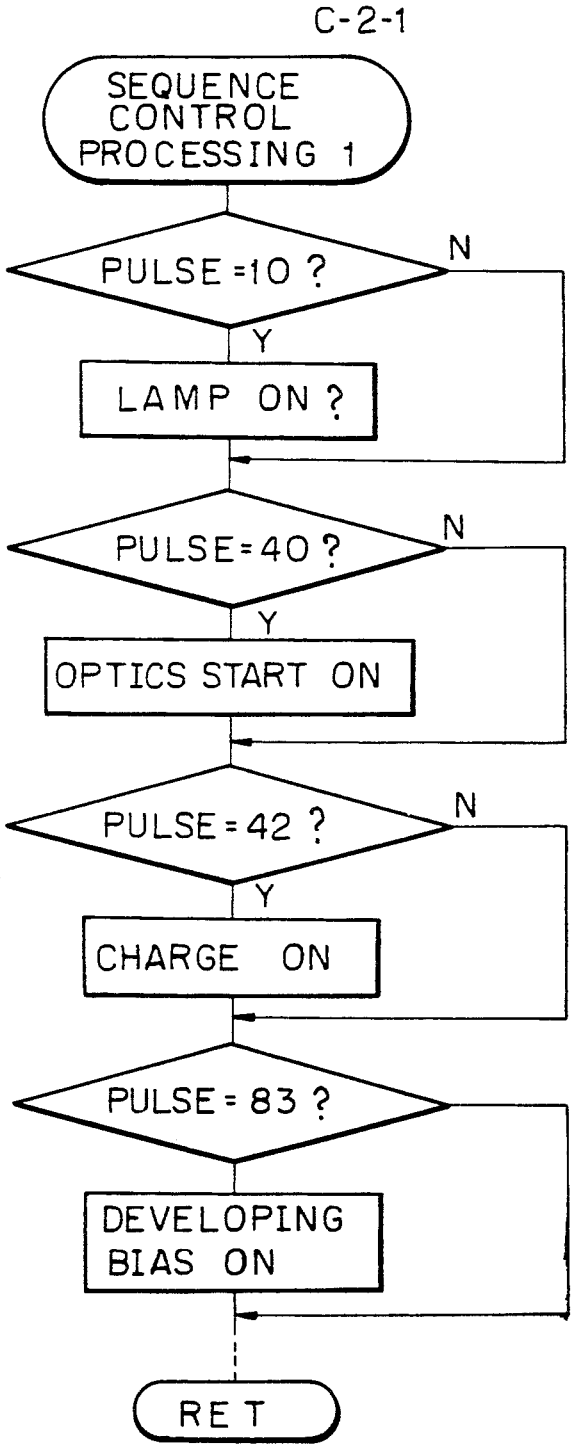
FIG. 15A is a flowchart showing sequence control processing 1.
Figure 15B:
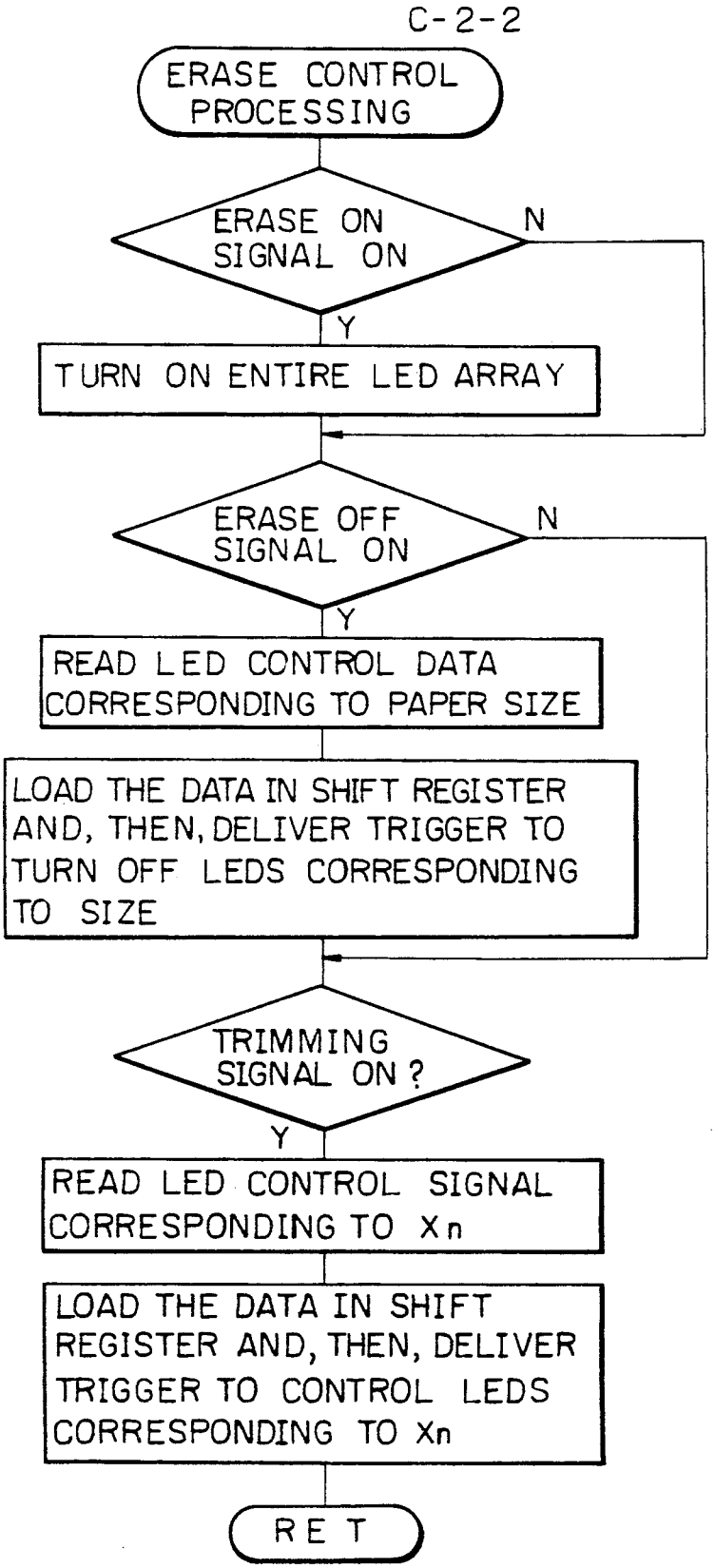
FIG. 15B is a flowchart showing erase control processing.

FIG. 15B shows erase control processing (C-2-2) included in the copy processing (C). First, when an erase ON signal becomes ON, the entire LED array is turned ON. As the erase ON signal becomes OFF, LED control data corresponding to the paper size is read out. After the LED control data is lodged in a shift register or shift registers, a trigger is turned ON so as to turn off those LEDs which correspond to the paper size. Next, if a trimming signal is ON, LED control data corresponding to Xn is read out. After that data has been lodged in the shift registers, the trigger is turned ON to control those LEDs which correspond to Xn. Then, the optical system produces scanner position data based on the document size, paper size, data trimming area, and X-direction data as sent to the optical system from the body, delivering a signal representative of a position as measured from the starting point of the scanner (in terms of the number of pulses produced by an encoder which is interlocked with a control motor). The procedure described above is the processing which occurs in the trim mode.

The shift mode adapted to shift or center a trimmed image will be described in detail.

Mode Setting (a) A shift key on the operation board is depressed to set up the image shift mode, the centering mode, or the OFF mode based on the image shift setting routine (A-1-4).

(b) A mode indicator associated with the mode selected is turned on (A-1-4).

(c) When the shift mode is set after the magnification change mode has been set, the partial magnification change mode is set up (A-1-5-4).

(d) When the shift mode is set after the combine mode or the undercolor mode has been set, the program mode is set up.

FIG. 8D demonstrates image shift set (A-1-4) which is included in the mode set processing. When the image shift key is turned on while the copier is out of operation, an image shift loop counter is incremented by 1. Then, as in the case of trimming, while the image shift key is continuously depressed, a shift of 2 mm is caused by one time of up-counting, and a shift of 40 mm is caused by forty times (0.4 second) of up-counting. When the count of the loop counter is 1, the mode indicators are selectively turned on depending upon the mode selected, i.e., center mode or image shift mode. Subsequently, an edit flag is set, and the buzzer is energized. When the image shift mode is set after the undercolor mode has been selected, the program mode is set up. Then, the recall flag is cleared.

Details of data entry in the image shift mode will be described.

Data Entry (a) Image shift data is entered by depressing a particular one of the keys which is representative of a desired direction of shift.

(b) When the right/left keys or the up/down keys are depressed as desired, data is input to X or Y and, at the same time, the associated direction flag is set (A-1-5-1, A-1-5-2).

(c) In response to the data and direction flag, the associated direction indicator on the operation board is turned on with the shift data displayed.

(d) Every time the data is input, the enter key is depressed to store it in the memory.

(e) When the enter key is depressed without manipulating any data key, the previous data in the memory is preserved.

(f) So long as none of the other modes is set, depression of the enter key sets a data set end flag to complete the entry of data.

(g) In the center mode, the entry of data is needless.

Next, the data conversion in the shift mode will be described in detail.

Data Conversion (a) When the shift mode is combined with magnification change, shift data is multiplied by a desired magnification (A-1-5-11).

FIG. 8E-11 shows shift data convert (A-1-5-11) included in the edit data set processing. If edit data set is ON, if shift image is ON and, yet, if none of the save, delete, partial conversion, and shift data set is ON, shift data is multiplied by a magnification. Then, shift data set is turned ON.

Centering which is included in the image shift mode is as follows.

Center Processing (a) In the centering data convert (A-1-5-10), a difference (amount of shift) between the center of a trimming area and that of a paper size is determined (XS, YS).

(b) In the trimming data convert (A-1-5-7), the data (XS, YS) is added to or subtracted from the trimming data. This provides trimming data which is centered at 1 magnification.

(c) The data is multiplied by a magnification to complete the data convert (A-1-5-6).

Figure 21A:
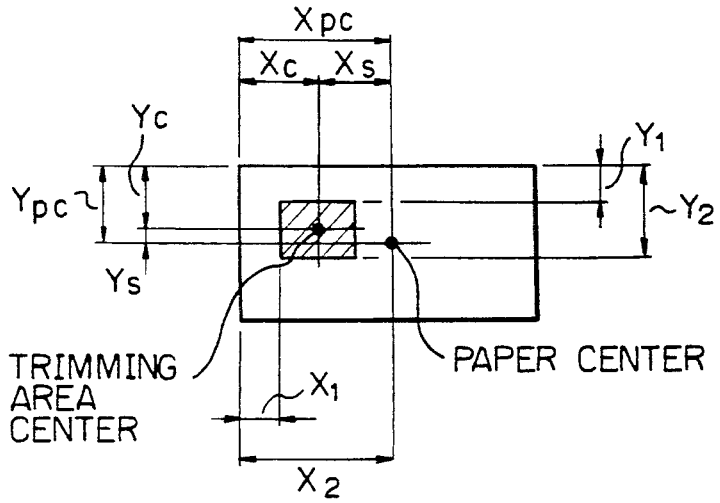
FIGS. 21A to 21C are diagrams explanatory of data convertion for centering.
Figure 21B:
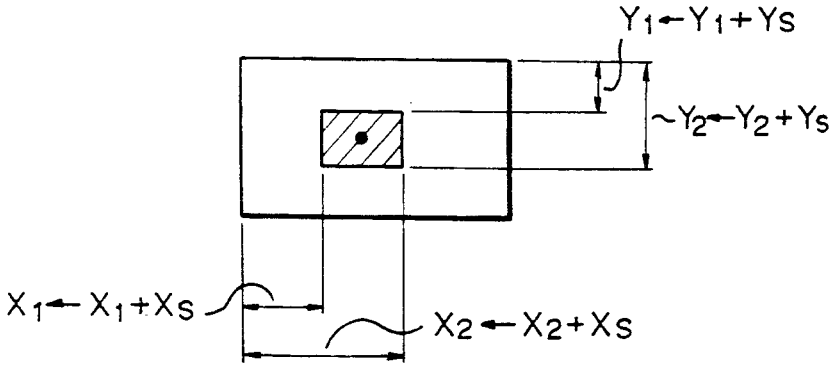
Figure 21C:
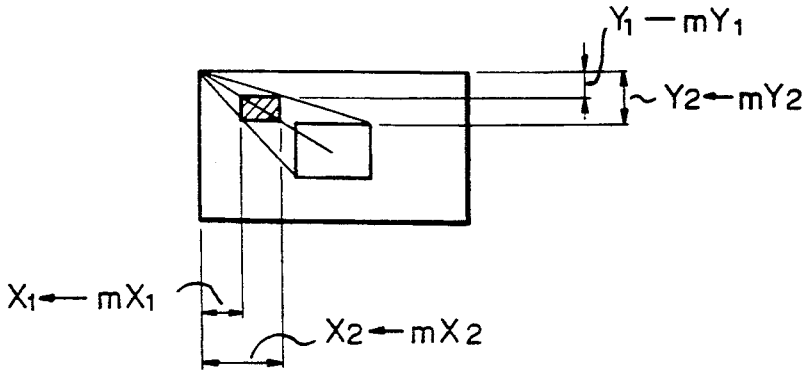

FIGS. 21A to 21C show how data is converted in the center mode. First, as shown in FIG. 21A, the distances XC and YC from the individual reference points to the center of a trimming area and the distances XPC and YPC from the individual reference points to the center of a paper are determined. Based on a difference between those distances, XS and YS are obtained, as shown in FIG. 21B. Then, the trimming area is centered. The area shown in FIG. 21C (hatched) is produced by multiplying X1 and Y1 by a coefficient m of magnification change when a change of magnification is specified.

FIG. 8E-10 demonstrates centering data conversion (A-1-5-10) which is included in the edit data setting processing. If edit data set is ON, if centering data set is OFF, if trimming data is present and, yet, if partial magnification change is specified, the trimming data is multiplied by a magnification. If partial magnification change is not specified, X-direction shift data of the center of a trimming area to the center of a paper size is determined and, then, the right shift flag is set. If YPC is greater than YC, Y-direction shift data of the center of the trimming area to the center of the paper size is determined. In this condition, the down shift flag is set while, at the same time, centering data is made ON. When XPC is smaller than YC, none of the right shift flag and down shift flag is set. When trimming data is absent, the X-direction shift data of the center of the document size to the center of the paper size is determined and, then, the Y-direction shift data of the center of the document size to the center of the paper size is determined. Then, the right shift flag and the down shift flag are set (only when XPC is greater than XOC and YPC is greater than YOC).

The copying operation will be described in detail.

Copying Operation (a) The shift of Y axis is effected by feeding shift data to the optical system so as to move the lens.

(b) The shift of X axis is effected by changing the relative position of an image on the drum and a paper, in any of the following four different modes.

(i) When the shift is the left shift and if the amount of shift is smaller than $(l_3+l_4)-l_4$, i.e., (distance between the center of a slit and the transfer)−(distance between transfer and register rollers), (i)−1: the period of time as counted from the instant of arrival of the scanner at the slit section is shortened by the amount of shift (C-2-3);

(i)−2: the copy start is delayed relative to a usual one by the amount of shift (B-2-3).

(ii) When the shift is the left shift and if the amount of shift is smaller than $l_3+l_2$ and greater than $l_3$, where $l_2$ is the distance between lamp ON and slit center (see (B-2-3)), (ii)−1: after a register sensor has become ON, the lamp is turned ON at a transport section stop timing plus $\alpha$ (B-2-4);

(ii)−2: after the lamp has been turned ON, the register rollers are started at $(l_2+l_3)$−(amount of shift) (B-2-5, B-2-6).

(iii) When the shift is the left shift and if the amount of shift is greater than $l_3+l_2$, (iii)−1: After a register sensor has been turned ON, the register rollers are started at the transport stop timing plus $\alpha$ (B-2-4);

(iii)−2: After the start of the register rollers, the lamp is turned ON at (amount of shift)−$(l_2+l_3)$ (B-2-5, B-2-6).

(iv) When the shift is the right shift, the register rollers are started when a value produced by adding the amount of shift to the period of time since the arrival of the scanner at the slit section is reached, whatever the amount of shift may be.

The procedure described so far pertains to the shift mode.

Hereinafter, the combine mode will be described in detail. The combine mode is adapted to reproduce the first document on a paper and, then, the second document on the same surface of the paper, and it may be effected in combination with trimming, image shift, color, etc.

Combine Mode

Mode Setting (a) In combine mode setting (A-1-2), a combine mode/undercolor mode mode or an OFF mode is selected. This causes a corresponding mode indicator on the operation board to glow.

(b) After the combine mode or the undercolor mode has been selected, there may be selected another mode such as a color mode, a magnification change mode, a copy number mode, etc.

(c) When the trim mode or the image shift mode is selected after the combine mode or the undercolor mode has been selected, the program mode is set up (A-1-3, A-1-4).

(d) When the magnification change mode is set while the combine mode or the undercolor mode is set or when the combine mode or the undercolor mode is selected after a change of magnification has been set, the partial magnification change mode is set (A-1-5-4).

FIG. 8B demonstrates combine mode setting (A-1-2) included in the mode set processing. After that the copier is out of operation has been confirmed (an in-copy flag is set upon print ON initialization and cleared by the copy end processing), a combine key loop counter is incremented by 1 when the in-copy flag is set while a combine key ON signal from the operation board is input. This counter is incremented by 1 every time the combine mode setting flow is executed. If the count of the counter is greater than 1 and smaller than 40, meaning that the key is continuously depressed, processing for changing over the mode at predetermined intervals is performed. Depending upon the mode, i.e., undercolor mode or combine mode, a corresponding mode flag is set with a corresponding mode indicator on the operation board turned on. Next, a first-time flag is set while, at the same time, a first-time indicator on the operation board is turned on. After the combine mode has been executed with the buzzer energized, a program flag is cleared. The program flag is a flag which is set when the trim mode or the image shift mode has been set after the combine mode.

Hereinafter will be described the copying operation for simple combination.

Copying Operation (a) The sequence of steps from the print ON to the fixing are the same as those of the usual copying sequence.

(b) On the path along which a fixed paper is fed out, when the paper has reached a position just before the inlet of an intermediate tray gate, an intermediate tray gate pawl SOL is turned ON by a count of a register counter which has been started at the time of register ON, whereby the paper is led to an intermediate tray (C-2-4).

(c) When the leading end of the paper moves past the intermediate tray sensor, an intermediate tray set SOL is turned ON to lift up intermediate tray set rollers (C-2-6).

(d) As the trailing end of the paper moves past the previously mentioned sensor, a discharge counter is incremented by 1 while, at the same time, an intermediate tray control pulse is started (C-2-6).

(e) In response to the intermediate tray control pulse, the set SOL is turned OFF, then the intermediate tray set rollers are lowered, then the paper is laid on the intermediate tray, and then the rollers are lifted up again (C-2-5-a).

(f) By end operation processing (D-2) which is included in the copy end processing, an intermediate tray control is executed to press a presser plate against the final repeated paper so as to prepare for the second feed (C-2-5-b).

(g) The second feed of papers, or copies, is effected by coupling a feed clutch which is associated with the intermediate tray (B-1, B-2, B-3, B-2-2-1).

(h) When the leading end of the paper reaches a position just before a combine tray gate pawl, the gate pawl is opened so that the paper is turned over and then fed to a combine tray (B-2-2-1-2).

(i) As the trailing end of the paper moves past a combine sensor, a combine feed control pulse is started (B-2-2-2).

(j) By the above pulse control, the paper is fed to a body sheet transport path in such a direction that the trailing end of the paper becomes the leading end.

(k) At a timing when the leading end of the paper reachs a certain distance before the register rollers (see B-2-3), a copy start flag 1 is set.

(l) When the copy start flag 1 is set, if shift data is absent, the program advances to the copy routine provided the other conditions are satisfied.

(m) By the procedure described above, the second copy is provided on the same surface of the paper as the first copy to complete a combined copy.

As stated above, the trimming and shifting operations are implemented by moving the lamp in the X direction and changing the relative position of the image on the drum and the paper in the Y direction.

Figure 12:
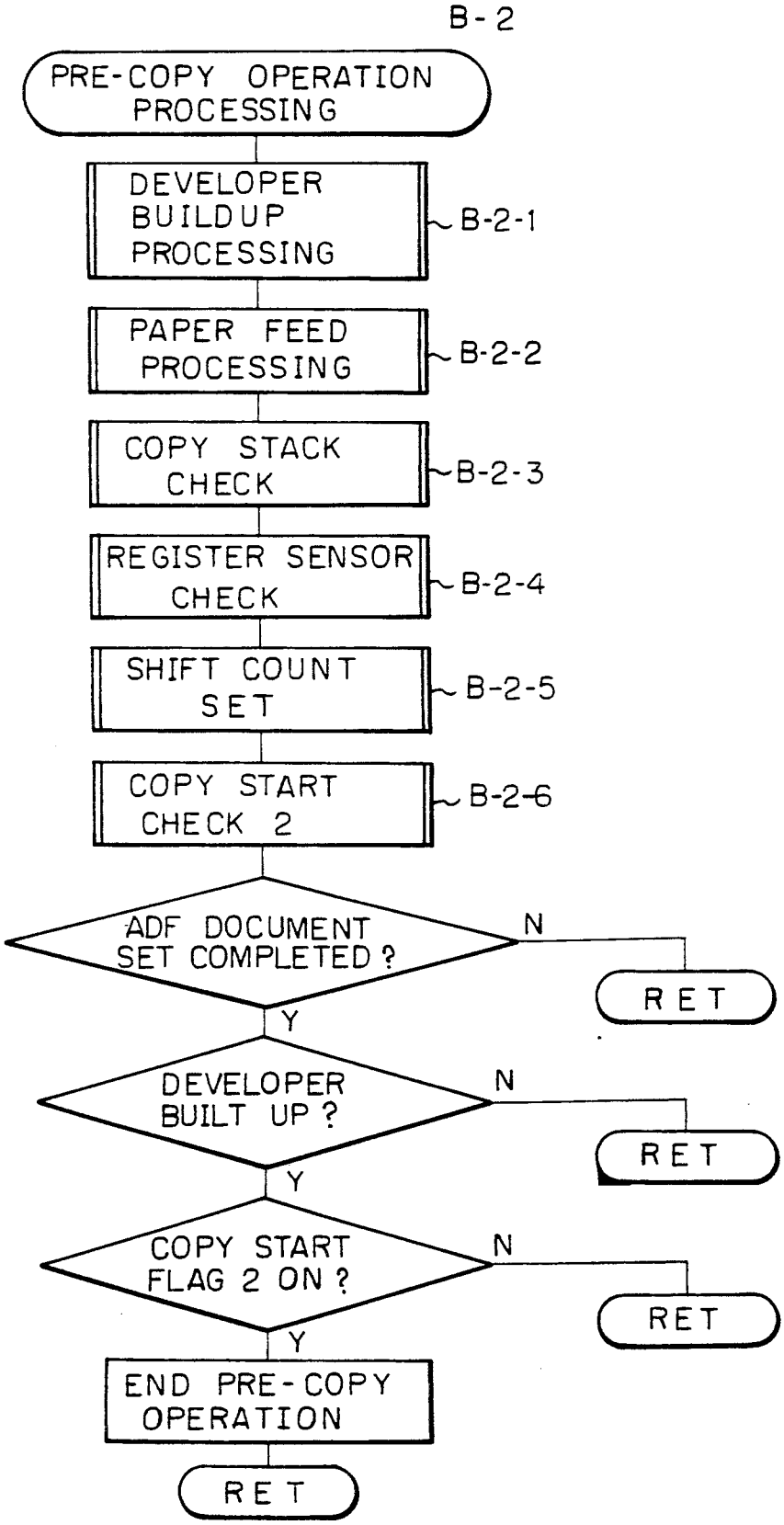
FIG. 12 is a flowchart showing a pre-copy operation processing.
Figure 12A:
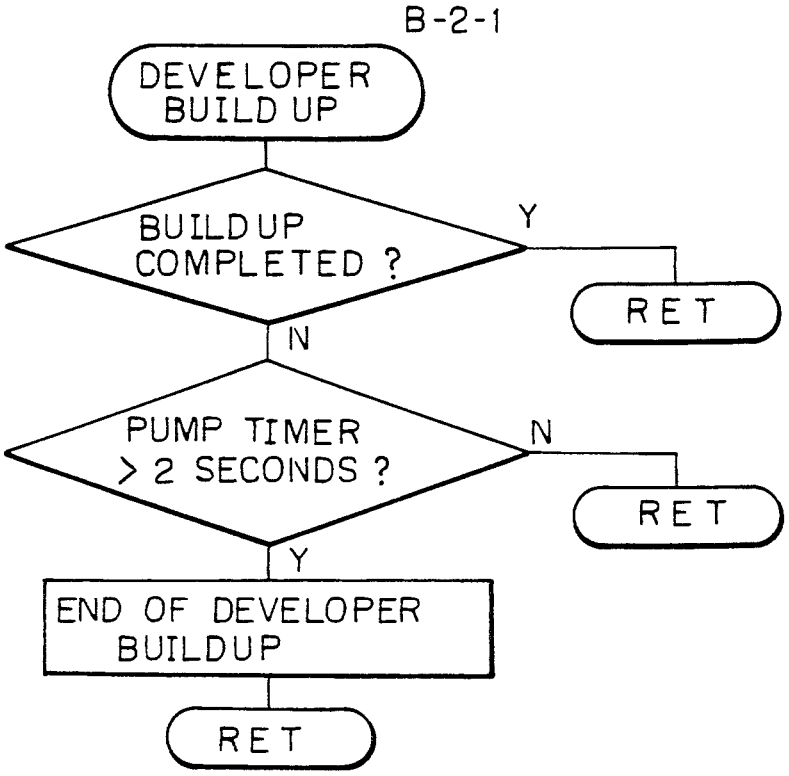
FIG. 12A is a flowchart showing developer buildup.
Figure 12B:
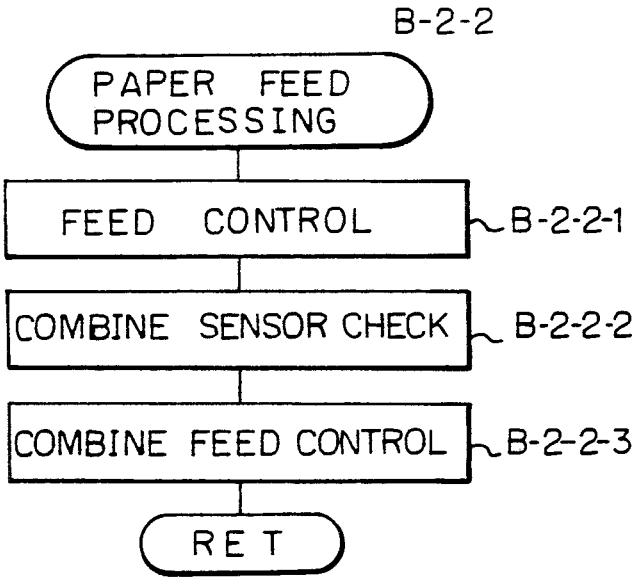
FIG. 12B is a flowcharting showing paper feed processing.
Figures 1, 1A, 12B:
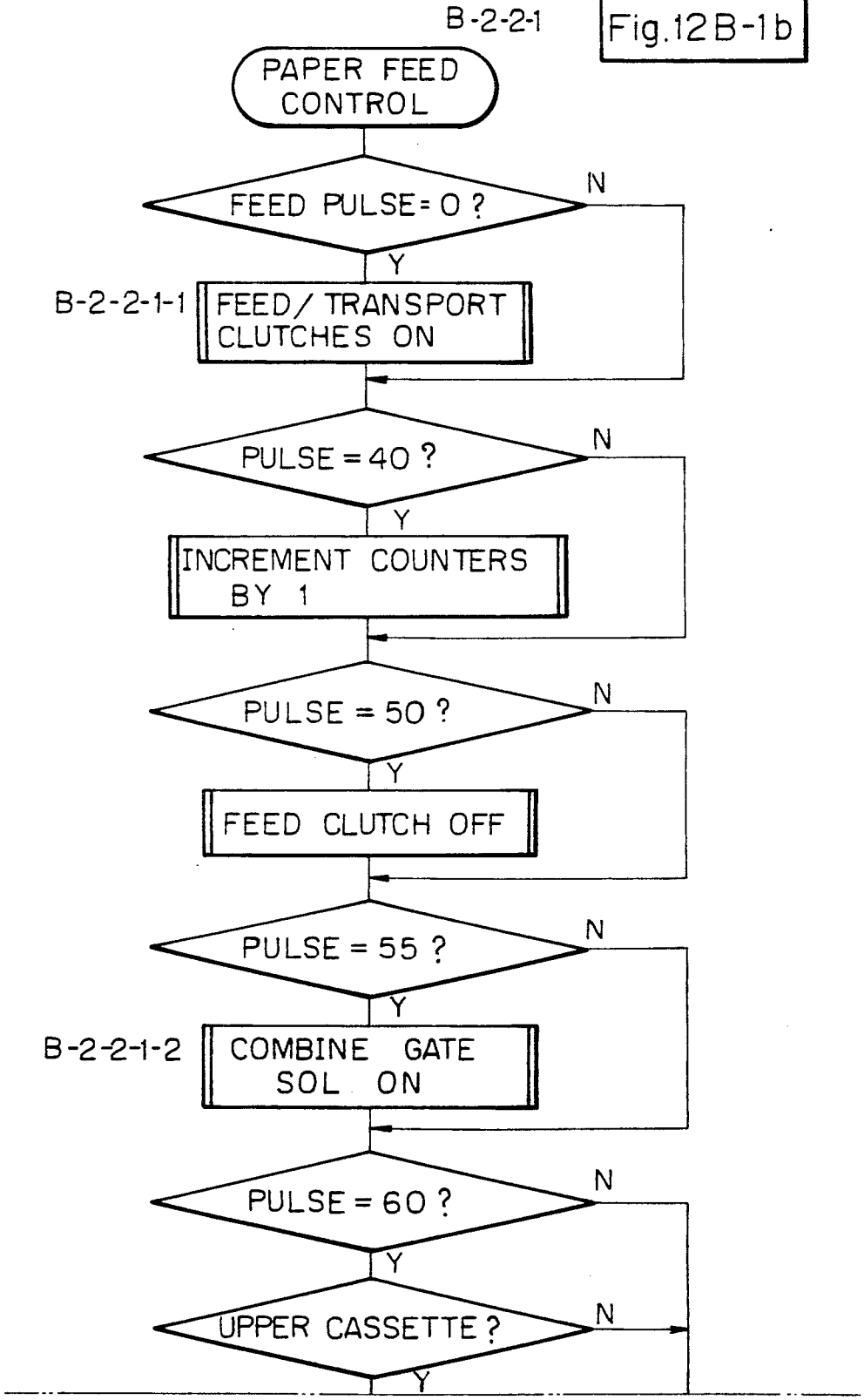
Figures 1B, 12B:
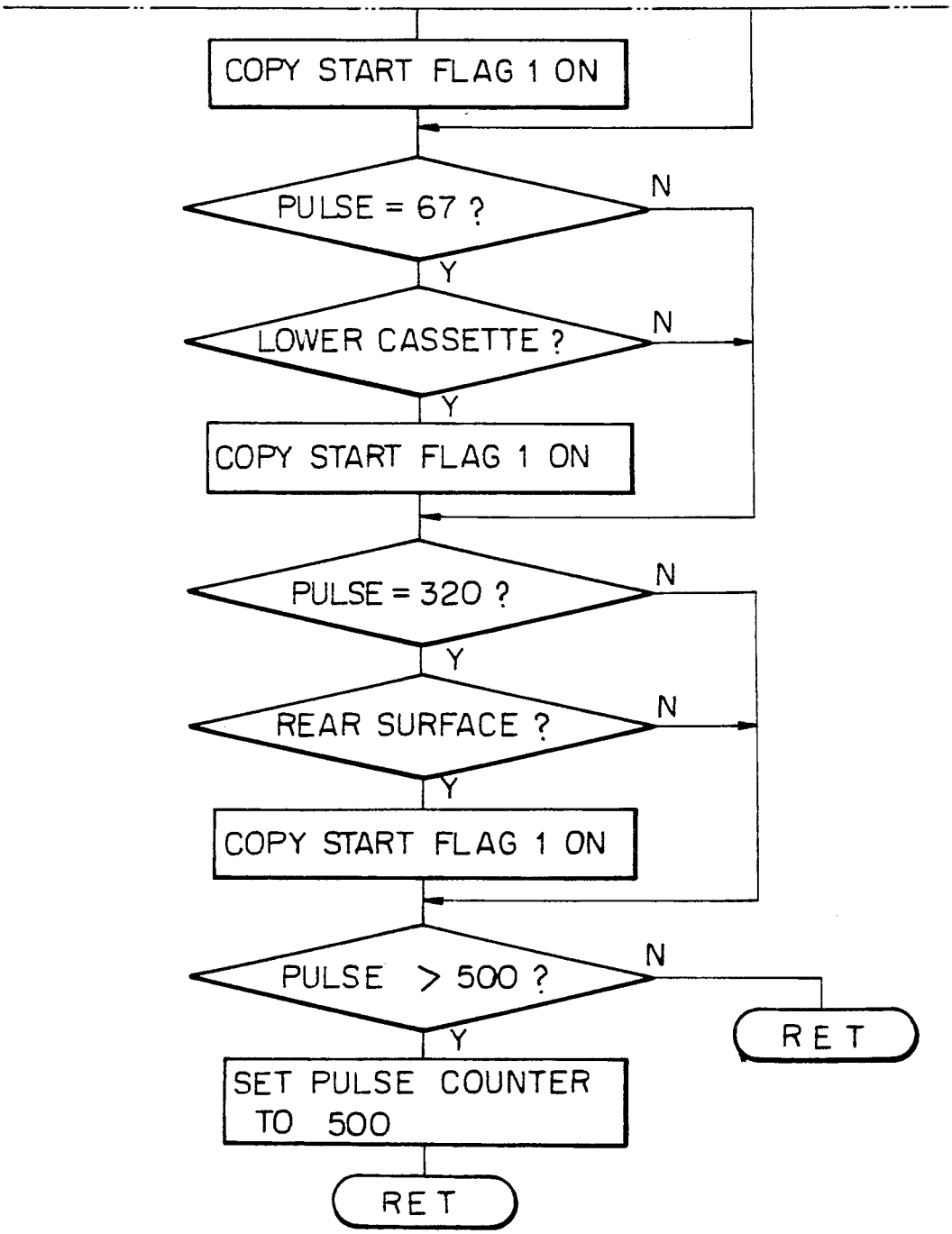
Figures 1, 12B:
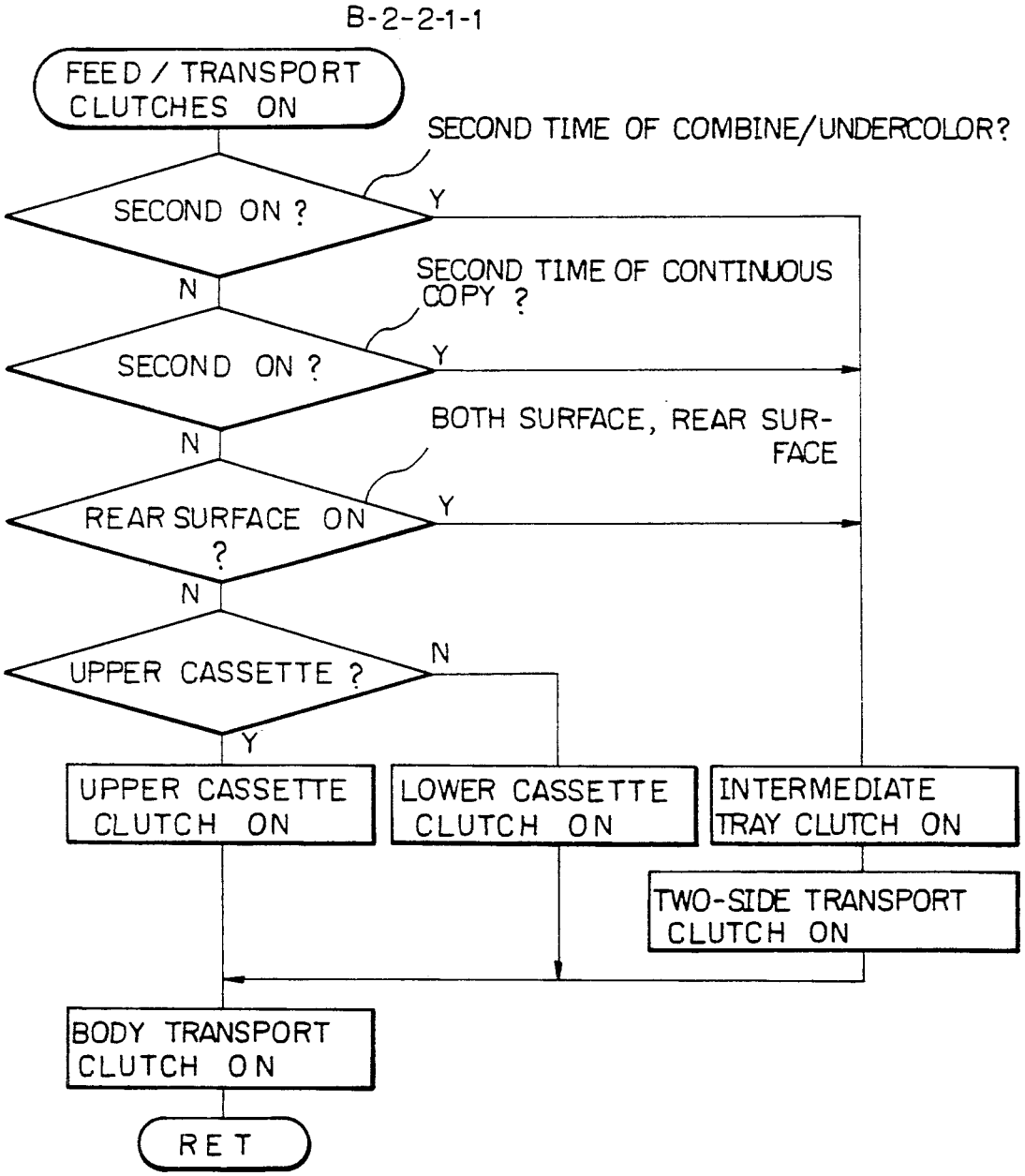
Figures 1, 2, 12B:
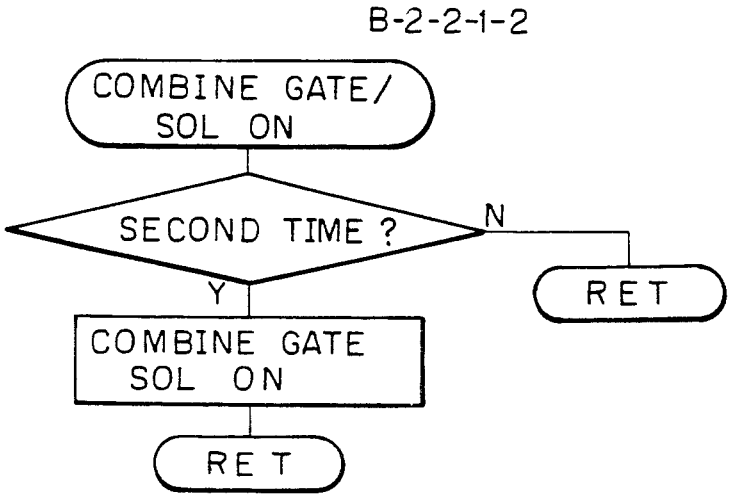
Figures 2, 12B:
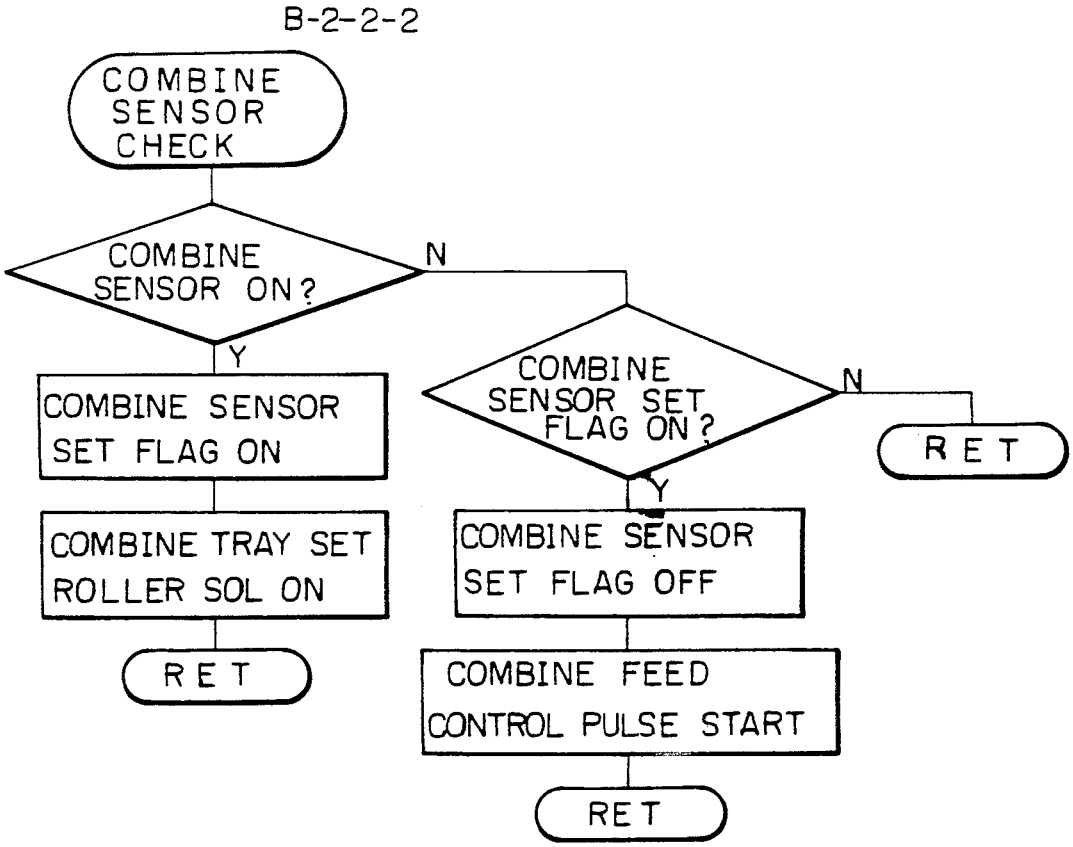
Figures 3, 12B:
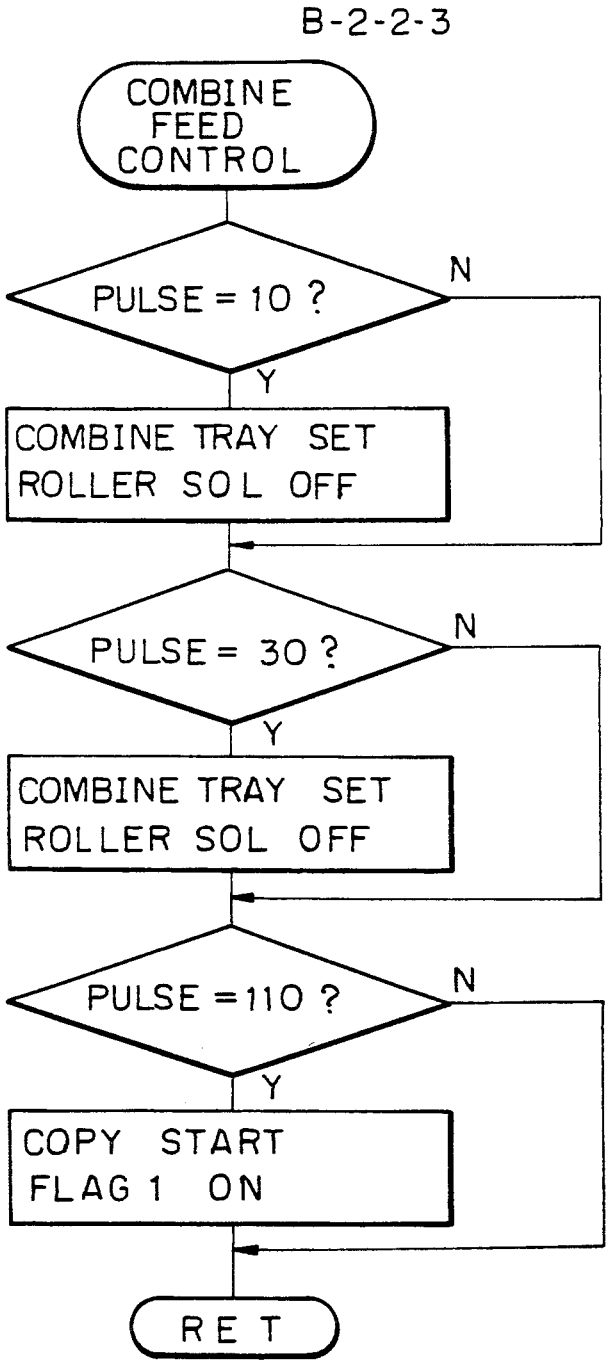
Figures 1, 12C:
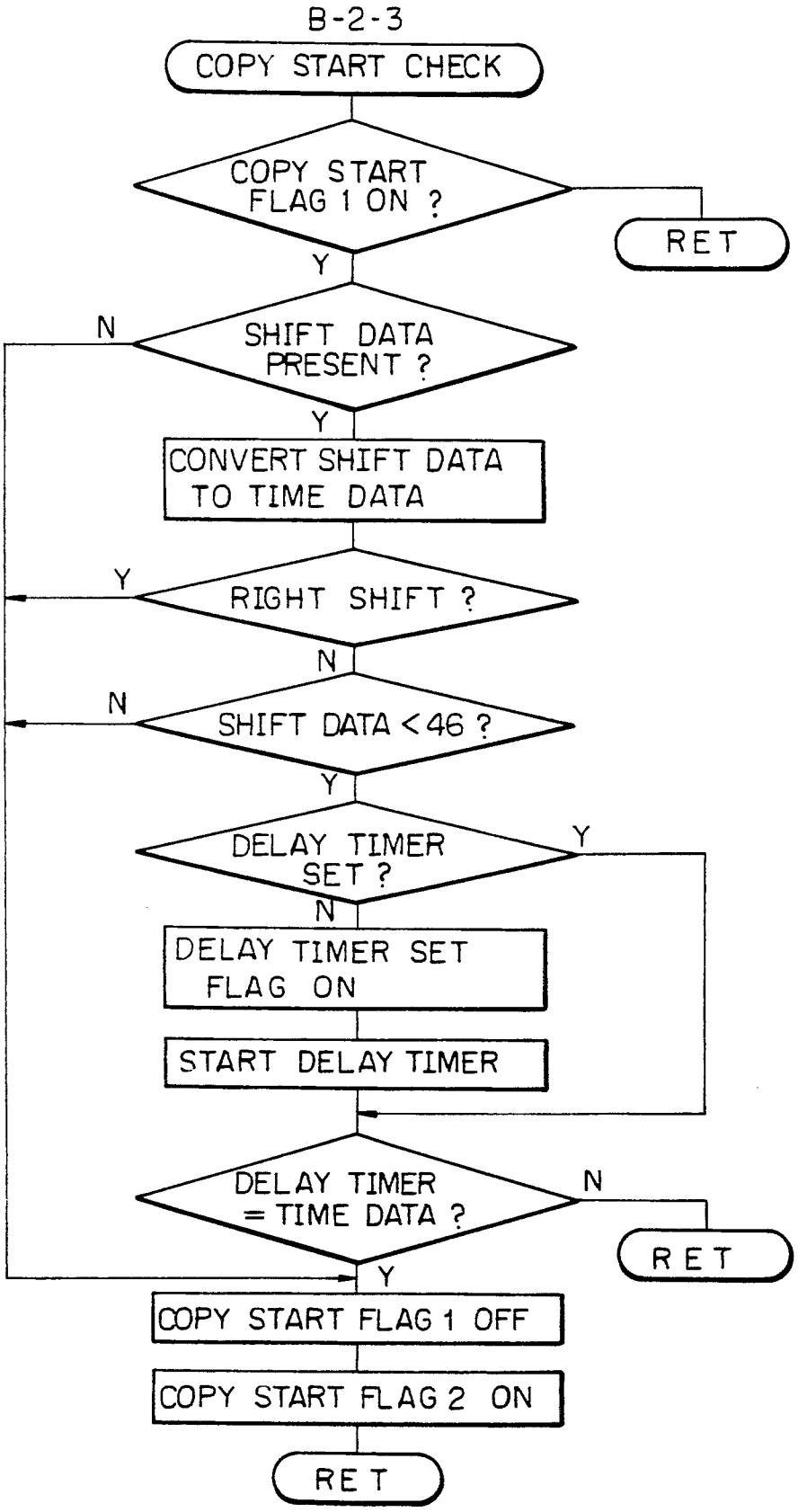
Figure 12:
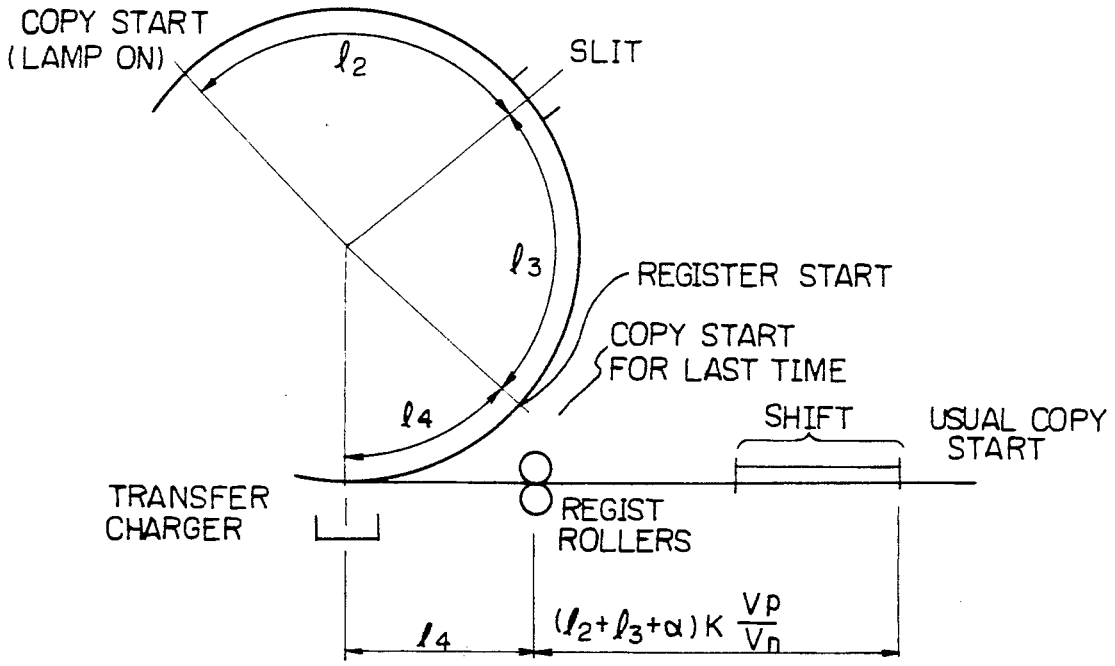
Figures 1, 12D:
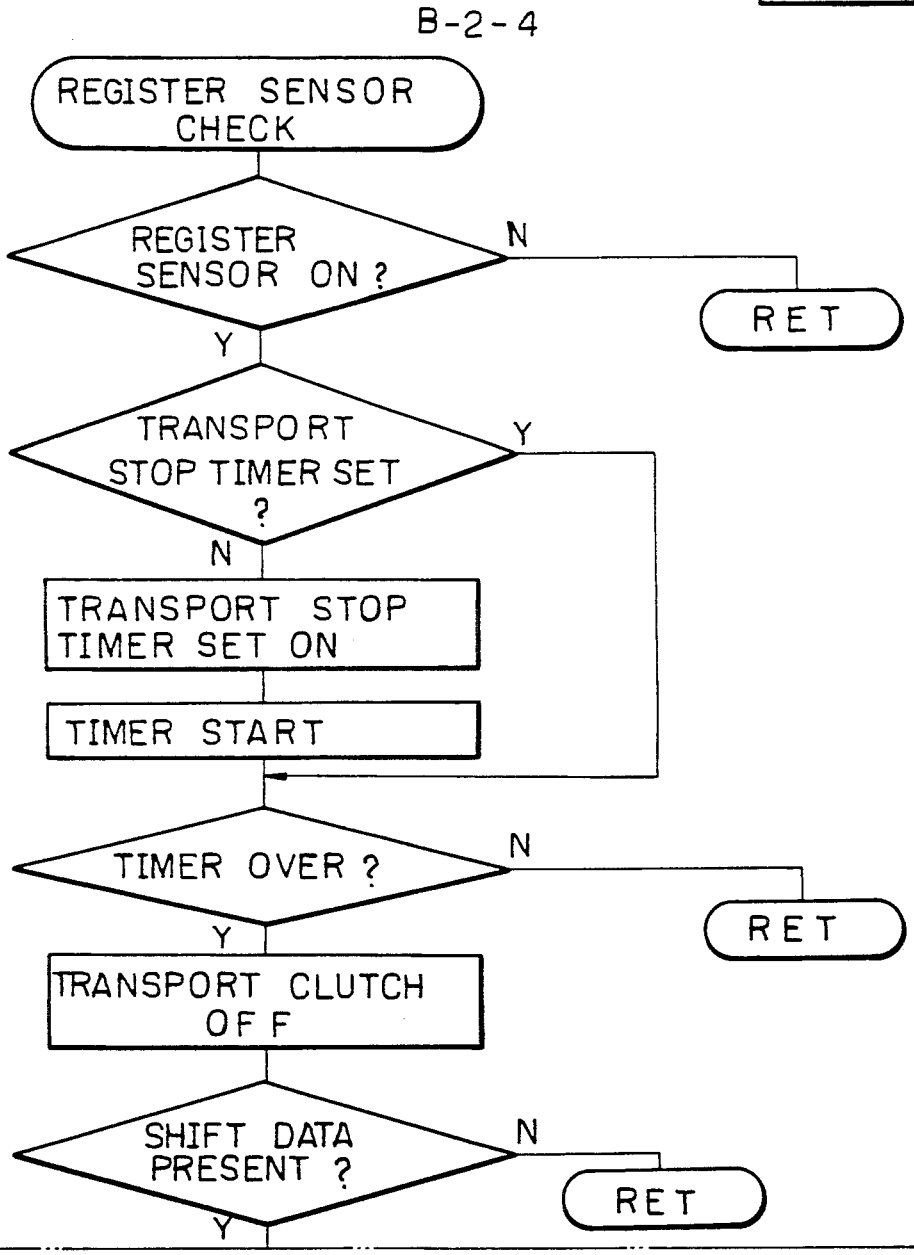
FIG. 12D is a flowchart showing register sensor check.
Figures 2, 12D:
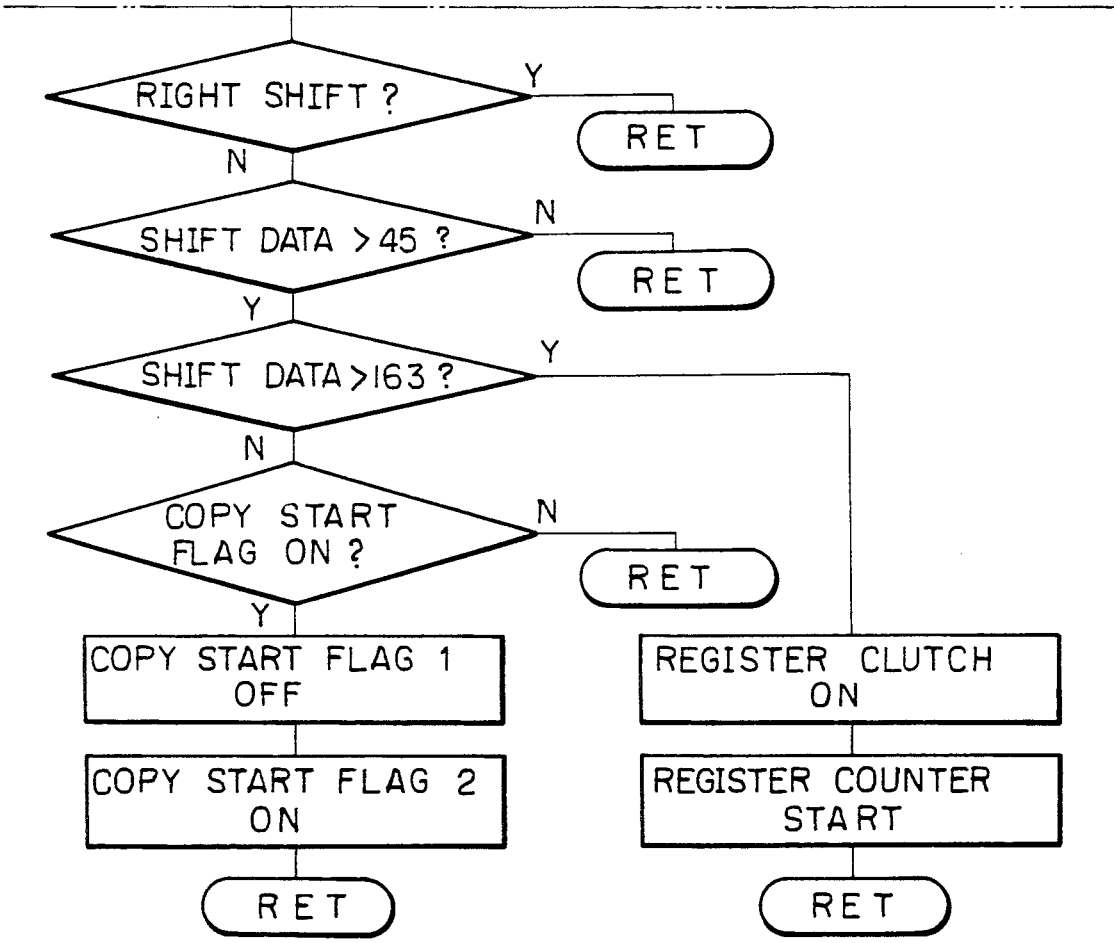

FIG. 12D demonstrates register sensor check (B-2-4) which is included in the pre-copy operation processing. As a register sensor located in the vicinity of the register rollers is turned ON, a transport stop timer is started if it has not been set. This is to provide a delay for causing a transport clutch to become OFF after the paper abutted against the register rollers has been slackened by about 10 mm. When the timer is over, the transport clutch is turned OFF, and the copy start flag is cleared and a copy start flag 2 is set on condition that shift data is present, that the shift is not the right shift, that the shift data is greater than 45 and smaller than 163, and that the copy start flag 1 has been set. The copy start flag 2 allows a copying operation to be executed. When the shift data is greater than 163, the register clutch is turned ON while, at the same time, the register counter is started.

Figure 12E:
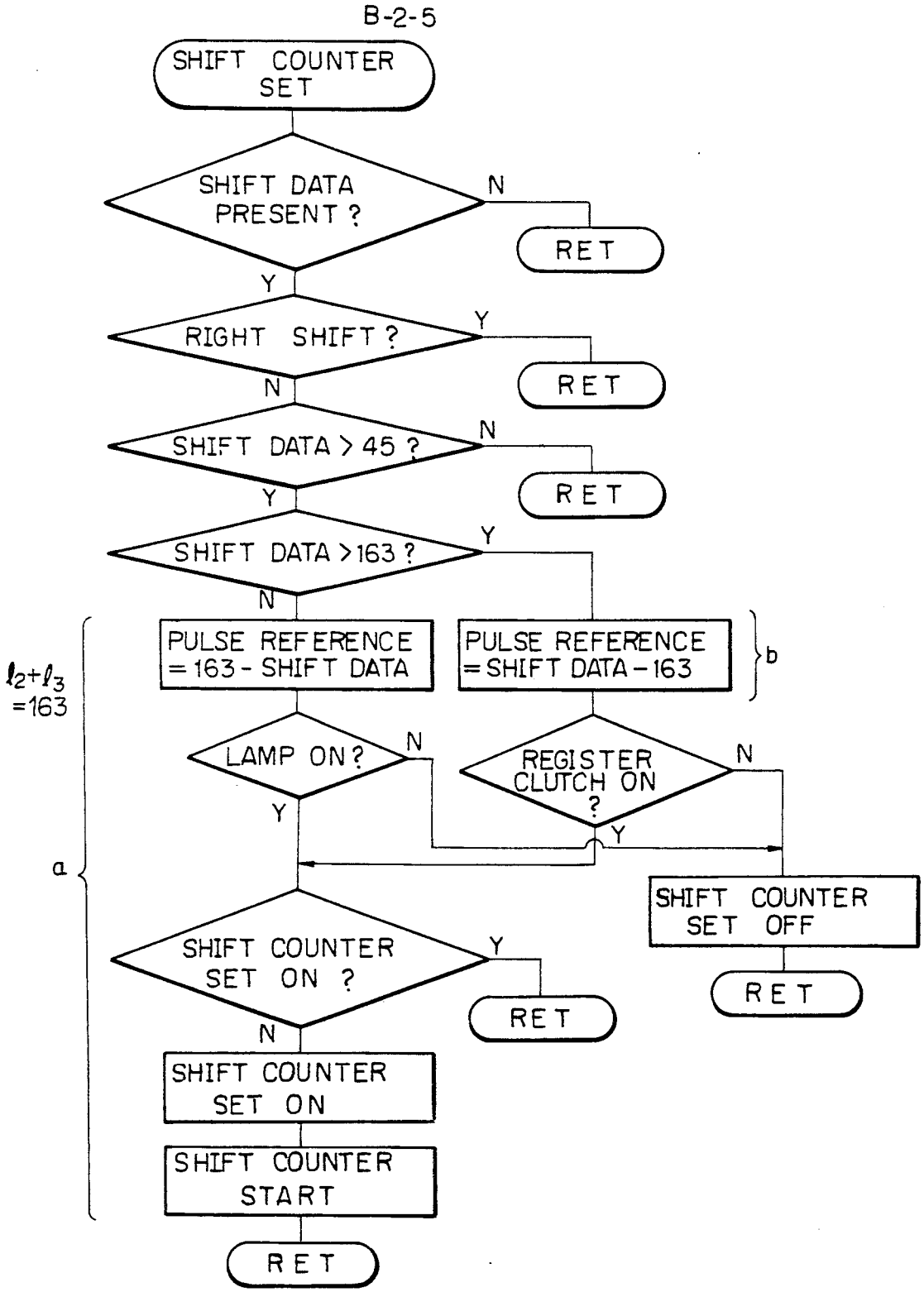
FIG. 12E is a flowchart showing shift counter set processing.
Figure 12F:
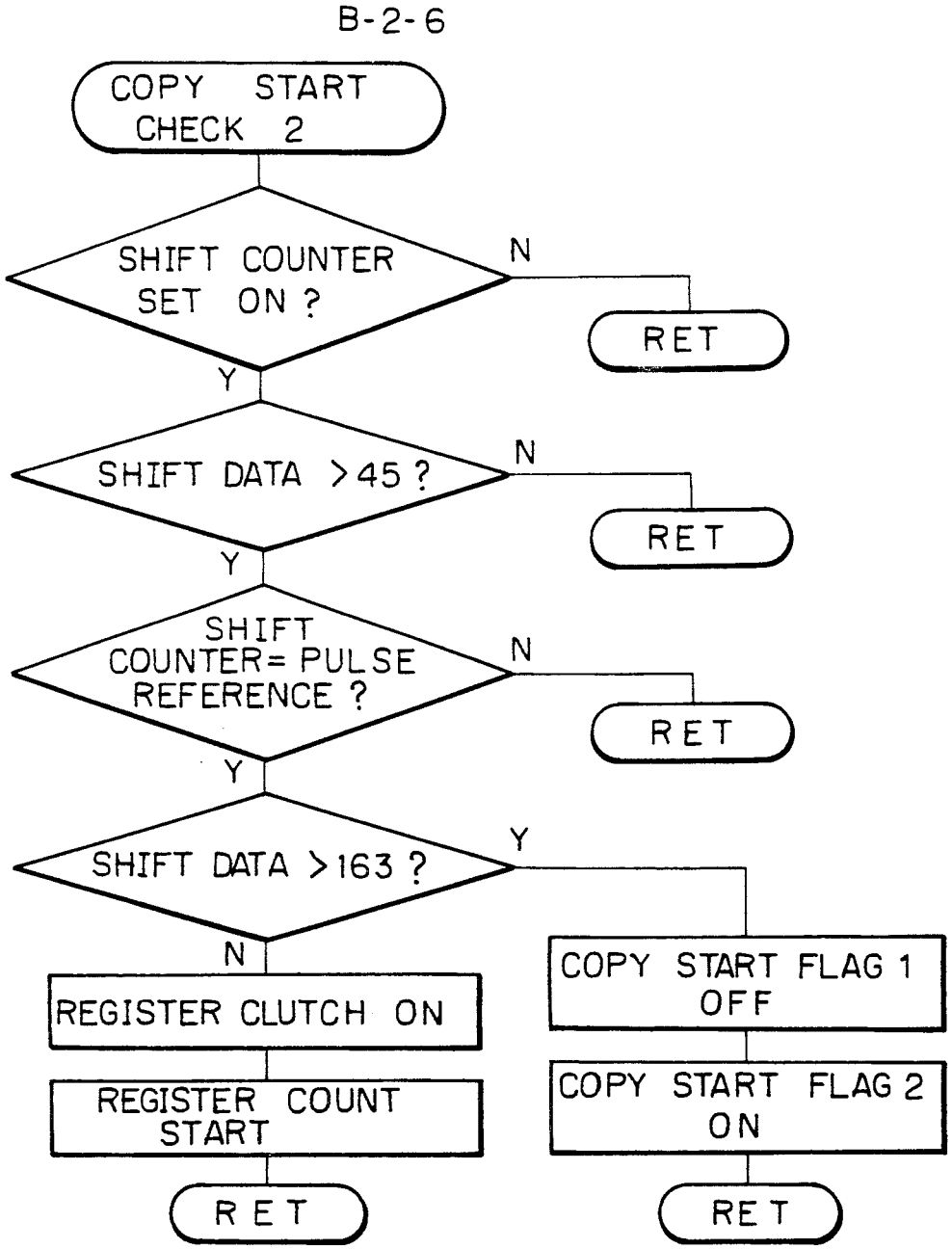
FIG. 12F is a flowchart showing copy start check 2.

FIGS. 12E and 12F demonstrate, respectively, shift counter setting (B-2-5) and copy start check 2 (B-2-6) which are included in the pre-copy operation processing. In the shift counter setting of FIG. 12E, on condition that shift data is present, that the shift is to the left, and that the shift data is greater than 45 and smaller than 163, the pulse reference is replaced with a value which is produced by substracting the shift data from 163. Then, upon the turn-on of the lamp, that shift counter set is OFF is confirmed, and then the shift counter set is made ON to start the shift counter (procedure a). If the shift data is greater than 163, the pulse reference is changed to a value which is produced by subtracting 163 from the shift data, then register clutch ON and shift counter set OFF are confirmed, and then shift counter set is made ON to start the shift counter (procedure b). In this manner, when the shift is to the left and the amount of shift is smaller than $l_2$ and greater than $l_3$, the procedure a is executed so that, upon lamp ON, the shift counter for starting the register rollers is started when $(l_2+l_3)-$(amount of shift) is reached. Conversely, when the amount of shift is greater than $l_3$, the procedure b is executed so that, upon register clutch ON, the shift counter for turning on the lamp is started when (amount of shift)$-(l_2+l_3)$ is reached.

In the copy start check 2 of FIG. 12F, on condition that the shift counter set is ON, that shift data is greater than 45 and smaller than 163, and that the shift counter is equal to the pulse reference, the register clutch is turned ON while, at the same time, the register counter is started. On the other hand, when the shift data is greater than 163, the copy start flag 1 is cleared, and the copy start flag 2 is set.

FIG. 12C-1 demonstrates copy start check (B-2-3) and FIG. 12-2, a positional relation thereof. In this particular embodiment, when a shift not greater than 45 mm exists in the X direction, the copy start timing is delayed by the amount of shift. A left shift not greater than 45 mm is effected by subtracting a timer time as counted from the input of a slit signal. It follows that if the copy start is not delayed relative to a paper, it may occur that paper fails to reach the registering section when the register rollers are turned ON. In the copy start check, shift data is converted into time data on condition that the copy start flag 1 is ON and shift data is present. Next, if the shift data is not to the right, the shift data is smaller than 46 mm, and the delay timer is not ON, a delay timer flag is set to start the delay timer. When the delay timer is equal to time data, the copy start flag 1 is cleared and, instead, the copy start flag 2 is set.

FIG. 12C-2 shows a positional relationship between the drum and the register rollers. After the surface of the drum has been charged by the main charger, light is incident to the drum surface through the slit to form an electrostatic latent image on the drum surface. Assuming that the distance between the copy start (lamp On) position on the drum and the slit is the distance $l_2$ necessary for gaining time for the buildup of the lamp, the distance between the slit and the position where the register rollers are started is the distance $l_3$ for delaying the copy start by the amount of shift, and the distance between the register roller start position and the transfer charger is the distance $l_4$, a paper is to be started at a position which is farther than the distance $l_4$ between the transfer charger and the register rollers by $(l_2+l_3+\alpha)\times(VP/VD)$, where VP is the paper feed rate and VD, the drum speed. During usual copying (without a shift), if copying is started when the leading end of a paper has arrived at the above-mentioned position, the image and the paper will efficiently meet each other at the transfer charger. In the event of left shift, copying is started at a position which is advanced by the amount of shift $l_3$, i.e., the copy start is delayed by the amount of shift.

As described above, in this particular embodiment, the image shift is effected by changing the relative position of an image on the drum and a paper. Specifically, an image is shifted to the left by delaying the copy start timing (lamp ON timing) with the register clutch ON as a reference, and it is shifted to the right by delaying the register roller start timing with the copy start (lamp ON) as a reference. Based on such a relationship between the copy start and the register roller ON, three different modes may be controlled, as follows:

(i) a mode wherein an image-forming process on the drum is started (lamp ON) before a period of time for a paper to reach the register rollers expires, and a period of time from the instant of arrival of the scanner, which joins the above process, at a predetermined position to the instant when the register rollers are activated is changed;

(ii) a mode wherein the above-stated process is started when a paper reachs the register rollers, and the interval between that instant and the instant of register roller activation is changed; and (iii) a mode wherein the register rollers are activated when a paper reached the rollers becomes slightly slackened thereat, and the interval between that instant and the instant when the process is started is changed.

Figures 1, 1A, 15C:
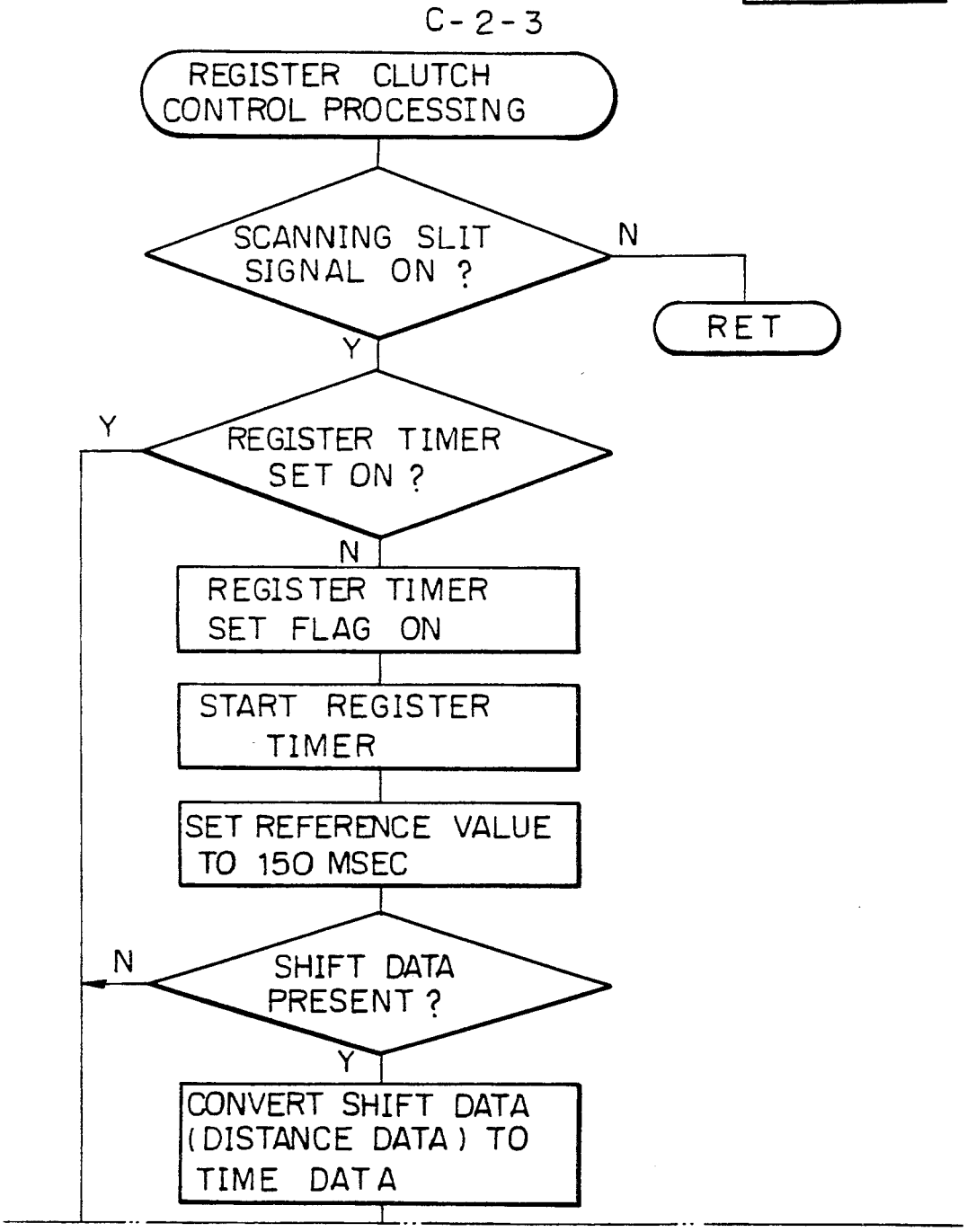
Figures 1B, 15C:
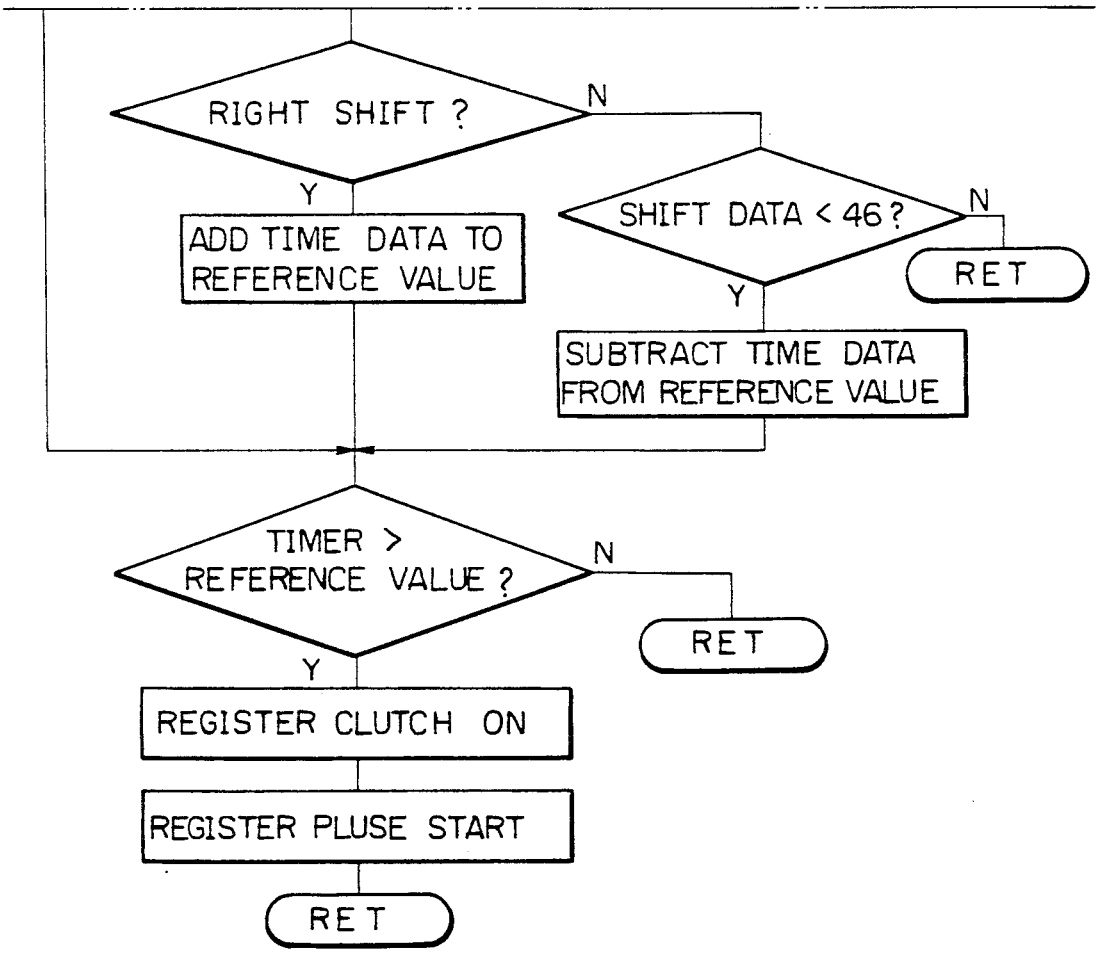
Figures 2, 15C:
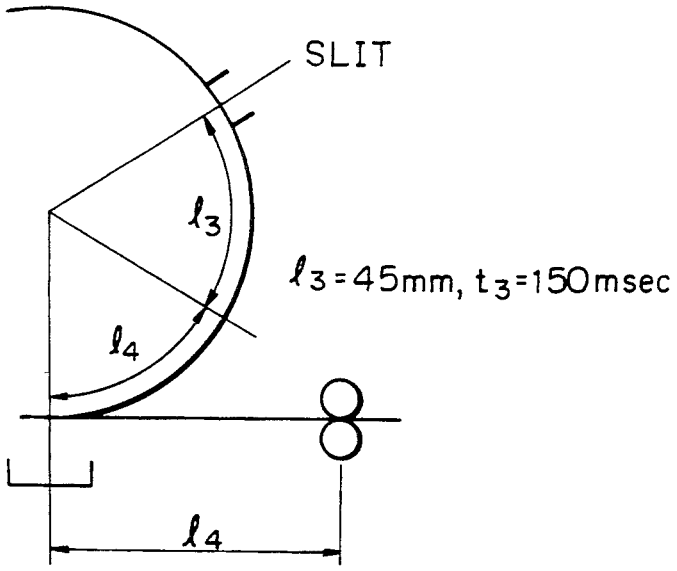

FIG. 15C-1 demonstrates register clutch control processing while FIG. 15C-2 shows a positional relationship between the drum and the register rollers. In the register clutch control processing, on condition that a scanner slit signal is ON and the register timer is not set, a register timer flag is set and, then, the register timer is started. Then, the reference value is set to 150 msec. The scanner slit signal is a signal which is to be fed to the copier body when the scanner reaches the slit section. If shift data is present, the shift data is converted into time data. In the case of right shift, the above-mentioned time data is added to the reference value (i.e. register clutch ON is further delayed). In the case of left shift, time data is subtracted from the reference value (i.e. register clutch ON occurs earlier) if the shift data is smaller than 46 mm. As soon as the timer exceeds the reference value, the register clutch is turned ON while, at the same time, a register pulse is started. It will be noted that as the amount of shift exceeds 46 mm, coupling the register clutch immediately after the scanner slit signal ON is out of time. In such a case, the copy start timer is set by the copy start check as shown in FIG. 12C-1 so as to delay the lamp ON timing.

In FIG. 15C-2, the register clutch is turned ON when a period of time $t_3$ expires since the arrival of the leading end of an image at the slit section. That is, $l_3$ is 45 mm and $t_3$ is 150 msec.

Figures 1, 15D:
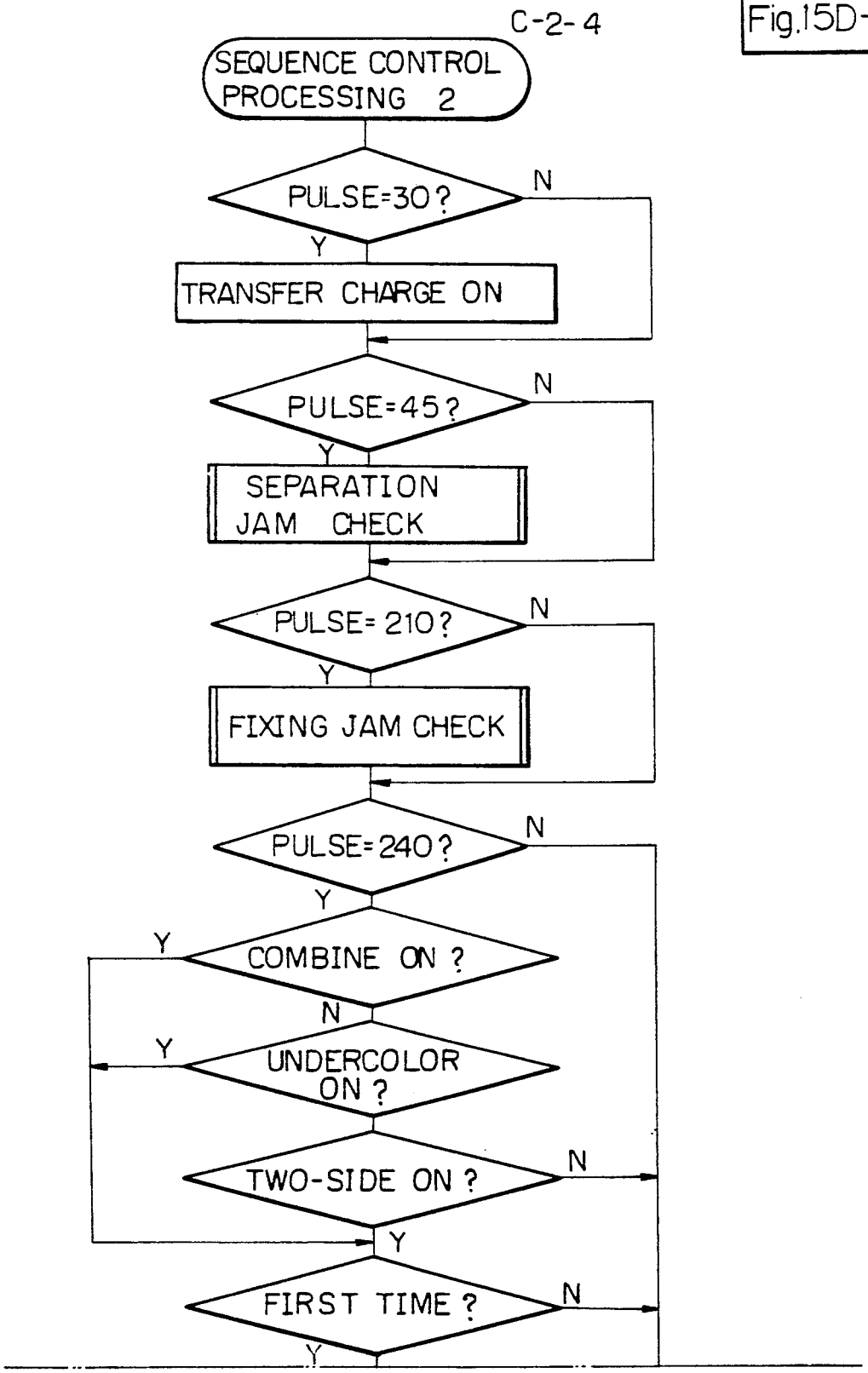
FIG. 15D is a flowchart showing sequence control processing 2.
Figures 2, 15D:
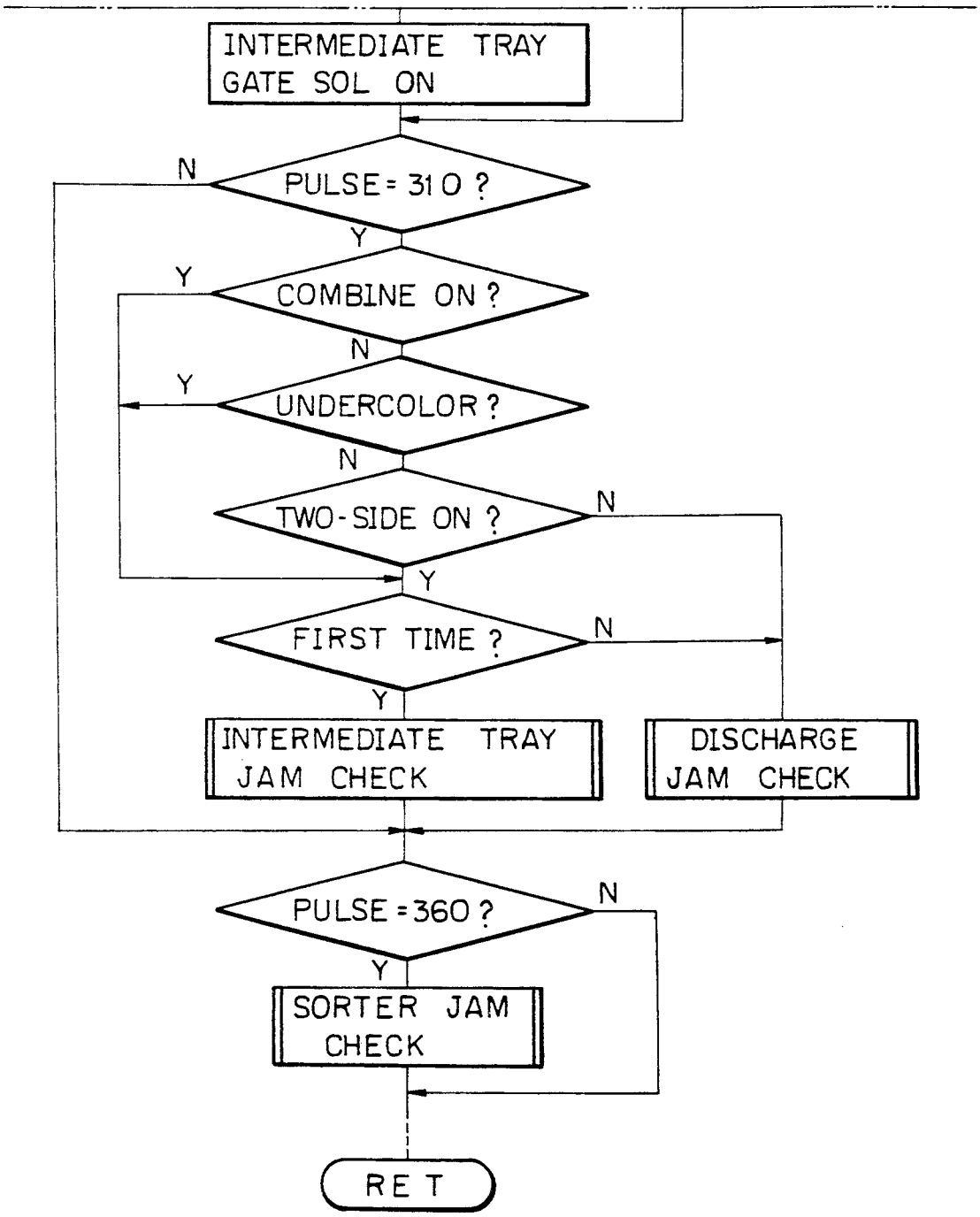

FIGS. 15A and 15D show, respectively, sequence control processing 1 and 2 which are included in the copy processing. In the sequence control processing 1 (C-2-1), when ten sequence pulses are produced, the lamp is turned ON. When forty sequence pulses are produced, the optical system is started. In this instance, the control is performed by counting signals (sequence pulses) generated by a pulse generator which is interlocked with a drive motor. When the optical system becomes ON, a scanner start signal is fed to the optical system. As the count of pulses reaches 42, a charger is turned ON. Further, as the count reaches 83, a developing bias is turned ON.

In the sequence control processing 2 (C-2-4), when the count of register pulses (started to appear in C-2-3) reaches 30, a transfer charger is turned ON; when it reaches 45, separation jam check is performed; when it reaches 210, fixing jam check is executed; and when it reachs 240, the intermediate tray gate SOL is turned ON only if the combine mode and the undercolor are ON or if the two-side mode is ON and if each of them is that of the first time. The pulses = 240 is obtainable if such a timing that the leading end of a paper reaches a position just before the intermediate tray gate pawl. Further, as the count of pulses is increased to 310, intermediate tray jam check is executed on condition that the combine mode and the undercolor mode are ON or the two-side mode is ON, and that each of them is that of the first time; when the one-side mode is ON, discharge jam check is executed. As the count of pulses reaches 360, sorter jam jet is performed.

Figure 14:
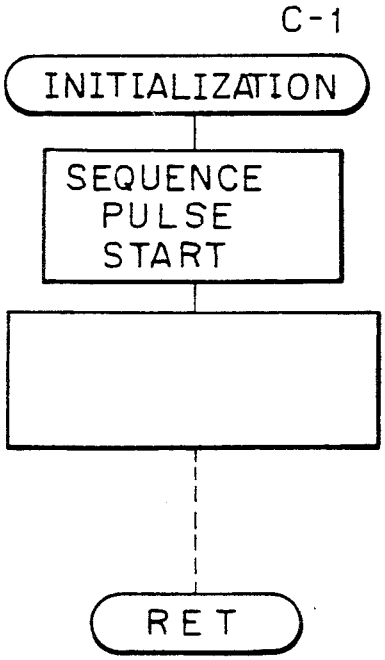
FIG. 14 is a flowchart showing initialization.

FIGS. 14 and 15 demonstrate, respectively, an initialize procedure (C-1) and a repeat procedure (C-2) which are included in the copy processing. In the initialize procedure, sequence pulses are produced to advance the sequence. In the repeat sequence, on the other hand, there are executed sequence control processing (C-2-1), erase control processing (C-2-2), register clutch control processing (C-2-3), sequence control processing 2 (C-2-4), intermediate tray control processing (C-2-5), sensor check (C-2-6), register sensor check (B-2-4). shift counter set (B-2-5), copy start check (B-2-6), etc.

Figure 15E:
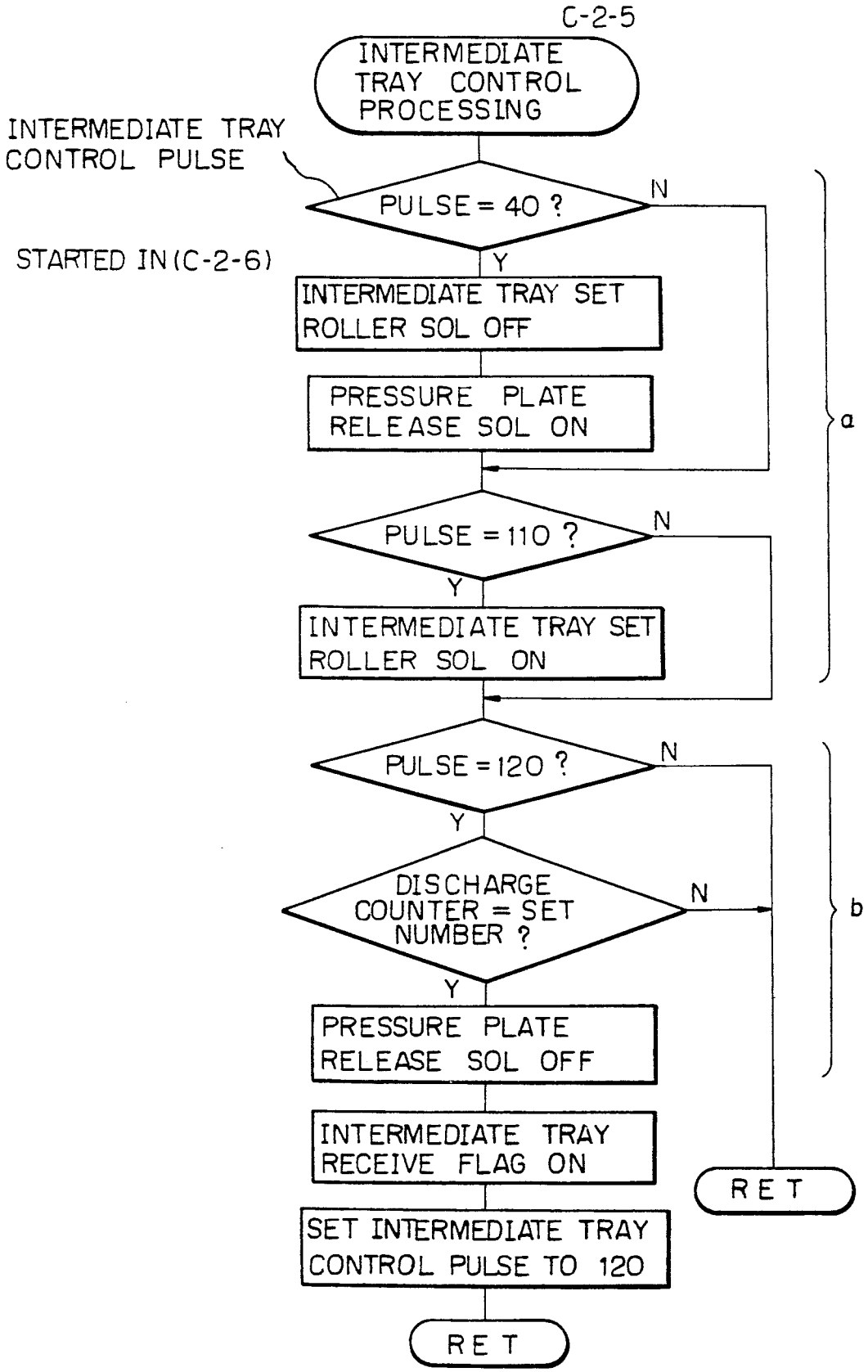
FIG. 15E is a flowchart showing intermediate tray control processing.
Figure 15F:
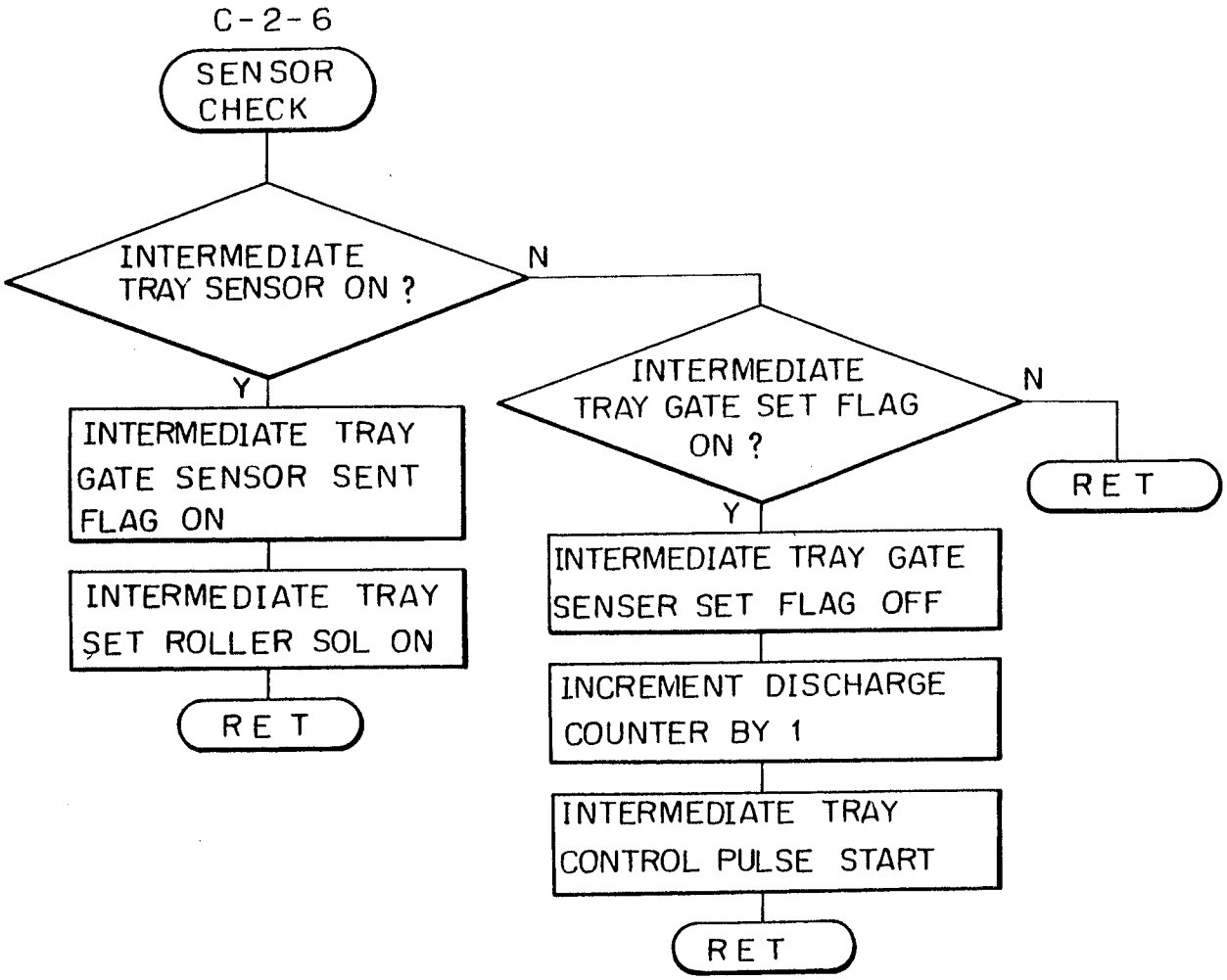
FIG. 15F is a flowchart showing sensor check.

FIG. 15F shows the sensor check (C-2-6) mentioned above. In this procedure, after intermediate tray sensor ON has been confirmed, an intermediate tray gate sensor set flag is set and, then, an intermediate tray set roller SOL is turned ON. If the intermediate tray sensor is not ON, whether or not an intermediate tray gate set flag is ON is decided and, if it ON, the intermediate tray gate sensor set flag is cleared, the discharge counter is incremented by 1, and then an intermediate tray control pulse is started to appear.

FIG. 15E shows the intermediate tray control procedure (C-2-5) included in the repeat processing. The former half of the procedure corresponds to C-2-5-a and the latter half, to C-2-5-b. Whether or not the number of intermediate tray control pulses C-2-6 as started in C-2-6 has reached 40 is decided and, if it has reached 40, the intermediate tray set roller SOL is turned OFF and, instead, a presser plate release SOL is turned ON (the set rollers are lifted at the instant when a paper is received in the tray). Then, as the count of pulses reachs 120, whether the discharge counter has reached the set number of copies is determined (if the paper is the last copy, the presser plate is pressed thereagainst so as to prepare for the next copying). If the number of pulses is equal to the set number of copies, the presser plate release SOL is turned OFF and, instead an intermediate tray receive flag is turned ON, and then the intermediate tray control pulse is set to 120.

Figures 8, 8E, 9, 10, 11:
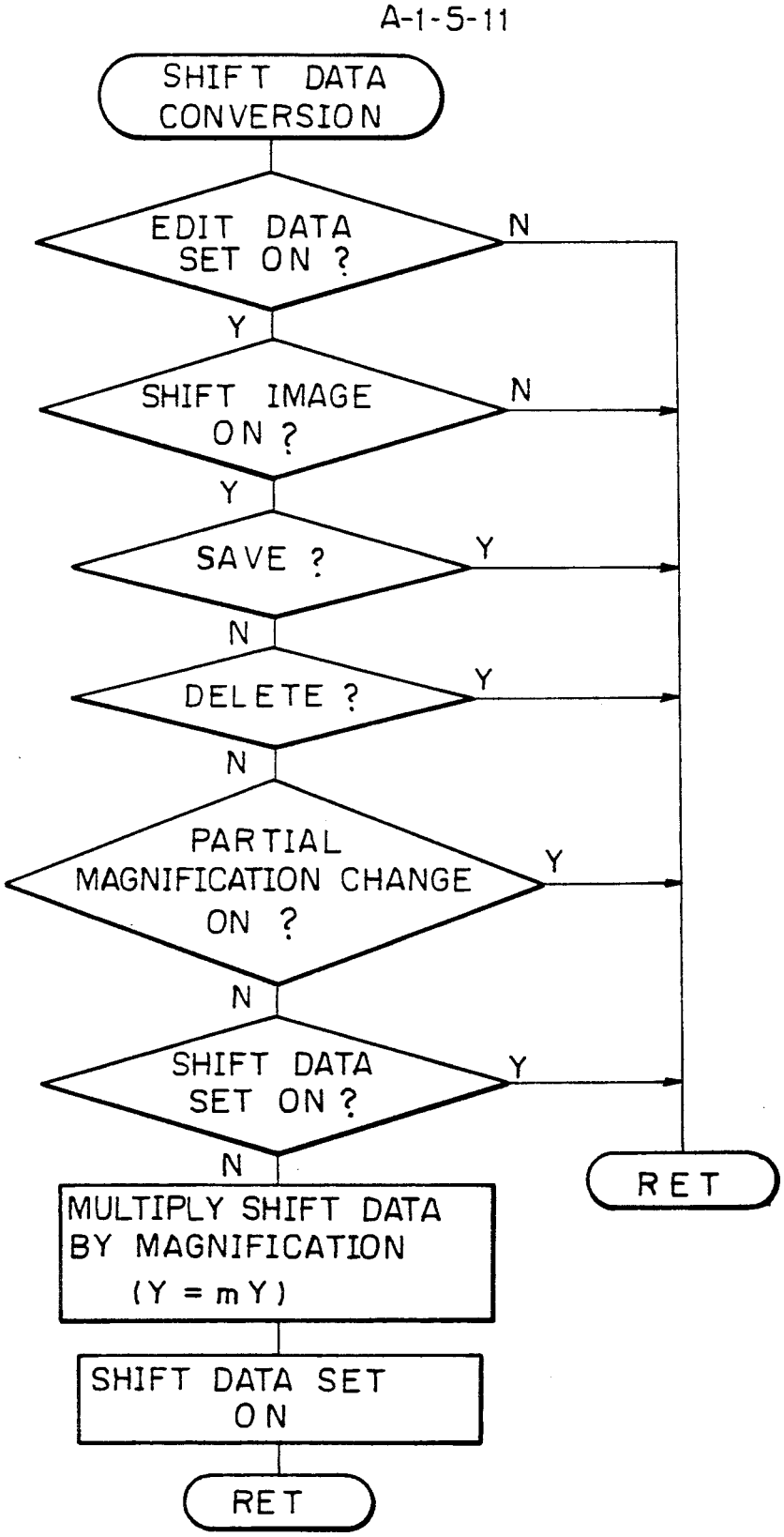

FIGS. 11 and 12 demonstrate, respectively, the print ON initialization (B-1) and pre-copy operation processing (B-2) which are included in the pre-copy processing. In the print ON initialization, the main motor is turned ON, the in-copy flag is set, the copy counter is cleared, the pulse counter is cleared, the READY display is turned off, a pump motor is turned on, and a pump timer is cleared. Thereafter, in the case of ADF mode, ADF feed is turned ON, then feed pulse ON is started, and then feed pulse start is set up. In the pre-copy operation processing, after developer buildup processing (B-2-1), paper feed processing (B-2-2), copy start check (B-2-3), register sensor check (B-2-4), shifter counter setting (B-2-5), and copy start check 2 (B-2-6), the end of pre-copy operation is decided on condition that the ADF document setting has been completed, that the developer has fully built up, and that the copy start flag has been set.

FIGS. 12A and 12B show, respectively, the developer buildup processing (B-2-1) and the paper feed processing (B-2-2) which are included in the pre-copy operation processing. In the developer buildup processing, that the pump timer is loaded with more than 2 seconds is confirmed and, then, the buildup of developer is finished. Executed in the paper feed processing are paper feed control (B-2-2-1), combine sensor check (B-2-2-2), and combine paper feed control (B-2-2-3).

FIGS. 12B-1-1 and 12B-1-2 show, respectively, paper feed/transport clutch ON procedure (B-2-2-1-1) and a combine gate SOL ON procedure (B-2-2-1-2) which are included in the paper feed control. In the case of the second copying of the combine/undercolor mode operation or that of the continuous print mode operation or the rear copying of the two-side copy mode operation, an intermediate tray clutch and a plane transport clutch is coupled. If papers are to be fed from an upper cassette, an upper cassette feed clutch is coupled and, if they are not to fed from it, a lower cassette feed clutch is coupled. In this manner, particular clutches are turned on for a desired mode. Finally, the transport clutch of the body is coupled. In the combine gate SOL ON procedure, in the case of the second copying of the combine/undercolor mode operation, the combine gate SOL is turned ON.

FIGS. 12B-2 and 12B-3 demonstrate, respectively, the combine sensor check (B-2-2-2) and the combine paper feed control (B-2-2-3) which are included in the paper feed control. In the combine sensor check, when a combine sensor is ON, a combine sensor set flag is set and a combine tray set roller SOL is turned ON. If the combine sensor set flat is set while the combine sensor is OFF, the combine sensor set flag is cleared to start a combine feed control pulse. In the combine paper feed control, as the number of pulses reaches 10, the combine tray sensor roller SOL is turned OFF. As the number of pulses is increased to 30, the combine tray set roller SOL is turned OFF. Further, as the number of pulses reaches 110, the copy start flag 1 is set.

FIG. 13B-1 is a flowchart demonstrating the paper feed control (B-2-2-1) included in the paper feed processing. When the number of paper feed pulses is zero, the paper feed/transport clutch is coupled (B-2-2-1-1). As the number of pulses reaches 40, counters (total counter, rental counter, paper feed counter, etc.) are incremented by 1 each. Upon the increase of the number of pulses to 50, the paper feed clutch is uncoupled. As the number of pulses reaches 55, the combine gate SOL is turned ON (B-2-2-1-2) (i.e. the gate SOL is turned on at a timing when the leading end of a paper reaches a position just before the combine tray gate pawl). When the number of pulses reaches 60, if papers are fed from the upper cassette, the copy start flag 1 is set. When the number of pulses reaches 67, if papers are fed from the lower cassette, the copy start flag 2 is set. Upon the increase of the number of pulses to 320, if an image is to be reproduced on the rear surface of a paper, the copy start flag 1 is set; as the pulse number exceeds 500, the pulse counter is set to 500.

The procedure described so far pertains to the combine mode.

A program combine mode which is related to this embodiment will be described in detail.

Program Combine Mode

In this mode operation, the first copy mode and the second copy mode are programmed beforehand in the combine mode or the undercolor mode. After the last mode has been set, the first mode is set and, then, the first copying is effected in response to print ON. Upon completion of the first copying, the second mode is automatically set up and, in response to print ON, the second copying is performed.

Mode Setting (a) Since the trim mode or the shift mode is set after the combine mode or the undercolor mode has been set, the program mode is set up (A-1-3, A-1-4).

(b) While in the program mode only the indicators are changed in the event of magnification change and color selection, actual movement of the lens and various operations for color changeover such as the supply of a color developer, changeover of a nozzle and cleaning of the developing section are not performed (A-1-1-3, example of magnification change).

(c) When the enter key is depressed after trim mode data or shift mode data has been set, the program advances to the second mode setting so as to specify the second mode (A-1-5-3).

(d) The indicators turned on first are turned off and, instead, the indicators for the second mode are turned on.

(e) When the enter key is depressed after the second mode and data setting, the data set end flag is set to finish data setting (A-1-5-3).

(f) When the data set end flag is set as stated above, the first mode setting is executed (A-1-6).

As shown in FIG. 8C, (A-1-3) has program mode set processing which is included in trim mode set processing. Specifically, when combination or under color is ON and ON for the first time, the program mode becomes ON; upon the second ON, the recall flag is reset.

As shown in FIG. 4D, (4-1-4) is such that when image shift is ON, the same flow as the one shown in FIG. 8C is inserted to set up the program mode.

As shown in FIG. 8E-3, (A-1-5-3) shows enter key processing. Specifically, when the program mode is ON and ON for the first time, first time is made OFF while, at the same time, second time is made ON, whereafter the second mode data area is designated. On the other hand, if the ON is the second ON, first time is turned ON and second time is turned OFF, followed by cancelling the designation of the second mode area.

Figures 1, 8F:
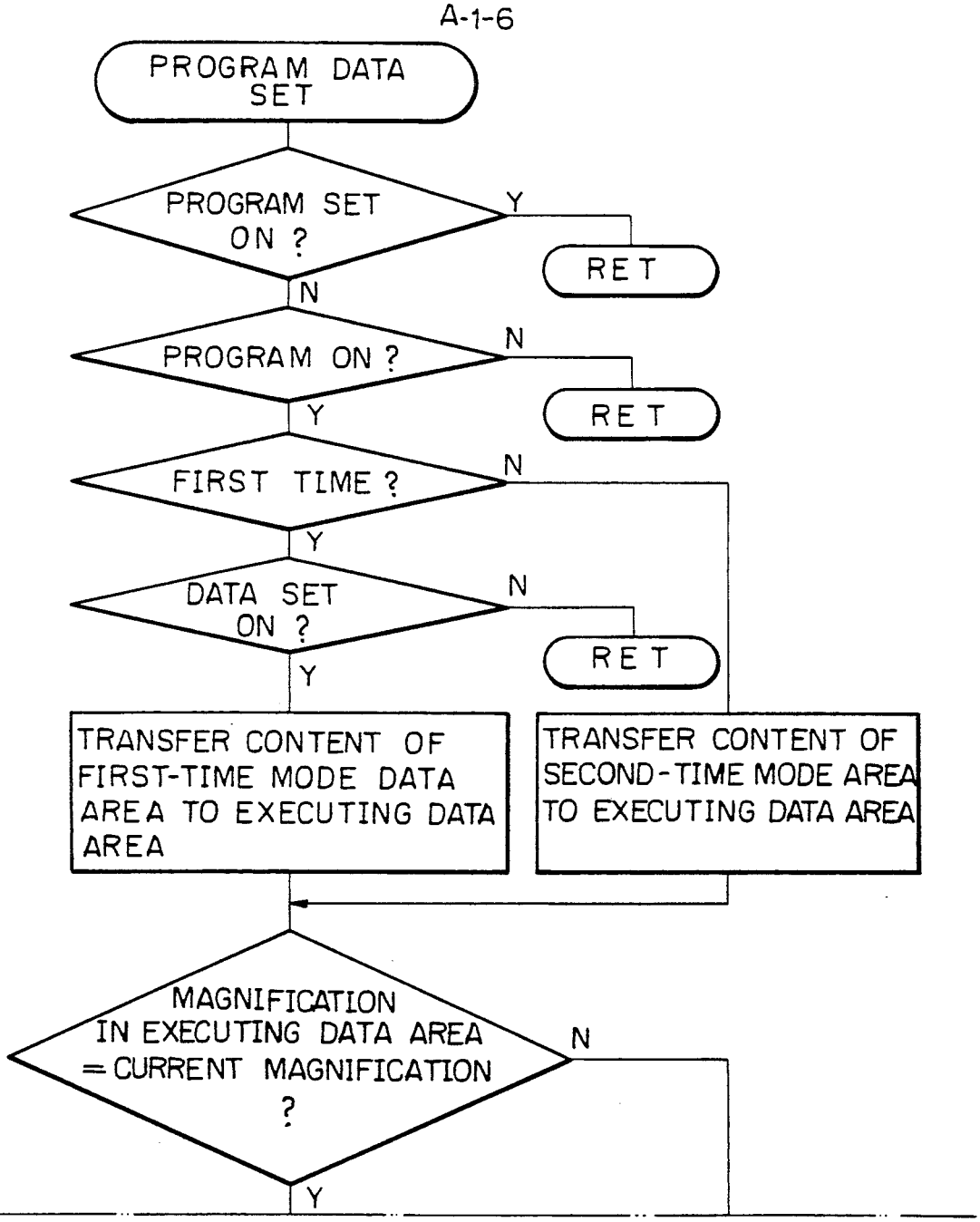
FIG. 8F is a flowchart showing program set.
Figures 2, 8F:
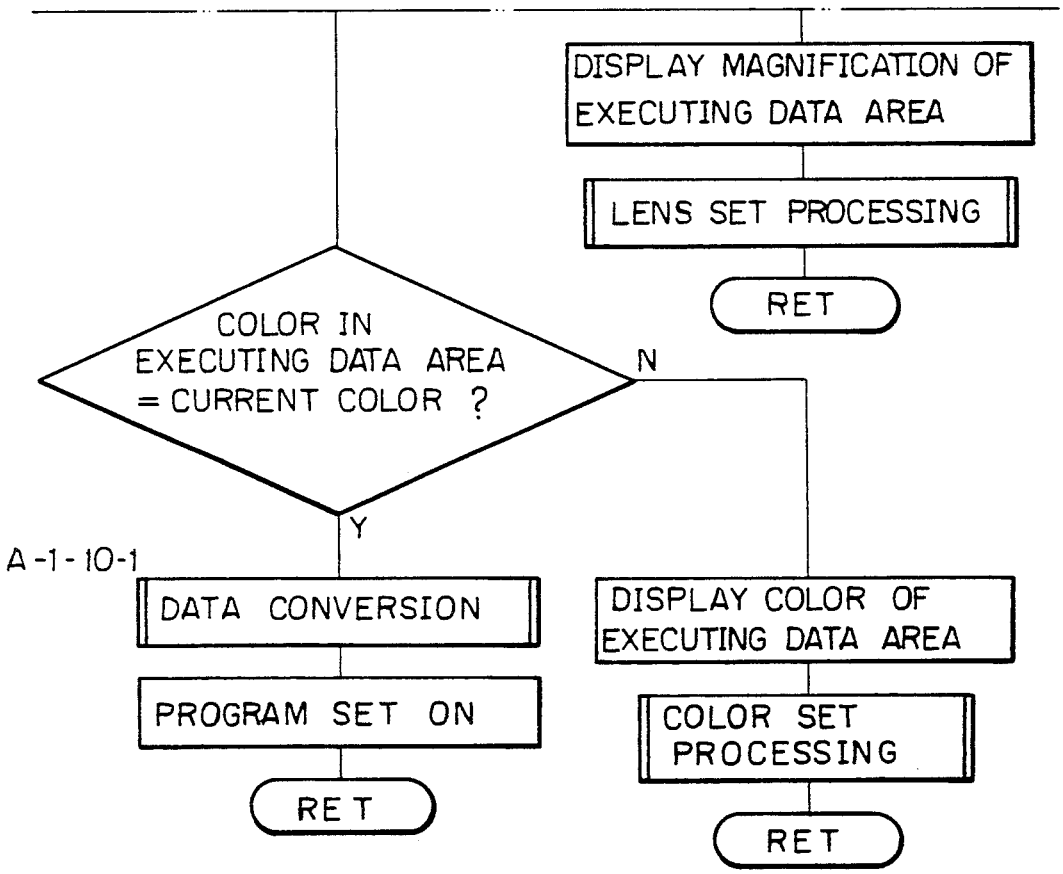

FIG. 8F shows a processing flowchart for program data setting (A-1-6). In the program mode, contents programmed beforehand are read out so that processing for setting up that mode is performed. The routine shown in FIG. 8F is executed for the first time at a time when the last mode is set (i.e. when the data set flag is set). Specifically, when the program mode is not ON, program ON is set up. If it is the first time and data set ON is set up, the content stored in the mode data area of the first time is transferred to an executing area. If it is the second time, the content stored in the second time mode data area is transferred to the executing area. If the magnification in the executing area is the current magnification and the color in the same area is the current color, program set ON is set up. If the magnification in the executing area is different from the current one, it is displayed while, at the same time, lens set processing is performed. If the color in the executing area is different from the current color, it is displayed while, at the same time, color set processing is performed.

Copying Operation (a) The procedure from print ON to the end of the first copying is the same as the previously stated combining procedure.

(b) In the copy end processing, when papers are fully received in the intermediate tray as determined by the copy end check 1 (D-3), the program set flag is cleared.

(c) Subsequently, program data setting (A-1-6) is executed in end operation processing (D-2) to perform the second data setting to thereby prepare for the second copying.

Figure 16:
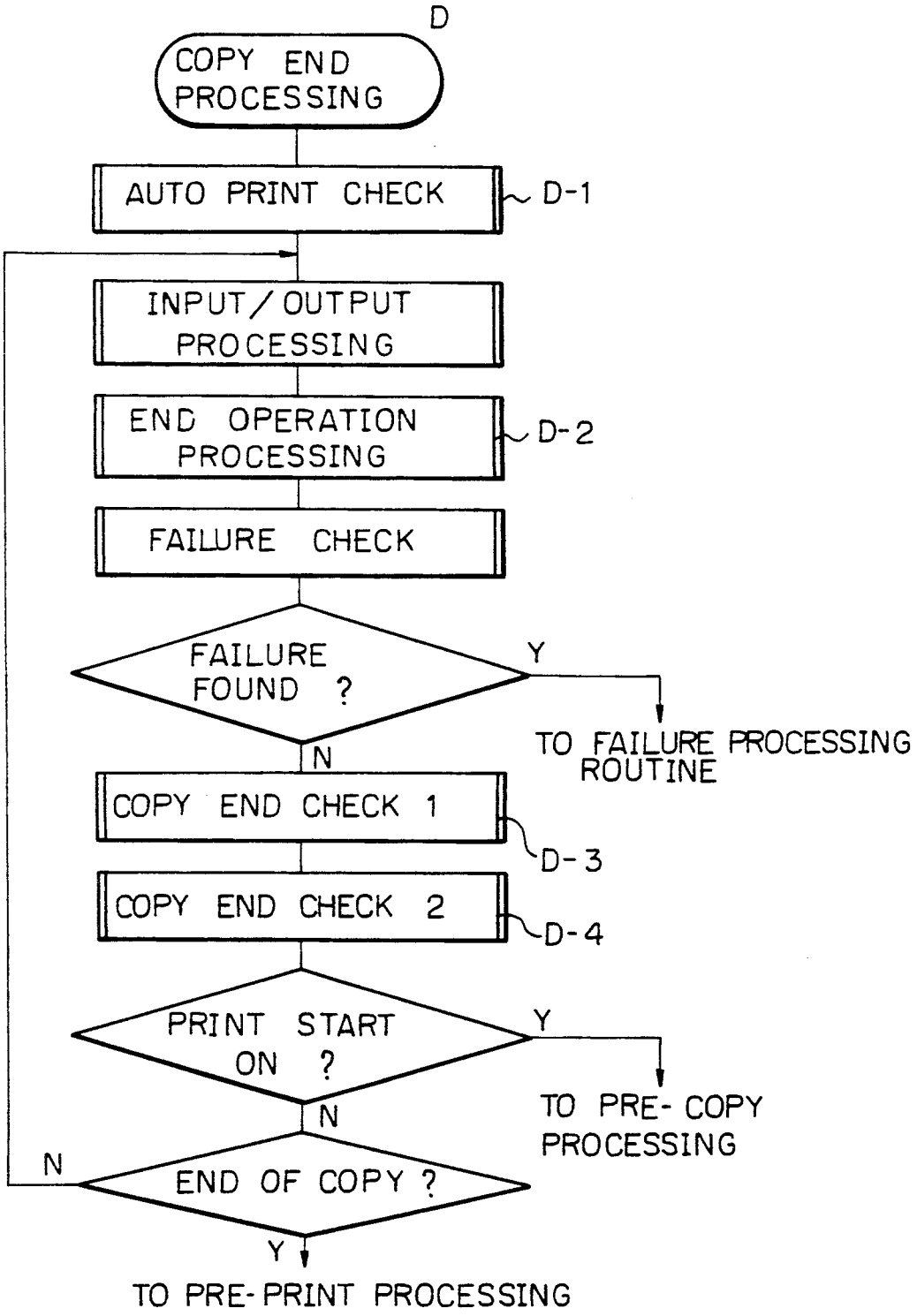
FIG. 16 is a flowchart showing copy end processing.
Figure 18:
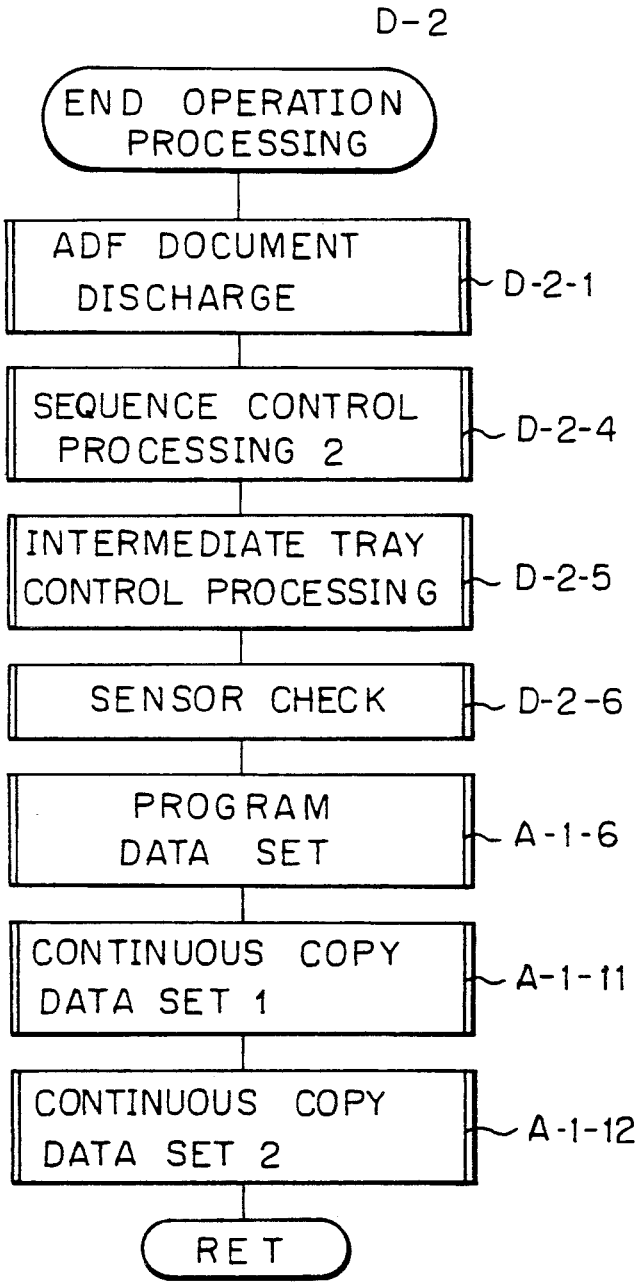
FIG. 18 is a flowchart showing end operation processing.
Figure 18A:
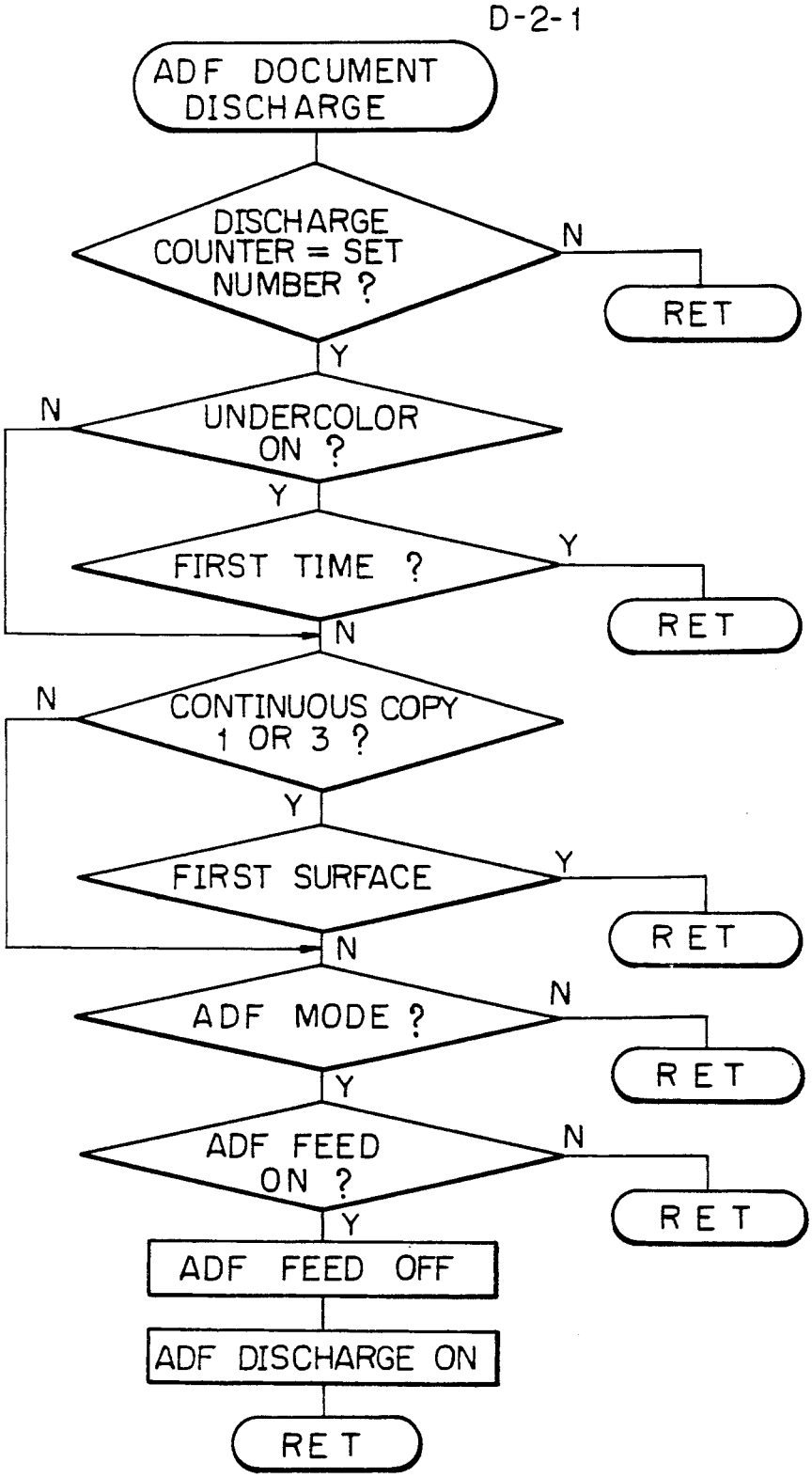
FIG. 18A is a flowchart showing ADF discharge processing.

(d) After the second copying operation has been performed in the same manner, the mode is restored to the first one. This completes all the copying steps. FIGS. 16, 18 and 18A show, respectively, the copy end processing (D), end operation processing (D-2) included in the processing (D), and ADF document discharge processing (D-2-1).

In the copy end processing of FIG. 16, auto print check (D-1), input/output processing, end operation processing (D-2), and failure check are performed. If any failure is found, the program is transferred to the failure processing routine (D-3). If no failure is found, copy end check 1 (D-3) and copy end check (D-4) are performed. If print start ON is set up, the program advances to the pre-copy processing routine. When print start ON is not set up, the program returns to the previous step if copying has been ended or advances to the pre-print processing if copying has not been ended.

In the end operation processing of FIG. 18, there are performed ADF document discharge (D-2-1), sequence control processing 2 (C-2-4), intermediate tray control processing (C-2-5), sensor check (C-2-6), and program data setting (A-1-6).

In the ADF document discharge (D-2-1) of FIG. 18A, if a set number of copies is loaded in the discharge counter, ADF discharge is made ON at the time of first copying under an undercolor ON condition, at the time of second copying under a continuous copy 1 and 3 condition, and after ADF feed OFF under and ADF mode ON and ADF feed ON condition.

Figures 19, 19A:
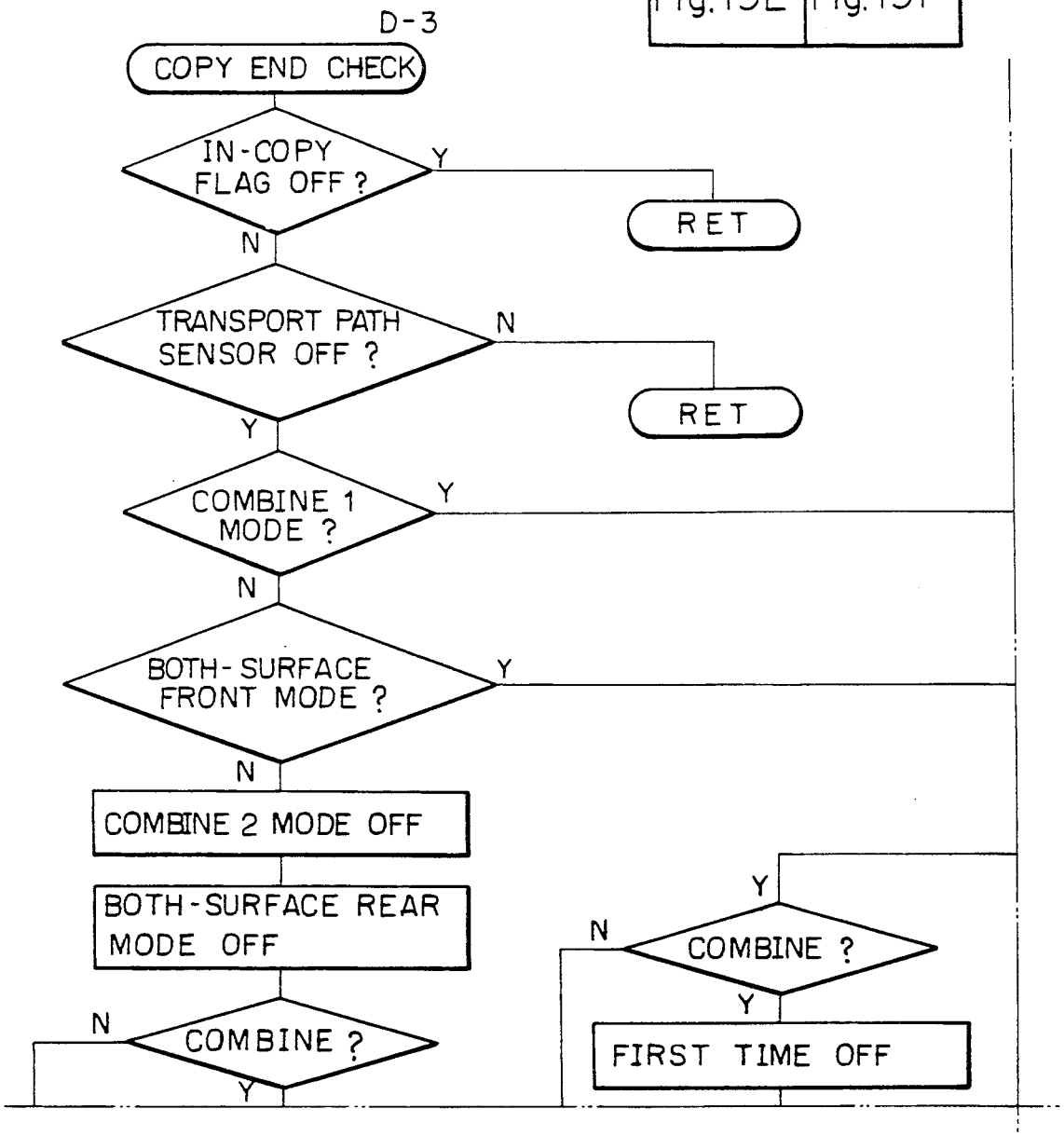
FIG. 19 is a flowchart showing copy end check 1.
Figure 19B:
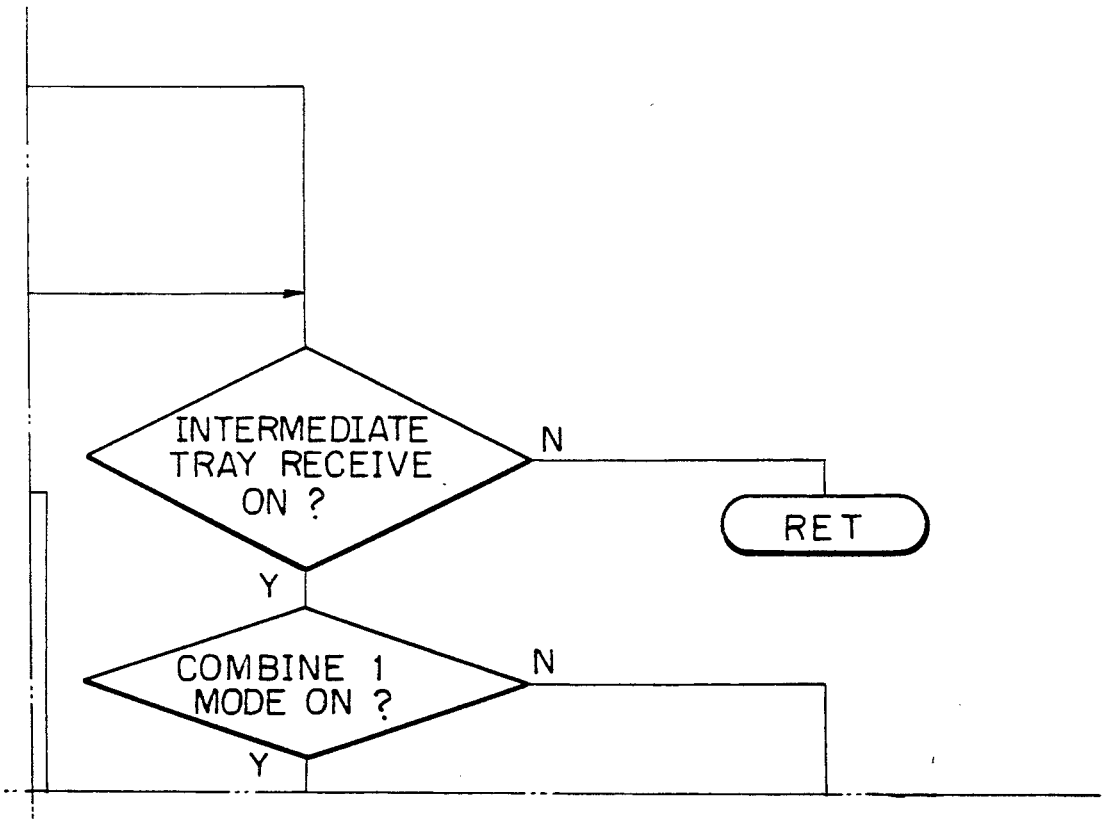
Figure 19C:
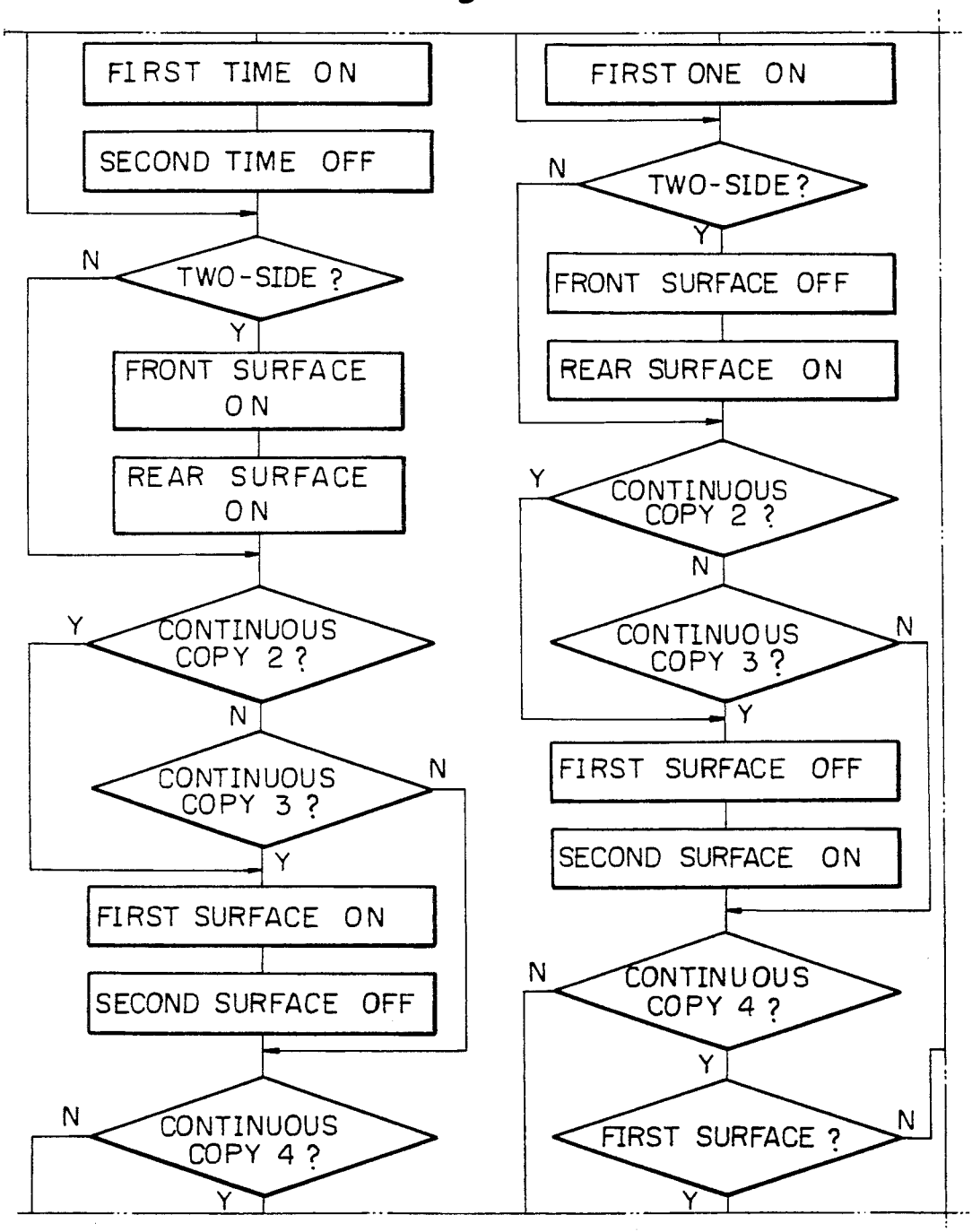
Figure 19D:
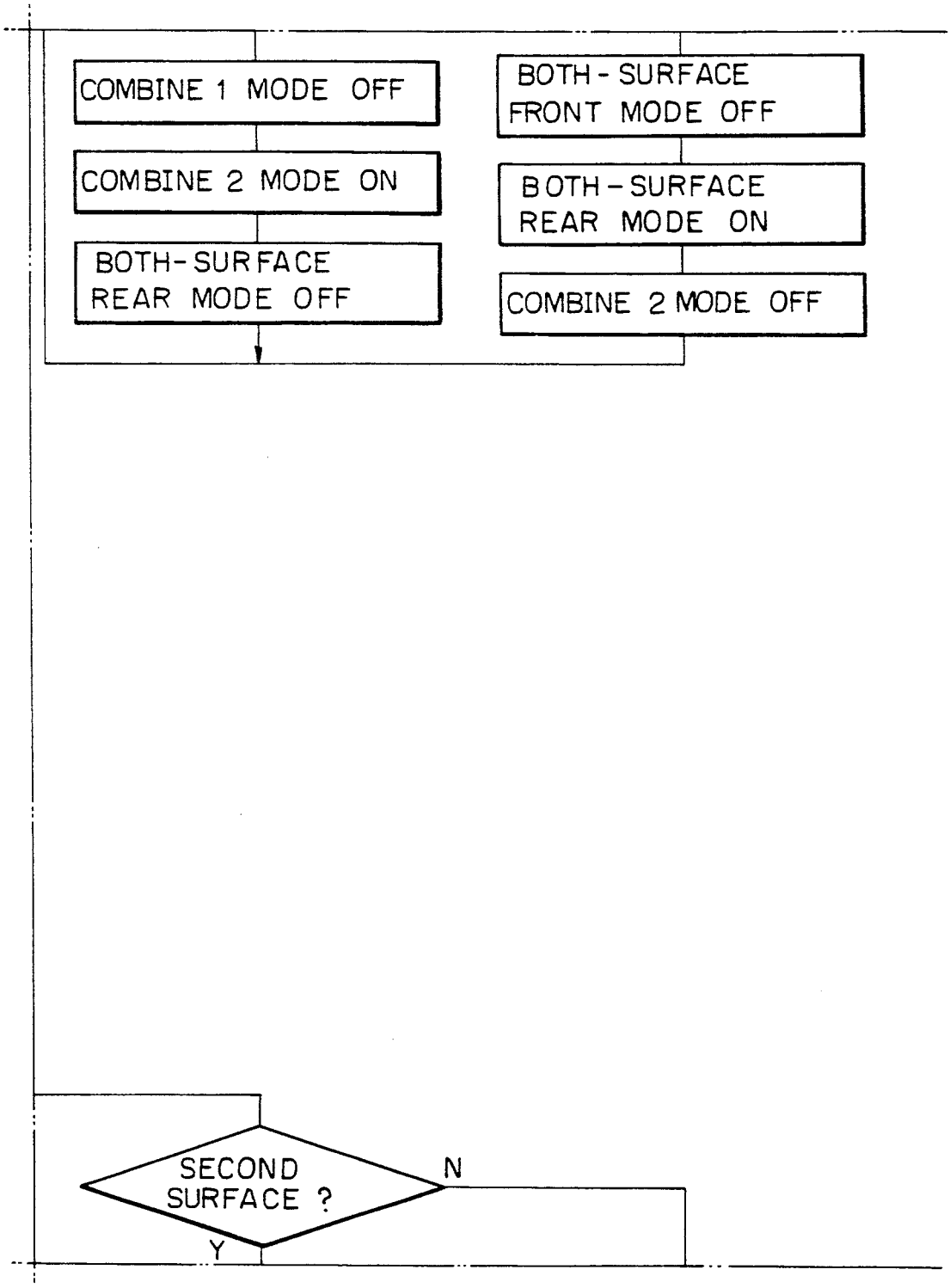
Figure 19E:
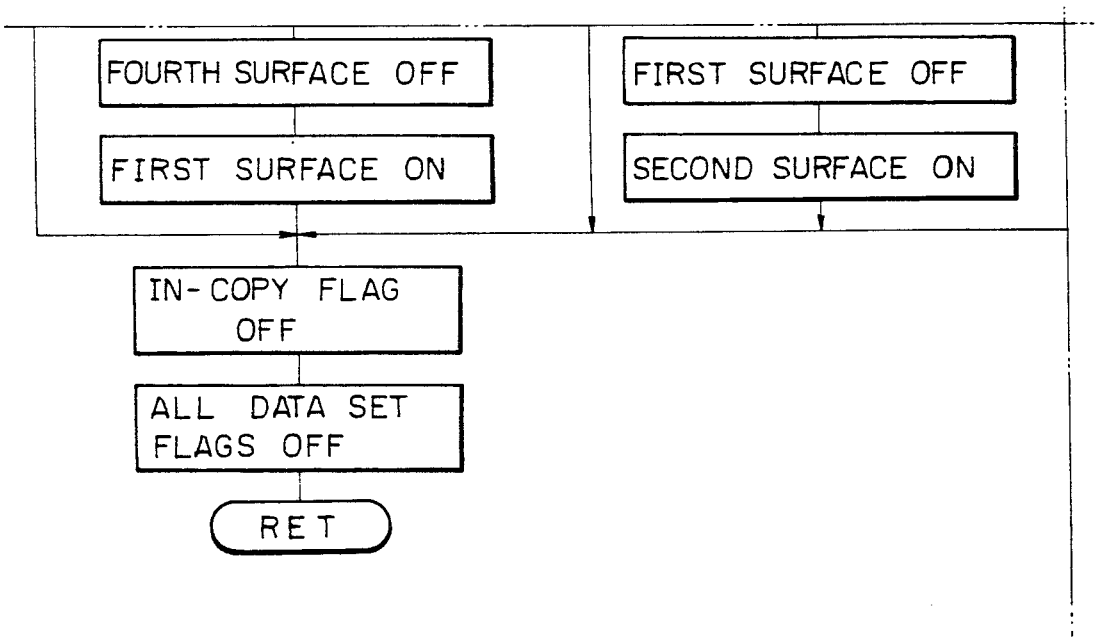
Figure 19F:
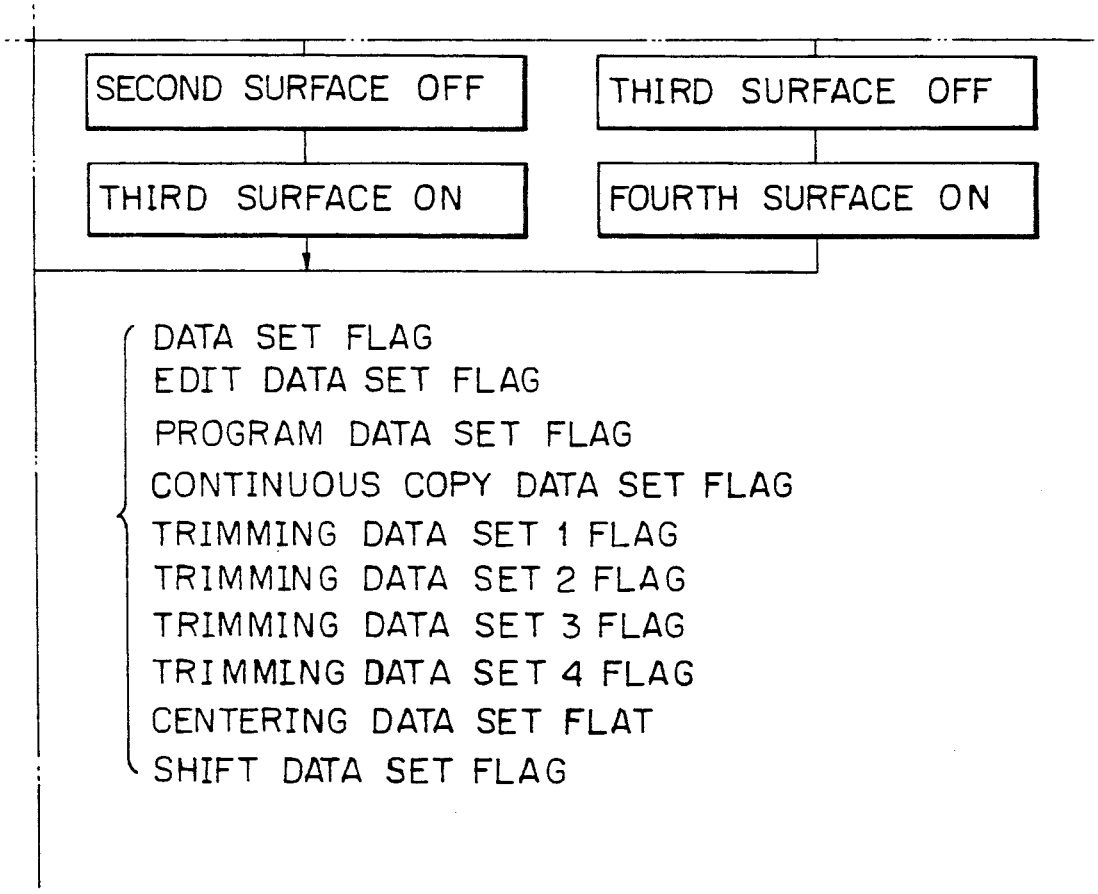

FIG. 19 shows the copy end check 1 (D-3) included in the copy end processing. On condition that the in-copy flag is ON, that all the transport path sensors are OFF, and that the first copying under the combine mode or the undercolor mode is finished or the front surface is finished under the two-side copy mode, front surface is turned OFF and rear surface ON under a two-side tray flag ON condition. When only the front surface is finished, first copying is made OFF and second copying ON. Further, when the first copying is not finished, second copying is made OFF and first copying ON; when only the front surface is finished, rear surface is made OFF and front surface ON. Subsequently, the in-copy flag is cleared and, then, program set is turned OFF.

Figure 20A:
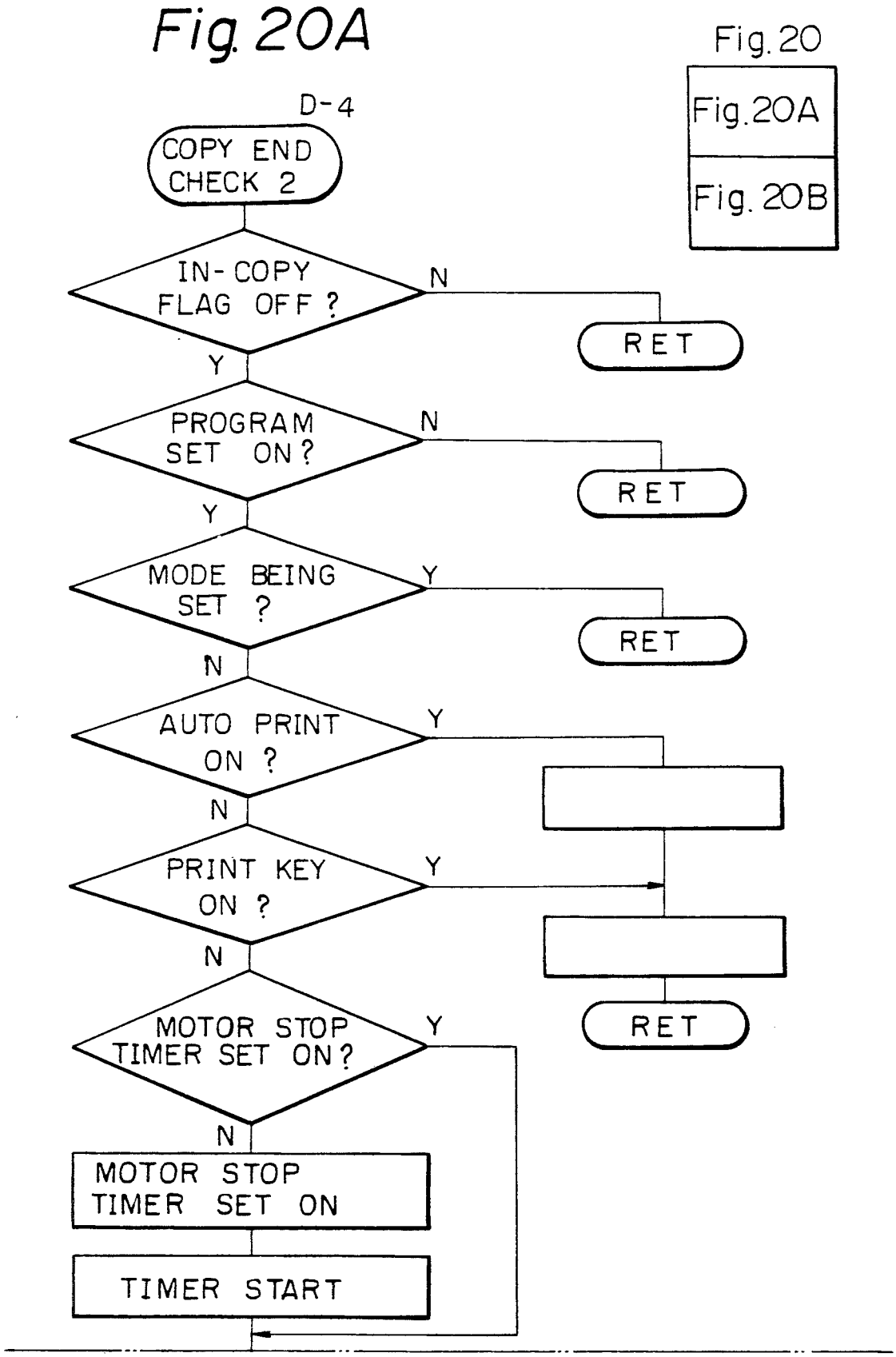
FIG. 20 is a flowchart showing copy end check 2.
Figure 20B:
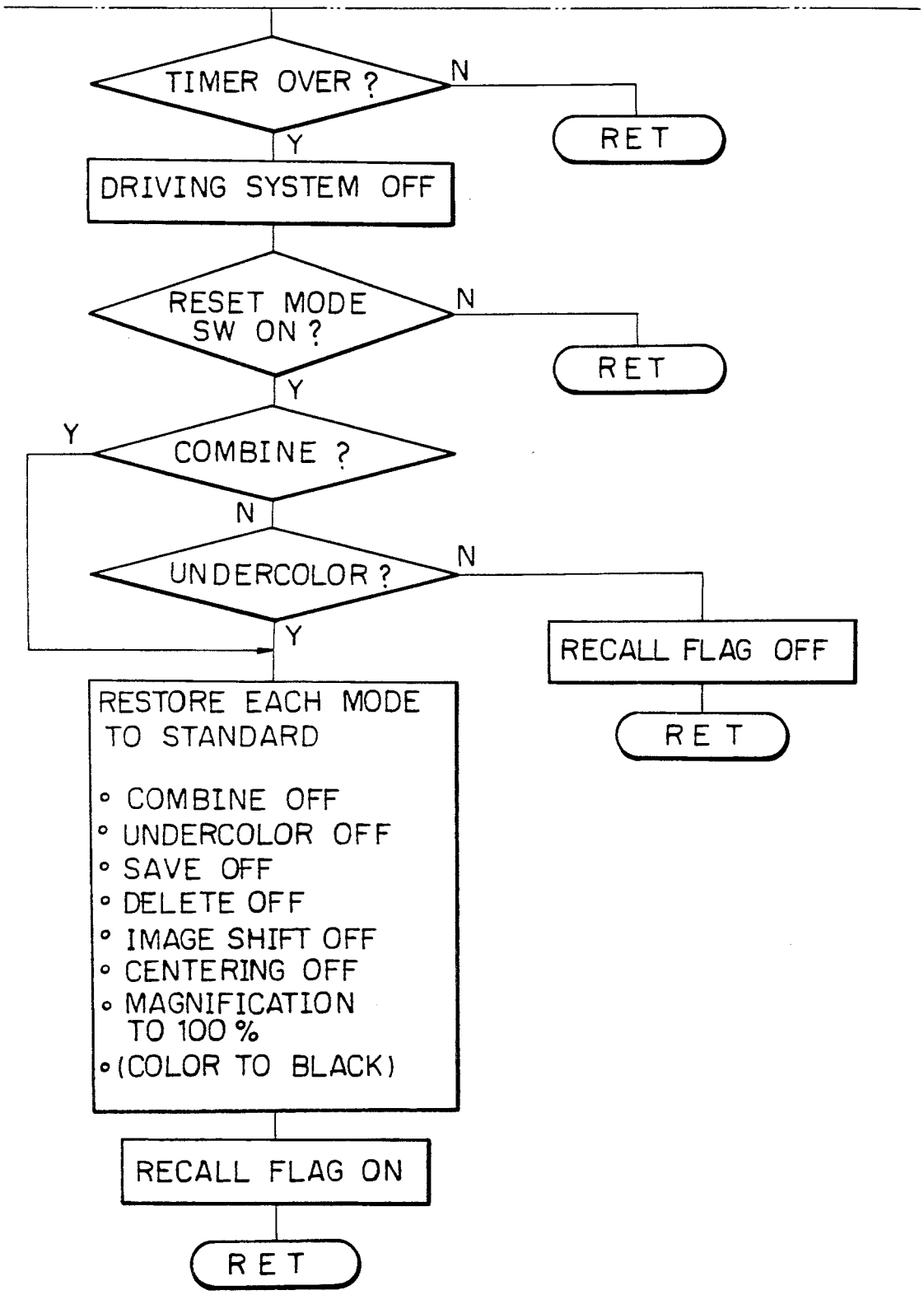

FIG. 20 shows the copy end check 2 (D-4) included in the copy end processing. A motor stop timer set ON condition is set up to start a motor stop timer on condition that the in-copy flag is cleared, that program set is ON, that no mode is set (magnification, color and other mode set flags are cleared), that auto print is not ON, that print key is not ON, and that motor stop timer set is not ON. If timer set is ON, the drive system is turned OFF when the timer is over. When the reset mode switch is ON and either the combine mode or the undercolor mode is selected, each mode is restored to standard.

Figure 17:
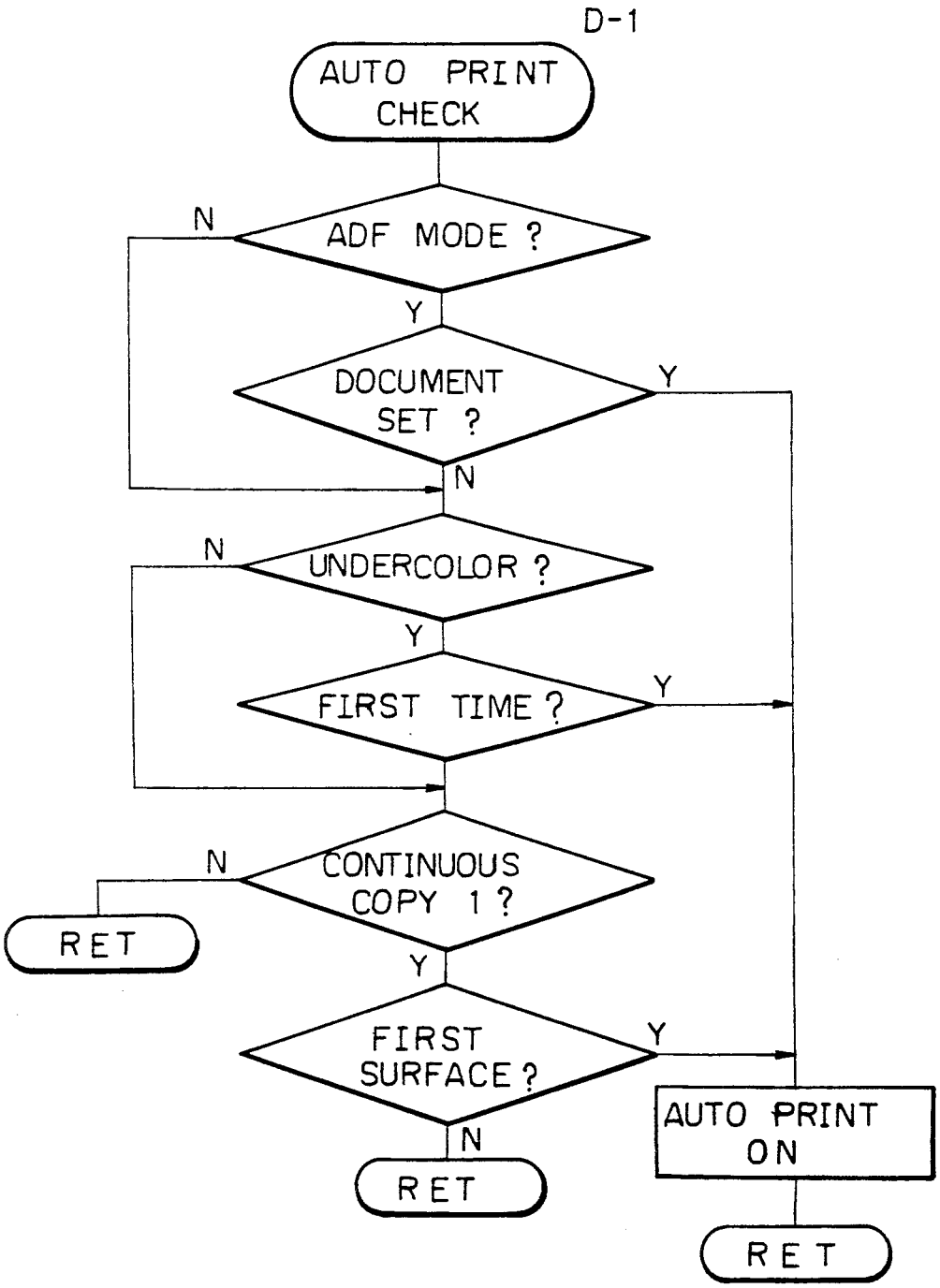
FIG. 17 is a flowchart showing auto print check.

FIG. 17 shows the auto print check (D-1) included in the copy end processing. If the ADF mode is selected and documents are loaded, auto print is made ON. When no document is loaded, the auto print ON condition is set up even at the first copying in the undercolor mode. Also, the auto print ON condition is set up even for the first surface of the continuous copy 1.

Figure 8G:
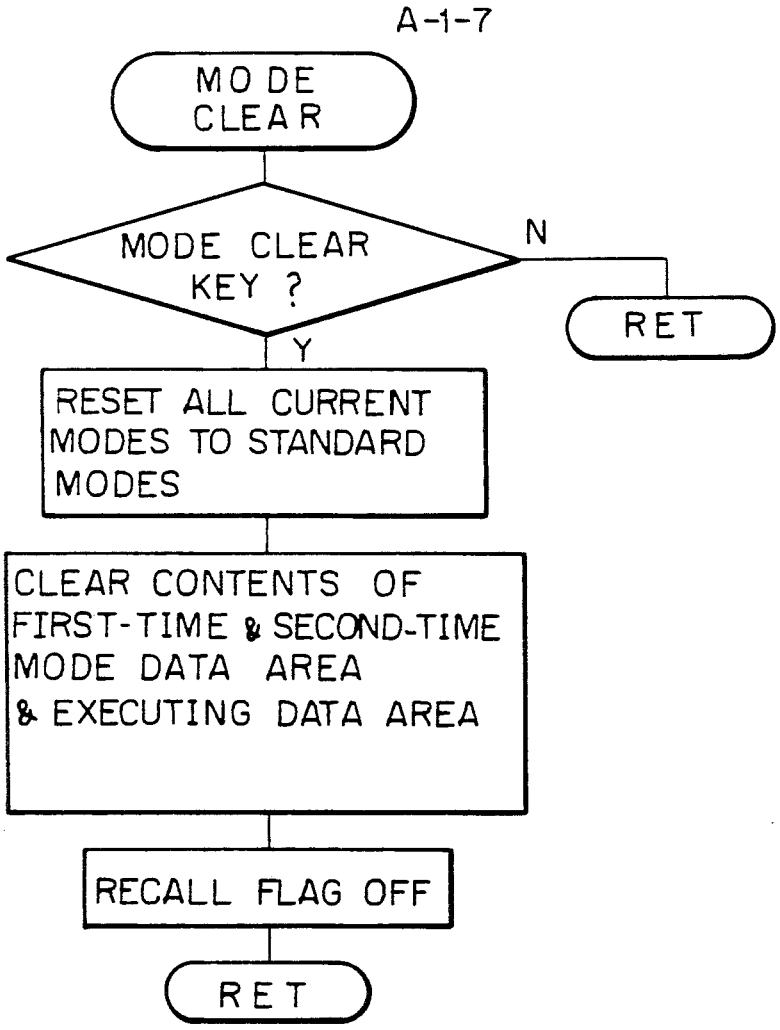
FIG. 8G is a flowchart showing mode clear.
Figure 8H:
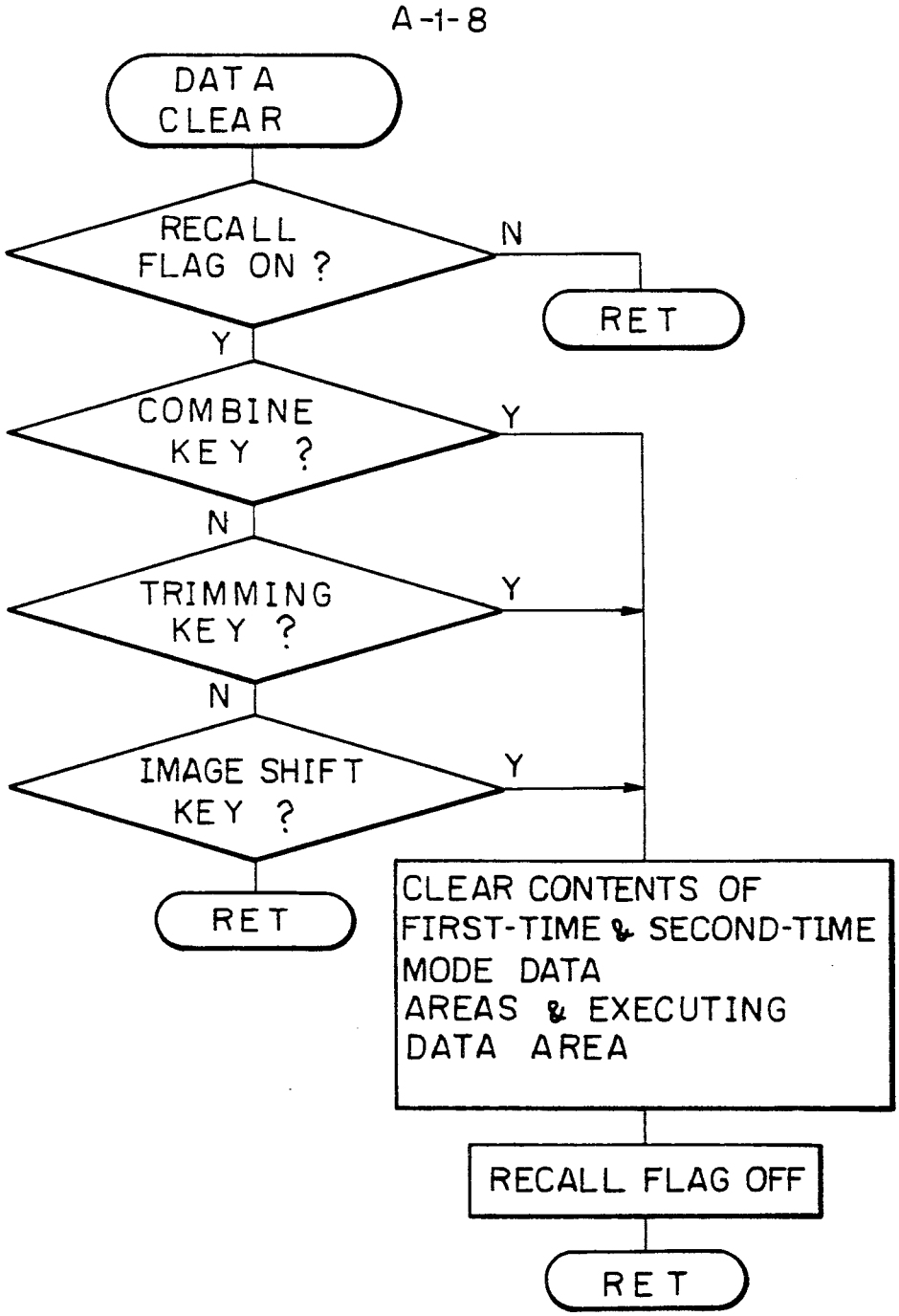
FIG. 8H is a flowchart showing data clear.

The mode set processing (A-1) includes mode clear processing (A-1-7) and data clear processing (A-1-8) which are shown in FIGS. 8G and 8H, respectively. In the data clear processing, on condition that the recall flag is set and that all of the combine key, trim key and image shift key are ON, the contents stored in the mode data areas of the first and second times and the content stored in the executing data area are cleared. Then, the recall flag is cleared. In the mode clear processing, when the mode clear key is ON, all the current modes are reset to the standard ones and, then, the contents of the mode data areas of the first and second times as well as the content of the executing data area are cleared. This is followed by clearing the recall flag.

The mode recall in accordance with this particular embodiment is as follows.

Mode Recall (a) In the combine mode, there are two different modes which are selectable by the reset mode switch, i.e., a mode in which the previous mode is maintained after the end of copying, and a mode in which the standard mode is recovered after the end of copying.

(b) While the reset mode switch is held in its ON condition, each mode is restored to standard in the copy end check 2 (D-4).

(c) In this case, when the enter key is depressed without depressing the trim mode key and shift mode key, the first mode and data are recalled (A-1-3, A-1-4, A-1-5-3). This is effective for the correction of a fragment of data.

The partial magnification change in accordance with the present invention will be described in detail.

In the partial magnification change mode of the present invention, (i) a control in which the center of a magnification-changed image is controlled into alignment with that of a document image in terms of coordinates, and a control in which the magnification-changed image is controlled to coordinates which correspond to a magnification selected are selectively effected. Also, (ii) a control in which a magnification-changed image is controlled to move by a specified distance (absolute value), and a control in which it is moved by a distance corresponding to a magnification are selectively effected. Further, while in the controls (i) and (ii) stated above the papers are assumed to be of the same format as the documents, (iii) a control is so effected as to cause a movement to the center or by a specified distance even when a document paper is enlarged or reduced in the same manner.

The partial magnification change mode is set up in two different conditions: (a) the magnification change mode is selected under the combine mode or the undercolor mode condition, and (b) in the conditions other than the combine mode and undercolor mode conditions, the trim or the image shift mode is selected after a change of magnification. When the magnification change mode is selected after the trim or the image shift mode has been set, the usual magnification mode is preserved.

Figure 22A:
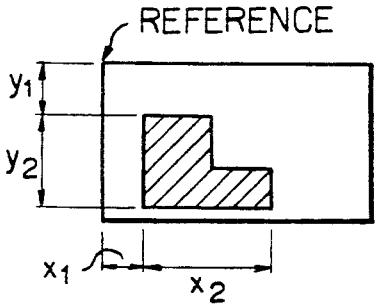
Figure 22A:
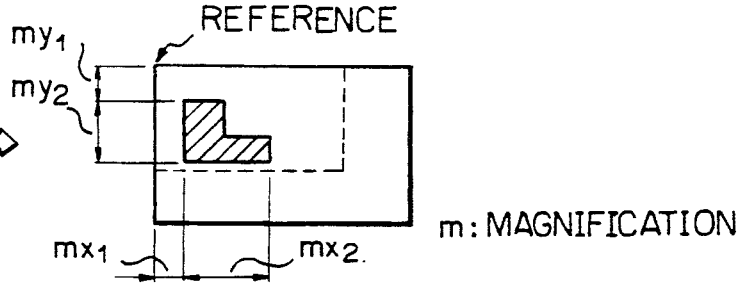
Figure 22C:
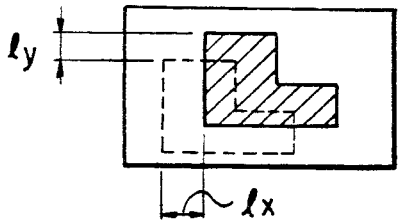
Figure 22D:
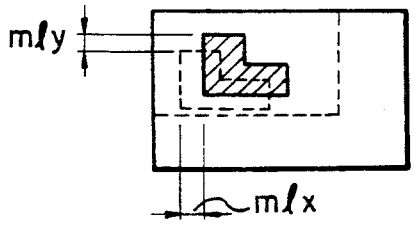

Referring to FIG. 22A, there is shown an image which is printed on a document. The image is dimensioned $y_1$ as measured from a reference point to the upper end of the image, $y_2$ as measured in the lateral direction, $x_1$ as measured from a reference point on the X axis to the leftmost end of the image, and $x_2$ along its lower end. When the magnification of such an image is changed to m, as shown in FIG. 22B, the dimensions $y_1$, $y_2$, $x_1$ and $x_2$ are changed to $my_1$, $my_2$, $mx_1$ and $mx_2$, respectively. Further, when it is desired to shift a document image shown in FIG. 22C from a dotted-line position to the center as indicated by hatching by a distance of ly in the Y direction and lx in the X direction, the magnification-changed image is unavoidably shifted by mly in the Y direction and mlx in the X direction, as shown in FIG. 22D. That is, the resulting image is not always coincident with the center coordinates.

Figure 23A:
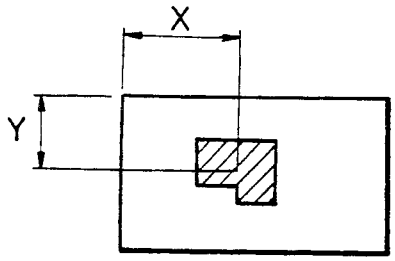
FIGS. 23A to 23D are diagrams showing an image in a partial magnification change mode in accordance with the present invention.
Figure 23B:
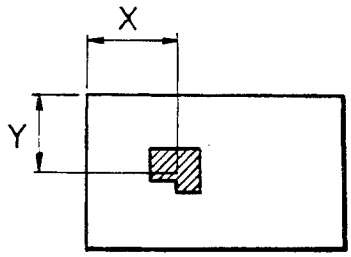
Figure 23C:
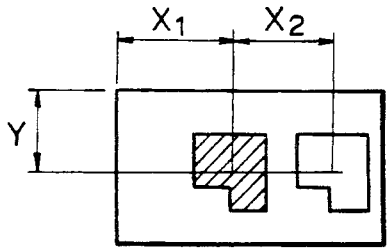
Figure 23D:
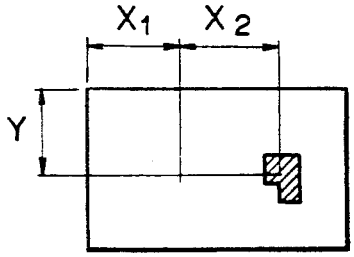

FIGS. 23A to 23D show the principle of the partial magnification change mode in accordance with the present invention. Specifically, FIGS. 23A and 23B are representative of a mode in which only the trimming area is changed in magnification with the original center coordinates of the area preserved, i.e., the distances on the Y and X axes as measured from the individual reference points are not changed although the image is reduced (corresponding to the previously mentioned control (i)). FIGS. 23C and 23D are representative of a mode in which only the trimming area is changed in magnification with the original amount of shift maintained, i.e., the previous amount of shift of $X_1+X_2$ is not changed when the image is shifted to the right by a distance $X_2$ after a change of magnification (corresponding to the control (ii)). Further, although not shown in the drawings, the control as described with reference to FIGS. 23A and 23B is applicable even to a case wherein not only an image but also a paper are subjected to magnification change.

FIG. 8E-4 demonstrates the edit data set processing (A-1-5-4). When the magnification change mode is set while the combine mode or the undercolor mode is ON, the partial magnification change mode is selected with the magnification change mode turned OFF. Even when none of the combine mode and the undercolor mode is ON, the partial magnification change mode becomes ON if the magnification change mode has previously been set under a data set ON condition, i.e., with the data set flag set. The data set flag is a flag which is set when the trim, image shift and other modes are selected and the data setting associated with such modes is completed. In short, the partical magnification mode is set up when the magnification change mode is selected after the combine or the undercolor mode has been set, and when the trim mode or the image shift mode is selected after the magnification change mode has been set and, then, data is set. So long as no data is set, the usual magnification change flag is set, and it is at this instant that a magnification set precede flag is set for the first time.

Partial Magnification Change Mode

The partial magnification change mode maintains the center of an image at the same position although changing the magnification of the image.

Mode Setting

Preconditions for the partial magnification change mode to be set up are (a) that magnification change be selected under the combine mode or the undercolor mode, and (b) that the trim mode or the shift mode be selected after a change of magnification has been set, as shown in FIG. 8E-4.

Data Conversion

Data conversion is as follows.

Figure 24A:
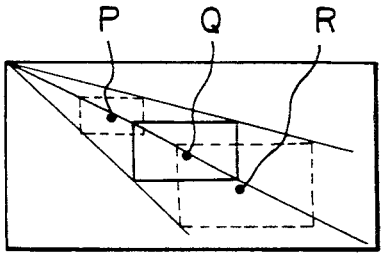
FIGS. 24A and 24B are diagrams showing how an image is shifted in a usual magnification change mode.
Figure 24B:
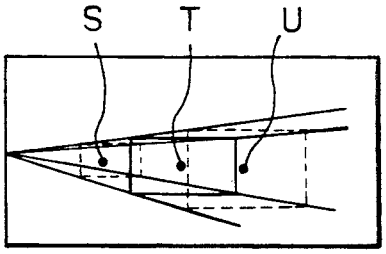
Figure 25A:
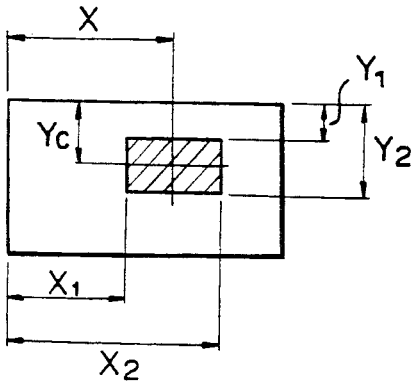
FIGS. 25A to 25C are diagrams showing data conversion which is effected in the partial magnification change mode in accordance with the present invention.
Figure 25B:
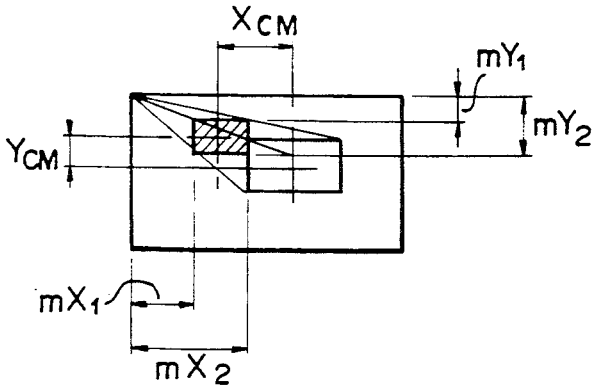
Figure 25C:
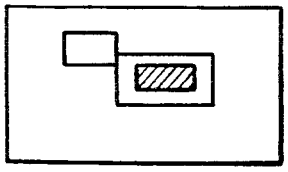

FIGS. 24A and 24B show the shift of the center in the usual magnification change mode. FIG. 32 is explanatory of data conversion for trimming in the partial magnification change mode. FIGS. 25A to 25C demonstrate data conversion for centering in the partial magnification change mode. Generally, a change of magnification causes the center of an image to be shifted with respect to a reference. As shown in FIG. 24A, in the case that the reference is defined by one side, when an image indicated by a broken line and having a center P is changed in magnification to become a hatched image, the center P is shifted to a position Q because the distance measured with the top left as a reference is changed also. When the image is enlarged as indicated by a broken line, the center is shifted to a position R. Likewise, when the reference is defined by the center, the center S shown in FIG. 24B is shifted to T and U sequentially.

The data conversion for trimming (plus shift) as shown in FIGS. 25A to 25C is as follows.

(1-1) Trimming data is multiplied by a magnification (A-1-5-8-a).

(1-2) Amounts of shift of the center of area caused by the magnification (return data in the X and Y directions) are determined (b).

(1-3) When any image shift is to occur, the shift data (return data itself if no image shift is to occur) is adjusted and set as shift data (c).

(1-4) Trimming data is increased or decreased by a fragment corresponding to the shift data by trimming data conversion (A-1-5-7), thereby completing data conversion.

Specifically, when a partial area indicated by hatching in FIG. 25A is reduced by magnification change, it appears as indicated by hatching in FIG. 25B with its distance from the reference point shifted. Hence, return data is determined as stated above in order to return the resulting image to the original position, as shown in FIG. 25C.

Data conversion for centering is effected as follows.

(2-1) Trimming data is multiplied by a magnification (A-1-5-10-a).

(2-2) A difference between the center of an area and that of a paper is determined and set in shift data (A-1-5-10-b).

(2-3) In the above condition, if no trimming data is present, a difference between the center of a document and that of a paper is set in the shift data (A-1-5-10-c).

(2-4) Such data is added to or subtracted from the trimming data to complete data conversion (A-1-5-7).

Figure 26A:
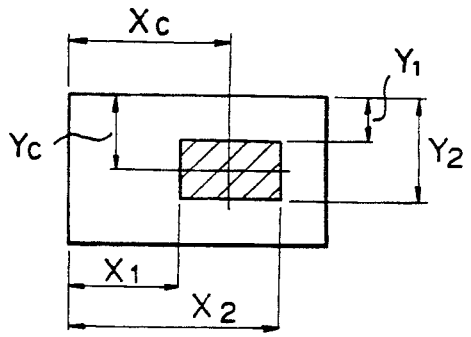
FIGS. 26A to 26C are diagrams showing data conversion for centering under the partial magnification change mode in accordance with the present invention.
Figure 26B:
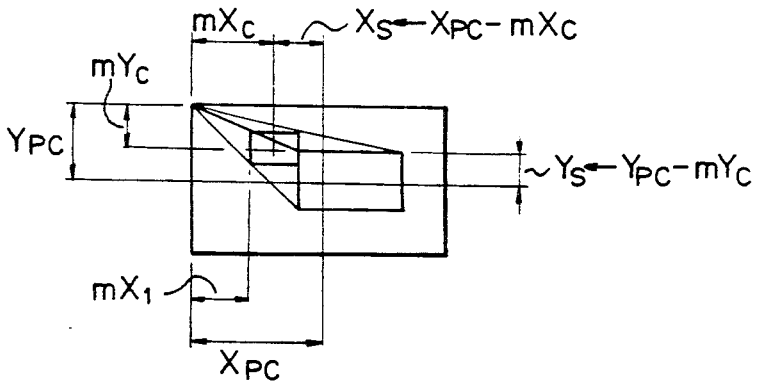
Figure 26C:
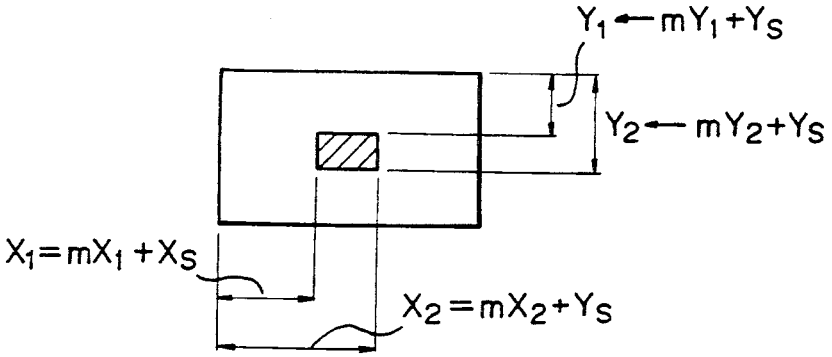

Specifically, the hatched partial area of FIG. 26A is reduced by partial magnification change, what occurs first is the shift of the distance measured from the reference, as indicated by hatching in FIG. 26B. Hence, a difference between the center of a document and that of a paper is calculated to shift the image by an amount as represented by the difference data, as shown in FIG.

26C. This successfully shifts the image to the center of a paper.

FIGS. 8A, 8A-1, 8A-2 and 8A-3 show, respectively, magnification set processing (A-1-1), magnification change setting 1 (A-1-1-1), magnification change setting 2 (A-1-1-2), and magnification change setting 3 (A-1-1-3). As shown in FIG. 8A, the magnification change set processing includes magnification change setting 1, 2 and 3. In the magnification setting 1 shown in FIG. 8A-1, a desired magnification is set up by manipulating the magnify key. Specifically, when the magnify key is continuously depressed, the magnification is sequentially changed at predetermined intervals. When the magnify key is ON, the magnification counter is incremented by 1. As the count reaches 40, a loop counter is cleared. 1 magnification corresponds to 68%, 2 magnifications corresponds to 78%, 3 magnifications corresponds to 94%, 4 magnifications corresponds to 100%, and 5 magnifications corresponds to 110%. The 5 magnifications will be followed by the 1 magnifications again. Every time the magnification is changed, a buzzer is energized. When the magnification is changed, a magnification change set 1 flag is set.

The magnification setting 2 of FIG. 18A-2 is adapted to prevent the lens from being moved while the magnify key is depressed. Specifically, when the magnify key is ON, a delay timer is maintained OFF. On condition that the magnify key is OFF, that magnification change set 1 is ON, and that delay timer set is OFF, delay timer set is made ON to load 0.5 second in a timer. As the 0.5 second expires, magnification change set 1 is made OFF and magnification change set 2 ON.

The magnification change set 3 of FIG. 8A-3 is adapted for lens move processing. On condition that magnification change set 2 is ON, that program is OFF, and that the lens position corresponds to a magnification set, magnification set 2 is made OFF. If the lens position does not correspond to the magnification, lens set processing is executed. Under the program ON condition, i.e., in the program mode, the first mode setting is performed after all the data have been programmed and, subsequently, lens move processing is performed.

FIGS. 8E-8-1 and 8E-8-2 show trimming data conversion 3 (A-1-5-8). As previously stated, trimming data is multiplied by a magnification on condition that centering is OFF, that edit data set is ON, that partial magnification change is ON, and that trimming data set 3 is OFF (a). Either a right return or a left return is selected based on a relation $Xc' > Xc$, and return data in the X direction based on the magnification of the center of a trimming area is determined. Likewise, an up-return or a down-return is selected based on a relation $Yc' > Yc$, and return data in the Y direction based on the magnification of the center of the trimming area is determined. Then, data undergone magnification change is set again in the trimming data (b). When an image shift is to occur, processing for adjusting the shift data is executed (c).

Besides the various modes described so far, the copier in accordance with the present invention is furnished with four different continuous copy modes, as described hereinafter.

Continuous Copy Mode (a) Continuous copy 1: a mode in which the right half and the left half of a single document are reproduced on different papers each having one half the size of the document. Since this mode is known in the art, details thereof will not be described.

Figure 27:
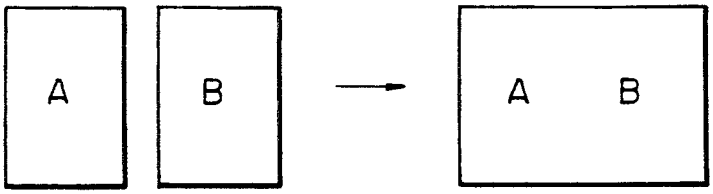
FIGS. 27 to 29 are diagrams showing some different continuous copy modes in accordance with the present invention.

(b) Continuous copy 2: a mode particular to the present invention and in which the first one of two copies is reproduced in the left area of a single paper and the second one in the right area immediately after the first one. Specifically, as shown in FIG. 27, assuming images A and B which are printed on different documents, the images A and B are continuously reproduced in, respectively, the left and the right areas of a paper which is double the size of the documents.

Figure 28:
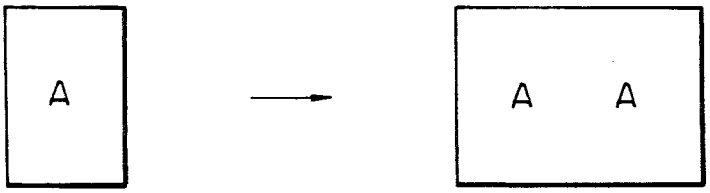

(c) Continuous copy 3: a mode particular to the present invention and in which a single document is continuously reproduced in the right and left areas of a paper. Specifically, as shown in FIG. 28, assuming an image A on a document, the image A is copied in the left area of a paper and, then, in the right area of the same, the paper having a size double the size of the document.

Figure 29:
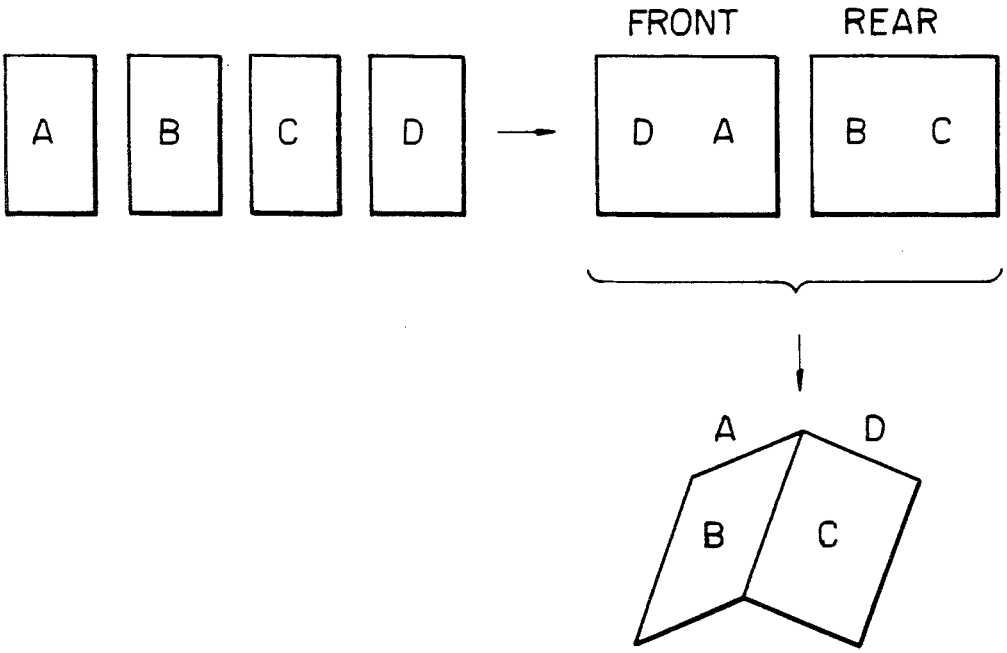

(d) Continuous copy 4: a mode particular to the present invention and in which four documents are loaded in the ADF and, when the print key is depressed, two of them are reproduced side by side on one surface of a single paper and the other two on the other surface of the same. Specifically, as shown in FIG. 29, assuming images A, B, C and D which are printed on four documents, the images D and A are reproduced on one surface of a paper and the images B and C on the other surface of the same, the paper having a size double the size of the documents. If the resulting paper is folded in half and paginated, the images A, B, C and D will appear on the first, second, third and fourth pages, respectively. Therefore, such a copying operation may be repeated a plurality of times to facilitate easy bookbinding.

The continuous copy 2 will be described in detail.

Mode Setting (a) Continuous mode setting (A-1-9) included in the mode set processing routine (A-1) is executed to select a continuous copy 1 to 3 mode and an OFF mode.

(b) Indicator lamps on the operation board which correspond to the modes selected are turned on.

(c) In the event of setting continuous copy 1 to 3, a continuous copy first-surface flag is set.

Data Setting (a) If the surface is the first surface, shift data which covers half the size of a paper is set by continuous copy data set (A-1-11) which is also included in the mode set processing routine (A-1).

(b) For the second surface, the shift data is reset to zero.

Copying Operation (a) The shift of the X axis is effected in the same manner as in the shift mode copying operation and, therefore, will not be described.

(b) In the print ON initialization, the combine 1 mode flag is set if the surface is the first surface of continuous copy 2 (B-1-2).

(c) The first image is transferred to the left half of the first surface and, then, the paper is fed to the intermediate tray (C-2-4).

(d) At the end of reproduction on the first surface, the copy end check 1 (D-3) is executed so that, after the paper has been received in the intermediate tray, the combine 1 mode and the continuous copy first-surface flag are cleared and, instead, the combine 2 mode and a continuous copy second-surface flag are set while, at the same time, all the data set flags are cleared.

(e) By the continuous data set 1 (A-1-11) included in the end operation processing (D-2), the shift data is reset to zero and a continuous copy data set flag (which has been cleared by (d)) is set.

(f) By the copy end check 2 (D-4), printing is started after auto print check ON so as to start on copying on the second surface.

(g) For the second surface, the paper is fed by way of the combine tray by the combine 2 mode (B-2-2-1-1, B-2-2-1-2).

The continuous copy 3 operation proceeds as follows.

Mode Setting (a) The continuous mode set (A-1-9) processing is executed to select the continuous copy 1 to 3 mode and OFF mode.

(b) The indicators on the operation board corresponding to the modes are turned on.

(c) In the event of continuous copy 1 to 3 setting, the continuous copy first-surface flag is set.

Data Setting (a) The continuous data set (A-1-11) processing is effected so that, if the surface is the first surface, shift data which covers one half the size of a paper is set.

(b) For the second surface, the shift data is reset to zero.

Copying Operation (a) For the first surface, the X axis is shifted (shift mode). If the surface is the first surface of continuous copy 3 as determined by the print ON initialization, the combine 1 mode flag is set (B-1-2). Consequently, an image is transferred to the left half of the first surface and, then, the paper is fed to the intermediate tray (C-2-4).

(b) After the image transfer to the first surface, the document is not discharged (D-2-1).

(c) At the start of copying on the second surface, the next document is not fed (B-1-1).

(d) As for the rest of the procedure, it is the same as in the usual continuous copy mode.

The continuous copy 4 will be described.

Mode Setting

The modes are selected in the same manner as in the previously described continuous copy 2.

Data Setting (a) If the surfaces are the first and third surfaces as determined by continuous data set 2 (A-1-12), the amount of shift is zero.

(b) If the surfaces are the second and fourth surfaces, shift data corresponding to one half the size of a paper is set.

Copying Operation (a) By the print initialize step, a both-surface front mode is set.

(b) An image is reproduced on the right half of the first surface of a paper and, then, the paper is fed to the intermediate tray (C-2-4).

(c) At the end of copying on the first surface, the copy end check 1 (D-3) is executed so that, after the paper has been received in the intermediate tray, the combine mode and the continuous copy first-surface flag are turned OFF and, instead, a both-surface rear mode and a continuous copy second-surface flag are turned ON. At the same time, all the data set flags are cleared.

(d) Continuous copy data set 2 (A-1-12) included in the end operation processing (D-2) is performed to set shift data corresponding to one half the size of the paper.

(e) After the auto print ON check as performed in copy end check 2 (D-4), printing is started to reproduce an image on the second surface.

(f) For the second surface, the combine 1 mode is set by the print ON initialization (B-1-2) (both of the both-surface rear and combine 1 modes become ON).

(g) The second document is fed (B-1-1).

(h) The paper is fed from the intermediate tray (B-1-1).

(i) As regards the second surface, an image is reproduced in the left area of the rear surface of the paper and, then, the paper is returned to the intermediate tray again (C-2-4).

(j) At the end of copying, after the paper has been received in the intermediate tray, the combine 1 mode, both-surface rear mode and continuous copy second surface mode are turned OFF and, instead, the combine 2 mode and a continuous copy third-surface mode are turned ON (D-3).

(k) Continuous copy data set 2 of the end operation processing (D-2) is executed to reset the shift data to zero.

(l) After auto print ON check, print start is made ON to start on copying for the third surface (D-4).

(m) The both-surface front mode is set by the print ON initialization for the third surface (B-1-2) (both of the combine 2 mode and the both-surface front mode become ON).

(n) The third document is fed (B-1-1).

(o) The paper is fed from the intermediate tray (B-2-2-1-1).

(p) As regards the third surface, an image is reproduced on the right area of the rear surface of the paper and, then, the paper is returned to the intermediate tray (C-2-4).

(q) At the end of copying, after the paper has been received in the intermediate tray, the both-surface front, combine 2, and continuous copy third-surface are turned OFF and, instead, the both-surface rear mode and continuous copy fourth-surface mode are made ON (D-3).

(r) The continuous copy data set 2 (A-1-12) is executed to set shift data corresponding to one half the size of the paper.

(s) After auto print ON check, print start is made ON to start on copying on the fourth surface (D-4).

(t) In the print ON initialization for the fourth surface, the mode setting is skipped (B-1-2) (only the both-surface rear mode is ON).

(u) The fourth document is fed.

(v) The paper is fed from the intermediate tray (B-2-2-1-1).

(w) The fourth document is reproduced on the left area of the front surface of the paper and, then, the paper is fed out of the copier (C-2-4).

(x) At the end of copying, after the paper has been discharged to the outside (all the transport path sensors are OFF), the combine 2, both-surface rear and continuous copy fourth-surface mode are made OFF and the continuous copy first-surface mode is turned ON, because the combine 1 mode and both-surface front mode are OFF (D-3).

(y) By the continuous copy data set 2 (A-1-12), the shift data is reset to zero.

(z) If the next document is not set, the continuous copy 4 mode operation is finished.

FIG. 8E shows the edit data set (A-1-5) which is included in the mode set processing. This procedure is made up of right/left key processing (A-1-5-1), up/-down key processing (A-1-5-2), enter key processing (A-1-5-3), and partial magnification change processing (A-1-5-4).

Figures 1, 8I:
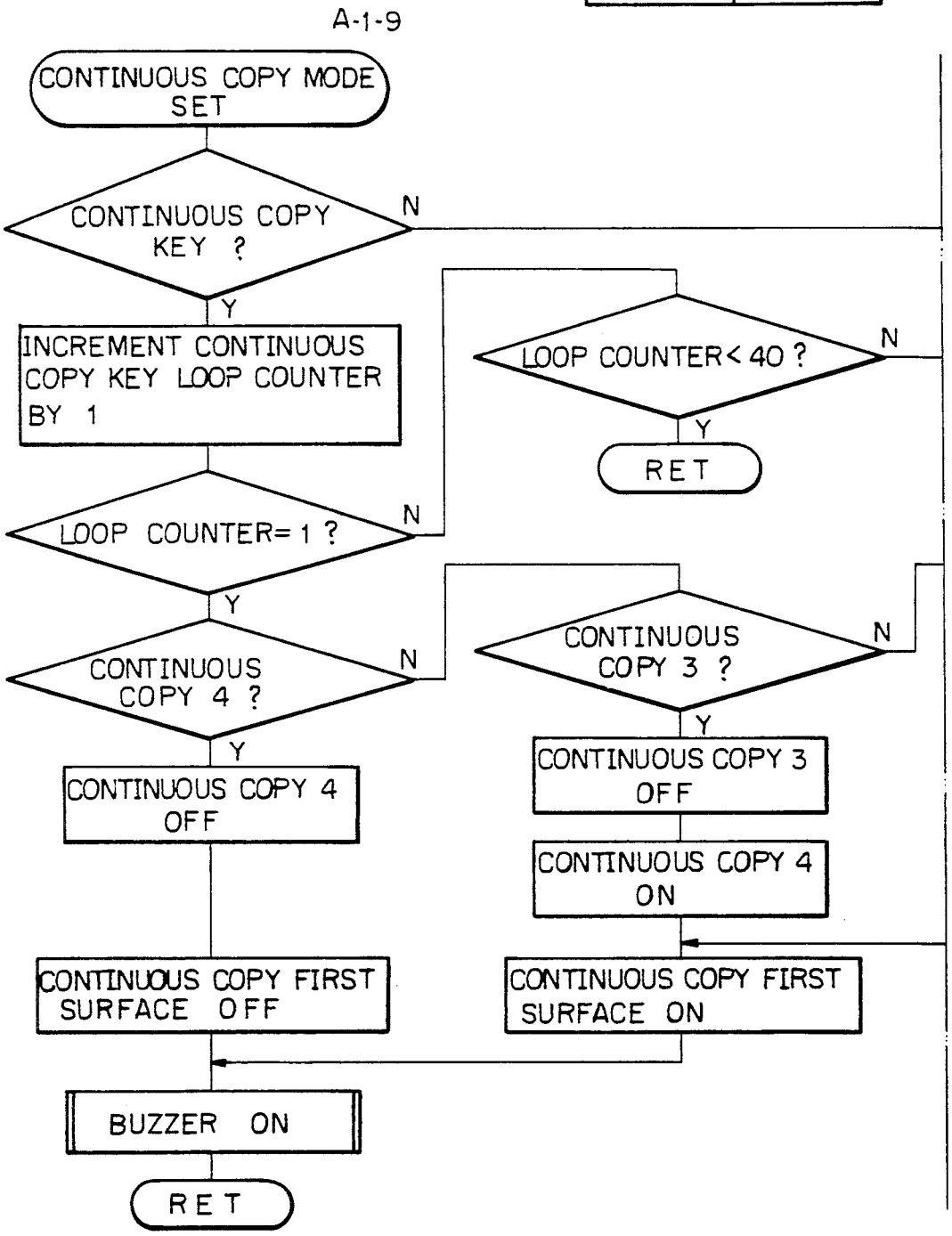
FIG. 8I is a flowchart showing continuous copy mode set processing.
Figures 2, 8I:
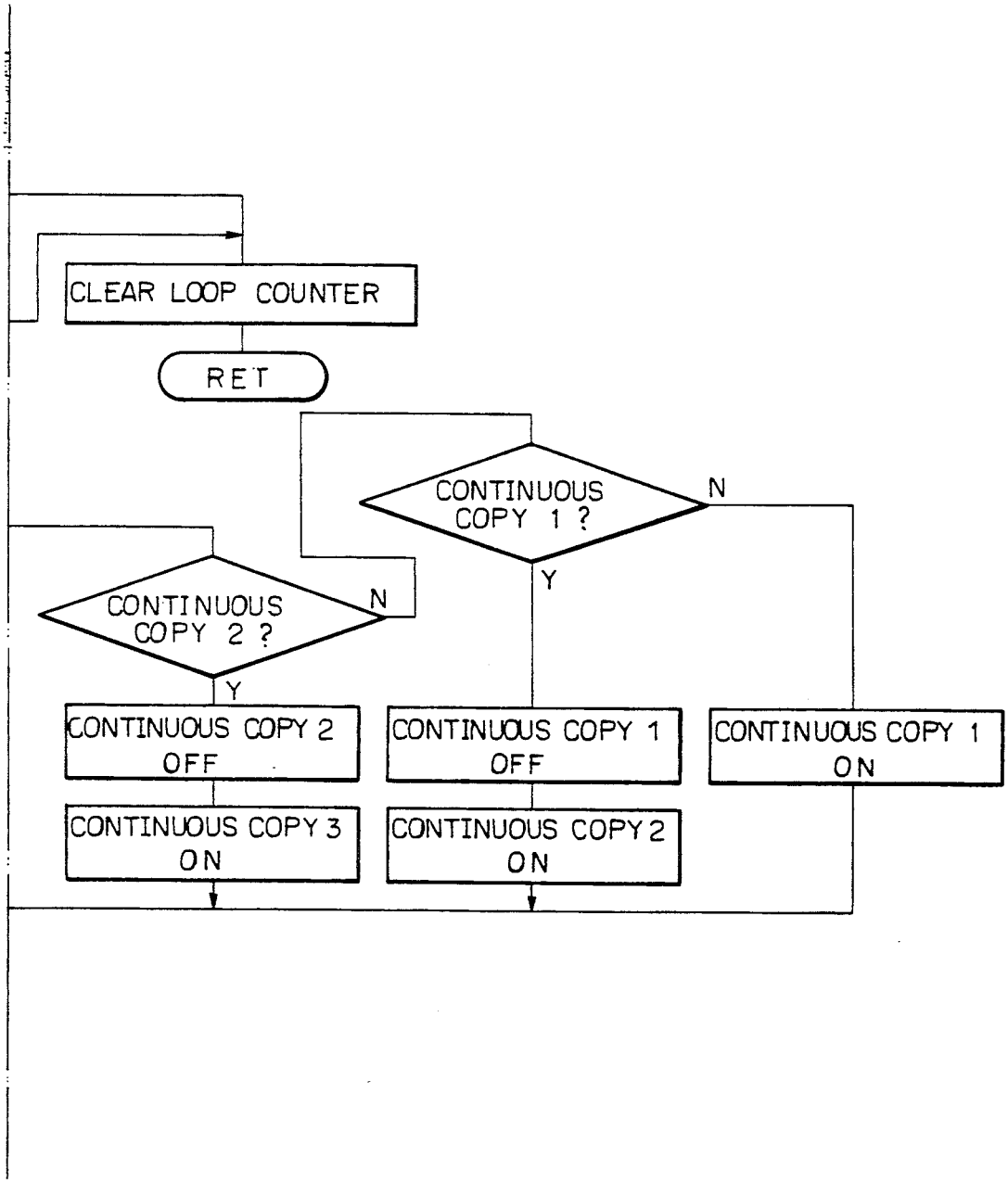
Figure 8J:
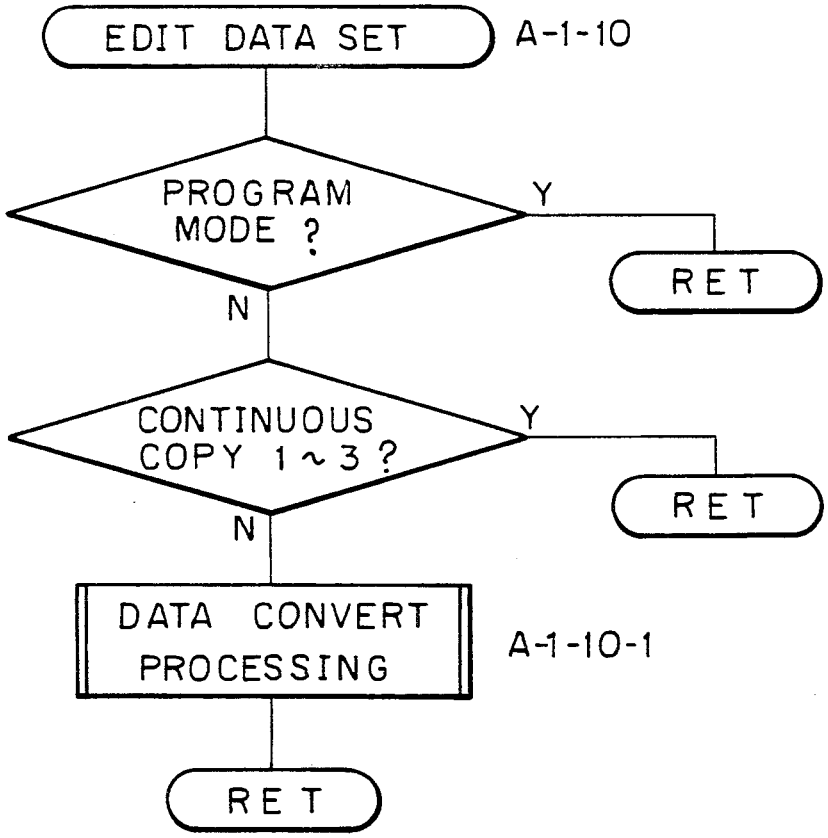
FIG. 8J is a flowchart showing edit data set processing.
Figure 8:
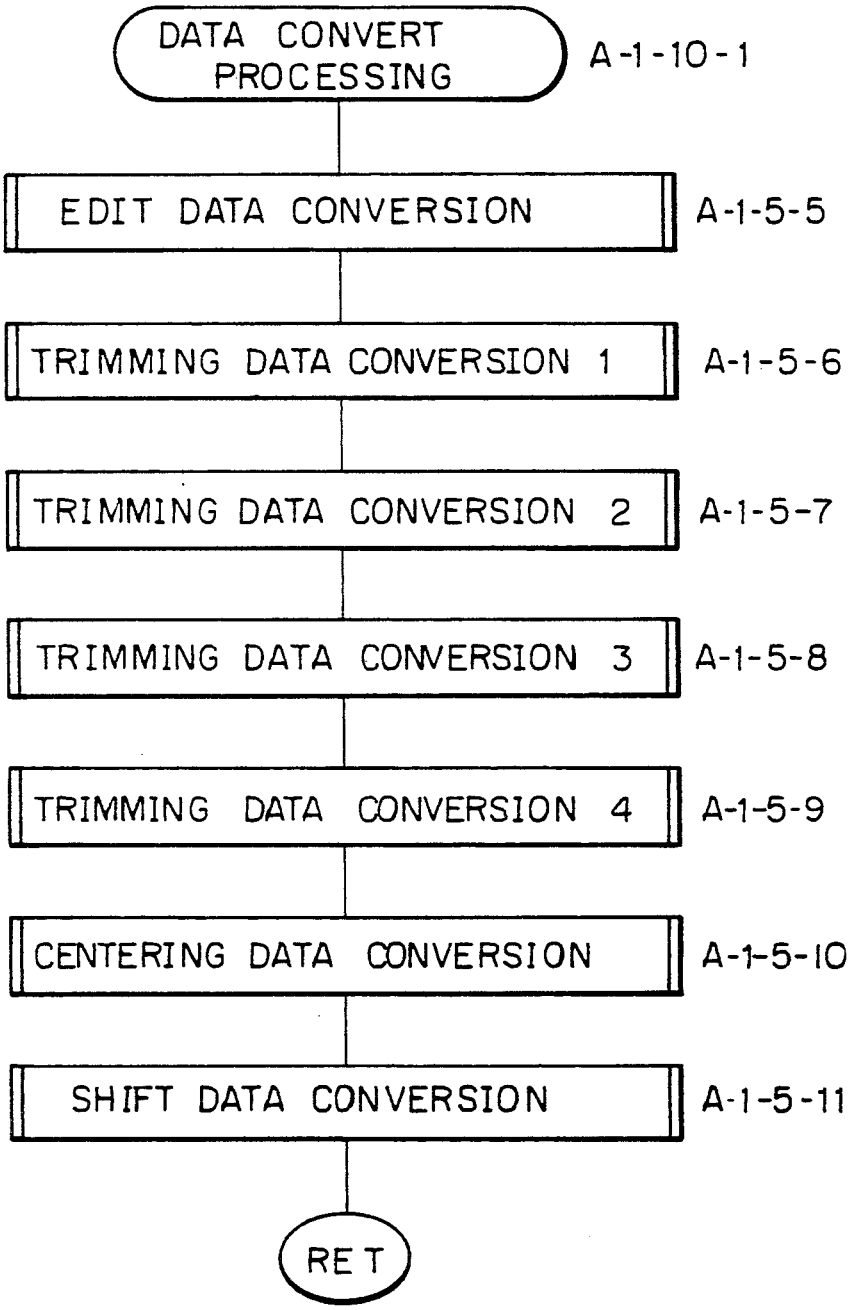

FIG. 8J shows the edit data set (A-1-10) also included in the mode set processing. In this procedure, the data conversion processing (A-1-10-1) is executed even when the program mode and the continuous copy 1 to 3 mode are OFF, i.e., even in the continuous copy 4 mode.

FIG. 8J-i demonstrates the data conversion processing (A-1-10-1). In this processing, there are executed trimming data conversion 1, trimming data conversion 2, trimming data conversion 3, trimming data conversion 4, centering data conversion, and shift data conversion.

FIG. 8I is representative of the continuous copy mode set (A-1-9) included in the mode set processing. In the continuous copy mode setting, when the continuous copy key is continuously depressed, a loop counter is incremented to set up the continuous copy 1, 2, 3 and 4 sequentially in this order. After the loop counter has counted up fourth such copy modes, it is cleared. If continuous copy 4 is set up when the count of the loop counter is 1, continuous copy 4 is turned OFF; if continuous copy 3 is set up, it is turned OFF and continuous copy 4 is turned ON; if continuous copy 2 is set up, it is turned off and continuous copy 3 is turned ON; and if continuous copy 1 is set up, it is turned OFF and continuous copy 2 is turned ON. When continuous copy 1, 2, 3 and 4 are turned ON, continuous copy first surface is made ON while, at the same time, the buzzer is energized.

Figure 8K:
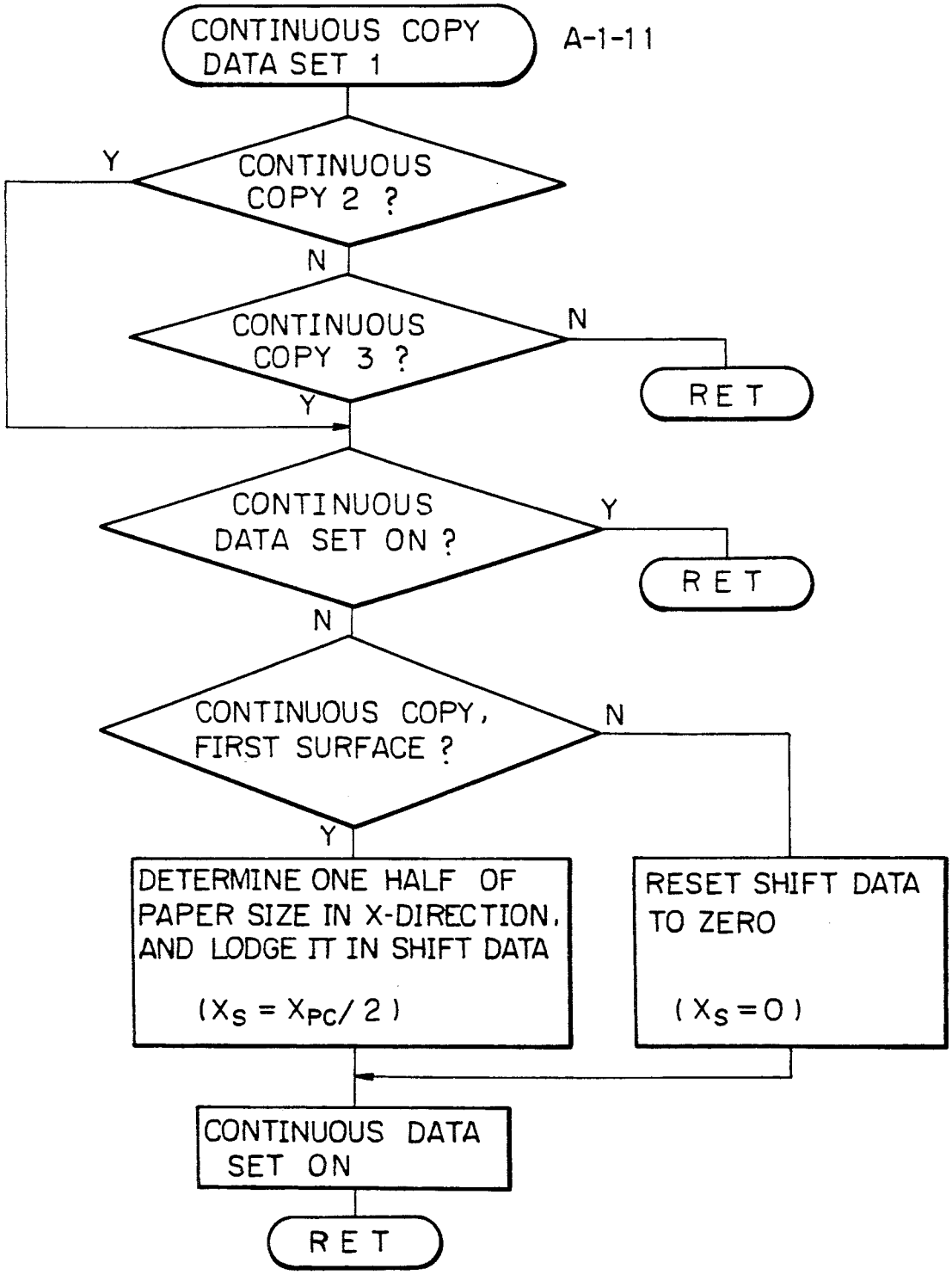
FIG. 8K is a flowchart showing continuous copy data set 1.

FIG. 8K shows the continuous copy data setting 1 (A-1-11). On condition that continuous copy 2 or 3 is ON, that continuous copy data set is OFF, and that continuous copy first-surface is ON, one half the size of a paper in the X direction is determined and lodged in shift data. If any of continuous copy second-surface and onward is ON, the shift data is reset to zero. Then, continuous data set is turned ON. It will be noted that no flag except for the right shift flag is set because the shift occurs to the right.

Figure 8L:
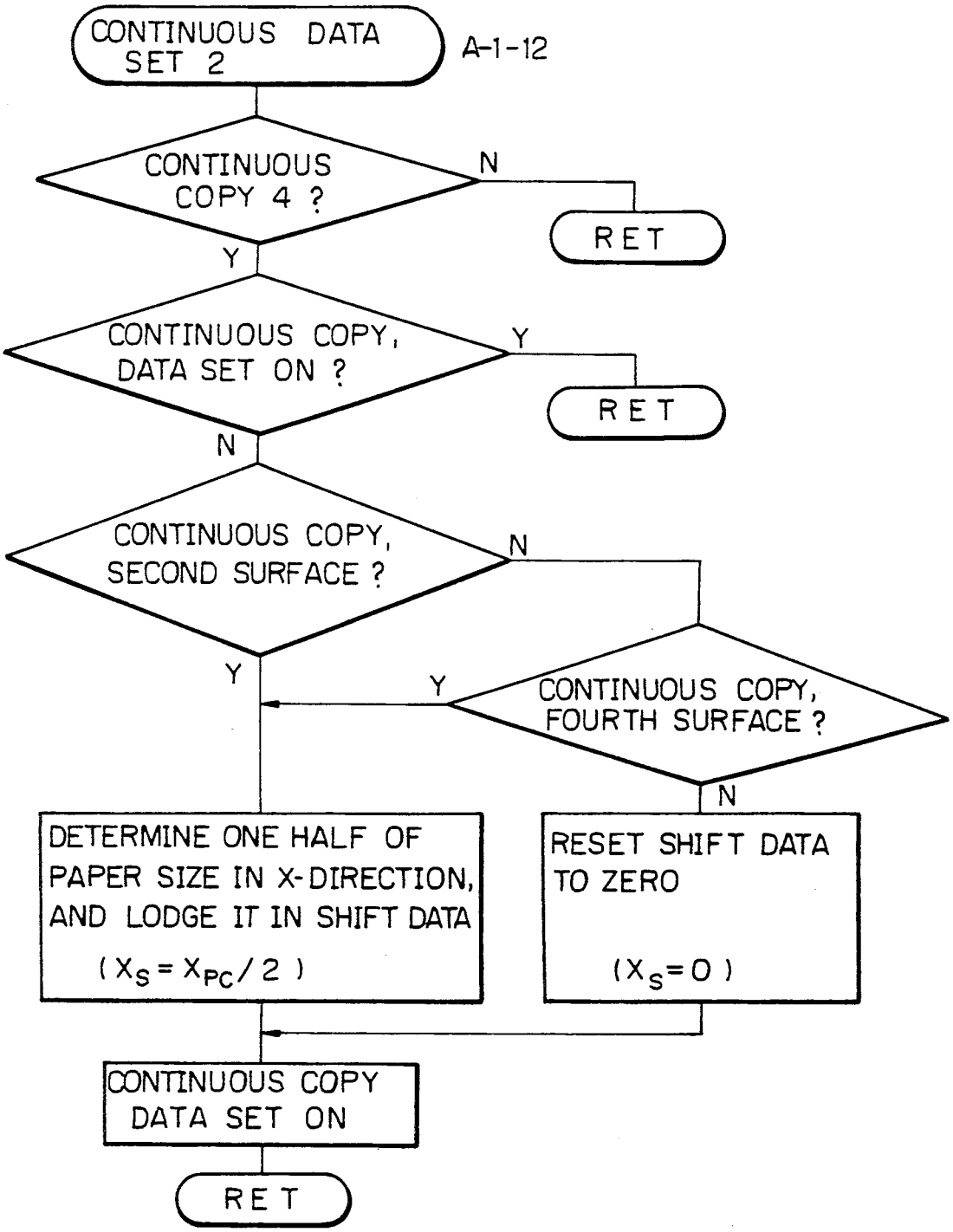
FIG. 8L is a flowchart showing continuous copy data set 2.
Figures 9, 9A:
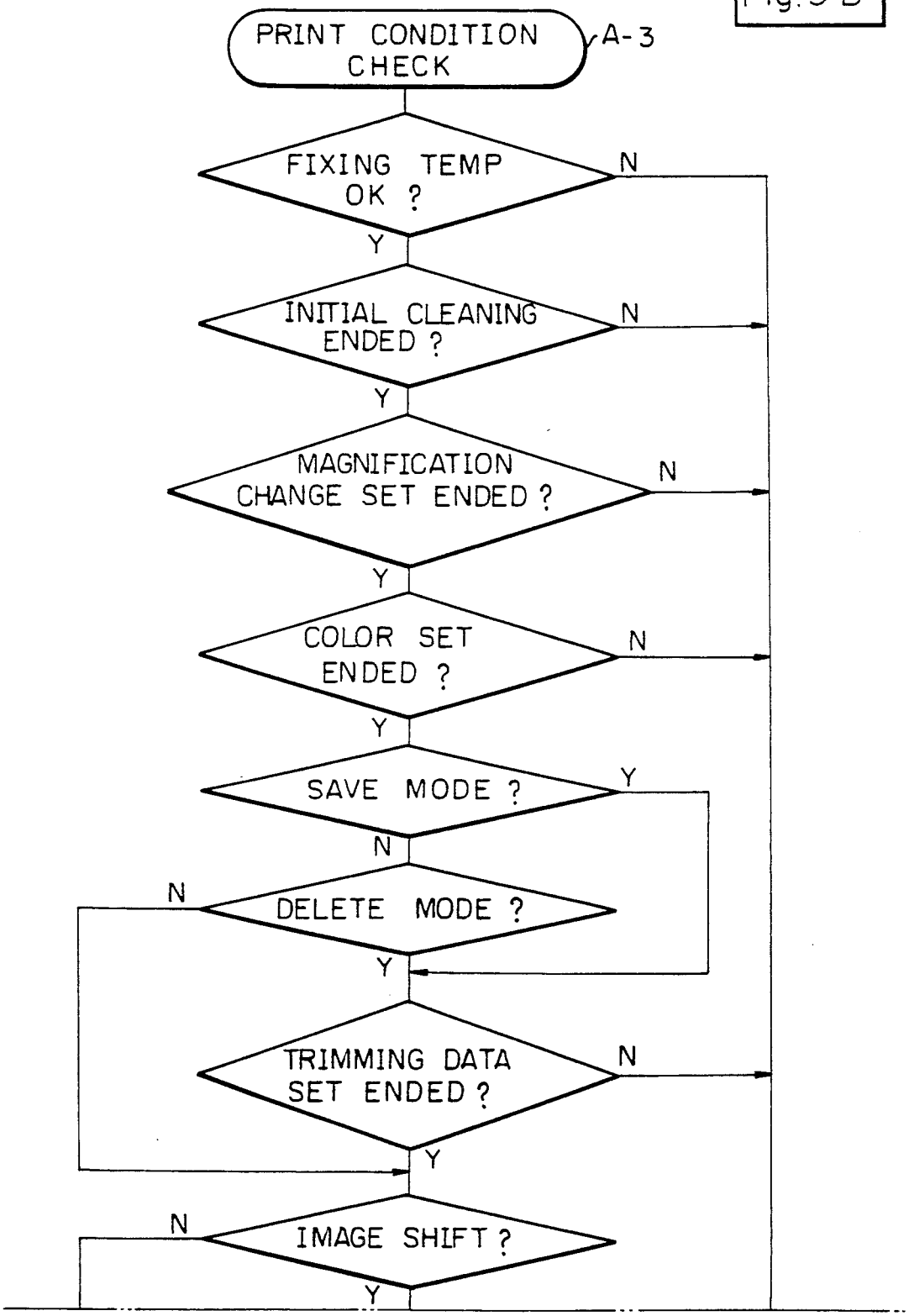
Figure 9B:
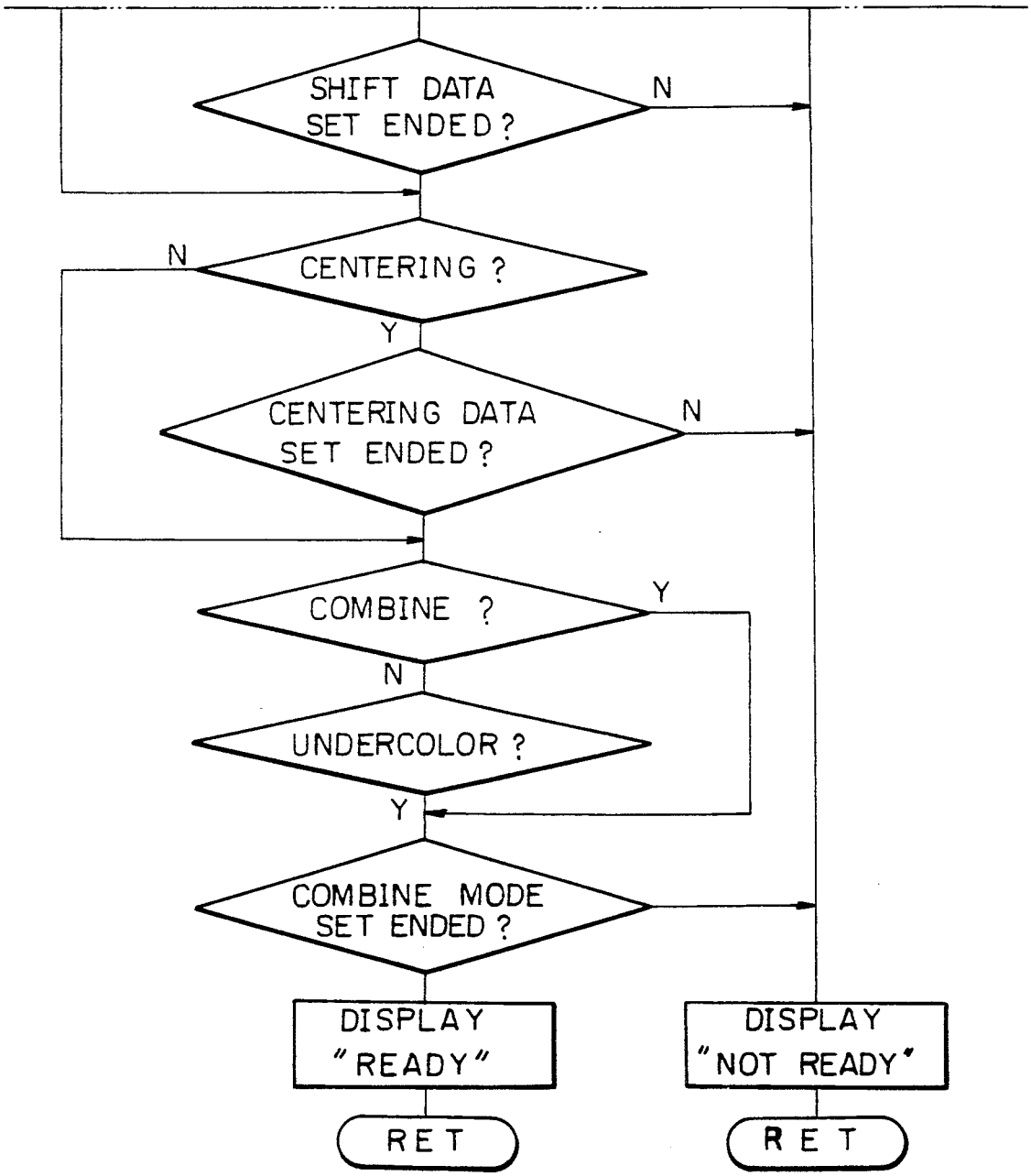
Figure 10:
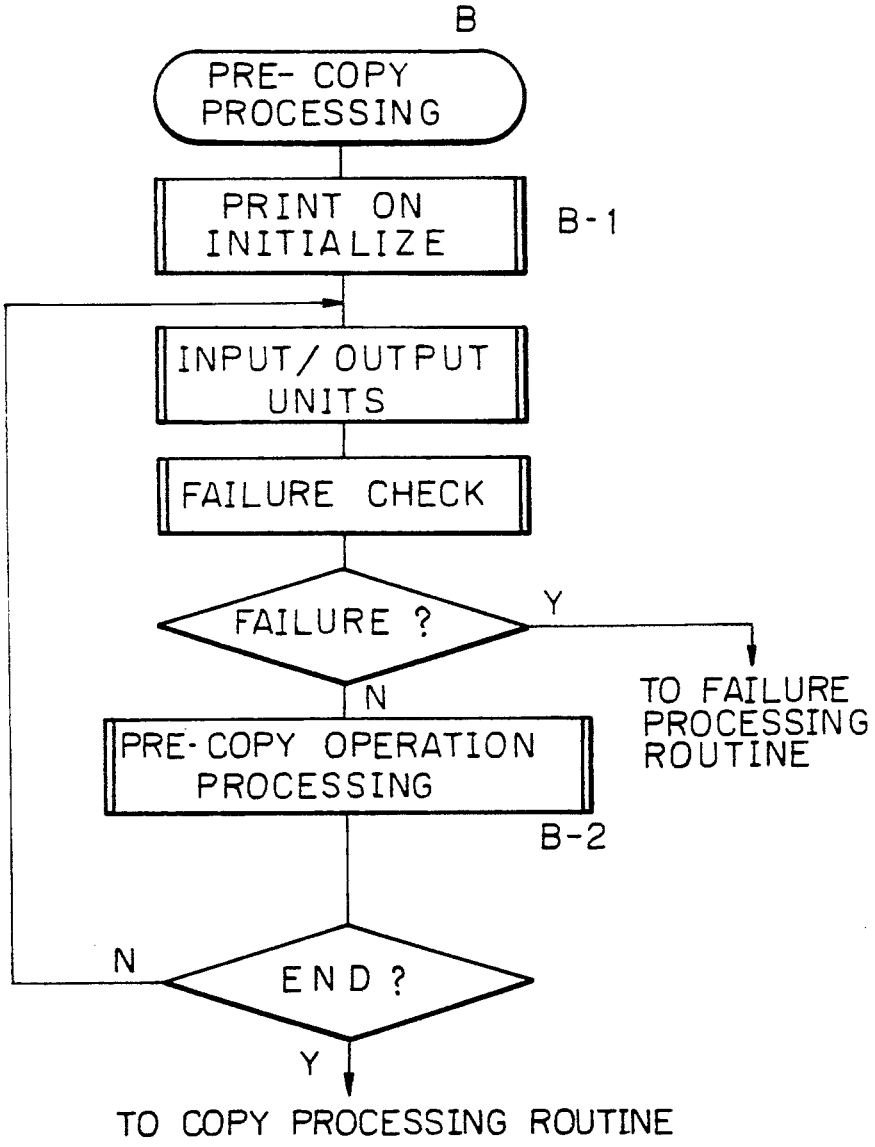

FIG. 8L shows the continuous data set 2 (A-1-12). On condition that continuous copy 4 is ON, that continuous data set is not ON, and that continuous copy second-surface or fourth-surface is ON, one half the size of a paper in the X direction is determined and lodged in shift data. If neither continuous copy second-surface nor continuous copy fourth-surface is ON (i.e. continuous copy 1 and 3 are ON), the shift data is reset to zero. Then, continuous copy data set is turned ON.

FIGS. 11, 12, 12A and 12B show, respectively, the print ON initialize processing (B-1), pre-copy operation processing (B-2), developer buildup (B-2-1), and paper feed processing (B-2-2). In the initialize processing, there are executed main motor ON, in-copy flag ON, copy counter clear, pulse counter clear, READY display OFF, pump motor ON, and pump timer clear in this order. Subsequently, if the ADF mode is set, ADF feed check (B-1-1) is performed. Under a feed pulse start OFF condition, feed pulse start is made ON to start the feed of feed pulses and, then, combine 1/surface mode set (B-1-2) is executed. In the pre-copy operation processing, there are executed developer buildup processing, paper feed processing, copy start check, register sensor check, shift counter set, and copy start check 2. Thereafter, on condition that documents are loaded in the ADF, that the developer has built up, and that the copy start flag 2 is ON, the pre-copy operation is completed. As regards the buildup of a developer, if the buildup has not been completed and the pump timer is longer than 2 seconds, the buildup is completed. In the paper feed processing, paper feed control, combine sensor check, and combine paper feed control are performed.

Figure 11:
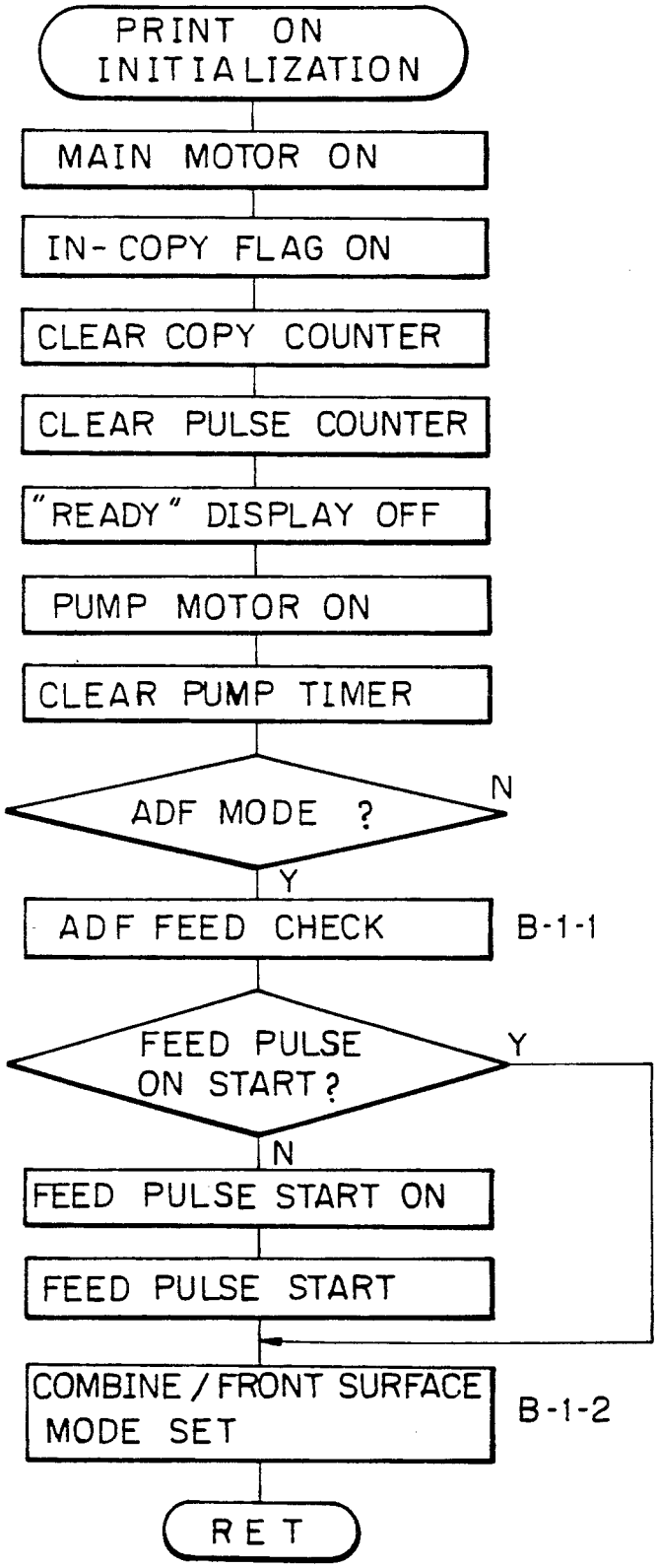
Figure 11A:
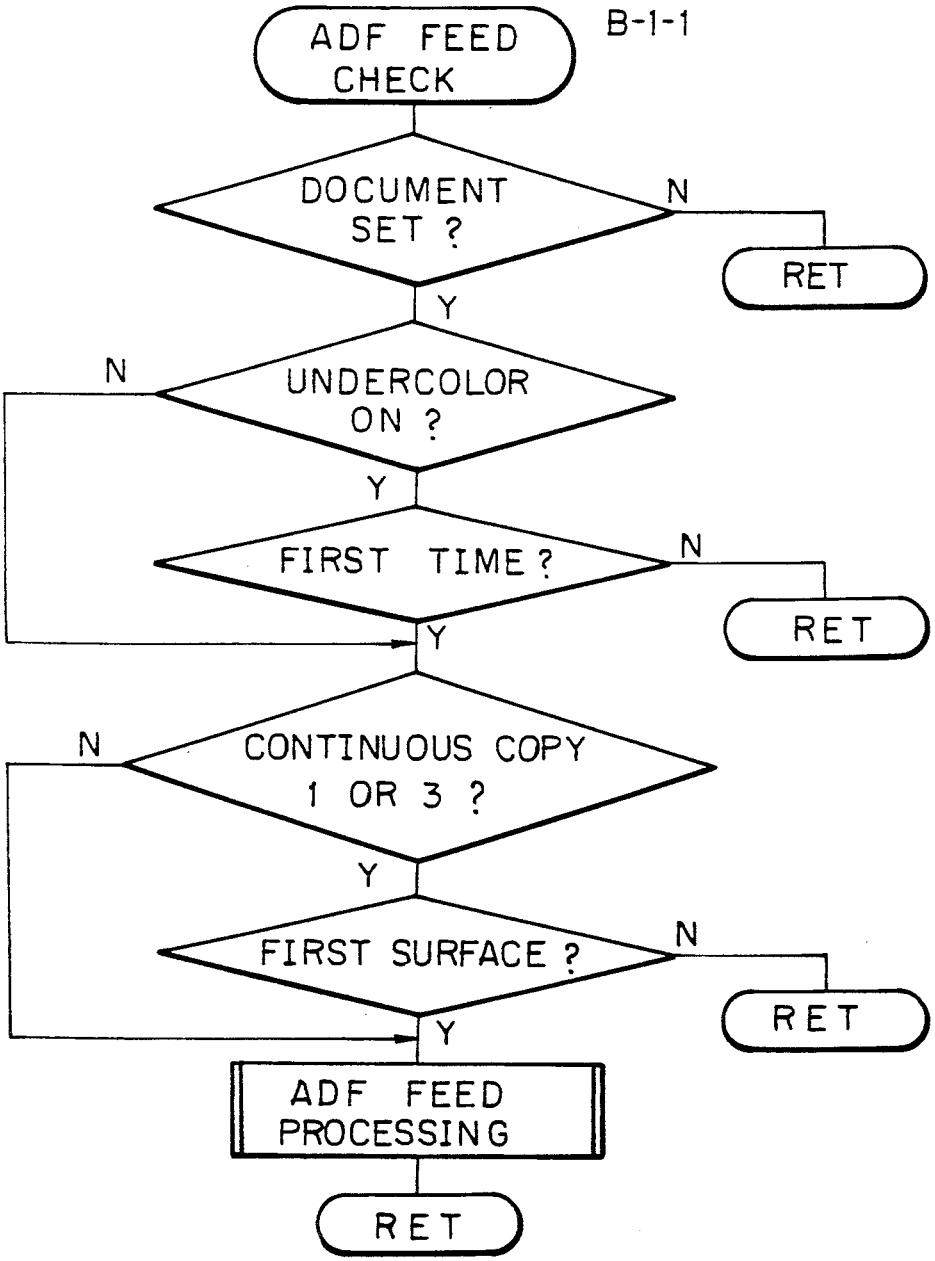
FIG. 11A is a flowchart showing ADF feed check.

FIG. 11A demonstrates the ADF feed check (B-1-1). On condition that the surface is the first surface of continuous copy 1 or 3 or continuous copy 2 or 4 is selected when documents are present in the ADF and undercolor is not ON or ON for the first time, ADF feed processing is effected.

Figures 1, 2, 11B:
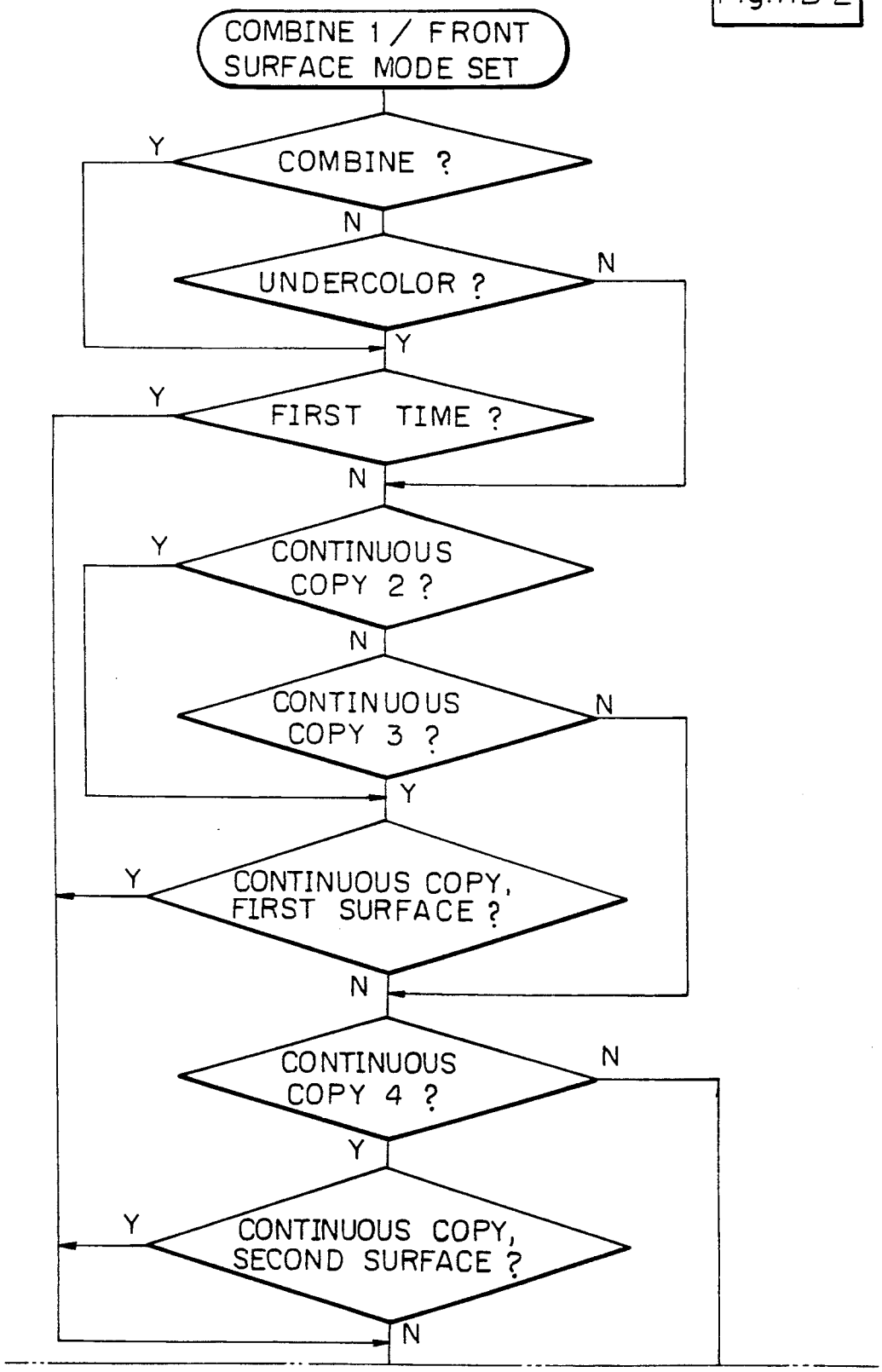
FIG. 11B is a flowchart showing combine 1/surface mode set processing.
Figures 2, 11B:
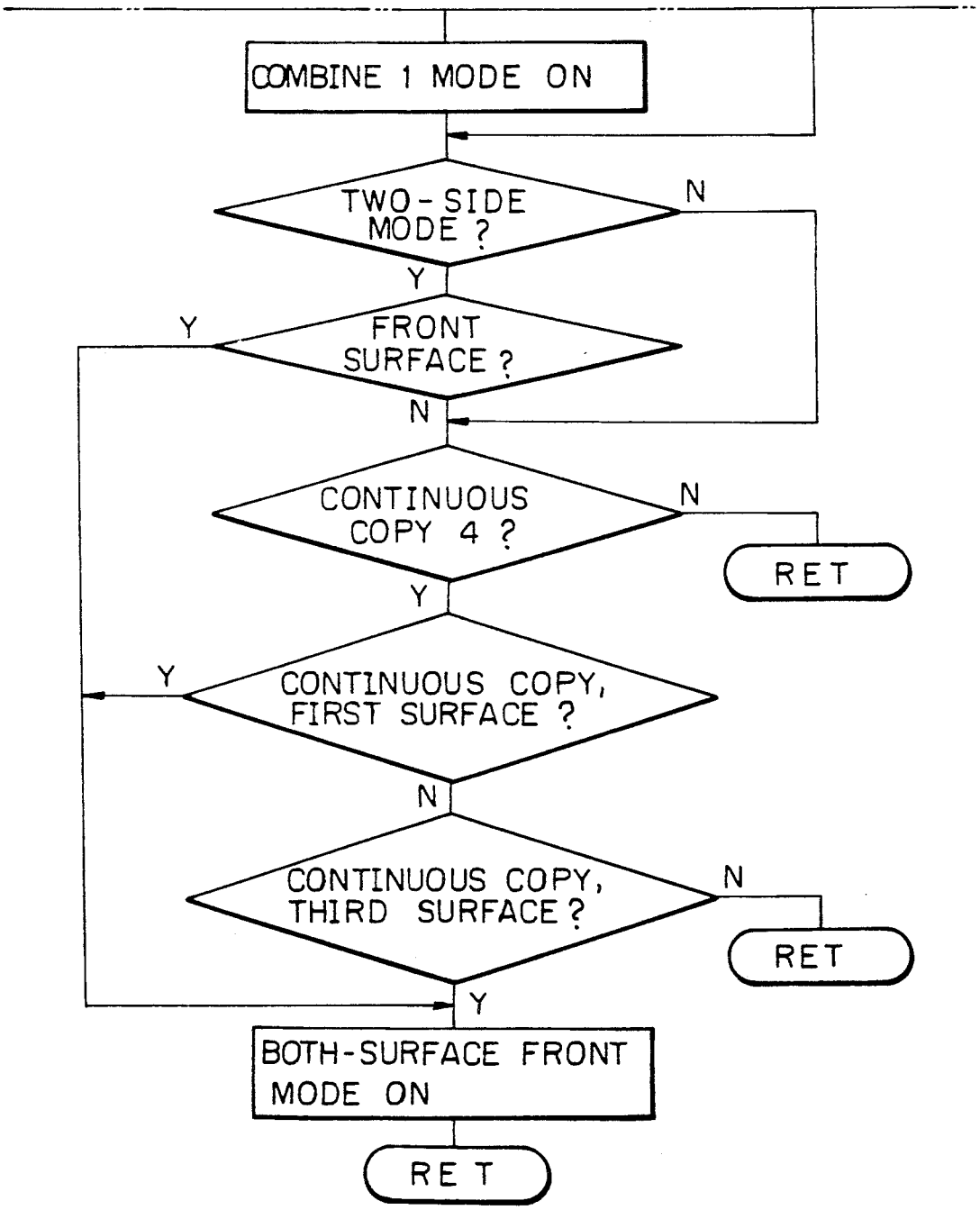

FIG. 11B shows the combine/surface mode set (B-1-2). Depending upon the mode, selected, i.e., which one of the combine tray and the both-side tray is selected, the transport mode is determined. The combine/both-side transport route is determined on the basis of a difference between continuous copy modes. Under the combine 1 mode ON condition, a paper is fed to the intermediate tray, and the next copy is transported through a combine route by way of the combine tray. Under the both-surface front mode ON condition, a paper is fed to the intermediate tray, and the next copy is fed through a both-side route.

FIGS. 12B-1 and 12B-1-2 show, respectively, paper feed/transport clutch ON (B-2-2-1-1) and combine gate SOL (B-2-2-1-2) flows. In the paper feed/transport clutch ON procedure, when the combine 2 mode or the both-surface rear mode is selected, intermediate tray clutch is made ON to couple a two-side transport clutch. If the upper paper cassette is selected when neither the combine 2 mode nor the both-surface rear mode is set, an upper feed clutch is coupled; if the lower paper cassette is selected, a lower feed clutch is coupled. Then, a body transport clutch is coupled. The decision as to which one of the combine 2 mode or the both-surface rear mode is set is adapted to check the mode as decided by B-1-2. In the combine gate SOL ON procedure, the combine gate SOL is turned ON if the combine 2 mode is ON. It is to be noted that the combine 2 mode refers to the mode of the second time of combination/undercolor.

FIGS. 16 and 18 are flowcharts showing, respectively the copy end processing (D) and the end operation processing (D-2). In the copy end processing, auto print check, input/output processing, end operation processing and failure check are executed and, if any failure is found, the program advances to the failure processing routine. If no failure is found, copy end check 1 and 2 are executed. If print start is ON, the operation is transferred to the pre-copy routine; if copying is ended, the operation is transferred to the pre-print processing and, it is not ended, the operation is returned to the input/output processing. In the end operation processing (D-2), there are effected ADF document discharge, sequence control processing 2, intermediate tray control processing, sensor check, program data set, continuous data set 1, and continuous data set 2. In the ADF document discharge (D-2-1), ADF feed is made OFF and, then, ADF discharge is made on, on condition that the discharge counter is equal to the set number of copies, that under the undercolor mode the copying is not the first one, that in the case of the continuous copy 1 or 3 the surface is not the first one, and that in the ADF mode ADF feed is ON.

FIG. 19 shows the copy end check (D-3). As shown, when the combine 1 mode or the both-surface front mode is selected while the in-copy flag is set and all the transport path sensors are OFF, if intermediate tray receive as decided by C-2-5 is ON and so is the combine 1 mode, the combine 1 mode is turned OFF and, instead, the combine 2 mode is turned ON with the both-surface rear mode turned OFF. If the combine 1 mode is OFF, the both-surface front mode is turned OFF, the both-surface rear mode ON, and the combine 2 mode OFF. On the other hand, when neither the combine 1 mode nor the both-surface front mode is set, the combine 2 mode is turned OFF and so is done the both-surface rear mode. It is to be noted that the flows on the right-hand side and left-hand side check the operation in the opposite manner to each other. After the first and second checks have been effected under the combine mode, or the front and rear surfaces have been checked under the both-side mode, or the first and second surfaces have been checked under the continuous copy 2 or 3 mode, or the fourth and first surfaces, the first and second surfaces, the second and third surfaces, and the third and fourth surfaces have been checked under the continuous copy 4 mode, the in-copy flag is cleared while, at the same time, all the data set flags are cleared. Namely, the data set flag, edit data set flag, program data set flag, continuous copy data set flag, trimming data 1 to 4 set flags, centering data set flag, and shift data set flag are reset.

In summary, it will be seen that in accordance with the present invention when a trim, image shift or like mode and a combine (inclusive of undercolor) mode are selected, such different modes are programmed beforehand so that the first and second data settings may be performed at the same time. This remarkably enhances efficient manipulation.

In accordance with the present invention, while specifying a trim, image shift or like mode and a combine mode (inclusive of undercolor) together causes a special mode to be set up, mode is restored to a standard one after copying operation. A person may manipulate a special key to recall the previous mode. Such allows the person to correct data with ease.

Further, the present invention is capable of controlling the center of a magnification-changed image into alignment with the center of a document image in terms of coordinates, capable of controlling the distance of shift of a magnification-changed image to a specified distance, and capable of performing such controls with no regard to the size of a paper, which may be the same or different from that of a document. Such promotes the ease of editing work.

When an image is to be shifted in such a direction that a paper precedes the image, the present invention is capable of adjusting the delay over a substantial range. Hence, an image can be efficiently shifted even beyond a limit.

Since the present invention allows a single document to be reproduced side by side on a single paper whose size is double the size of the document, not only the copying efficiency is improved but also a flexible continuous copy mode is realized.

Another capability of the present invention is reproducing two different documents side by side on a single paper. This enhances efficient copying and, yet, implements a flexible continuous copy mode.

In addition, in accordance with the present invention, four different documents may be continuously and neatly reproduced on both sides of a single paper. Hence, not only the copying efficiency is improved, but easy bookbinding is achievable by continuously stacking such papers.

Various modifications will become possible for those skilled in the art after receiving the teachings of the present disclosure without departing from the scope thereof.

What is claimed is:

1. A control system for a copier, wherein said copier has at least;

an image shifting means for shifting copy paper upon which copies are produced such that an image, produced from an original is shifted on copy paper relative to the edge of the copy paper thereby providing an image shift mode;

variable magnification means for controlling the magnification ratio of said copier, thereby providing a variable magnification mode;

recycling means for recycling the copy paper upon which copies are made through said copier, after an image has been placed on at least a portion of the copy paper such that additional images may be placed upon said copy paper, either on the same side or on an opposite side of the copy paper, thereby providing a combined image mode;

trimming means for trimming the image to be placed on the copy paper, thereby providing a trimming mode;

partial copying means for copying only a portion of an image on the copy paper, thereby providing a partial copying mode;

wherein said control system comprises:

an operator input panel for accepting control signals for accepting settings from an operator indicative of the amount of image shift desired, for inputting the magnification ratio desired, for setting the amount of trimming of an image, for selecting said combined image mode, and for selecting said partial copying mode of said copier;

memory means for storing control settings representative of said control signals and for saving said control settings for later use in a sequential fashion such that any combined image mode selected is stored in said memory means prior to any amount of trim selected with said amount of trim being stored in said memory means prior to any amount of image shift selected being stored in said memory means;

mode setting means for providing a mode setting for said copier such that when a center of a copied image, which has been selected by an operator from said operator input panel as having a variable size or shift is to be copied along with another image on a copy paper, said variable shift or variable size of both of said images is adjusted such that images coincide with each other with respect to the center of said images or the distance offset caused by said images;

control means coupled to said operator input panel and to said mode setting means for controlling the operation of said control system; and coupling means for coupling said control means to said image shifting means of said copier, said variable magnification means of said copier, said recycling means of said copier, said trimming means of said copier and said partial copying means of said copier, such that said control means controls said image shift means, said variable magnification means, said recycling means, said trimming means and said partial copying means.

2. A control system for a copier as in claim 1, further comprising:

stored program means for storing a program for the control of the operation of said control means such that said stored program does not allow said control means to operate on any settings provided by said operator input panel until signals have been received from said operator input panel indicative of the amount of trim or shift has been received.

3. A control system for a copier as in claim 1 wherein data entered at said operator input panel corresponding to the amount of image shift or variable magnification desired by said operator is converted by said control means with out regard to the size of paper upon which the copy is to be made and with out regard to the equality in size between the original document and the size of said copy paper.

4. A control system for a copier, wherein said copier has at least;

an image shifting means for shifting copy paper upon which copies are produced such that an image, produced from an original is shifted on copy paper relative to the edge of the copy paper thereby providing an image shift mode;

variable magnification means for controlling the magnification ratio of said copier, thereby providing a variable magnification mode;

recycling means for recycling the copy paper upon which copies are made through said copier, after an image has been placed on at least a portion of the copy paper such that additional images may be placed upon said copy paper, either on the same side or on an opposite side of the copy paper, thereby providing a combined image mode;

wherein said combined image mode further comprises a means to provide an undercolor, thereby providing an undercolor mode;

trimming means for trimming the image to be placed on the copy paper, thereby providing a trimming mode;

partial copying means for copying only a portion of an image on the copy paper, thereby providing a partial copying mode;

wherein said control system comprises:

an operator input panel for accepting control signals for accepting settings from an operator indicative of the amount of image shift desired, for inputting the magnification ratio desired, for setting the amount of trimming of an image, for selecting said combined image mode, for selecting said undercolor mode and for selecting said partial copying mode of said copier;

mode setting means for providing a mode setting for said copier such that when a center of a copied image, which has been selected by an operator from said operator input panel as having a variable size or shift is to be copied along with another image on a copy paper, said variable shift or variable size of both of said images is adjusted such that images coincide with each other with respect to the center of said images or the distance offset caused by said images;

control means coupled to said operator input panel and to said mode setting means for controlling the operation of said control system; and stored program means for storing a program for the control of the operation of said control means such that when signals indicative of the selection of the trim mode or the shift mode are selected, along with the selection of said combined mode and said undercolor mode, a composite copy mode is selected by said program, such that combined copy and undercolor copy is executed prior to said trim or shift mode copy and further wherein data as to the amount of said trim or shift is required to be inputted prior to the execution of either said combined and undercolor copy or said trim or shift copy; and coupling means for coupling said control means to said image shifting means of said copier, said variable magnification means of said copier, said recycling means of said copier, said trimming means of said copier and said partial copying means of said copier, such that said control means controls said image shift means, said variable magnification means, said recycling means, said trimming means and said partial copying means.

5. A control system for a copier as in claim 4 wherein said operator input panel accepts input from keys and further comprising:

a key on said operator input panel for recalling said composite mode.

6. A control system for a copier as in claim 5 wherein said key for recalling said composite mode is a key for registering data.

7. A control system for a copier as in claim 4 wherein said control means controls said variable magnification means such that the amount of said variable magnification mode is varied if an amount of trim other than zero or an amount of shift other than zero is inputted from the operator subsequent to the inputting by said operator a signal indicative of a variable magnification.

8. A control system for a copier, wherein said copier has at least;

a drum for receiving images;

a set of register rollers to provide paper to said drum;

an image shifting means for shifting copy paper upon which copies are produced such that an image, produced from an original is shifted on copy paper relative to the edge of the copy paper thereby providing an image shift mode;

variable magnification means for controlling the magnification ratio of said copier, thereby providing a variable magnification mode;

recycling means for recycling the copy paper upon which copies are made through said copier, after an image has been placed on at least a portion of the copy paper such that additional images may be placed upon said copy paper, either on the same side or on an opposite side of the copy paper, thereby providing a combined image mode;

trimming means for trimming the image to be placed on said paper, thereby providing a trimming mode;

partial copying means for copying only a portion of an image on said paper, thereby providing a partial copying mode;

wherein said control system comprises:

an operator input panel for accepting control signals for accepting settings from an operator indicative of the amount of image shift desired, for inputting the magnification ratio desired, for setting the amount of trimming of an image, for selecting said combined image mode, and for selecting said partial copying mode of said copier;

memory means for storing control settings representative of said control signals and for saving said control settings for later use in sequential fashion such that any combined image mode selected is stored in said memory means prior to any amount of trim selected with said amount of trim being stored in said memory means prior to any amount of image shift selected being stored in said memory means;

mode setting means for providing a mode setting for said copier such that when a center of a copied image, which has been selected by an operator from said operator input panel as having a variable size or shift is to be copied along with another image on a copy paper, said variable shift or variable size of both of said images is adjusted such that images coincide with each other with respect to the center of said images or the distance offset caused by said images;

control means coupled to said operator input panel and to said mode setting means for controlling the operation of said control system;

coupling means for coupling said control means to said image shifting means of said copier, said variable magnification means of said copier, said recycling means of said copier, and said partial copying means of said copier, such that said control means controls said variable magnification means, said recycling means, said trimming means and said partial copying means; and wherein said control means effects the image shift of said original on said copy based upon the amount of shift, by selecting among the control sequences of (a) starting the image forming process on said drum prior to the arrival of copy paper at said register rollers;

(b) starting said image forming process on said drum subsequent to the arrival of copy paper at said register rollers;

(c) the period of time at which said register rollers are activated is varied.

9. A control system for a copier, wherein said copier has at least;

an automatic document feeder for feeding originals to be copied into said copier;

an image shifting means for shifting copy paper upon which copies are produced such that an image, produced from an original is shifted on copy paper relative to the edge of the copy paper thereby providing an image shift mode;

variable magnification means for controlling the magnification ratio of said copier, thereby providing a variable magnification mode;

recycling means for recycling the copy paper upon which copies are made through said copier, after an image has been placed on at least a portion of the copy paper such that additional images may be placed upon said copy paper, either on the same side or on an opposite side of the copy paper, thereby providing a combined image mode;

trimming means for trimming the image to be placed on said paper, thereby providing a trimming mode;

partial copying means for copying only a portion of an image on said paper, thereby providing a partial copying mode;

wherein said control system comprises:

an operator input panel for accepting control signals for accepting settings from an operator indicative of the amount of image shift desired; for inputting the magnificaion ratio desired; for setting the amount of trimming of an image; for selecting said combined image mode; and for selecting said partial copying mode of said copier;

memory means for storing control settings representative of said control signals and for saving said control settings for later use in a sequential fashion such that any combined image mode selected is stored in said memory means prior to any amount of trim selected with said amount of trim being stored in said memory means prior to any amount of image shift selected being stored in said memory means;

mode selecting means for providing a mode setting for said copier such that when a center of a copied image, which has been selected by an operator from said operator input panel as having a variable size or shift is to be copied along with another image on a copy paper, said variable shift or variable size of both of said images is adjusted such that images coincide with each other with respect to the center of said images or the distance offset caused by said images;

control means coupled to said operator input panel and to said mode setting means for controlling the operation of said control system such that when a combined image mode has been selected a first copy is produced from a first original fed from said automatic document feeder on one portion of one side of the copy paper and a second copy from a second original is produced from a second original fed from said automatic document feeder on a second portion of the same side of the copy paper by use of said recycling means and said combined image mode; and coupling means for coupling said control means to said automatic document feeder, said image shifting means of said copier, said variable magnification means of said copier, said recycling means of said copier, said trimming means of said copier and said partial copying means of said copier, such that said control means controls said automatic document feeder, said image shift means, said variable magnification means, said recycling means, said trimming means and said partial copying means.

10. A control system for a copier, wherein said copier has at least;

an automatic document feeder for feeding originals to be copied into said copier;

an image shifting means for shifting copy paper upon which copies are produced such that an image, produced from an original is shifted on copy paper relative to the edge of the copy paper thereby providing an image shift mode;

variable magnification means for controlling the magnification ratio of said copier, thereby providing a variable magnification mode;

recycling means for recycling the copy paper upon which copies are made through said copier, after an image has been placed on at least a portion of the copy paper such that additional images may be placed upon said copy paper, either on the same side or on an opposite side of the copy paper, thereby providing a combined image mode;

trimming means for trimming the image to be placed on said paper, thereby providing a trimming mode;

partial copying means for copying only a portion of an image on said paper, thereby providing a partial copying mode;

wherein said control system comprises:

an operator input panel for accepting control signals for accepting settings from an operator indicative of the amount of image shift desired, for inputting the magnification ratio desired, for setting the amount of trimming of an image, for selecting said combined image mode, and for selecting said partial copying mode of said copier;

memory means for storing control settings representative of said control signals and for saving said control settings for later use in a sequential fashion such that any combined image mode selected is stored in said memory means prior to any amount of trim selected with said amount of trim being stored in said memory means prior to any amount of image shift selected being stored in said memory means;

mode setting means for providing a mode setting for said copier such that when a center of a copied image, which has been selected by an operator from said operator input panel as having a variable size or shift is to be copied along with another image on a copy paper, said variable shift or variable size of both of said images is adjusted such that images coincide with each other with respect to the center of said images or the distance offset caused by said images;

control means coupled to said operator input panel and to said mode setting means for controlling the operation of said control system such that when a combined image mode has been selected a first copy is produced from a first original fed from said automatic document feeder on one portion of one side of the copy paper and a second copy from the same original is produced on another portion of the same side of the copy paper by use of said recycling means and said combined image mode; and coupling means for coupling said control means to said automatic document feeder, said image shifting means of said copier, said variable magnification means of said copier, said recycling means of said copier, said trimming means of said copier and said partial copying means of said copier, such that said control means controls said automatic document feeder, said image shift means, said variable magnification means, said recycling means, said trimming means and said partial copying means.

11. A control system for a copier, wherein said copier has at least;

an automatic document feeder for feeding originals to be copied into said copier;

an image shifting means for shifting copy paper upon which copies are produced such that an image, produced from an original is shifted on copy paper relative to the edge of the copy paper thereby providing an image shift mode;

variable magnification means for controlling the magnification ratio of said copier, thereby providing a variable magnification mode;

recycling means for recycling the copy paper upon which copies are made through said copier, after an image has been placed on at least a portion of the copy paper such that additional images may be placed upon said copy paper, either on the same side or on an opposite side of the copy paper, thereby providing a combined image mode;

trimming means for trimming the image to be placed on said paper, thereby providing a trimming mode;

partial copying means for copying only a portion of an image on said paper, thereby providing a partial copying mode;

wherein said control system comprises:

an operator input panel for accepting control signals for accepting settings from an operator indicative of the amount of image shift desired, for inputting the magnification ratio desired, for setting the amount of trimming of an image, for selecting said combined image mode, and for selecting said partial copying mode of said copier;

memory means for storing control settings representative of said control signals and for saving said control settings for later use in a sequential fashion such that any combined image mode selected is stored in said memory means prior to any amount of trim selected with said amount of trim being in stored in said memory means prior to any amount of image shift selected being stored in said memory means;

mode setting means for providing a mode setting for said copier such that when a center of a copied image, which has been selected by an operator from said operator input panel as having a variable size or shift is to be copied along with another image on a copy paper, said variable shift or variable size of both of said images is adjusted such that images coincide with each other with respect to the center of said images or the distance offset caused by said images;

control means coupled to said operator input panel and to said mode setting means for controlling the operation of said control system such that when a combined image mode has been selected a first copy is produced from a first original fed from said automatic document feeder on right-hand portion of the front side of the copy paper, a second copy from a second original fed from said automatic document feeder is produced on left-hand portion on the reverse side of the copy paper by use of said recycling means, a third copy from a third original fed from said automatic document feeder is produced on right-hand portion on the reverse side of the copy paper by use of said recycling means, a fourth copy from a fourth original fed from said automatic document feeder is produced on left-hand portion on the front side of the copy paper by use of said recycling means, and said combined image mode; and coupling means for coupling said control means to said automatic document feeder, said image shifting means of said copier, said variable magnification means of said copier, said recycling means of said copier, said trimming means of said copier and said partial copying means of said copier, such that said control means controls the automatic document feeder, said image shift means, said variable magnification means, said recycling means, said trimming means and said partial copying means.

* * * * *